US010549833B2

(12) United States Patent
Davis et al.

(10) Patent No.: US 10,549,833 B2
(45) Date of Patent: Feb. 4, 2020

(54) OUTBOARD MOTOR INCLUDING ONE OR MORE OF COWLING, WATER PUMP, FUEL VAPORIZATION SUPPRESSION, AND OIL TANK FEATURES

(71) Applicant: Seven Marine, LLC, Germantown, WI (US)

(72) Inventors: Eric A. Davis, Mequon, WI (US); Richard A. Davis, Mequon, WI (US)

(73) Assignee: AB Volvo Penta, Gothenburg (SE)

( * ) Notice: Subject to any disclaimer, the term of this patent is extended or adjusted under 35 U.S.C. 154(b) by 0 days.

(21) Appl. No.: 15/387,235

(22) Filed: Dec. 21, 2016

(65) Prior Publication Data

US 2017/0259896 A1 Sep. 14, 2017

Related U.S. Application Data

(63) Continuation of application No. 14/765,277, filed as application No. PCT/US2014/016089 on Feb. 12, 2014, now abandoned.

(Continued)

(51) Int. Cl.
*B63H 5/20* (2006.01)
*B63H 5/125* (2006.01)

(Continued)

(52) U.S. Cl.
CPC ..... *B63H 20/10* (2013.01); *B63H 20/002* (2013.01); *B63H 20/02* (2013.01); *B63H 20/08* (2013.01);

(Continued)

(58) Field of Classification Search
CPC ..... B63H 20/00; B63H 20/002; B63H 20/08; B63H 20/10; B63H 20/12; B63H 20/24;

(Continued)

(56) References Cited

U.S. PATENT DOCUMENTS 4,401,085 A 8/1983 Staerzl
4,413,248 A 11/1983 Staerzl (Continued)

FOREIGN PATENT DOCUMENTS

WO WO 2014127035 A1 8/2014

OTHER PUBLICATIONS

PCT/US2014/016089 International Search Report and Written Opinion of the International Searching Authority dated May 16, 2014 (10 pages).

(Continued)

*Primary Examiner* — Daniel V Venne
(74) *Attorney, Agent, or Firm* — SmithAmundsen LLC

(57) ABSTRACT

Embodiments of outboard motors and related systems and components thereof, as well as arrangements of marine vessels implementing same, as well as related methods of operation, use, assembly, and manufacture, and related improvements, are disclosed herein. In at least some embodiments, the outboard motor includes a cowling system in which at least one divider portion separates an interior region into first and second portion, with the transmission and engine respectively being situated in the first and second portions, respectively. Additionally, in at least some embodiments, the outboard motor includes a water pump system in which a water pump is integrated with the transmission. Further, in at least some embodiments, the outboard motor includes a fuel vaporization suppression feature, or an oil tank feature that allows for desirable oil drainage from the engine of the outboard motor particularly when the outboard motor is in particular (e.g., storage) positions.

25 Claims, 48 Drawing Sheets

Related U.S. Application Data

(60) Provisional application No. 61/764,529, filed on Feb. 13, 2013, provisional application No. 61/840,013, filed on Jun. 27, 2013.

(51) Int. Cl.

| | |
|---|---|
| ***B63H 20/08*** | (2006.01) |
| ***B63H 20/00*** | (2006.01) |
| ***F02B 61/04*** | (2006.01) |
| ***F02B 75/20*** | (2006.01) |
| ***B63H 20/10*** | (2006.01) |
| ***F02B 75/22*** | (2006.01) |
| ***B63H 20/02*** | (2006.01) |
| ***B63H 20/24*** | (2006.01) |
| ***B63H 20/28*** | (2006.01) |
| ***F01P 3/20*** | (2006.01) |
| ***B63H 20/12*** | (2006.01) |
| ***B63H 20/32*** | (2006.01) |
| *F01P 5/10* | (2006.01) |
| *F02B 75/18* | (2006.01) |

(52) U.S. Cl.

CPC ..... *B63H 20/106* (2013.01); *B63H 20/12* (2013.01); *B63H 20/24* (2013.01); *B63H 20/245* (2013.01); *B63H 20/28* (2013.01); *B63H 20/32* (2013.01); *F01P 3/205* (2013.01); *F02B 61/045* (2013.01); *F02B 75/22* (2013.01); *B63B 2758/00* (2013.01); *B63B 2770/00* (2013.01); *B63H 2020/006* (2013.01); *F01P 2005/105* (2013.01); *F01P 2050/12* (2013.01); *F01P 2060/02* (2013.01); *F01P 2060/04* (2013.01); *F01P 2060/16* (2013.01); *F02B 2075/1832* (2013.01)

(58) Field of Classification Search

CPC ..... B63H 20/28; B63H 20/32; B63H 20/106; B63H 20/245; B63H 2020/00; B63H 2020/006; B63H 2020/08; F01P 2060/02; F01P 2060/04; F01P 2060/16; F01P 3/205; F01P 2005/105; F01P 2050/12; F02B 61/045; F02B 27/0284; F02B 75/22

USPC ..... 440/53, 88 L

See application file for complete search history.

(56) References Cited

U.S. PATENT DOCUMENTS

| | | | | | |
|---|---|---|---|---|---|
| 4,493,661 | A * | 1/1985 | Iwai | F02B 61/045 | 123/195 P |
| 4,523,556 | A | 6/1985 | Suzuki | | |
| 4,667,637 | A | 5/1987 | Staerzl | | |
| RE32,620 | E * | 3/1988 | Iwai | F02B 61/045 | 123/195 P |
| 4,728,306 | A | 3/1988 | Schneider | | |
| RE32,667 | E | 5/1988 | Staerzl | | |
| 4,768,492 | A | 9/1988 | Widmer et al. | | |
| 4,776,303 | A | 10/1988 | Hundertmark | | |
| 4,794,888 | A | 1/1989 | Lang | | |
| 4,794,889 | A | 1/1989 | Hensel | | |
| 4,809,122 | A | 2/1989 | Fitzner | | |
| 4,844,043 | A | 7/1989 | Keller | | |
| 4,848,283 | A | 7/1989 | Garms et al. | | |
| 4,856,483 | A | 8/1989 | Beavis et al. | | |
| 4,865,004 | A | 9/1989 | Widmer et al. | | |
| 4,875,439 | A | 10/1989 | Widmer et al. | | |
| 4,876,993 | A | 10/1989 | Slattery | | |
| 4,940,027 | A | 7/1990 | Garms | | |
| 5,103,793 | A | 4/1992 | Riese et al. | | |
| 5,149,287 | A | 9/1992 | Koike | | |
| 5,389,245 | A | 2/1995 | Jaeger et al. | | |
| 5,553,586 | A * | 9/1996 | Koishikawa | F02B 61/045 | 123/184.34 |
| 5,613,470 | A * | 3/1997 | Shiomi | B63H 21/305 | 123/195 P |
| 5,628,927 | A | 5/1997 | Sweeney et al. | | |
| 5,640,936 | A * | 6/1997 | Hudson | F01M 1/12 | 123/196 A |
| 5,769,036 | A * | 6/1998 | Takahashi | F01M 1/02 | 123/195 P |
| 5,832,903 | A | 11/1998 | White et al. | | |
| 5,854,464 | A | 12/1998 | Sweeney et al. | | |
| 5,964,206 | A | 10/1999 | White et al. | | |
| 5,997,372 | A | 12/1999 | Idzikowski et al. | | |
| 6,253,742 | B1 | 7/2001 | Wickman et al. | | |
| 6,553,974 | B1 | 4/2003 | Wickman et al. | | |
| 6,694,955 | B1 | 2/2004 | Griffiths et al. | | |
| 6,718,953 | B1 | 4/2004 | Torgerud | | |
| 6,923,165 | B1 | 8/2005 | Draves et al. | | |
| 7,112,110 | B1 | 9/2006 | Kollmann | | |
| 7,118,435 | B2 * | 10/2006 | Takahashi | B63H 20/002 | 440/88 L |
| 7,124,736 | B2 | 10/2006 | Kondo et al. | | |
| 7,441,528 | B2 * | 10/2008 | Osakabe | F02B 27/0284 | 123/184.34 |
| 8,020,373 | B2 | 9/2011 | Hermansson et al. | | |
| 8,657,638 | B1 * | 2/2014 | Gonring | B63H 20/002 | 123/196 W |
| 8,661,787 | B1 | 3/2014 | Przybyl et al. | | |
| 9,709,013 | B2 | 7/2017 | Yudanov | | |
| 10,047,661 | B1 | 8/2018 | Torgerud | | |
| 2003/0036320 | A1 | 2/2003 | Matsuda | | |
| 2003/0066711 | A1 * | 4/2003 | Saiga | F01M 11/03 | 184/6.5 |
| 2005/0118900 | A1 * | 6/2005 | Takahashi | B63H 20/002 | 440/88 L |
| 2007/0240666 | A1 * | 10/2007 | Osakabe | F02B 27/0284 | 123/184.34 |
| 2010/0216358 | A1 * | 8/2010 | Blomdahl | B63H 20/14 | 440/75 |
| 2011/0195620 | A1 * | 8/2011 | Davis | B63H 20/14 | 440/75 |
| 2013/0273792 | A1 | 10/2013 | Davis et al. | | |
| 2015/0367924 | A1 | 12/2015 | Davis et al. | | |
| 2016/0001863 | A1 | 1/2016 | Davis et al. | | |
| 2016/0001864 | A1 | 1/2016 | Davis et al. | | |
| 2016/0023737 | A1 | 1/2016 | Davis et al. | | |
| 2017/0025986 | A1 | 9/2017 | Davis et al. | | |

OTHER PUBLICATIONS

Communication pursuant to Article 94(3) EPC for European Application No. 14707559.2 dated Jul. 8, 2016 (3 pages).

Response to Communication pursuant to Article 94(3) EPC for European Application No. 14707559.2 dated Apr. 20, 2017 (5 pages).

Communication pursuant to Article 94(3) EPC for European Application No. 14707559.2 dated Aug. 14, 2017 (4 pages).

Response to Communication pursuant to Article 94(3) EPC for European Application No. 14707559.2 dated May. 30, 2018 (16 pages).

Communication pursuant to Article 94(3) EPC for European Application No. 14707559.2 dated Sep. 13, 2018 (4 pages).

Response to Communication pursuant to Article 94(3) EPC for European Application No. 14707559.2 dated Jan. 23, 2019 (3 pages).

Communication under Rule 71(3) EPC concerning Intention to Grant regarding European Application No. 14707559.2 dated Mar. 18, 2019 (5 pages).

* cited by examiner

FIG. 8
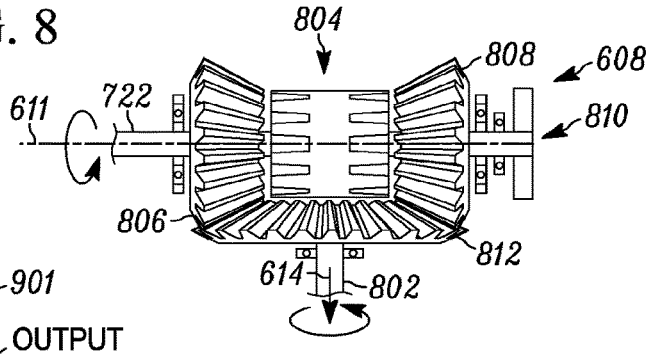
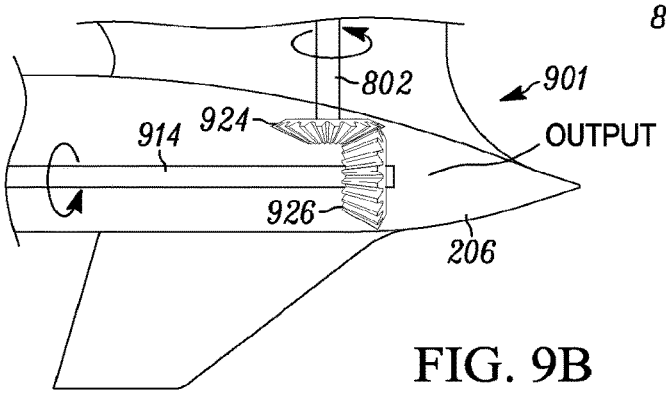
FIG. 9B
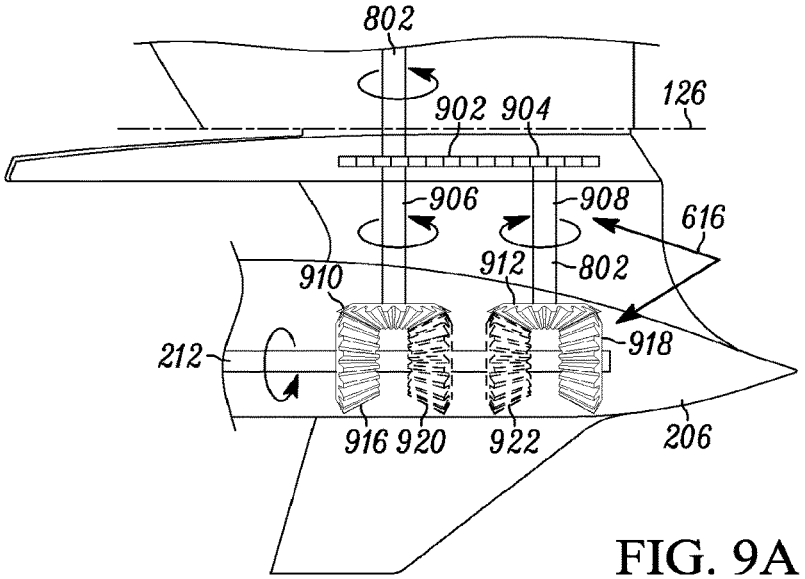
FIG. 9A
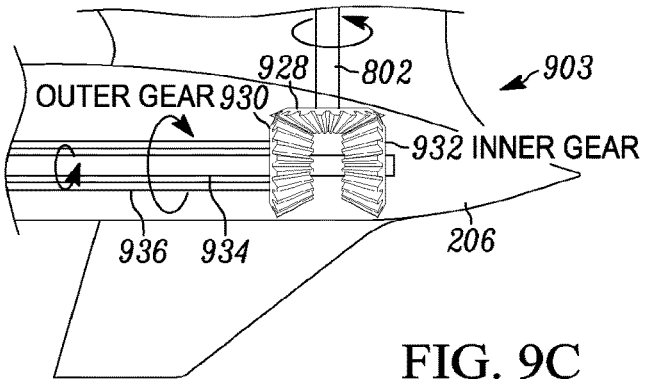
FIG. 9C

OUTBOARD MOTOR INCLUDING ONE OR MORE OF COWLING, WATER PUMP, FUEL VAPORIZATION SUPPRESSION, AND OIL TANK FEATURES

CROSS-REFERENCE TO RELATED APPLICATIONS

The present application is a continuation of U.S. patent application Ser. No. 14/765,277 filed on Jul. 31, 2015 and entitled "OUTBOARD MOTOR INCLUDING ONE OR MORE OF COWLING, WATER PUMP, FUEL VAPORIZATION SUPPRESSION, AND OIL TANK FEATURES", now abandoned, which is a U.S. national stage entry of International Patent Application No. PCT/US2014/016089 filed on Feb. 12, 2014 and entitled "OUTBOARD MOTOR INCLUDING ONE OR MORE OF COWLING, WATER PUMP, FUEL VAPORIZATION SUPPRESSION, AND OIL TANK FEATURES", which has been published and is based upon, and claims priority to each of, U.S. provisional patent application No. 61/764,529 filed on Feb. 13, 2013 and entitled "Cowling and Water Pump for Outboard Motor", and also U.S. provisional patent application No. 61/840,013 filed on Jun. 27, 2013 and entitled "OUTBOARD MOTOR INCLUDING ONE OR MORE OF COWLING, WATER PUMP, FUEL VAPORIZATION SUPPRESSION, AND OIL TANK FEATURES", and the contents of each of those two provisional patent applications is hereby incorporated by reference herein.

STATEMENT REGARDING FEDERALLY SPONSORED RESEARCH OR DEVELOPMENT

- -

FIELD OF THE INVENTION

The present invention relates to marine propulsion systems and/or related methods of making and/or operating such systems, and more particularly to outboard motors used as marine propulsion systems (and/or systems or components thereof), alone and/or in combination with marine vessels with respect to which those motors are implemented, and/or methods of making and/or operating same, and/or methods of manufacturing such systems, motors, and components.

BACKGROUND OF THE INVENTION

Current outboard motors or engines employed in relation to marine vessels typically employ an engine coupled to a leg system that mounts the engine and constrains the engine above the water's surface and a 90° gear case below the water surface. The engine shafting transmits torque that is downwardly directed to the 90° gear case which in turn supports a propeller for the creation of horizontal thrust to propel the attached watercraft. As such current outboard motors have a cowling system that surrounds the engine on all sides thus encasing it and protecting it from the environment. One of the significant functions of an outboard motor (or engine) cowl is to provide or facilitate airflow to the enclosed engine and throttle at relatively low restriction to allow for engine operation and prevent/minimize loss of horsepower due to inadequate air flow.

Although the cowling system of an outboard motor must be capable of allowing the passage of air to the engine in order to support combustion, this airflow into the cowling can be challenging as the air can be carrying large amounts of entrapped moisture and or liquid water into the engine compartment. Indeed, a complication associated with providing air to the engine is that typically the air provided to the engine is from the outside environment of the motor, which is in direct proximity to water of a body of water in which the motor is operating, such that the air entering the motor usually (if not always) includes along with it some amount of water that is entrapped/entrained with the air. Indeed, an outboard motor can be subjected to following waves of water that can cover the cowling system with water and result in significant water entering into the outboard motor and, regardless of wave levels, rain water or splashing from the ocean can present liquid water to the cowl air inlet system. As the engine is enclosed by the cowl system, once water enters the cowl it is important that the water be prevented/hindered from entering the engine intake system to avoid negative effects upon the engine by the ingress of water.

In view of the above, outboard cowling systems such as a cowling system 5200 shown in FIG. 52 (Prior Art) are typically carefully designed to minimize inbound water while at the same encouraging airflow to the engine less power losses occur due to intake air restrictions. Thus an air entrance area (air intake) 5202 is normally located high on the cowling system along an upper cowling portion 5206, far from the water's surface (and above a lower cowling portion 5208), as determined in part by an arrangement of an upper cover section 5210 along the upper cowling portion 5206. With such an arrangement, the cowling system 5200 is fashioned in a manner to accept air via an air flow path (or paths) 5212 that particular involves passage of air but discourages the entrance of liquid water. Further, normally upwardly-looking air passages 5204 are projecting above an internal surface 5214 and are covered from above by the upper cover section 5210 to prevent/hinder direct ingress of water into the outboard motor, as shown. A further development in conventional cowl systems is the inclusion of an inner liner system that controls entering air and directs it downwardly to the bottom cowl (lower cowling portion 5208, which is located above a leg system 5218 of the outboard motor) where the air/moisture is then released into the cowling system. In this manner the downward path of the air inside the liner is done to direct extra water down to the lower cowl where drains are included to release the water to the body of water (e.g., ocean) while air is allowed to rise thru the engine compartment (inside space for the engine) 5216 for the engine air intake.

Both of the above-described systems have proven to be effective for various sizes of outboard motors with engines up to and including 350 horsepower (hp) engines. However, as increased power is accompanied by increased airflow, these types of intake systems become spatially inadequate to provide large amounts of airflow within the compact space of the cowling system without creating large airflow restrictions in order to accomplish the necessary separation of air from water.

In addition to the above concerns, in today's current inboard and stern drive marine propulsion systems, two types of water pumps are used. First a sea pump lifts water from the ocean and provides it to the engine where a circulation pump then in turn circulates water continuously thru the engine block and heat system. The sea pump is normally rubber belt driven from the crankshaft with external water hoses connecting to the drive apparatus where water is picked up and returned to. The sea pump is typically (if not always) composed of a multivane flexible polymer impeller which has a positive displacement feature at low speed and starting for priming functions and transitions to a centrifugal pump at speed as the polymer vanes loose contact with the liner at higher speeds. The circulation pump is typically (if not always) of rigid centrifugal impeller construction and is attached to the engine and also rubber belt driven from the crankshaft.

Such sea and circulation pumps operate efficiently together and as such are widely used both in open cooling systems where sea water is the only coolant utilized and in closed coolant systems where sea water is circulated by the sea pump thru heat exchangers while the circulation pump circulates coolant (glycol types) thru the engine and heat exchanger (much like an automotive system if the radiator were replaced with a water to water heat exchanger for the sea pump to push sea water through).

Notwithstanding the practicality of such existing arrangements, such water pump arrangements in outboard motors nevertheless have some disadvantages. In particular, given the complexity of such arrangements, such arrangements lack compactness. For example, portions of the water pumps or associated components (e.g., manifolds associated therewith) can protrude out of the side of the outboard motor/engine or otherwise extend or be arranged in inconvenient manners. Also, the parts count of such water pump arrangements can be high. Further, durability of such arrangements can be limited, due to the use of fan belts and other components.

In addition to the above considerations, in contrast to many fuel systems developed for fuel injected engines in non-marine applications, where fuel is managed so as to be largely or mostly consumed by the engine but yet a portion of the fuel can be returned back to the fuel tank, conventional outboard motors typically have fuel systems that have been uniquely developed to pull fuel from a boat's fuel tank system and consume the fuel within the outboard motor's engine without returning fuel to the boat. In many fuel systems, there is a desire to be able to return fuel to a fuel tank particularly to allow for "excess" fuel output by a pressure regulator of the fuel system (serving to regulate fuel pressure) to return to the fuel tank. However the return of fuel to a fuel tank is viewed as problematic in marine applications in the case of an undetected leakage of fuel (e.g., because of disconnection of a fuel line) in the return circuit since, if such a leakage were to occur, the engine could continue to make power and propel the craft in spite of the fact that fuel is being lost into the boat without being delivered to the fuel tank. Indeed, such a problem can be difficult to detect as it does not immediately affect boat operation. Further, it has also been found that if leakage occurs on the supply side where fuel is being drawn into the engine, air or water is most likely entrained in the fuel line as the pressure in the fuel line on the supply side is depressed below atmospheric pressure, thereby enabling flow into the line, which can soon affect engine performance. Therefore, outboard motors that are mounted outside the rear of the vessel (i.e., mounted on the transom) have been developed with fuel systems that draw fuel into the engine, but without returning the fuel back across the transom into the boat.

Further in regard to fuel systems, it is also known to employ a vapor separator device or vapor separating tank ("VST") within a fuel injected engine for drawing fuel into the engine without returning fuel to the fuel tank. Such VSTs are equipped with fuel pump(s), fuel filter(s), and a working volume of fuel that is required to supply fuel to the pump(s). This working volume of fuel is either vented or unvented to atmospheric pressure. VSTs separate air from fuel in the working volume of fuel, thus supplying liquid fuel to the fuel pump and venting the vapor or air (that occurs due to pressure depression in the supply line) out of the working volume of fuel. If air (vapor) is entrained in the fuel, to measurable extents, the fuel pump cannot maintain fuel flow or pressure. Fuel temperature can also cause vapor creation and, for at least this reason, many cooling devices have been incorporated into vapor separating tanks ("VSTs") as fuel temperature now causes vapor according to the vapor pressure of the fuel. Aside from the use of such VSTs, the other known method of eliminating vapor, other than venting it out to atmosphere, involves pressurizing the working volume of fuel. In general, therefore, conventional VSTs either vent air out of the system or pressurize the fuel in the system in order to reliably deliver pressurized fuel to the engine.

Existing types of VSTs more particularly include (1) VSTs that are mechanically-switched (float-needle seat system), (2) VSTs that are electrically-switched, and (3) VSTs that are proximity-switched. A mechanically-switched VST often includes the following operational features or characteristics: (a) a high vacuum lift pump draws fuel from the onboard tank to the outboard; (b) fuel is delivered into a float chamber; (c) a float is lifted when there is a sufficient level of fuel in the float chamber; (d) the float acts upon a needle and seat which shuts off the incoming fuel; (e) the high pressure pump draws fuel from the float chamber and delivers it to a regulator; (f) the regulator allows a set pressure of fuel to pass and returns the excess to the float chamber; and (g) pressurized fuel exiting the high pressure pump is ready to be consumed by the engine. By comparison, an electrically-switched VST typically includes many of the aforementioned features of a mechanically-switched VST, but differs in that a diaphragm lift pump of the mechanically-switched VST will typically be replaced with an electric pump in the electrically-switched VST and, additionally, the float actuates an electrical switch opening the power circuit stopping the lift pump when the float chamber is full. This type of system can be made to operate without venting the float chamber to atmosphere, as the float and switch do not need an atmospheric reference. Lastly, proximity-switched VSTs typically include many of the same features or characteristics of mechanically-switched and electrically-switched VSTs, but further include a proximity switch on the float valve, or an ultrasonic device that indicates fluid level in the "float chamber" thereby interrupting the flow of the low pressure pump to halt the overfilling of the float chamber or working fuel volume.

Additionally, outboard motors have classically been designed to incorporate two cycle engine technology in a number of aspects. As two cycle engines did not require a captive lubricant compartment from which to draw lubricant or to which to return lubricant (from and to locations within the engine), in such engines the lubricant (typically oil) was added to the fuel in prescribed ratios and consumed through the course of normal operation. Yet as emissions regulations have become more stringent, the two-cycle engine, with its inherent disadvantage of hydro-carbon emissions, has given way to the four-cycle engine. With this transition in engine technology came the need for an oil sump from which the engine could pump and return lubricant. As outboard engines have historically been constructed with the engine being vertical in orientation, that is, with the crankshaft extending vertically, the oil sump has been mounted below the engine in a compartment not common to the crankcase. The sump additionally has been configured so that the oil will not flood into the engine as the engine is trimmed, that is, rotated about a horizontal axis perpendicular to the axis of propulsion. Thus, for many conventional outboard motors with such a vertical configuration (vertically oriented such that the crankshaft is vertically mounted) traditionally have included these additional characteristics: (1) sump mounted below the engine; (2) the engine crankcase communicates to the sump, but is not integral with the sump; (3) the sump has a geometry that is tall and thin; (4) the sump will not allow the engine to fill with oil when trimmed to an extent, such as approximately 70 degrees from horizontal; and (5) cylinders face aft and are tilted toward vertical when trimmed, preventing them from filling with oil should any oil be left in the engine during or after tilting.

Notwithstanding the traditional prevalence of vertically-configured outboard motors, horizontally-configured outboard motors (that is, outboard motors having a horizontally-oriented engine with a horizontally-extending crankshaft) have arisen that have somewhat different features, including: (1) an oil sump which is integral with the crankcase; (2) cylinders that are generally vertically oriented (or in the case of a V-type engine, oriented between 30 to 60 degrees from vertical); and an (3) an oil sump that is long, narrow, and shallow. Given this arrangement, when the engine is mounted in an outboard configuration and tilted (as described above in relation to vertically oriented engine), the engine oil pours out of the oil sump and into the crankcase of the engine. Consequently, oil that enters the crankcase can run into the cylinders as one or more of the cylinders have rotated to a near horizontal position. Yet oil that enters a cylinder can potentially be detrimental to the engine, as it can result in bending of the connecting rods due to hydraulic locking the engine, particularly if enough oil enters the combustion chamber and is acted upon by the piston.

Therefore, in view of the above, it would be advantageous if an improved outboard motor for use with marine vessels, and/or systems or components thereof, and/or methods or processes for operating or using same (and/or related methods or processes for manufacturing such an outboard motor, or systems or components thereof), could be developed that addressed one or more of the above concerns and/or provided one or more other or additional advantages.

BRIEF SUMMARY OF THE INVENTION

The present inventors have recognized these concerns, and further have recognized that an improved outboard motor can be developed that alleviates one or more of these concerns. In at least some example embodiments, the present invention relates to an outboard motor for use with a marine vessel comprising and outboard motor. The outboard motor includes a transmission, an engine positioned adjacent to the transmission, and a cowling assembly. The cowling assembly includes at least one outer formation extending around the transmission and the engine so as to provide a housing therefore, and a wall formation extending within the outer formation between the transmission and the engine so as to form a barrier therebetween, so that an interior within the at least one outer formation is divided into a plurality of portions including a first portion and a second portion. The transmission is positioned at least partly within the first portion and the engine is positioned at least partly within the second portion.

There exists a space beneath the wall formation so that the first portion is in fluid communication with the second portion, and the at least one outer formation includes at least one inlet positioned at or proximate to a top of the at least one outer formation along the first portion so as to allow the first portion to be in fluid communication with a region outside of the outboard motor. The outboard motor is configured to allow air to enter the first portion via the at least one outer formation and to pass from the first portion into the second portion via the space, whereby, due to the wall formation, the air entering the outboard motor via the at least one inlet must pass downward within the first portion to the space in order for the air to enter into the second portion, and due to the downward movement of the air, at least some water entering the at least one inlet along with the air proceeds downward past the space and does not enter the second portion.

Additionally in at least some example embodiments, the present invention relates to a water pump assembly. The water pump assembly includes a pump housing having an inlet and an outlet, a first impeller located within the pump housing and configured to rotate in a rotational plane, about a first axis of rotation, in a first rotating direction, and a second impeller located within the pump housing and configured to rotate in the rotational plane, about a second axis of rotation, in a second rotating direction that is opposite the first rotating direction.

Further in at least some example embodiments, the present invention relates to a vapor separating tank (VST) system. The VST system includes a first pump configured to receive fuel at a first pressure from a fuel source and to output the fuel at a second pressure that is higher than the first pressure, and also includes a fuel reservoir coupled to the first pump via at least one first linkage so that the fuel at the second pressure output by the first pump is received at the fuel reservoir. Further, the VST system also includes a second pump coupled to the fuel reservoir via at least one second linkage, where the second pump is configured to receive the fuel at the second pressure from the fuel reservoir and to output the fuel at a third pressure that is higher than the second pressure, and additionally includes an output port by which at least some of the fuel at the third pressure can be communicated from the VST system to an internal combustion engine. Also, the VST system further includes a first pressure regulator at least indirectly coupled between the output port and the fuel reservoir by way of at least one third linkage so that, if a first pressure differential across the first pressure regulator exceeds a first predetermined threshold, a first fluid communication path is at least temporarily established between the output port and the fuel reservoir via the first pressure regulator.

Additionally in at least some example embodiments, the present invention relates to an outboard motor having a front surface and an aft surface and configured to be mounted on a marine vessel having a front to rear axis, such that the front surface would face the marine vessel and the aft surface would face away from the marine vessel when in a standard operational position. The outboard motor includes a housing having an upper portion and a lower portion and having an interior, and an internal combustion engine disposed within the housing interior and that provides rotational power output via a crankshaft that extends horizontally or substantially horizontally in a front-to-rear direction when the outboard motor is in the standard operational position, where the engine is further disposed substantially or entirely above a trimming axis and is steerable about a steering axis, the trimming axis being perpendicular to or substantially perpendicular to the steering axis, and the steering axis and trimming axis both being perpendicular to or substantially perpendicular to the front-to-rear axis of the marine vessel. The outboard motor further includes a tank positioned within the housing and connected to a crankcase of the engine, wherein the tank is configured such that little, if any, of an amount of the lubricant is in or provided to the tank when the engine is in the standard operational position.

BRIEF DESCRIPTION OF THE DRAWINGS

FIG. 8 is a schematic diagram showing in more detail an example embodiment of a second transmission of the outboard motor of FIG. 6A;

FIGS. 9A-9C are schematic diagrams showing in more detail three example embodiments of a third transmission of the outboard motor of FIG. 6A (or a modified version thereof having two counterrotating propellers);

DETAILED DESCRIPTION OF THE INVENTION

Figure 1:
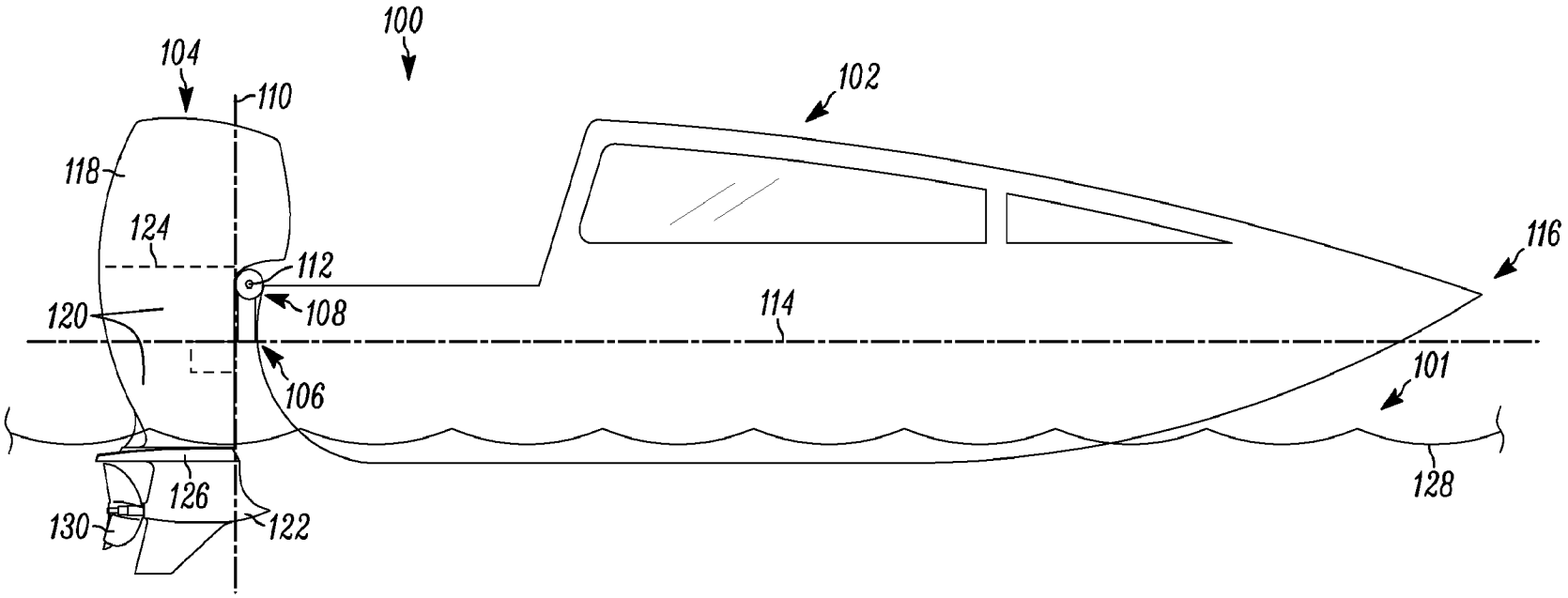
FIG. 1 is a schematic view of an example marine vessel assembly including an example outboard motor.

The present inventors have recognized that vertical crankshaft engines, which are naturally suited for outboard motor applications insofar as the crankshafts naturally are configured to deliver rotational power downward from the engines to the propellers situated at the bottoms of the outboard motors for interaction with the water, nevertheless impose serious limits on the development of higher power systems, because the development of vertical crankshaft engines capable of achieving substantial increases in power output in outboard motor marine propulsion systems has proven to be very time-consuming, complicated, and costly. Additionally, the present inventors have recognized that it is possible to implement horizontal crankshaft engines in outboard motor marine propulsion systems, and that the use of horizontal crankshaft engines opens up the possibility of using a wide variety of high quality, relatively inexpensive engines (including, for example, many automotive engines) in outboard motor marine propulsion systems that can yield dramatic improvements in the levels of power output by outboard motor marine propulsion systems as well as one or more other types of improvements as well.

Relatedly, the present inventors have recognized one or more features that, depending upon the embodiment, can be employed in the design of outboard motor marine propulsion systems utilizing horizontal crankshaft engines that can enhance the performance of such systems and allow for more streamlined, more efficient, and otherwise more effective integration of horizontal crankshaft engines in relation to other system components. For example, in some embodiments, a three-part transmission (including, further for example, a forward-neutral-reverse transmission) can be utilized so as to deliver and allow for the delivery of rotational power from the engine to the propeller(s). Also for example, in some embodiments, exhaust from the engine can be delivered by way of exhaust conduit(s) to the gear assembly and out a rear hub proximate a propeller of the assembly. Further for example, in at least some embodiments, some of the water within which the marine vessel is situated can be utilized for cooling of gear portions and/or for cooling the engine itself, via a heat exchanger. Also for example, the mounting system by which the outboard motor is attached to the marine vessel itself can have one or more particular attributes that reflect, and take advantage of, the use of a horizontal crankshaft engine.

Further, the present inventors have recognized that a variety of implementations and embodiments of transmission devices can be implemented in one or more such outboard motors. For example, transmission devices can be employed in which one or more internal power train components such as one or more gears can be accessed and replaced so as to modify operational parameter(s) of the transmission devices, for example, a gear ratio of a transmission device. This can be achieved, in at least some embodiments for example, by providing a cover portion on the transmission device that can be removed to allow access of the one or more internal power train components. Further, in some such transmission devices, an oil pump can be integrated with the transmission device and particularly mounted upon a rotating shaft associated with the transmission device such that, when the transmission is operating such that the rotating shaft is experiencing rotation, the oil pump pressurizes and outputs oil for use by any one or more of a variety of components that can benefit from such oil.

Additionally, the present inventors have also recognized that one or more other features can be provided in an outboard motor so as to achieve enhanced performance in one or more respects. Among other things, such features can include an enhanced cowling system having a configuration that minimizes or reduces the amount of water that can reach water-sensitive internal components of the outboard motor (e.g., the engine or throttle) and/or, relatedly, facilitates the elimination or discharge of such water from the outboard motor. More particularly, in one such enhanced cowling system encompassed herein, the cowling system (or cowling) is divided into first and second portions. A first portion is implemented around the transmission, which is insensitive to water submersion, and air enters the outboard motor via the first portion. A second portion is enclosed around the engine. Airflow passages connect the two portions in such a manner as to allow passage of air but discourage passage of water toward the engine.

Also, such features for allowing an outboard motor to achieve enhanced performance in at least some embodiments can include a water pump configuration that improved upon existing water pump configurations in terms of any one or more of enhancing compactness, reducing part count, improving durability, or enhancing other aspects of the outboard motor. In at least some such embodiments, an outboard motor includes an engine mounted circulation pump that is provided with automotive type engines but integrates the sea pump into the transmission of the outboard motor. Also, in at least some such embodiments, such an arrangement enhances compactness, reduces parts count, and/or enhances durability of the water pumping arrangement by the elimination of external plumbing and rubber belt drive systems.

Additionally, in some embodiments, the outboard motor includes a vapor separating tank (VST) feature that prevents (or substantially limits) vaporized fuel from reaching the engine or engine combustion chambers. In at least some such embodiments, the VST feature includes a low pressure pump that pumps fuel received from a fuel source to a fuel mixer or filter, where the fuel exiting the low pressure pump is at a low (or medium) pressure level, and then additionally includes a high pressure pump that receives fuel from the fuel mixer or filter and further pressurizes the fuel to a high (or higher) pressure level suitable for the engine. Further, in at least some embodiments, the outboard motor includes an additional oil tank that is positioned proximate the front of the engine and serves to receive oil that will drain from the engine when the outboard motor is tilted (trimmed) to a non-operating orientation, so as to collect oil and prevent oil from collecting (or limit the extent to which oil collects) in any cylinders of the engine during engine storage in the non-operating orientation.

Therefore, numerous embodiments of outboard motors and related systems and components thereof, as well as arrangements of marine vessels implementing same, as well as related methods of operation, use, assembly, and manufacture, and related improvements, are disclosed herein. In at least some embodiments, the outboard motor includes a cowling system in which at least one divider portion separates an interior region into first and second portion, with the transmission and engine respectively being situated in the first and second portions, respectively. Air for use by the engine enters the outboard motor via air inlets in the first portion, proceeds downward within that portion to a space in the at least one divider portion, and then proceeds through the space and upward into the second portion. Additionally, in at least some embodiments, the outboard motor includes a water pump system in which a water pump is integrated with the transmission. The water pump includes a single inlet for water that is then driven by two counterrotating impellers and can ultimately be driven through each of higher and lower velocity outlets. Further, in at least some embodiments, the outboard motor includes a fuel vaporization suppression feature. Additionally, in at least some embodiments, the outboard motor includes an oil tank feature that allows for desirable oil drainage from the engine of the outboard motor particularly when the outboard motor is in particular (e.g., storage) positions.

Notwithstanding the above comments, it should be understood that, depending upon the embodiment, one or more of these types of features can be present and/or one or more of these various features need not be present. Further, the present inventors have additionally realized that one or more of these features can potentially be advantageously implemented in embodiments of outboard motor marine propulsion systems even though other(s) of these features are not present, and even potentially where other types of engines other than horizontal crankshaft engines are being utilized (or even possibly in some sterndrive or other marine propulsion systems where the engine is not integrated with the outboard assembly).

Referring to FIG. 1, an example marine vessel assembly 100 is shown to be floating in water 101 (shown in cut-away) that includes, in addition to an example marine vessel 102, an example outboard motor marine propulsion system 104, which for simplicity is referred to below more simply as an outboard motor 104. As shown, the outboard motor 104 is coupled to a stern (rear) edge or transom 106 of the marine vessel 102 by way of a mounting system 108, which is described in further detail below. Also described below, the mounting system 108 will be considered, for purposes of the present discussion, to be part of the outboard motor 104 although one or more components of the mounting system can technically be assembled directly to the stern edge (transom) 106 and thus could also be viewed as constituting part of the marine vessel 102 itself. In the present embodiment shown, the marine vessel 102 is shown to be a speed boat although, depending upon the embodiment, the marine vessel can take a variety of other forms, including a variety of yachts, other pleasure craft, as well as other types of boats, marine vehicles and marine vessels.

As will be discussed in further detail below, the mounting system 108 allows the outboard motor 104 to be steered about a steering (vertical or substantially vertical) axis 110 relative to the marine vessel 102, and further allows the outboard motor 104 to be rotated about a tilt or trimming axis 112 that is perpendicular to (or substantially perpendicular to) the steering axis 110. As shown, the steering axis 110 and trimming axis 112 are both perpendicular to (or substantially perpendicular to) a front-to-rear axis 114 generally extending from the stern edge 106 of the marine vessel toward a bow 116 of the marine vessel.

The outboard motor 104 can be viewed as having an upper portion 118, a mid portion 120 and a lower portion 122, with the upper and mid portions being separated conceptually by a plane 124 and the mid and lower portions being separated conceptually by a plane 126 (the planes being shown in dashed lines). Although for the present description purposes the upper, mid and lower portions 118, 120 and 122 can be viewed as being above or below the planes 124, 126, these planes are merely provided for convenience to distinguish between general sections of the outboard motor, and thus in certain cases it may be appropriate to refer to a section of the outboard motor that is positioned above the plane 126 (or plane 124) as still being part of the lower portion 122 (or mid portion 120) of the outboard motor view, or to refer to a section of the outboard motor that is positioned below the plane 126 (or plane 124) as still being part of the mid portion 120 (or upper portion 118). This is the case, for example, in the discussion with respect to FIG. 10A.

Nevertheless, generally speaking, the upper portion 118 and mid portion 120 can be understood as generally being positioned above and below the plane 124, while the mid portion 120 and lower portion 122 can be understood as generally being positioned above and below the plane 126. Further, each of the upper, mid, and lower portions 118, 120, and 122 can be understood as generally being associated with particular components of the outboard motor 104. In particular, the upper portion 118 is the portion of the outboard motor 104 in which the engine or motor of the outboard motor assembly is entirely (or primarily) located. In the present embodiment, given the positioning of the upper portion 118, the engine therewithin (e.g., internal combustion engine 504 discussed below with respect to FIG. 5) particularly can be considered to be substantially above (or even entirely above) the trimming axis 112 mentioned above. Given such positioning, the engine essentially is not in contact with the water 101 during operation of the marine vessel 102 and outboard motor 104, and advantageously the outside water 101 does not tend to enter cylinder ports of the engine or otherwise deleteriously affect engine operation. Such positioning further is desirable since, by positioning the engine above the trimming axis 112, the mounting system 108 and the transom 106 to which it is attached can be at a convenient (e.g., not-excessively-elevated) location along the marine vessel 102.

By comparison, the lower portion 122 is the portion that is typically within the water during operation of the outboard motor 104 (that is, beneath a water level or line 128 of the water 101), and among other things includes a gear casing (or torpedo section), as well as a propeller 130 as shown (or possibly multiple propellers) associated with the outboard motor. The mid portion 120 positioned between the upper and lower portions 118, 122 as will be discussed further below can include a variety of components and, among other things in the present embodiment, will include transmission, oil reservoir, cooling and exhaust components, among others.

Figure 2:
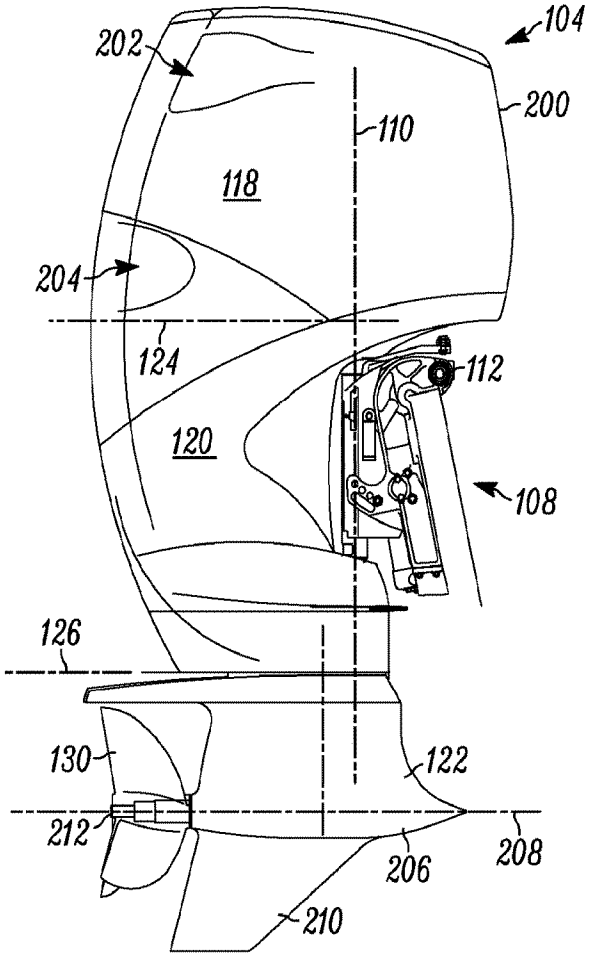
FIG. 2 is a right side elevation view of the outboard motor of FIG. 1.
Figure 3:
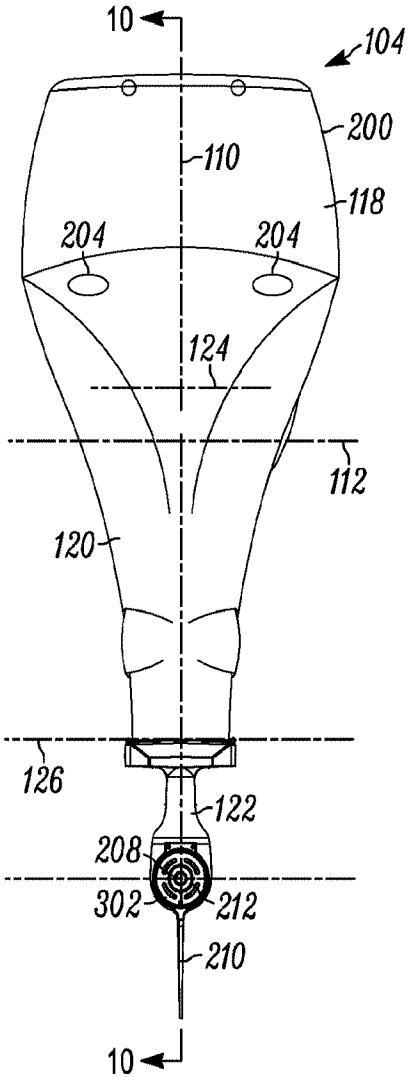
FIG. 3 is a rear elevation view of the outboard motor of FIG. 1.

Turning next to FIGS. 2 and 3, a further side elevation view (right side elevation view) and rear view of the outboard motor 104 of FIG. 1 are provided. It will be understood that the left side view of the outboard motor 104 is in at least some embodiments a mirror image of the right side view provided in FIG. 2. In particular, FIGS. 2 and 3 again show the outboard motor 104 as having the upper portion 118, mid portion 120 and lower portion 122 separated by the planes 124 and 126, respectively. Further, the steering axis 110 and trimming (or tilt) axis 112 are also shown. The mounting system 108 is particularly evident from FIG. 2, as is the propeller 130 (which is not shown in FIG. 3). FIGS. 2 and 3 particularly show several features associated with an outer housing or cowling 200 of the outboard motor 104. Among other things, the cowling 200 includes air inlet scoops (or simply air inlet) 202 along upper side surfaces of the upper portion 118 of the outboard motor 104, one of which is shown in the right side elevation view provided in FIG. 2 (it being understood that a complimentary air inlet is provided on the left side of the cowling 200). In the present embodiment, the air inlet scoops 202 extend in a rearward-facing direction and serve as an entry for air to be used in the engine of the outboard motor 104 (see FIG. 5). The high positioning of the air inlet scoops 202 reduces the extent to which seawater can enter into the air inlets.

Additionally as shown, also formed within the cowling 200 are exhaust bypass outlets 204, which are shown in further detail in FIG. 3 to be rearward-facing oval orifices in the upper portion 118 of the outboard motor 104 extending into the cowling 200. As discussed further below, the exhaust bypass outlets 204 in the present embodiment serve as auxiliary (or secondary) outlets for exhaust generated by the engine of the outboard motor 104. As such, exhaust need not always (or ever) flow out of the exhaust bypass outlets 204, albeit in the present embodiment it is envisioned that under at least some operational circumstances the exhaust will be directed to flow out of those outlets.

Further as evident from FIG. 2, the lower portion 122 of the outboard motor 104 includes a gear casing (or torpedo) 206 extending along an elongated axis 208 about which the propeller 130 spins when driven. Downwardly-extending from the gear casing 206 is a downwardly-extending fin 210. Referring particularly to FIG. 3, it should further be understood that an orifice (actually multiple orifices as discussed further with respect to FIGS. 10A and 10B) 302 is formed at a rearward-most end or hub 212 of the gear casing 206 that surrounds a propeller driving output shaft 212 extending along the axis 208. As will be discussed further below, this orifice 302 forms a primary exhaust outlet for the outboard motor 104 that is the usual passage out of which exhaust is directed from the engine of the outboard motor (as opposed to the exhaust bypass outlets 204).

Figure 4B:
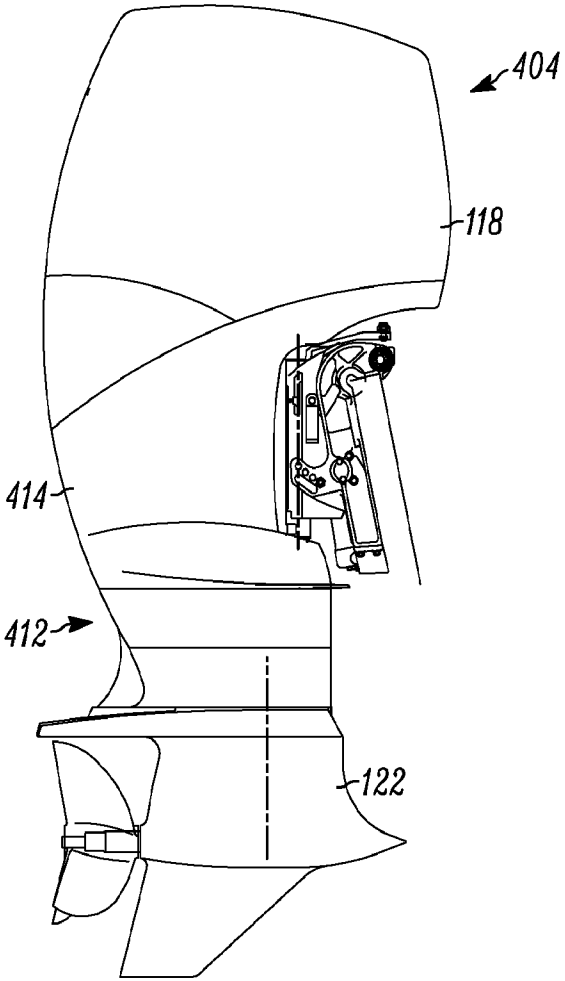
FIGS. 4A and 4B are right side elevation views of alternate embodiments of the outboard motor of FIG. 1.
Figure 4A:
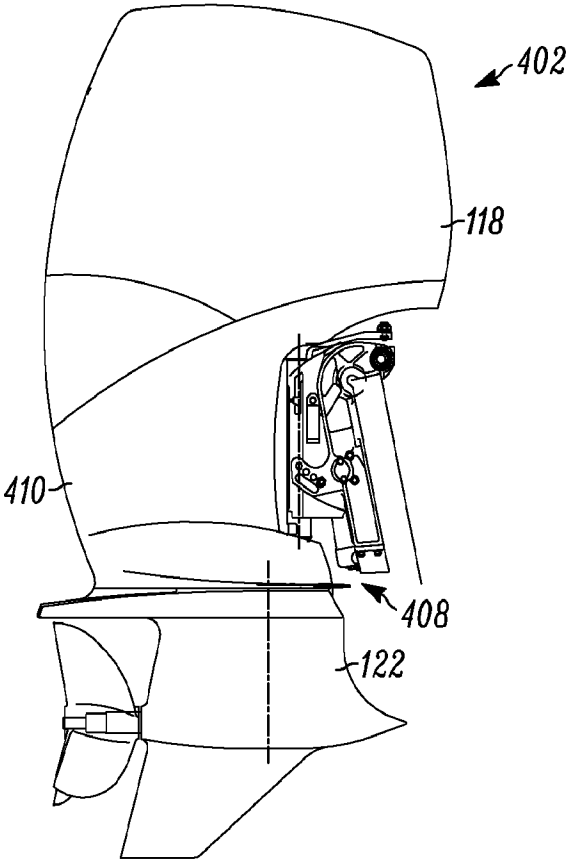

Referring additionally to FIGS. 4A and 4B, first and second alternate embodiments 402 and 404, respectively, of the outboard motor 104 are shown. Each of these alternate embodiments 402, 404 is substantially identical to the outboard motor 104 shown in FIG. 2, except insofar as the mid portion 120 of the outboard motor 104 is changed in its dimensions in each of these other alternate embodiments. More particularly, a leg lengthening section 408 of a mid portion 410 of the first alternate embodiment 402 of FIG. 4A is shortened relative to the corresponding leg lengthening section of the mid portion 120 of the outboard motor 104, while a leg lengthening section 412 of a mid portion 414 of the second alternate embodiment 404 of FIG. 4B is elongated relative to the corresponding section of the mid portion 120 of the outboard motor 104. Thus, with such variations, the positioning of the lower portion 122 can be raised or lowered relative to the upper portion 118 depending upon the embodiment and particularly the leg lengthening section of the mid portion.

Figure 5:
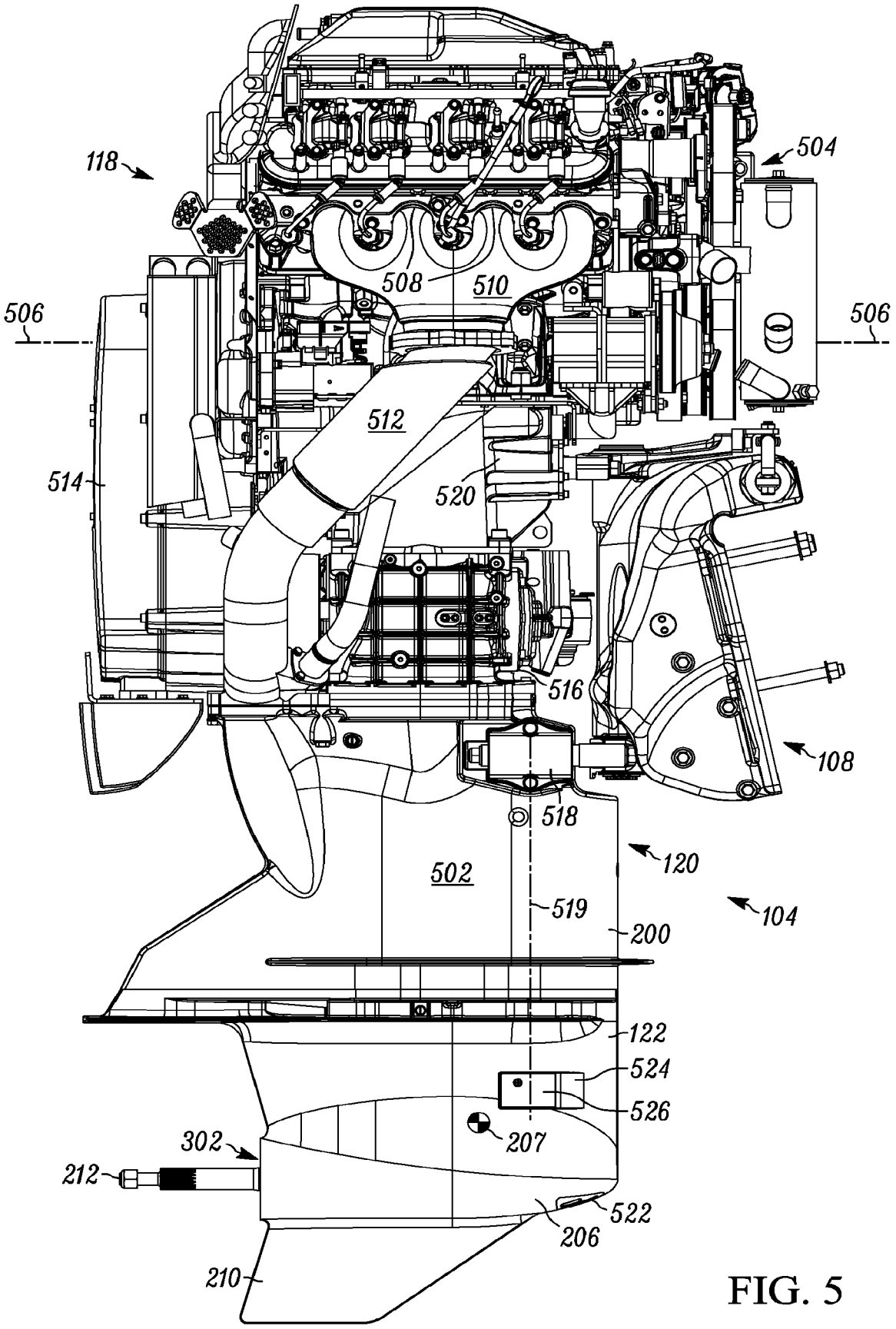
FIG. 5 is a further right side elevation view of the outboard motor of FIG. 1, showing in more detail several example internal components of the outboard motor particularly revealed when cowling portion(s) of the outboard motor are removed.

Turning to FIG. 5, a further right side elevation view of the outboard motor 104 is provided that differs from that of FIG. 2 at least insofar as the cowling 200 (or, portions thereof) is removed from the outboard motor to reveal various internal components of the outboard motor, particularly within the upper portion 118 and mid portion 120 of the outboard motor. At the same time, the lower portion 122 of the outboard motor 104 is viewed from outside the cowling 200 of the outboard motor, as is a lower section of the middle portion 120 that can be termed a midsection 502 of the middle portion 200. Again though, above the midsection 502, various internal components of the outboard motor 104 are revealed. As with the views provided in FIG. 2 and FIG. 4, the view in FIG. 5 is the mirror image (or substantially a mirror image) of the left side elevation view that would be obtained if the outboard motor were viewed from its opposite side (with the cowling removed).

More particularly as shown in FIG. 5, an engine 504 of the outboard motor 104 is positioned within the upper portion 118 of the outboard motor, entirely or at least substantially above the trimming axis 112 as mentioned earlier. In at least some embodiments, and in the present embodiment, the engine 504 is a horizontal crankshaft internal combustion engine having a horizontal crankshaft arranged along a horizontal crankshaft axis 506 (shown as a dashed line). Further, in at least some embodiments and in the present embodiment, the engine 504 not only is a horizontal crankshaft engine, but also is a conventional automotive engine capable of being used in automotive applications and having multiple cylinders and other standard components found in automotive engines. More particularly, in the present embodiment, the engine 504 particularly is an eight-cylinder V-type internal combustion engine such as available from the General Motors Company of Detroit, Mich. for implementation in Cadillac (or alternatively Chevrolet) automobiles. Further, the engine 504 in at least some embodiments is capable of outputting power at levels of 550 horsepower or above, and/or power within the range of at least 557 horsepower to at least 707 horsepower.

As an eight-cylinder engine, the engine 504 has eight exhaust ports 508, four of which are evident in FIG. 5, emanating from the left and right sides of the engine. The four exhaust ports 508 emanating from the right side of the engine 504 particularly are shown to be in communication with an exhaust manifold 510 that merges the exhaust output from these exhaust ports into an exhaust channel 512 that leads downward from the exhaust manifold 510 to the midsection 502. It will be understood that a complimentary exhaust manifold and exhaust channel are provided on the left side of the engine to receive the exhaust from the corresponding exhaust ports on that side of the engine. As will be described in further detail below, both of the exhaust channels (including the exhaust channel 512) upon reaching the midsection 502 further are coupled to the lower portion 122 at which the exhaust is ultimately directed through the gear casing 206 and out the orifice 302 serving as the primary exhaust outlet. It should further be noted that, given the use of the horizontal crankshaft engine 504, all of the steam relief ports associated with the various engine cylinders are at a shared, high level, above the crankshaft (all or substantially all steam in the engine therefore rises to a shared engine level). Also the accessory drive and heat exchanger system are accessible at the front of the engine 504 (particularly when the lid portion of the cowling 200 is raised as discussed further below). In addition to showing the aforementioned components, FIG. 5 additionally shows a transfer case 514 within which is provided a first transmission as discussed further below, and a second transmission 516 that is located below the engine 504.

Further, FIG. 5 shows the mounting system 108, including a lower mounting bracket structure 518 of the mounting system 108 by which the midsection 502 of the mid portion 120 of the outboard motor 504 is linked to the mounting system, and also an upper mounting bracket 520 by which the mounting system is attached to an upper section of the mid portion 120. An elastic axis of mounting 519 is provided and passes through the upper mounting bracket 520 and the lower mounting bracket 518. In at least some embodiments, the center of gravity of the engine 504 is in line with the elastic axis of mounting. Also FIG. 5 shows a lower water inlet 522 positioned along a front bottom section of the gear casing 206 forward of the fin 210, as well as an upper water inlet 524 and associated cover plate 526 provided near the front of the lower portion 122, about midway between the top and bottom of the lower portion. The lower and upper water inlets 522, 524 and associated cover plates 526 (there is also a corresponding upper water inlet and associated cover plate on the left side of the lower portion 122) are discussed further with respect to FIG. 10A. All of these components, and additional components of the outboard motor 104, are discussed and described in further detail below.

Figure 6A:
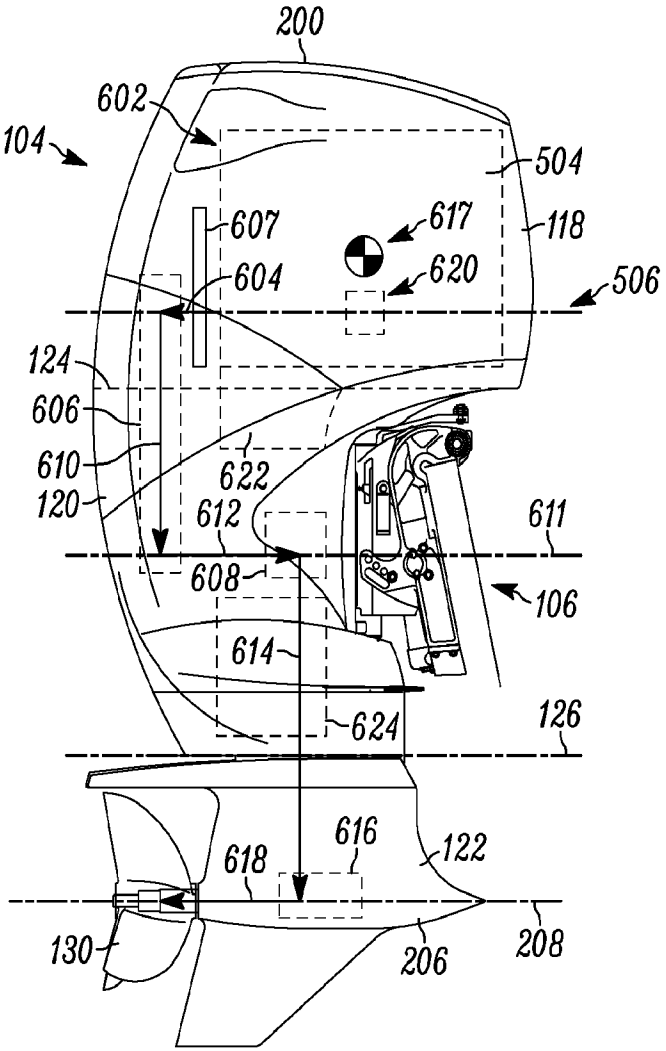
FIG. 6A is a schematic diagram illustrating in additional detail several example internal components of the outboard motor of FIGS. 1 and 5.

Turning to FIG. 6A, a further right side elevation view of the outboard motor 104 is provided in which the relationship of certain internal components of the outboard motor are figuratively illustrated in phantom. More particularly as shown, the outboard motor 104 again is shown to include the engine 504 (this time as represented by a dashed outline in phantom) within the upper portion 118 of the outboard motor. Further as illustrated, rotational power output from the engine 504 is delivered from the engine and to the propeller 130 of the outboard motor by way of three distinct transmissions. More particularly as shown, rotational output power is first transmitted outward from a rear face 602 of the engine 504, along the crankshaft axis 506 as represented by an arrow 604, to a first transmission 606 shown in dashed lines (the power being transmitted by the crankshaft, not shown). A flywheel 607 of the outboard motor 104 is further positioned between the rear of the engine 504 and the first transmission 606, on the crankshaft, for rotation about the crankshaft axis 506.

Figure 6B:
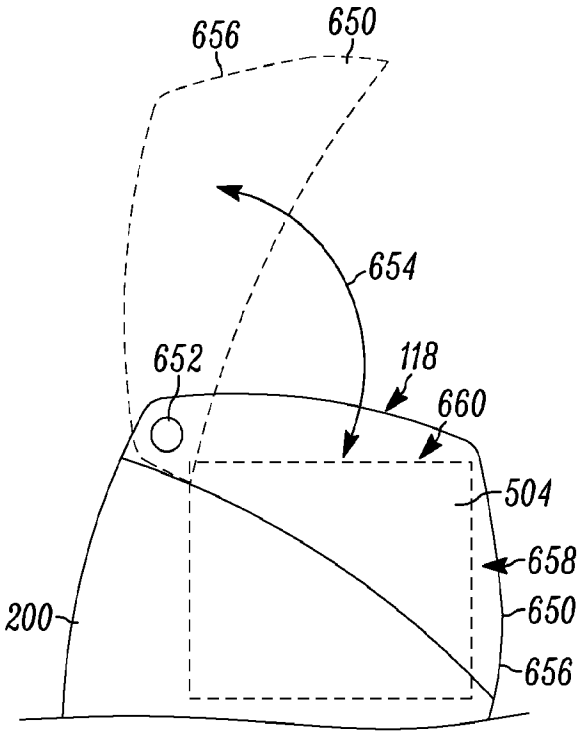
FIG. 6B is a further diagram showing an upper portion of the outboard motor of FIG. 6 an illustrating an example manner of configuring the cowling of the outboard motor to allow for opening and closing of a portion of the cowling so as to reveal internal components.

Referring additionally to FIG. 6B, an additional cutaway view of the upper portion 118 of the outboard motor 104 shown in FIG. 6A is provided so as to particularly illustrate a portion of the cowling 200, shown as a cowling portion 650, that is hinged relative to the remainder of the cowling by way of a hinge 652. As a result of the particular manner in which the cowling portion 650 is hingedly coupled to the remainder of the cowling 200, the cowling portion 650 is able to be opened in a manner by which the cowling swings upward and aftward relative to the remainder of the cowling, in a direction represented by an arrow 654. Thus, the cowling portion 650 can take on both a closed position (shown in FIG. 6B in solid lines) and an open position (shown in dashed lines), as well as positions intermediate therebetween. Further, because the cowling portion 650 includes a front side 656 that extends all or almost all of (or a large portion of) the height of the upper portion 118 of the outboard motor 104, opening of the cowling portion in this manner allows the engine 504 to be largely exposed and particularly for a front portion 658 of the engine 504 and/or a top portion 660 of the engine to be easily accessed, and particularly easily accessed by a service technician or operator standing at the stern of the marine vessel 102 to which the outboard motor 104 is attached. In embodiments where the engine 504 is a horizontal crankshaft engine, particularly an automotive engine as mentioned above, servicing of the engine (and particularly those portions or accessories of the engine that most commonly are serviced, such as oil level, spark plugs, belts, and/or various electrical components) can be particularly facilitated by this arrangement. Also, an accessory drive, extending from the front of the engine 504, along with an associated accessory drive belt, can be accessed in this manner.

Referring again to FIG. 6A, the purpose of the first transmission 606 is first of all to transmit the rotational power from the crankshaft axis 506 level within the upper portion 118 of the engine 104 to a lower level corresponding to a second transmission 608 (also shown in dashed lines) within the mid portion 120 of the outboard motor 104 (the upper portion 118 and middle portion 120 again being separated by the plane 124). Thus, an arrow 610 is shown connecting the arrow 604 with a further arrow 612 at a set level 611 of the second transmission 608. The arrow 612, which links the arrow 610 with the second transmission 608, is representative of a shaft or axle (see FIG. 7) linking the first transmission 606 with the second transmission 608, by which rotational power is communicated in a forward direction within the outboard motor 104 from the first transmission to the second transmission. Additionally, a further arrow 614 then represents communication of the rotational power downward again from the level of the second transmission 608 within the mid portion 120 to a third transmission 616 within the gear casing 206 of the lower portion 122. In accordance with at least one aspect, the gear casing 206 has a center of pressure 207 that is aft of the elastic axis of mounting (FIG. 5). Finally, as indicated by an arrow 618, rotational power is communicated from the third transmission 616 aftward (rearward) from that transmission to the propeller 130 along the axis 208. It can further be noted that, given this arrangement, the flywheel 607 mentioned above is aft of the engine 504, forward of the first transmission 606, and above each of the second and third transmissions 608 and 616. In at least some embodiments, an oil pump is provided that is concentrically driven by the engine crankshaft.

Thus, in the outboard motor 104, power output from the engine 504 follows an S-shaped route, namely, first aftward as represented by the arrow 604, then downward as represented by the arrow 610, then forward as represented by the arrow 612, then downward again as represented by the arrow 614 and then finally aftward again as represented by the arrow 618. By virtue of such routing, rotational power from the horizontal crankshaft can be communicated downward to the propeller 130 even though the power take off (that is, the rotational output shaft) of the engine is proximate the rear of the outboard motor 104/cowling 200. Although it is possible that, in alternate embodiments, rotational power need not be communicated in this type of manner, as will be described further below, this particular manner of communicating the rotational power via the three transmissions 606, 608, 616 is consistent with, and makes possible, a number of advantages. Additionally, it should further be noted that in FIG. 6A, a center of gravity 617 of the engine 504 is shown to be above the crankshaft axis 506, and a position of the mounting pad for the engine block 620 is also shown (in phantom) to be located substantially at the level of the crankshaft axis 506.

In addition to showing the above features of the outboard motor 104 particularly relating to the transmission of power within the outboard motor, FIG. 6A also shows certain aspects of an oil system of the outboard motor 104. In particular, in the present embodiment, it should be understood that each of the engine 504, the first transmission 606, the second transmission 608, and the third transmission 616 includes its own dedicated oil reservoir, such that the respective oil sources for each of these respective engine components (each respective transmission and the engine itself) are distinct. In this regard, the oil reservoirs for the first transmission 606 and third transmission 616 can be considered part of those transmissions (e.g., the reservoirs can be the bottom portions/floors of the transmission housings). As for the engine 504, an engine oil reservoir 622 extends below the engine itself, and in this example extends partly into the mid portion 120 of the outboard motor 104 from the upper portion 118. Notwithstanding the present description, the engine oil reservoir 622 can also be considered to be part of the engine itself (in such case, the engine 504 is substantially albeit possibly not entirely above the trimming axis 112; alternatively, the engine oil reservoir 622 can be considered distinct from the engine per se, in which case the engine is entirely above the trimming axis). In accordance with other embodiments of the present disclosure, a dry sump (not shown) can be provided, separate and apart from the engine oil reservoir 622. And in accordance with embodiments of the present disclosure, a circulation pump is provided, for example, as part of the engine to circulate glycol, or a like fluid.

Further, FIG. 6A particularly shows that a second transmission oil reservoir 624 is positioned within the mid portion 120 of the outboard motor 104, beneath the second transmission 608. This positioning is advantageous for several reasons. First, as will be discussed further below, the positioning of the second oil transmission reservoir 624 at this location allows cooling water channels to pass in proximity to the reservoir and thus facilitates cooling of the oil within that reservoir. Additionally, the positioning of the second oil transmission reservoir 624 at this location is advantageous in that it makes use of interior space within the mid portion 120 which otherwise would serve little or no purpose (other than as a housing for the shaft connecting the second and third transmissions and for cooling and exhaust pathways as discussed below), as a site for storing oil that otherwise would be difficult to store elsewhere in the outboard motor. Indeed, because as discussed below the second transmission 608 is a forward-neutral-reverse (FNR) transmission, that transmission utilizes a significant amount of oil (e.g., 10 quarts or 5 Liters) and storage of this amount of oil requires a significant amount of space, which fortunately is found at the mid portion 120 (within which is positioned the second oil transmission reservoir 624 capable of holding such amounts of oil).

Figure 6C:
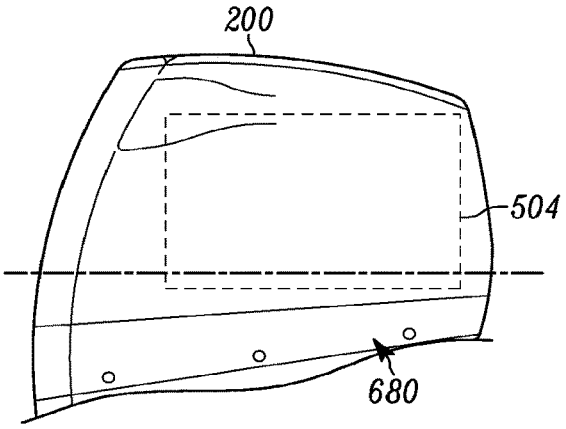
FIGS. 6C-6E illustrate schematically sealing pan features associated with the engine.
Figure 6E:
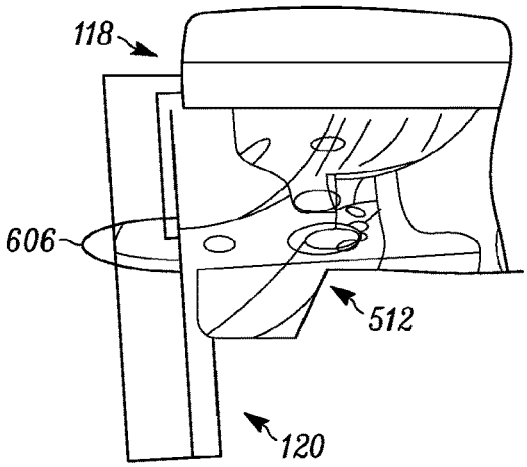
Figure 6D:
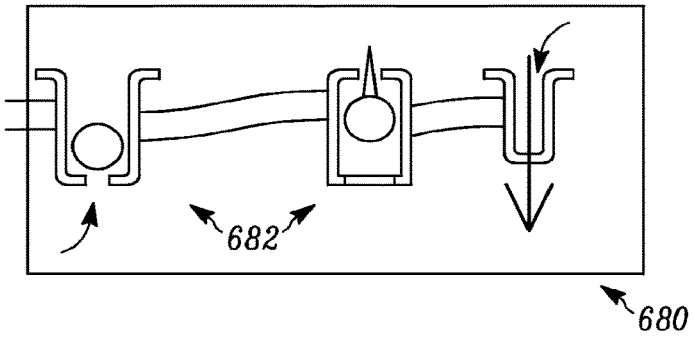

Turning next to FIGS. 6C-6D, additional features of the outboard motor 104 are shown, particularly in relation to the cowl 200 and a watertight sealing pan beneath the engine 104. As illustrated particularly in FIG. 6C (which shows a cutaway view of the upper portion 118), the cowl 200 particularly serves to house the engine 504 and serves to separate the engine compartment from other remaining portions of the outboard motor 104 to provide a clean and dry environment for the engine. For this purpose, in combination with the cowl 200, the outboard motor 104 additionally includes a substantially watertight sealing pan 680 that is positioned beneath the engine 504. Referring additionally to FIG. 6D, which schematically provides a top view of the watertight sealing pan 680. In particular as shown, the watertight sealing pan 680 includes valves 682 that allow water that resides in the watertight sealing pan to exit the watertight sealing pan, but that preclude water from reentering the watertight sealing pan. As for FIG. 6E, a further schematic view illustrates a rights side view of the upper portion 118 and a section of the mid portion 120 to illustrate how the exhaust conduits 512 pass through holes separate from the first transmission 606 through the sealing pan.

Turning next to FIGS. 7A-9C, internal components of the first, second and third transmissions 606, 608 and 616 are shown. It should be understood that, notwithstanding the particular components shown in FIGS. 7A-9C, it is envisioned that the first, second and third transmissions can take other forms (with other internal components) in other embodiments as well. Particularly referring to FIG. 7A, both a rear elevation view and also a right side elevation view (corresponding respectively to the views provided in FIG. 3 and FIG. 2) of internal components 702 of the first transmission 606 are shown. In this embodiment, the first transmission 606 is a parallel shaft transmission that includes a series of first, second and third gears 704, 706 and 708, respectively, that are each of equal diameter and are arranged to engage/interlock with one another in line between the crankshaft axis 506 and the level 611 previously discussed with reference to FIG. 6A. All three of the first, second and third gears 704, 706 and 708 are housed within an outer case 710 of the first transmission 606. An axis of rotation 712 of the second gear 706 positioned in between the first gear 704 and the third gear 708 is parallel to the first axis 506 and level 611, and all of the first axis 506, level 611 and axis of rotation 712 are within a shared vertically-extending or substantially vertically-extending plane.

As will be understood, because there are three gears, rotation of the first gear 704 in a first direction represented by an arrow 714 (in this case, being counterclockwise as shown in the rear view) produces identical counterclockwise rotation in accordance with an arrow 716 of the third gear 708, due to intermediary operation of the second gear 706, which rotates in the exact opposite (clockwise) direction represented by an arrow 718. Thus, in this embodiment, rotation of a crankshaft 720 of the engine (as shown in cutaway in the side elevation view) about the crankshaft axis 506 produces identical rotation of an intermediate axle 722 rotating about the level 611, the intermediary axle 722 linking the third gear 708 with the second transmission 608.

Figure 7B:
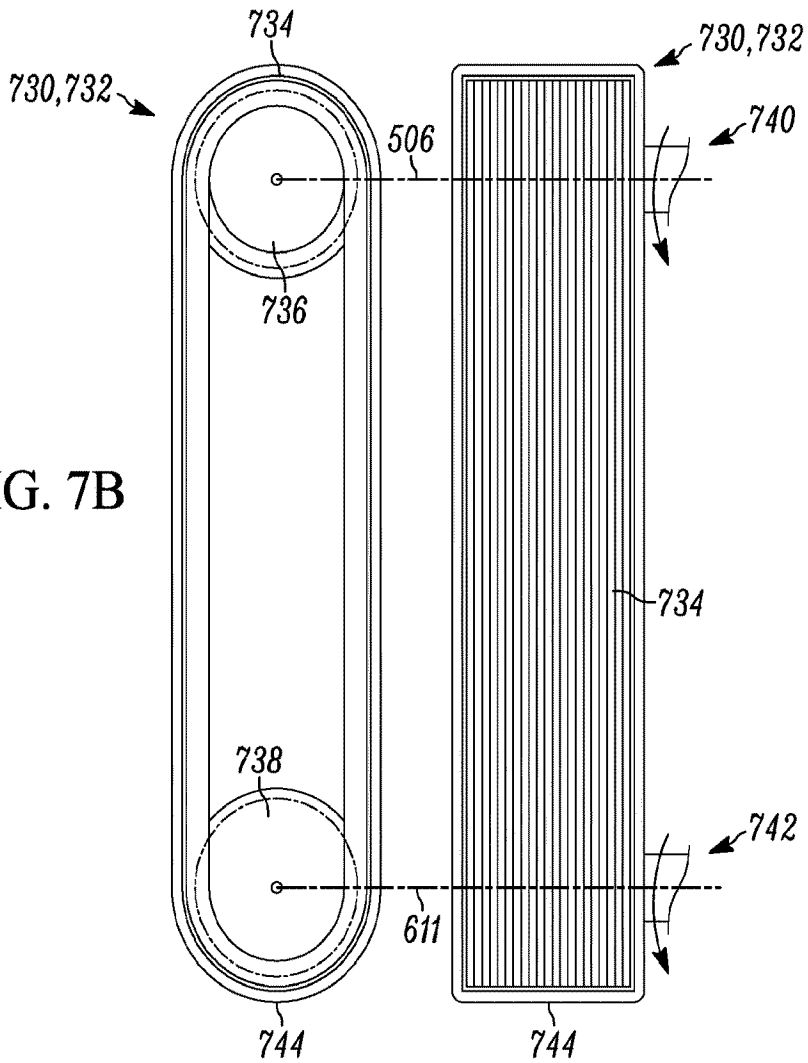
FIGS. 7A and 7B are schematic diagrams showing in more detail two example embodiments of a first transmission of the outboard motor of FIG. 6A.
Figure 7A:
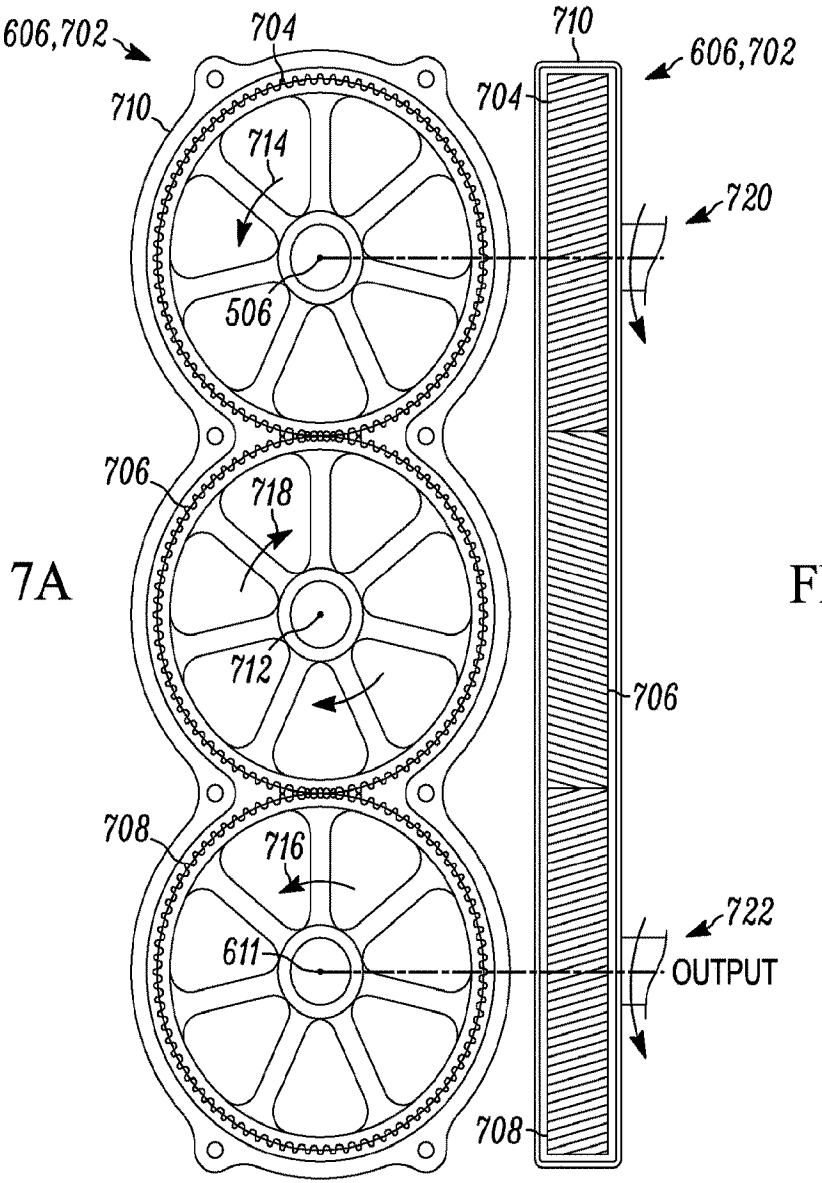

Although in the present embodiment of FIG. 7A, each of the first, second and third gears 704, 706 and 708 are of equal diameter, in other embodiments the gears can have different diameters such that particular rotation of the crankshaft 720 produces a different amount of rotation of the intermediary axle 722 in accordance with stepping up or stepping down of gear ratios. In addition, depending upon the embodiment, the number of gears linking the crankshaft 720 with the intermediary axle 722 need not be three. If an even number of gears is used, it will be understood that the intermediary axle will rotate in a direction opposite that of the crankshaft. Further, in at least some embodiments, the particular gears employed in the first transmission can be varied depending upon the application or circumstance, such that the outboard motor 104 can be varied in its operation in real time or substantially real time. For example, a 3-gear arrangement can be replaced with a 5-gear arrangement, or a 3 to 2 step down gear ratio can be modified to a 2 to 3 step up ratio.

Notwithstanding the embodiment of the first transmission 606 shown in FIG. 7A, in an alternate embodiment of the first transmission shown in FIG. 7B as a transmission arrangement 730, internal components 732 of the transmission include a chain 734 that links a first sprocket 736 with a second sprocket 738, where the first sprocket 736 is driven by a crankshaft 740 and the second sprocket 738 drives an intermediary axle 742 (intended to link the second sprocket 738 to the second transmission 608). Due to operation of the chain 734, rotation of the crankshaft 740 in a particular direction produces identical rotation of the intermediary axle 742. Also as shown, the chain 734 and sprockets 736, 738 are housed within an outer case 744.

Notwithstanding the embodiments shown in FIGS. 7A-7B, it should be understood that a variety of other transmission types can be employed in other embodiments to serve as (or in place of) the first transmission 606. For example, in some embodiments, a first wheel (or pulley) driven by the crankshaft (power take off from the engine 504) can be coupled to a second wheel (or pulley) for driving the intermediate axle (for driving the second transmission 608) by way of a belt (rather than a chain such as the chain 734). In still another embodiment, a 90 degree type gear driven by the crankshaft can drive another 90 degree type gear in contact with that first 90 degree gear, and that second 90 degree gear can drive a further shaft extending downward (e.g., along the arrow 610 of FIG. 6A) so as to link that second gear with a third 90 degree gear that is located proximate the level 611. The third 90 degree gear can turn a fourth 90 degree gear that is coupled to the intermediary axle and thus provides driving power to the second transmission 608.

Additionally, as already noted, in at least some embodiments, the particular gears (or other components) employed in the first transmission can be varied depending upon the application or circumstance, such that the gear ratio between the input and output of that first transmission can be varied and such that the outboard motor 104 can consequently be varied in its operation in real time or substantially real time. One further example of a first transmission that particularly allows for such gear ratio variation is shown to be a transfer case 751 in FIGS. 7C and 7D, where the transfer case 751 is configured to be coupled (and mounted in relation) to the engine 504 to receive input power therefrom, and also to the second transmission 608 (to which output power from the transfer case is provided).

As shown, in this embodiment, the transfer case 751 includes an input shaft 758, a first change gear 760, a second change gear 765, an intermediate shaft 771, a further gear 766, an additional gear 772, a lay shaft 773, a final output gear 774, and an output shaft 775. The first change gear 760 is particularly mounted upon the input shaft 758 by way of a splined coupling, and the second change gear 765 is mounted upon the intermediate shaft 771 also via a splined coupling. During normal operation, the transfer case 751 operates by transmitting power received from the engine 504 via the input shaft 758. Rotation of the input shaft 758 drives rotation of the first change gear 760, which meshes with and consequently drives the second change gear 765. Power is then transmitted from the second change gear 765 by way of the intermediate shaft 771 to the further gear 766, which is also mounted upon the intermediate shaft 771. The further gear 766 drives the additional gear 772 that is mounted to the lay shaft 773. The additional gear 772 in turn meshes with and drives the final output gear 774, which is mounted to the output shaft 775, thus allowing for the delivery of output power from the output shaft that can be provided to the second transmission 608.

Further as shown, the transfer case 751 has particular features that facilitate modification of gear/power train components within the transfer case. The transfer case 751 has a primary cover 752 that serves as a housing that surrounds and encloses the transfer case and the gears/power train components therewithin (including the aforementioned first change gear 760, second change gear 765, intermediate shaft 771, further gear 766, additional gear 772, lay shaft 773, final output gear 774, and at least portions of the input shaft 758 and output shaft 775). However, as should be particularly evident from FIG. 7D, the primary cover 752 does not entirely enclose all of the gears/power train components but rather has an orifice 790 at an upper rear-facing region of the primary cover by way of which the first and second change gears 760, 765 are accessible from outside of the primary cover to allow for modifications to the gears/power train components so as to result in gear ratio modifications. So that the gears/power train components can be fully enclosed (and protected from the outside environment) once a desired arrangement and gear ratio have been achieved, the transfer case 751 additionally includes a change gear (or simply gear) cover 753, which can be assembled to the primary cover 752 (e.g., by way of bolts or other fastening structures) so as to cover over the orifice 790. The gear cover 753 in the present embodiments additionally serves to support some of the gear/power train components of the transfer case 751 when it is assembled to the primary cover 752.

Figure 7C:
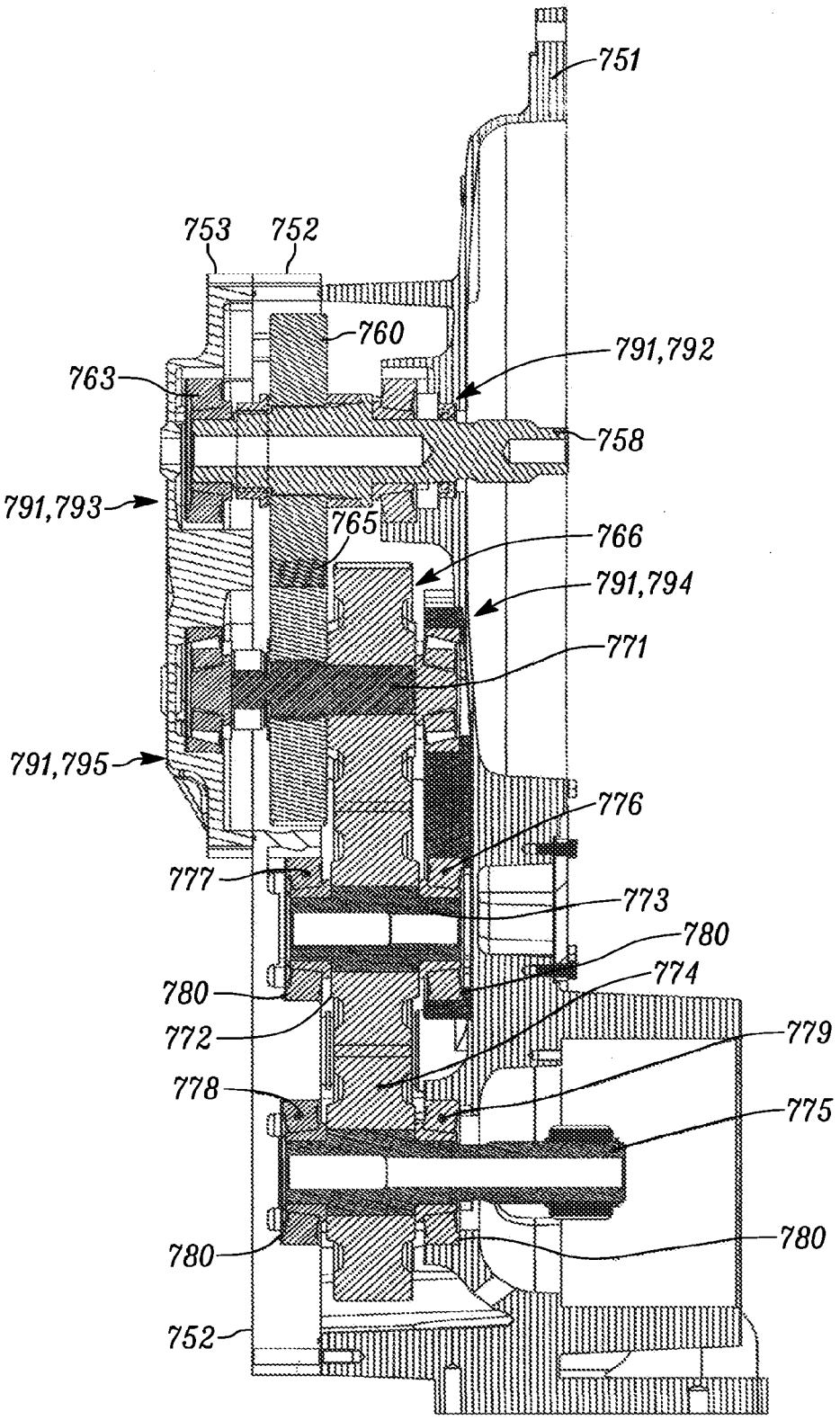
FIG. 7C is a cross-sectional view of an alternate embodiment of a first transmission (transfer case) of the outboard motor of FIG. 6A that is configured to allow for gear ratio variation, the cross-section being taken a long a central plane extending through the central axes of the input and output shafts of the transfer case.
Figure 7D:
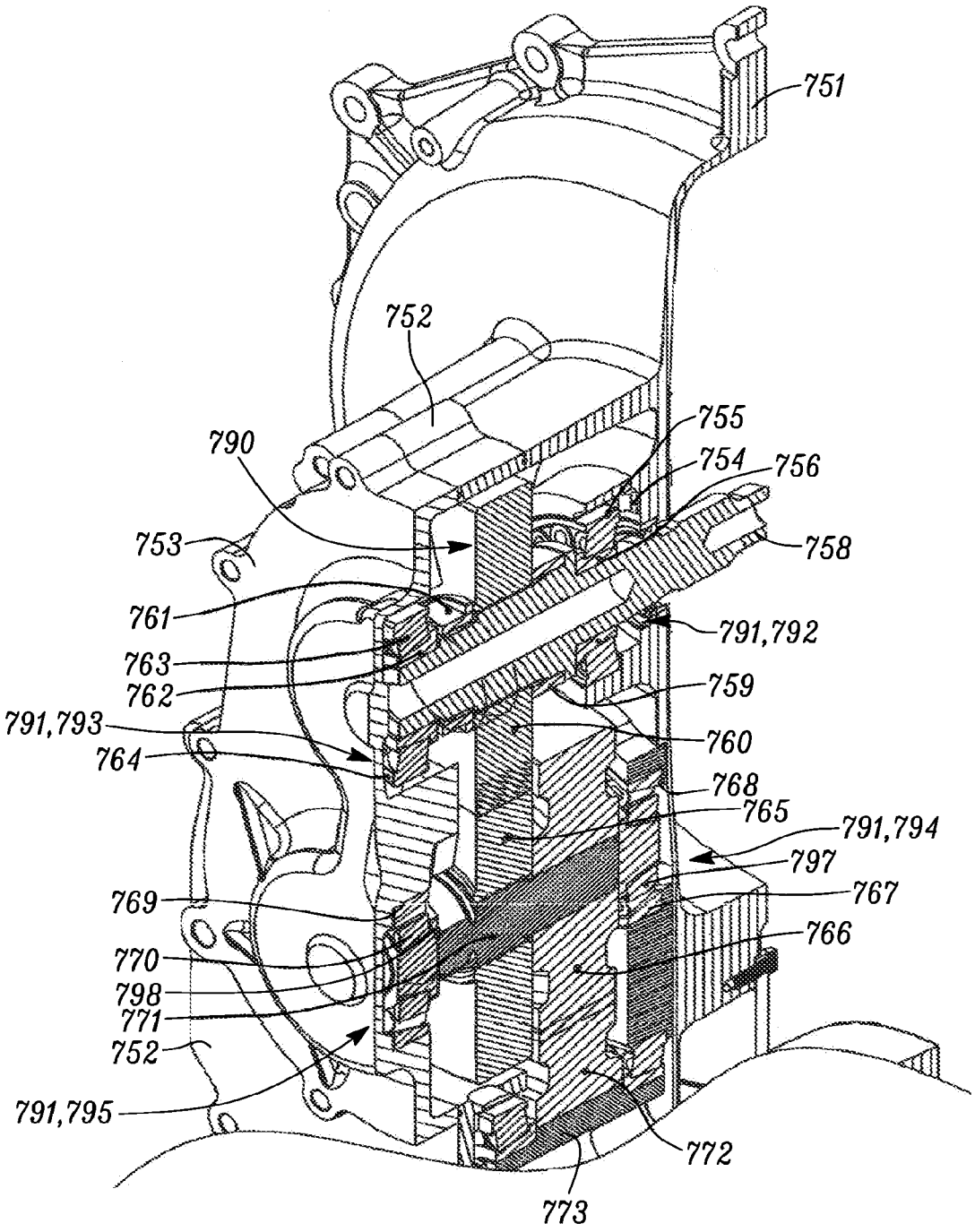
FIG. 7D is an additional, partially-cutaway, cross-sectional view of an upper portion of the first transmission (transfer case) shown in FIG. 7C, the cross-section being taken along a plane extending through the central axis of the input shaft of the transfer case but extending askew of the output shaft central axis.

In addition to the above, FIGS. 7C and 7D show further features of the transfer case 751 and gears/power train components therewithin. More particularly, the respective first change gear 760 can be securely fastened to the input shaft 758 via a first nut 761 (see FIG. 7D) and the second change gear 765 can be securely fastened to the intermediate shaft 771 by way of a second nut (which is not shown, but should be understood to be of the same type as the first nut and at a location in relation to the second change gear that corresponds to the location of the first nut relative to the first change gear). Additionally as shown, each of the input shaft 758 and the intermediate shaft 771 is suspended/supported within (or relative to) the transfer case 751 by way of a respective pair of roller bearing assemblies 791 respectively positioned at opposite ends of the respective shaft within the transfer case (at opposite ends proximate the front and rear of the transfer case 751). More particularly, the input shaft 758 is supported by a first roller bearing assembly 792 located proximate the front of the transfer case 751 that includes an outer cup 755 and a cone 756 on the shaft 758, plus a shim 754, and a second roller bearing assembly 793 located proximate the rear of the transfer case 751 that includes an outer cup 763 and a cone 762 on the shaft 758, plus a shim 764. Similarly, the intermediate shaft 771 is supported by a third roller bearing assembly 794 located proximate the front of the transfer case 751 that includes an outer cup 767 and a cone 797 on the shaft 771, plus a shim 768, and a fourth roller bearing assembly 795 located proximate the rear of the transfer case 751 that includes an outer cup 770 and a cone 798 on the shaft 771, plus a shim 769.

The bearing assemblies 791 (792, 793, 794, and 795) are particularly set to the appropriate pre-load level by way of the shims 754, 764, 768, and 769 (in other words, the bearings partiality to the appropriate pre-load level with the shims). It can be further noted that, in the present embodiment, the first change gear 760 is spaced apart from the first bearing assembly 792 by way of a cylindrical spacer 759, but is spaced (kept) apart from the second bearing assembly 793 by way of the nut 761. By comparison, the second change gear 765 is spaced part from the third bearing assembly 794 by way of the further gear 766, and spaced (kept) part from the fourth bearing assembly 795 by way of the second nut mentioned above (not shown). Finally, it should be appreciated from FIG. 7C that each of the lay shaft 773 and output shaft 775 also are supported by way of respective pairs of bearing assemblies As shown, the lay shaft 773 is particularly supported by a fifth bearing assembly 776 proximate the front of the transfer case 751 and a sixth bearing assembly 777 proximate the rear of the transfer case, and that the output shaft 775 is supported by a seventh bearing assembly 779 proximate the front of the transfer case and an eighth bearing assembly 778 proximate the rear of the transfer case. In this embodiment, each of the bearing assemblies includes a respective shim 780 (although the same reference numeral 780 is used for simplicity in referring to each of these shims, it should be appreciated that the respective shims used for each bearing can be different from the others), and also each of the bearing assemblies includes a respective outer cup and respective cone.

Given the design shown in FIGS. 7C and 7D, with the gear cover 753 removed from the primary cover 752, the first and second change gears 760 and 765 can be selected and modified to vary the gear ratio as required depending on the application. In particular, the first change gear 760 can be removed and replaced as desired without changing the shimming of the roller bearing assemblies 792, 793 (or bearing set) on the input shaft 758. Also, the same method of shimming and changing of the second change gear 765 can be performed in relation to the intermediate shaft 771 without changing the shimming of the roller bearing assemblies 794, 795 (bearing set) associated with that shaft. For example, although in the present example embodiment of the transfer case 751 shown in FIGS. 7C and 7D the first and second change gears 760 and 765 have the same (or substantially the same) diameter as one another, the first change gear 760 can be replaced with a first replacement change gear (not shown) having a larger (or smaller) diameter than the first change gear 760 and the second change gear 765 can be replaced with a second replacement change gear (not shown) having a smaller (or larger) diameter than the second change gear 765 so as to vary the gear ratio between the input shaft 758 and the intermediate shaft 771 from a 1:1 (or substantially 1:1) ratio to a ratio substantially less than (or greater than) a 1:1 ratio. Also for example, if the transfer case 751 initially has a first change gear that is larger (or smaller) in diameter than the second change gear, the first and second change gears can be replaced so that the first change gear is smaller (or larger) in diameter than the second change gear (or so that the first and second change gears share the same diameter), so as effect additional changes in gear ratio.

Using this approach, therefore, variations in the gear ratio of the transfer case 751 can be accomplished simply by removing the gear cover 753, removing the two retaining nuts (one of which is shown as the nut 761) from the shafts 758, 771, changing/replacing of one or both of the change gears 760, 765, placing the retaining nuts (or possibly other nuts or other fasteners differing from the original ones) back onto the shafts to retain the changed/replacement gears, and reassembling the gear cover 753 onto the remainder of the transfer case 751 (e.g., onto the primary cover 752). The gears 760, 765 and thus the associated gear ratio of the transfer case 751 can consequently be changed without affecting the pre-load torque of the shafts 758, 771. An advantage of this design is that, in contrast to many conventional transfer case designs, which require that the transfer case be separated completely from the engine and transmission in order to check a preload shaft, the present embodiment of FIGS. 7C and 7D particularly eliminates this disassembly requirement.

Notwithstanding the particular discussion provided with respect to FIGS. 7C and 7D, a variety of alternate embodiments are also possible. For example, in some alternate embodiments, the respective shims on one or the other of the ends of one or both of the input and intermediate shafts 758, 771 can be eliminated from the roller bearing assemblies 791 at those respective end(s). That is, in one such alternate embodiment, the shim 754 can be present while the shim 764 is absent, or vice-versa. Likewise, in alternate embodiments shims can be absent from one or the other of the bearing assemblies used to support one or both of the shafts 773 and 775. Also, although in the embodiment of FIGS. 7C and 7D removal of the gear cover 753 allows for access and modification/replacement of the first and second change gears 760, 765 (as well as possibly one or more of the associated components, such as one or more components of the bearing assemblies 791 such as one or more of the shims 754, 764, 768, 769), in other embodiments the gear cover 753 and primary cover 752 (e.g., in terms of the size of the orifice 790) can be modified to allow for accessing and modification/replacement of one or more of the other gears 766, 772, 774 and associated power train components (again such as one or more of the associated bearing assemblies and components thereof such as one or more shims). Also, in other embodiments, the numbers and/or types of gears and associated power train components in the transfer case can be varied.

Figure 7F:
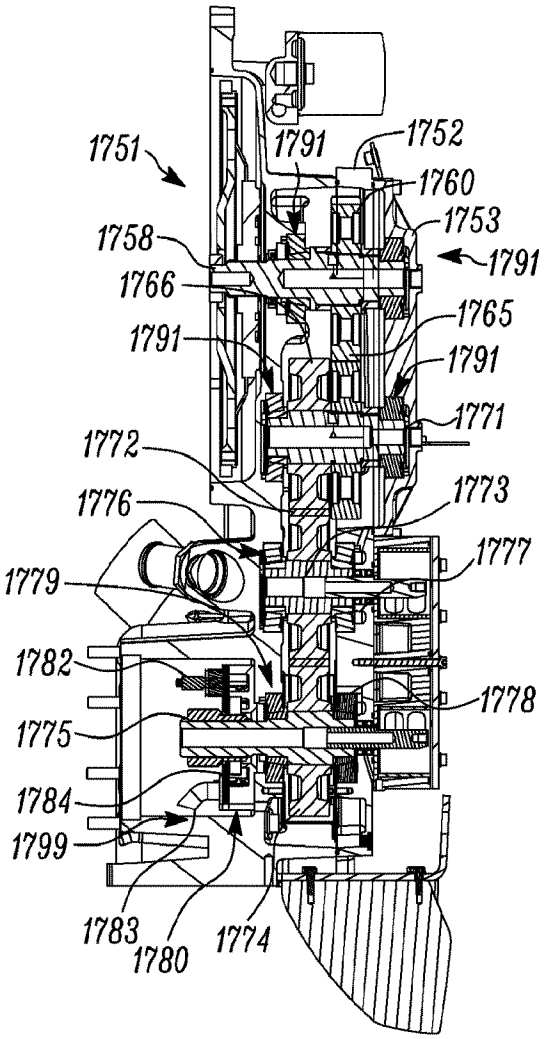
FIG. 7F is a cross-sectional view of the further alternate embodiment of the first transmission (transfer case) shown in FIG. 7E, taken along line F-F of FIG. 7E.
Figure 7E:
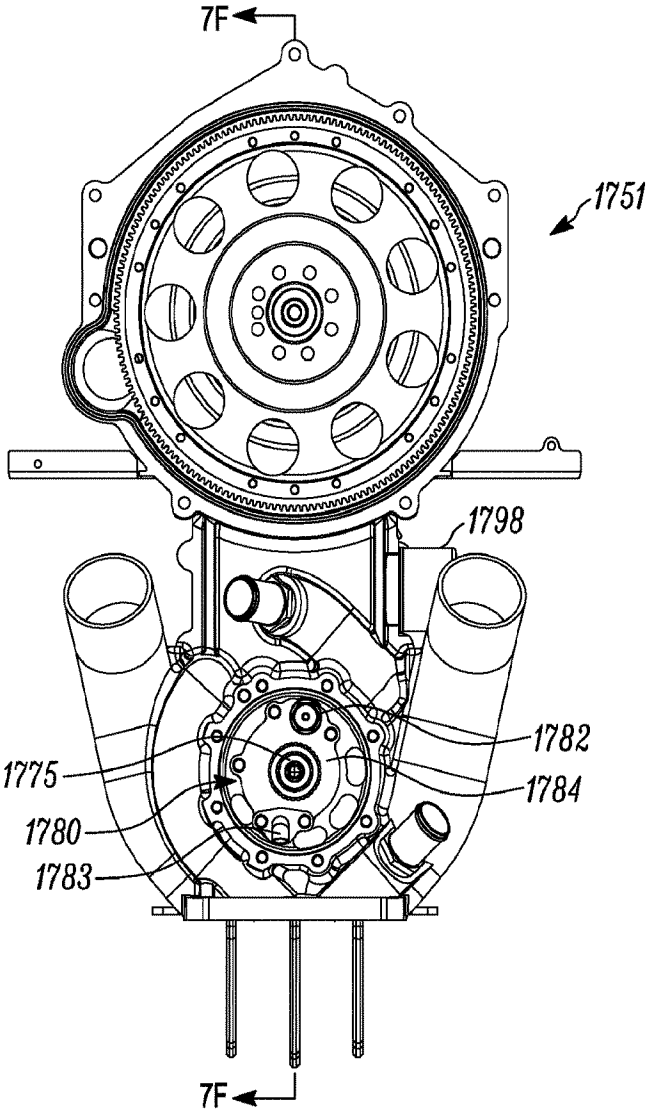
FIG. 7E is a front elevation view of a further alternate embodiment of a first transmission (transfer case) of the outboard motor of FIG. 6A that is configured to allow for gear ratio variation and that also includes an integrated oil pump.
Figure 7H:
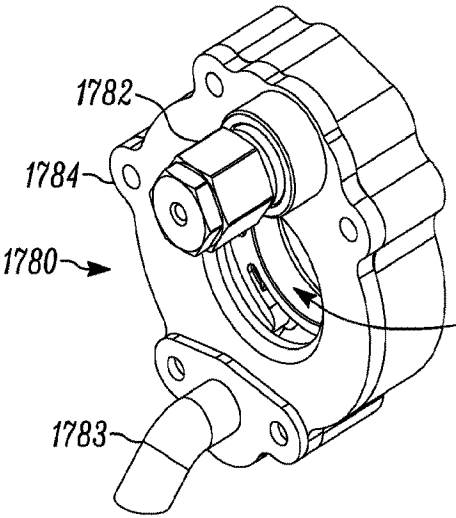
FIGS. 7G, 7H, 7I, 7J, and 7K respectively are left side perspective, right side perspective, rear elevation, right side, and front elevation views of the oil pump that is integrated in the further alternate embodiment of the first transmission (transfer case) of FIGS. 7E and 7F.
Figure 7G:
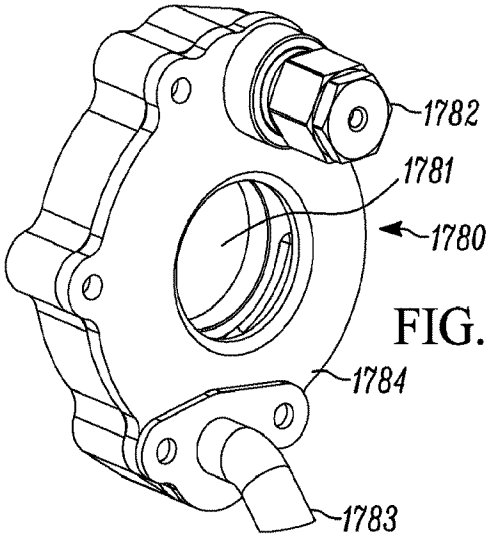

Referring to FIGS. 7E and 7F, in still an additional alternate embodiment of the first transmission 606, the first transmission can be (or include) a transfer case 1751 that includes an integrated oil pump 1780. FIG. 7E particularly shows a front elevation view of the transfer case 1751 and FIG. 7F shows a cross-sectional view of the transfer case 1751 taken along line F-F of FIG. 7E (with the view directed so as to allow for viewing of portions of a right half of the transfer case). As is evident from FIG. 7F in particular, the transfer case 1751 includes a number of components that correspond to the same or substantially the same components of the transfer case 751 of FIGS. 7C and 7D. Among other things, the transfer case 1751 includes a first change gear 1760, second change gear 1765, intermediate shaft 1771, further gear 1766, additional gear 1772, lay shaft 1773, final output gear 1774, and at least portions of an input shaft 1758 and output shaft 1775 that respectively correspond to (and are identical to or substantially similar to) the first change gear 760, second change gear 765, intermediate shaft 771, further gear 766, additional gear 772, lay shaft 773, final output gear 774, and the input shaft 1758 and output shaft 1775 (or portions of those shafts), respectively.

Further, the transfer case 1751 includes two pairs of roller bearing assemblies 1791 for supporting the input shaft 1758 and intermediate shaft 1771, which correspond respectively to the roller bearing assemblies 791 of the transfer case 751 (in which each roller bearing assembly includes a respective cup, cone, and shim), as well as roller bearing assemblies 1776, 1777, 1778, and 1779 respectively corresponding to the respective roller bearing assemblies 776, 777, 7778, and 7779 of the transfer case 751 (and again which each include a respective cup, cone, and shim), and also includes nuts (or other spacers) corresponding to the nuts of the transfer case 751 (e.g., the first nut 761 discussed above) for maintaining relative positioning of the gears. Additionally, the transfer case 1751 also includes a primary housing 1752 and gear cover 1753 that is attachable to and removable from the primary housing, so as to reveal and allow for changing/replacement of the first and second change gears 1760 and 1761 so as to allow for variation of the gear ratio provided by the transfer case. Thus, in terms of allowing for the transfer of rotational power from the input shaft 1758 and the output shaft 1775, and facilitating variation of the gear ratio provided by the transfer case 1751 by the changing/replacement of one or more of the change gears 1760 and 1761, the transfer case 1751 operates in a manner that is the same as or substantially the same as the transfer case 751 of FIGS. 7C and 7D.

Figure 7K:
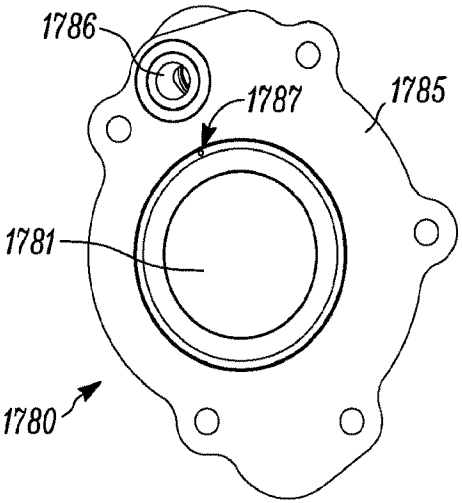
Figure 7J:
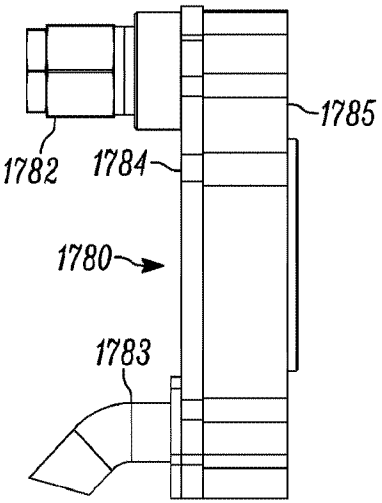
Figure 7I:
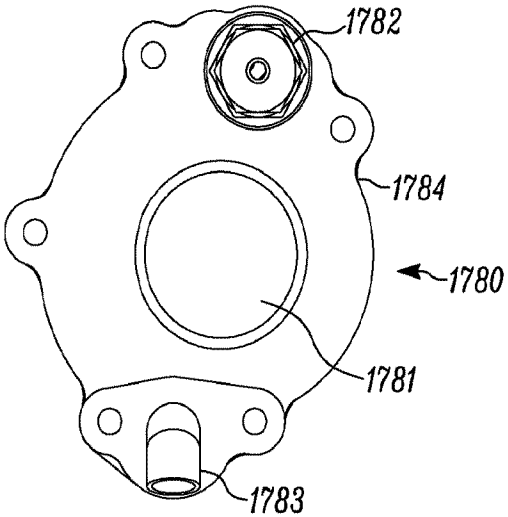

Notwithstanding these similarities, the transfer case 1751 includes additional features different from those of the transfer case 751 particularly insofar as the transfer case 1751 includes the oil pump 1780 integrated within the transfer case. As shown, in the present embodiment, the oil pump 1780 particularly is mounted on the output shaft 1775 as it extends forward from the final output gear 1774, toward the location at which is positioned the second transmission 608 (not shown) below the engine 504. More particularly as shown in additional FIGS. 7G, 7H, 7I, 7J, and 7K, which respectively are left side perspective, right side perspective, rear elevation, right side, and front elevation views of the oil pump 1780 independent of the remainder of the transfer case 1751, the oil pump 1780 is a substantially annular structure having an inner orifice 1781 (as particularly is evident from FIGS. 7G, 7H, 7I, and 7K), an oil output port 1786 (see particularly FIG. 7K), and an oil input port 1783 (below the oil output port), where the oil input port 1783 is positioned along a front-facing face 1784 of the oil pump (as is visible in FIGS. 7G, 7H, 7I, and 7J) and the oil output port 1786 is formed along a rear-facing face 1785 of the oil pump (as shown in FIGS. 7J and 7K). The oil output port 1786 is shown particularly as including an orifice surrounded by an O-ring. Further as shown, the oil pump 1780 additionally includes an oil pressure relief valve 1782 that extends outward (forward) from the front-facing face 1784 of the oil pump, which is located above the oil input port 1783, and which serves to prevent oil pressure from going beyond predetermined level(s).

As is evident particularly from the FIG. 7F, when the oil pump 1780 is mounted on the output shaft 1775, the output shaft 1775 passes through the inner orifice 1781. Due to coupling of an exterior splined surface of the output shaft with an inner splined surface within the oil pump that forms the inner orifice 1781, rotation of the output shaft causes rotation of the oil pump. Since the output shaft 1775 turns when the engine 504 causes rotation of the input shaft 1758 (that is, when transfer case 1751/first transmission operates or turns), engine operation and consequent rotation of the output shaft drives the oil pump and causes the oil pump to deliver oil. Although operation can vary depending upon the embodiment, in the present embodiment, the oil pump only operates to deliver oil when the when the transfer case (first transmission) 1751 is operating and the output shaft 1775 is rotating. When the oil pump is operating due to rotation of the output shaft 1775, the pump pressurizes incoming oil received via the oil input port 1783 and delivers (outputs) the pressurized oil via the output port 1786 to an oil filter 1798 (see FIG. 7E), which removes debris from the oil. The filtered, pressurized oil exiting the oil filter 1798 then is ready to be used, and is supplied from the oil filter to any of a variety of components of the outboard motor (e.g., in this case, the outboard motor 104 equipped with the transfer case 1751) that can utilize that oil, by way of any of a variety of, or a series of (or a variety of series of), of interconnected passages, galleries, tubes, and/or holes.

In the present embodiment, the oil pump 1780 can be a conventional gerotor pump suitable for pumping oil suitable for use in an engine such as the engine 504 or in relation to components of transmission devices such as the first, second, and third transmissions 606, 608, and 616. A gerotor pump can be suitable as the oil pump 1780 particularly because the output shaft 1775 passes through the center of the pump on a spline that allows radial driving torque for the pump but also allows free axial motion of the pump driver (thus not affecting the free axial motion of the pump inner member that is typically required for the correct functioning of a gerotor pump). Nevertheless, in other embodiments, the oil pump 1780 can be another type of oil pump including, for example, a vane type oil pump or a geared oil pump.

Also, in the present embodiment, the oil pump 1780 is positioned on the output shaft 1775 because an oil sump or reservoir 1799 from which the oil pump draws oil is located at the bottom of (or below) the transfer case 1751 and the output shaft 1775 is the lowermost shaft of the transfer case that is closest to that oil sump. More particularly as illustrated, the oil input port 1783 (oil pump inlet tube or pickup tube) in the present embodiment extends into the oil sump 1799 such that, as the outboard motor changes angle during operation of the outboard motor or the marine vessel on which the outboard motor is implemented (in terms of any of fore and aft or aft angle referred to as "trim" or boat roll angles), the oil input port allows oil to be accessed and delivered even despite such movements of the outboard motor/marine vessel.

Nevertheless, in alternate embodiments, the oil pump can instead be mounted on any other of the shafts of the transfer case 1751 (e.g., any of the input shaft 1758, the intermediate shaft 1771, the lay shaft 1773), and/or can be mounted in other manners. Indeed, the present disclosure is intended to encompass any of a variety of embodiments in which any of a variety of oil pumps is formed as part of, and/or integrated with, a transmission device (or transfer case), and is driven to pump oil when the transmission device (or transfer case) is operating to communicate rotational power. And the present disclosure is further intended to encompass any of a variety of such embodiments involving an oil pump formed as part of or integrated with a transmission device, where the pumped oil can be utilized to lubricate any of a variety of component(s) of that transmission device (e.g., power train components such as gears or shafts or bearings thereof), and/or of other transmission devices, the engine, or other structures or devices (e.g., other components of the outboard motor).

Providing of the oil pump 1780 in the transfer case 1751 in the manner shown in FIGS. 7E and 7F is advantageous in the present embodiment of an outboard motor in which a horizontal crankshaft engine is employed. To begin, providing of the oil pump 1780 in an integrated manner along the output shaft 1775 (or another shaft of the transfer case), is a convenient and elegant manner of implementing an engine-driven oil pump. Although the oil pump 1780 can provide oil to any of a variety of components of the outboard motor, including components of the engine 504 and/or any of the transmissions 606, 608, 616, in the present embodiment a primary purpose of the oil pump 1780 is to lift oil from the oil sump 1799, drive the oil through the oil filter 1798, and cause delivery of the filtered oil to the backside(s) of the tapered roller bearings (e.g., the roller bearing assemblies 1791, 1776, 1777, 1778, 1779) of the transfer case 1751 via interconnecting passages. This augments the natural flow of oil thru each bearing.

The particular interconnecting passages used to communicate oil from the oil pump (and oil filter 1798) to the bearings can vary depending upon the embodiment. In the present embodiment, in which the transfer case 1751 includes eight of the bearings (four bearing assemblies 1791, plus the bearing assemblies 1776, 1777, 1778, and 1779), the oil pump (or oil pump via the oil filter 1798) can deliver oil to the uppermost six (6) of the bearings (the bearing assemblies 1791, 1776, and 1777) via transmission internal drill ways. Also, as shown in FIG. 7K, in the present embodiment oil can be delivered from the oil pump 1780 to a seventh of the bearings (the bearing assembly 1779) by way of an orifice 1787 included in the oil pump body itself, so as to feed oil to that bearing, which is the bearing that is closest to the oil pump. The eighth of the bearings (the bearing assembly 1778) can be directly exposed to the oil sump 1799. With such an arrangement, oil returns to the oil sump 1799 from the bearings by cascading downwardly, thereby lubricating the gears 1760, 1765, 1766, 1772, and 1774 of the transfer case 1751 (first transmission).

In addition, placement of the oil pump 1780 in the location shown in FIGS. 7E and 7F not only allows for filtered, pressurized oil to be directly supplied to components of the transfer case 1751, but also allows for such oil to be provided to any of a number of other components of the outboard motor that can benefit from such oil. Indeed, in the present embodiment of the outboard motor, in which first, second, and third transmissions are employed (e.g., in this example, the transfer case 1751, the second transmission 608, and the third transmission 616, respectively) to connect the engine 504 to the propeller mounted at the gear casing 206 and to communicate engine torque and driving power to the propeller, there are numerous components that require or can benefit from lubrication provided by the oil delivered from the oil pump 1780.

Further in this regard, it should be appreciated that, depending upon the embodiment of outboard motor, there are a variety of different types of transmissions and transmission components that can be employed as well as a variety of manners of assembling and/or coupling those transmissions and transmission components, and the present disclosure is intended to encompass numerous such embodiments including, further for example (and without limitation), embodiments involving any one or more of gear, belt, shaft, electric generator and/or motor, hydraulic pump and/or motor, and/or other components. Regardless of which of such implementations are provided in any given embodiment, in all or substantially all of such implementations, an oil pump providing lubrication can beneficially supply oil to one or more components of such implementations.

Turning next to FIG. 8, in the present embodiment the second transmission 608 is a wet plate transmission (or multi-plate wet disk clutch transmission) that receives rotational power via the intermediary axle 722 (previously shown in FIG. 7A) rotating about the level 611 and provides output power by way of an output shaft 802, which extends downwardly in the direction of the arrow 614 and links the second transmission to the third transmission 616 within the gear casing 206. The internal components of the wet disk clutch transmission constituting the second transmission 608 can be designed to operate in a conventional manner. Thus, operation of the second transmission 608 is controlled by controlling positioning of a clutch 804 positioned between a reverse gear 806 on the left and a forward gear 808 on the right of the clutch, where each of the reverse gear, clutch and forward gear are co-aligned along the axis established by the level 611. Movement of a control block 810 located to the right of the forward gear 808, to the right or to the left, causes engagement of the reverse gear 806 or forward gear 808 by the clutch 804 such that either the reverse gear 806 or the forward gear 808 is ultimately driven by the rotating intermediary axle 722.

Further as shown, each of the reverse gear 806 and forward gear 808 are in contact with a driven gear 812, with the reverse gear engaging a left side of the driven gear and the forward gear engaging a right side of the driven gear, the reverse and forward gears being oriented at 90 degrees relative to the driven gear. The driven gear 812 itself is coupled to the output shaft 802 and is configured to drive that shaft. Thus, depending upon whether the reverse gear 806 or forward gear 808 is engaged, the driven gear 812 connected to the output shaft 802 is either driven in a counterclockwise or clockwise manner when rotational power is received via the intermediate axle 722. Also, a neutral position of the clutch 804 disengages the output shaft 802 from the intermediary axle 722, that is, the driven gear 812 in such circumstances is not driven by either the forward gear 808 or the reverse gear 806 and consequently any rotational power received via the intermediary axle 722 is not provided to the output shaft 802.

It should be noted that the use of a wet disk clutch transmission in the present embodiment is made possible since the wet disk clutch transmission can serve as the second transmission 608 rather than the third transmission 616 in the gear casing (and since the wet disk clutch transmission need not bear as large of torques, particularly when the twin pinion arrangement is employed in the third transmission). Nevertheless, it can further be noted that, in additional alternate embodiments, the second transmission 608 need not be a wet disk clutch transmission but rather can be another type of transmission such as a dog clutch transmission or a cone transmission. That is, although in the present embodiment the wet disk clutch transmission serves as the second transmission 608, in other embodiments, other transmission devices can be employed. For example, in other embodiments, the second transmission 608 can instead be a cone clutch transmission or a drop clutch transmission. Further, in other embodiments, the third transmission (gear casing) 616 can itself employ a dog clutch transmission or other type of transmission. Also, in other embodiments, the first transmission 606 can serve as the transmission providing forward-neutral-reverse functionality instead of the second transmission providing that capability, in which case the second transmission can simply employ a pair of bevel gears to change the direction of torque flow from a horizontal direction (between the first and second transmissions) to a downward direction (to the third transmission/gear case).

Turning next to FIG. 9A, internal components of the third transmission 616 are shown within a cutaway section of the lower portion 122 of the outboard motor 104 (plus part of the mid portion 120). In the present embodiment the third transmission 616 is a twin pinion transmission. Given this configuration, the output shaft 802 extending from the second transmission 608 reaches the plane 126 at which are located a pair of first and second gears 902 and 904, respectively, that are of equal diameter and engage one another. In the present embodiment, the second gear 904 is forward of the first gear 902, with both gears having axes parallel to (or substantially parallel to) the steering axis 110 (see FIG. 1) of the outboard motor 104. First and second additional downward shafts 906 and 908, respectively, extend downward from the first and second gears 902 and 904, respectively, toward first and second pinions 910 and 912, respectively, which are located within the gear casing 206 with the first pinion 910 being aft of the second pinion 912. Due to the interaction of the first and second gears 902 and 904, while rotation of the first additional downward shaft 906 proceeds in the same direction as that of the output shaft 802, the rotation of the second additional downward shaft 908 is in the opposite direction relative to the rotation of the output shaft 802. Thus, the pinions 910 and 912, respectively, rotate in opposite directions.

Further as shown, each of the first and second pinions 910 and 912 engages a respective 90 degree type gear that is coupled to the propeller driving output shaft 212 that is coupled to the propeller 130 (not shown). The power provided via both of the pinions 910, 912 is communicated to the propeller driving output shaft 212 by way of a pair of first and second 90 degree type gears 916 and 918 or, alternatively, 920 and 922. Only the gears 916, 918 or the gears 920, 922 are present in any given embodiment (hence, the second set of gears 920, 922 in FIG. 9A are shown in phantom to indicate that those gears would not be present if the gears 916, 918 were present). As shown, the gears of each pair 916, 918 or 920, 922 are arranged relative to their respective pinions 910, 912 along opposite sides of the pinions such that the opposite rotation of the respective pinions will ultimately cause the respective gears of either pair to rotate the propeller driving output shaft 212 in the same direction. That is, the first 90 degree type gear 916 is towards the aft side of the first pinion 910 while the second 90 degree type gear 918 is to the forward side of the pinion 912. Likewise, while the first 90 degree type gear 920 (shown in phantom) is to the forward side of the first pinion 910, the second 90 degree type gear 922 is (also shown in phantom) to the aft side of the second pinion 912.

Notwithstanding the above discussion, in alternate embodiments the third transmission 616 can take other forms. For example, as shown in FIG. 9B, in one alternate embodiment of the third transmission shown as a transmission 901, there is only a single pinion 924 within the gear case 206 that is directly coupled to the output shaft 802 (elongated as appropriate), and that pinion drives a single 90 degree type gear 926 coupled to the propeller driving output shaft 914. In yet a further alternate embodiment of the third transmission 616, shown as a transmission 903 in FIG. 9C, gears within the gear casing 206 are configured to drive a pair of counter-rotating propellers (not shown). More particularly, in this embodiment, a single pinion 928 within the gear casing 206 is driven by the output shaft 802 (again as appropriately elongated) and that pinion drives both rear and forward 90 degree type gears 930 and 932, respectively. As shown, the forward 90 degree type gear 932 drives an inner axle 934 that provides power to a rearmost propeller (not shown) of the counter-rotating pair of propellers, while the rear 90 degree type gear 930 drives a concentric tubular axle 936 that is coaxially aligned around the first axle 934. The tubular axle 936 is connected to the forward one of the propellers of the pair of counter-rotating propellers (not shown) and drives that propeller.

Figures 10A, 10B:
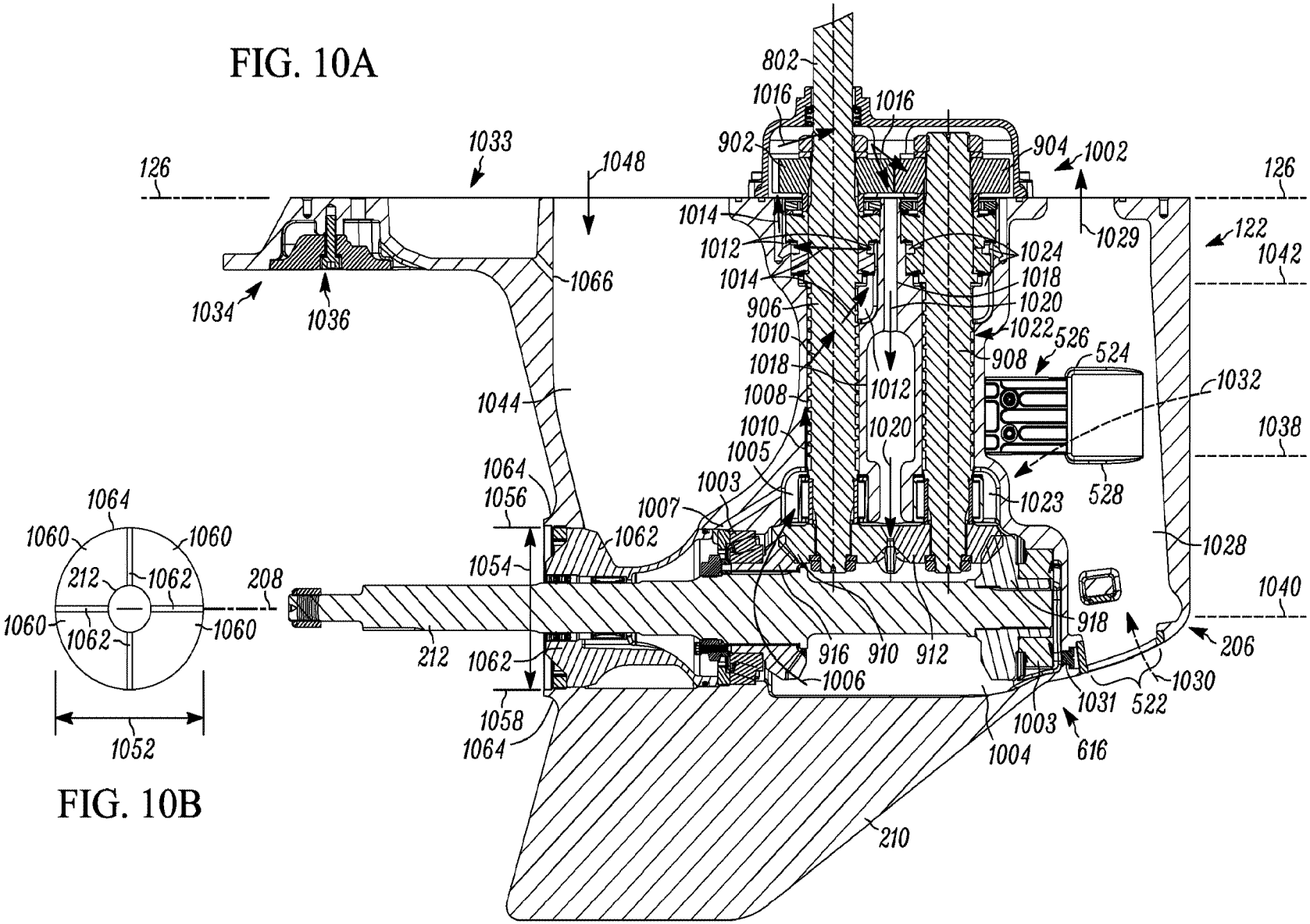
FIG. 10A is a cross-sectional view of a lower portion of the outboard motor of FIGS. 1-3, 5, and 6A, taken along line 10-10 of FIG. 3, shown cutaway from mid and upper portions of that outboard motor.
FIG. 10B is a rear elevation view a gear casing of the lower portion of the outboard motor of FIG. 10A, shown cutaway from the remainder of the lower portion.

Referring further to FIG. 10A, an additional cross-sectional view is provided of the lower portion 122 of the outboard motor 104, taken along line 10-10 of FIG. 3. Among other things, this cross-sectional view again shows components of the third transmission 616 of the outboard motor 104. The view provided in FIG. 10A particularly also is a cutaway view with portions of the outboard motor 104 above the plane 126 cutaway, aside from a section 1002 of the lower portion 122 receiving the output shaft 802 from the second transmission 608 and housing the first and second gears 902, 904 (contrary to the schematic view of FIG. 9A, in FIG. 10A the section 1002 actually extends slightly above the plane 126 serving as the general conceptual dividing line between the lower portion 122 and the mid portion 120, but nevertheless can still be considered part of the lower portion 122 of the outboard motor 104). In addition to the section 1002, FIG. 10A also shows the first and second additional downward shafts 906 and 908, which link the respective first and second gears 902 and 904 with the first and second pinions 910 and 912, respectively. In turn, the first and second pinions 910 and 912, respectively, are also shown to engage the first and second 90 degree type gears 916 and 918, respectively, which drive the propeller driving output shaft 212 (as with FIG. 3, the propeller 130 is not shown in FIG. 10A) extending along the elongated axis 208 of the gear casing 206 above the fin 210. Tapered roller bearings 1003 are further shown in FIG. 10A to support the first and second 90 degree type gears 916, 918 and the propeller driving output shaft 212 relative to the walls of the third transmission 616.

In addition to showing some of the same components of the third transmission 616 shown schematically in FIG. 9A, FIG. 10A is also intended to illustrate oil flow within the third transmission, and further to illustrate several components/portions of a cooling system of the outboard motor 104 and also several components/portions of an exhaust system of the outboard motor that are situated within the lower portion 122 (additional components/portions of the cooling system and exhaust system of the outboard motor 104 are discussed further below with respect to subsequent FIGS.). With respect to oil flow within the third transmission 616, it should be noted that oil congregates in a reservoir portion 1004 near the bottom of the gear casing 206. By virtue of rotation of the first and second 90 degree type gears 916 and 918, not only is oil provided to lubricate those gears but also oil is directed to the first and second pinions 910 and 912, respectively. Flow in this direction, particularly from the reservoir portion 1004 via the first 90 degree type gear 916 to the first pinion 910 and a space 1005 above the first pinion is indicated by an arrow 1006 (it will be understood that oil proceeds in a complementary manner via the second 90 degree type gear 918 to the second pinion 910).

Upon reaching the space 1005 above the first pinion 910, some of that oil is directed to the tapered roller bearings 1003 supporting the 90 degree type gears 916, 918 and the propeller driving output shaft 212 (as well as aft of those components) via a channel 1007. Further, additional amounts of the oil reaching the space 1005 is directed upward to the first gear 902 by way of rotation of the first additional downward shaft 906, due to operation of an Archimedes spiral mechanism 1008 formed between the outer surface of the first additional downward shaft and the inner surface of the passage within which that downward shaft extends, as represented by arrows 1010. Ultimately, due to operation of the Archimedes spiral mechanism 1008, oil is directed upward through the channel of the Archimedes spiral mechanism up to additional channels 1012 linking a region near the top of the Archimedes spiral mechanism with the first gear 902 as represented by arrows 1014. Upon reaching the first gear 902, the oil lubricates that gear and also further lubricates the second gear 904 due to its engagement with the first gear as represented by arrows 1016. Then, some of the oil reaching the first and second gears 902, 904, proceeds downward back to the reservoir portion 1004 by way of further channels 1018 extending downward between the first and second additional downward shafts 906, 908 to the reservoir portion 1004, as represented by arrows 1020.

Although in this example oil reaches the top of the third transmission 616 and particularly both of the first and second gears 902, 904 via the Archimedes spiral mechanism 1008 associated with the first additional downward shaft 906, such operation presumes that the first additional downward shaft is rotating in a first direction tending to cause such upward movement of the oil. However, this need not always be the case, since the outboard motor 104 can potentially be operated in reverse. Given this to the be the case, an additional Archimedes spiral mechanism 1022 is also formed between the outer surface of the second additional downward shaft 908 and the inner surface of the passage within which that downward shaft extends. Also, additional channels 1024 corresponding to the additional channels 1012 are also formed linking the top of the additional Archimedes spiral mechanism 1022 with the second gear 904. Given the existence of the additional Archimedes spiral mechanism 1022 and the additional channels 1024, when the direction of operation of the outboard motor 104 is reversed from the manner of operation shown in FIG. 10A, oil proceeds upward from the reservoir portion 1004 via the second 90 degree type gear 918, the second pinion 912, an additional space 1023 above the second pinion 912 (corresponding to the space 1005), the additional Archimedes spiral mechanism 1022, and the additional channels 1024 to the second gear 904 and ultimately the first gear 902 as well (after which the oil then again proceeds back down to the reservoir portion via the further channels 1018). Thus, oil reaches the first and second gears 902 and 904 and the entire third transmission 616 is lubricated regardless of the direction of operation of the outboard motor 104.

Finally, it should also be noted that, assuming a given direction of operation of the outboard motor 104, while oil proceeds upward to the first and second gears 102, 104 via one of the Archimedes spiral mechanism 1008, 1022, it should not be assumed that the other of the Archimedes spiral mechanism 1022, 1008 is not operating in any manner. Rather, whenever one of the Archimedes spiral mechanisms 1008, 1022 is tending to direct oil upward, the other of the Archimedes spiral mechanisms 1022, 1008 is tending to direct at least some of the oil reaching it back down to that one of the pinions 910, 912 and then ultimately to the reservoir portion 1004 as well (via the corresponding one of the 90 degree type gears 916, 918). Thus, in the example of FIG. 10A showing oil to be provided upward due to operation of the Archimedes spiral mechanism 1008, it should also be understood that at least some of the oil reaching the second gear 904, rather than being direct downward back to the reservoir portion 1004 via the further channels 1018, instead proceeds back down to the reservoir portion via the additional Archimedes spiral mechanism 1022, which in this case would tend to be directing oil downward. Alternatively, if the outboard motor 104 was operating in the reverse manner and oil was directed upward via the additional Archimedes spiral mechanism 1022, then the Archimedes spiral mechanism 1008 would tend to direct at least some of the oil reaching it via the first gear 902 back down to the reservoir portion 1004 as well.

As already noted, FIG. 10A also shows several cooling system components of the lower portion 122 of the outboard motor 104. In the present embodiment, coolant for the outboard motor 104 and particularly the engine 504 is provided in the form of some of the water 101 within which the marine vessel assembly 100 is situated. More particularly, FIG. 10A shows that the outboard motor 104 receives/intakes into a coolant chamber 1028 within the lower portion 122 some of the water 101 (see FIG. 1) via multiple water inlets, namely, the lower water inlet 522 and two of the upper water inlets 524 already mentioned with respect to FIG. 5. As earlier noted, the lower water inlet 522 is positioned along the bottom of the gear casing 206, near the front of that casing forward of the fin 210, and the water 101 proceeds into the coolant chamber 1028 via the lower water inlet generally in a direction indicated by a dashed arrow 1030.

It should further be noted from FIG. 10A that an oil drain screw 1031 allowing for draining of oil from the reservoir portion 1004/third transmission 616 extends forward from the third transmission toward the lower water inlet 522, from which it can be accessed and removed so as to allow oil to drain from the third transmission even though the oil drain screw is still located interiorly within the outer housing wall of the outboard motor 104. Such positioning of the oil drain screw 1031 is advantageous because, in contrast to some conventional arrangements, the oil drain screw does not protrude outward beyond the outer housing wall of the outboard motor 104 and thus does not create turbulence or drag as the outboard motor passes through the water and also does not as easily corrode over time due to water exposure.

In contrast to the lower water inlet 522, the upper water inlets 524 are respectively positioned midway along the left and right sides of the lower portion 122 (particularly along the sides of a strut portion of the lower portion linking the top of the lower portion with the torpedo-shaped gear casing portion at the bottom), and the water 101 proceeds into the coolant chamber 1028 via these inlets in a direction generally indicated by a dashed arrow 1032. It should be understood that, as a cross-sectional view from the right side of the lower portion 122, FIG. 10A particularly shows the left one of the upper water inlets 524, while the right one of the upper water inlets (along the right side of the lower portion 122) is shown instead in FIG. 5. More particularly, in the present embodiment, each of the respective left and right ones of the upper water inlets 524 is formed by the combination of a respective one of the cover plates 526 (previously mentioned in FIG. 5) and a respective orifice 528 within the respective left or right sidewalls (housing or cowling walls) of the lower portion 122. The respective cover plate 526 of each of the upper water inlets 524 serves to partly, but not entirely, cover over the corresponding one of the respective orifices 528, so as to direct water flow into the coolant chamber 1028 via the respective one of the upper water inlets in a front-to-rear manner as illustrated by the dashed arrow 1032. The cover plates 526 can be attached to the sidewalls of the lower portion 122 in a variety of manners, including by way of bolts or other fasteners, or by way of a snap fit.

Upon water being received into the coolant chamber 1028 via the lower and upper water inlets 522, 524, water then proceeds in a generally upward direction as indicated by an arrow 1029 toward the mid portion 120 (and ultimately to the upper portion 118) of the outboard motor 104 for cooling of other components of the outboard motor including the engine 504 as discussed further below. It should be further noted that, given the proximity of the coolant chamber 1028 adjacent to (forward of) the third transmission 616, cooling of the oil and third transmission components (including even the gears 902, 904) can be achieved due to the entry of coolant into the coolant chamber. Eventually, after being used to cool engine components in the mid portion 120 and upper portion 118 of the outboard motor 104, the cooling water is returned back down to the lower portion 122 at the rear of the lower portion, where it is received within a cavity 1033 within a cavitation plate 1034 along the top of the lower portion, and is directed out of the outboard motor via one or more orifices leading to the outside (not shown). It should be further noted that FIG. 10A, in addition to showing the cavity 1033, also shows the cavitation plate 1034 to support thereon a sacrificial anode 1036 that operates to alleviate corrosion occurring due to the proximity of the propeller 130 (not shown), which can be made of brass or stainless steel, to the lower portion 122/gear casing 206, which can be made of Aluminum.

Although in the present embodiment the cover plates 526 allow water flow in through the respective orifices 528 into the coolant chamber 1028, and additionally water flow is allowed in through the lower water inlet 522 as well, this need not be the case in all embodiments or circumstances. Indeed, it is envisioned that, in at least some embodiments, a manufacturer or operator can adjust whether any one or more of these water inlets do in fact allow water to enter the outboard motor 104 as well as the manner(s) in which water flow into the coolant chamber 1028 is allowed. This can be achieved in a variety of manners. For example, rather than employing the cover plates 526, in other embodiments or circumstances other cover plates can be used to achieve a different manner of water flow into the orifices 528 of the upper water inlets 524, or to entirely preclude water flow into the coolant chamber 1028 via the orifices (e.g., by entirely blocking over covering over the orifices). Likewise, a cover plate can be placed over the lower water inlet 522 (or the orifice formed thereby) that would partly or entirely block, or otherwise alter the manner of, water flow into the coolant chamber 1028.

Adjustment of the lower and upper water flow inlets 522, 524 in these types of manners can be advantageous in a variety of respects. For example, in some implementations or operational circumstances, the outboard motor 104 will not extend very deeply into the water 101 (e.g., because the water is shallow) and, in such cases, it can be desirable to close off the upper water flow inlets 524 so that air cannot enter into coolant chamber 1028 if the upper water flow inlets happen to be positioned continuously above or occasionally exposed above the water line 128, for example, if the water line is only at about a mid strut level 1038 as shown in FIG. 5 or even lower, further for example, at a level 1040 (which can be considered the water line or water surface for on plane speed for surfacing propellers). Alternatively, in some implementations or operational circumstances, the outboard motor 104 will extend deeply into the water, such that the water line could be at a high level 1042 (which can be considered the water line or water surface for on plane speeds for submerged propellers) above the upper water flow inlets 524. In such cases, it would potentially be desirable to have all of the lower and upper water flow inlets 522, 524 configured to allow for entry of the water 101 into the coolant chamber 1028.

Yet in still other circumstances, even with the outboard motor 104 extending deeply into the water, it can be desirable for the upper water flow inlets 524 to be configured to allow water entry therethrough and yet to block water entry via the lower water flow inlet 522, for example, if the bottom of the lower portion 122 is nearing the bottom of the body of water in which the marine vessel assembly 100 is traveling, such that dirt or other contaminants are likely to enter into the coolant chamber 1028 along with water entering via the lower water flow inlet 522 (but such dirt/contaminants are less likely to be present at the higher level of the upper water flow inlets 524). It is often, if not typically, the case that one or more of the lower and upper water flow inlets 522, 524 will be partly or completely blocked or modified by the influence of one or more cover plates, to adjust for operational circumstances or for other reasons.

Referring still to FIG. 10A, in addition to the aforementioned cooling system components, also shown are several components of the outboard motor 104 that are associated with the exhaust system. In particular, as discussed above and discussed further below, exhaust produced by the engine and delivered via the exhaust channels 512 (as shown in FIG. 5), depending upon the circumstance or embodiment, primarily or entirely directed to the lower portion 122 and into an exhaust cavity 1044 that is positioned generally aft relative to the components of the third transmission 616 (e.g., aft of the first and second gears 902, 904 and first and second pinions 910, 912), generally in a direction indicated by an arrow 1048. The exhaust cavity 1044 opens directly to the rear gear casing 206. To show more clearly the manner in which the exhaust cavity 1044 is in communication with the exterior of the outboard motor 104 (e.g., to the water 101), further FIG. 10B is provided that shows a rear elevation view 1050 of the gear casing 206 of the lower portion 122, cutaway from the remainder of the lower portion. For comparison purposes, a diameter 1052 of the gear casing 206 of FIG. 10B corresponds to a distance 1054 between lines 1056 and 1058 of FIG. 10A.

More particularly as shown in FIG. 10B, exhaust from the exhaust cavity 1044 particularly is able to exit the outboard motor 104 via any and all of four quarter section orifices 1060 (which together make up the orifice 302 of FIG. 3) surrounding the propeller driving output shaft 212 and respectively extending circumferentially around that output shaft between respective pairs of webs 1062 extending radially inward toward the crankshaft from a surrounding wall 1064 of the lower portion 122. Given the particular relationship between the cross-sectional view of FIG. 10A and the rear elevation view of FIG. 10B, two of the webs 1062 are also shown in FIG. 10A extending radially upward and downward from the propeller driving output shaft 212 to the surrounding wall 1064 of the lower portion 122. As shown, the webs 1062 also extend axially along the propeller driving output shaft 212 and along the surrounding wall 1064. It can further be noted that, in the present embodiment, a bore 1066 extends between the cavity 1033 that receives cooling water and the exhaust cavity 1044, which allows some amount of excess cooling water within the cavity 1033 to drain out of outboard motor 104 via the exhaust cavity 1044 and quarter section orifices 1060/orifice 302 (although this manner of draining coolant is not at all the primary manner by which coolant exits the outboard motor). It should be noted that such interaction with coolant, and in other locations where the coolant system interacts with the exhaust system, helps to cool the exhaust in a desirable manner.

Figure 11A:
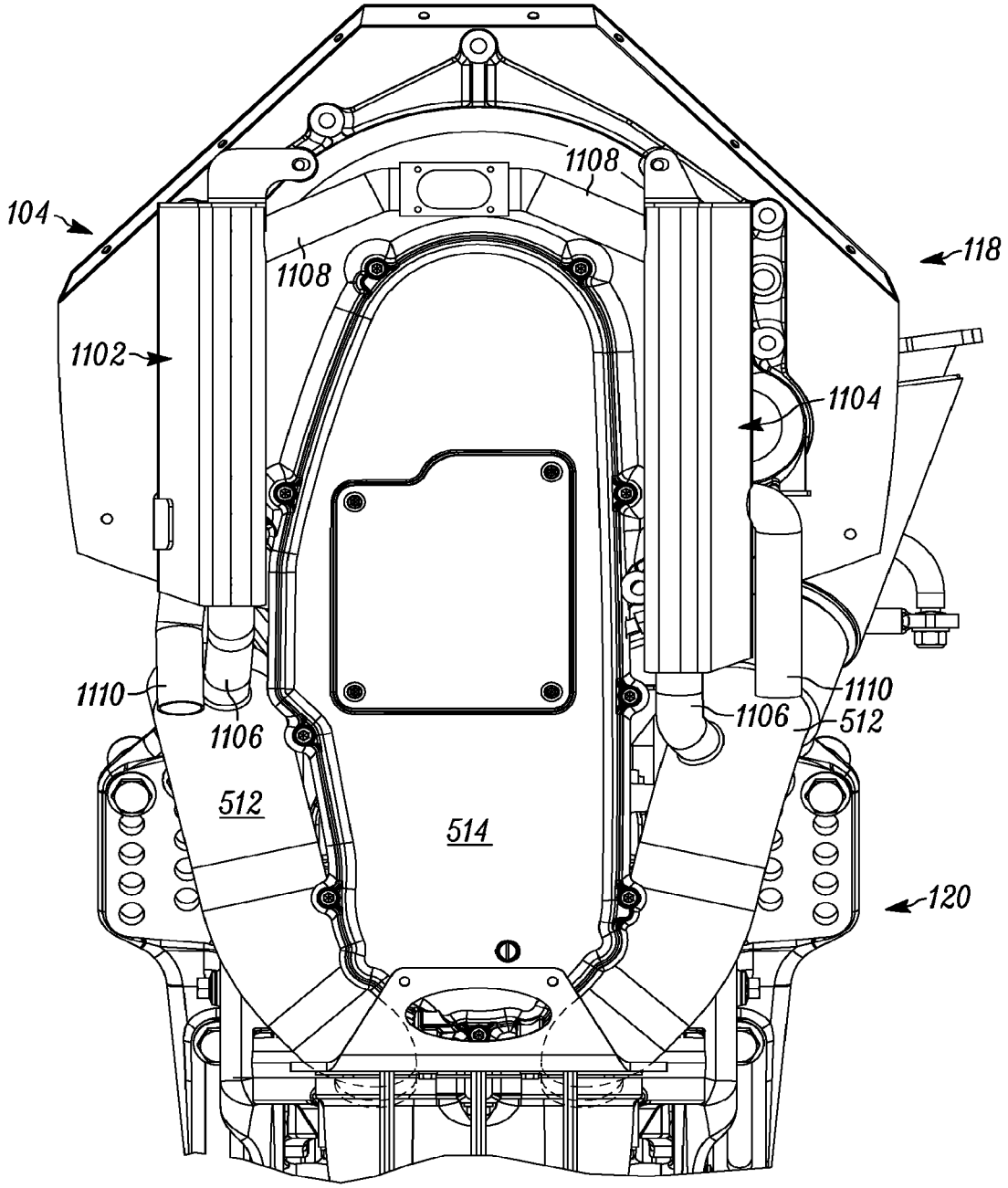
FIG. 11A is a rear elevation view of upper and mid portions of the outboard motor of FIGS. 1-3, 5, 6A and 10A-10B, shown with the cowling of the outboard motor removed to reveal internal components of the outboard motor including exhaust system components.

Turning next to FIG. 11A, several other components of the exhaust system of the outboard motor 104 are shown in additional detail by way of an additional rear elevation view of the upper portion 118 and mid portion 120 of the outboard motor, shown with the cowling 200 removed, and shown in cutaway so as to exclude the lower portion 122 of the outboard motor. In particular as shown, the exhaust conduits 512 receiving exhaust from the exhaust manifolds 510 along the right and left sides of the engine 504 (see also FIG. 5) are shown extending downward toward the lower portion 122 and the exhaust cavity 1044 described with respect to FIG. 10A.

As illustrated, the exhaust conduits 512 particularly direct hot exhaust along the port and starboard sides of the outboard motor 104, so as to reduce or minimize heat transfer from the hot exhaust to internal components or materials (e.g., oil) that desirably should be or remain cool.

Exhaust from the engine 504 is primarily directed by the exhaust conduits 512 to the exhaust cavity 1044 since exhaust directed out of the outboard motor 104 via the orifice 302 proximate the propeller 130 (not shown) is typically (or at least often) innocuous during operation of the outboard motor 104 and the marine vessel assembly 100 of which it is a part. Nevertheless, there are circumstances (or marine vessel applications or embodiments) in which it is desirable to allow some exhaust (or even possibly much or all of the engine exhaust) to exit the outboard motor 104 to the air/atmosphere. In this regard, and as already noted with respect to FIGS. 2 and 3, in the present embodiment the outboard motor 104 is equipped to allow at least some exhaust to exit the outboard motor via the exhaust bypass outlets 204. More particularly, in the present embodiment, at least some exhaust from the engine 504 proceeding through the exhaust conduits 512 is able to leave the exhaust conduits and proceed out via the exhaust bypass outlets 204. So that exhaust exiting the outboard motor 104 in this manner is not overly noisy, further in the present embodiment such exhaust proceeds only indirectly from the exhaust conduits to the exhaust bypass outlets 204, by way of a pair of left side and right side mufflers 1102 and 1104, respectively, which are arranged on opposite sides of the transfer case 514 aft of the engine 504 within which is positioned the first transmission 606. Further as shown in FIG. 11A, each of the left side muffler 1102 and right side muffler is coupled to a respective one of the exhaust conduits 512 by way of a respective input channel 1106. Each of the mufflers 1102, 1104 then muffles/diminishes the sound associated with the received exhaust, by way of any of a variety of conventional muffler internal chamber arrangements. Further, in the present embodiment, the left and right side mufflers 1102, 1104 are coupled to one another by way of a crossover passage 1108, by which the sound/air patterns occurring within the two mufflers are blended so as to further diminish the noisiness (and improve the harmoniousness) of those sound/air patterns. As a result of the operations of the mufflers 1102, 1104 individually and in combination (by way of the crossover passage 1108), exhaust output provided from the respective mufflers at respective output ports 1110 is considerably less noisy and less objectionable than it would otherwise be. The exhaust output from the output ports 1110 thus can be provided to the exhaust bypass outlets 204 (again see FIGS. 2 and 3) so as to exit the outboard motor 104.

Figure 11B:
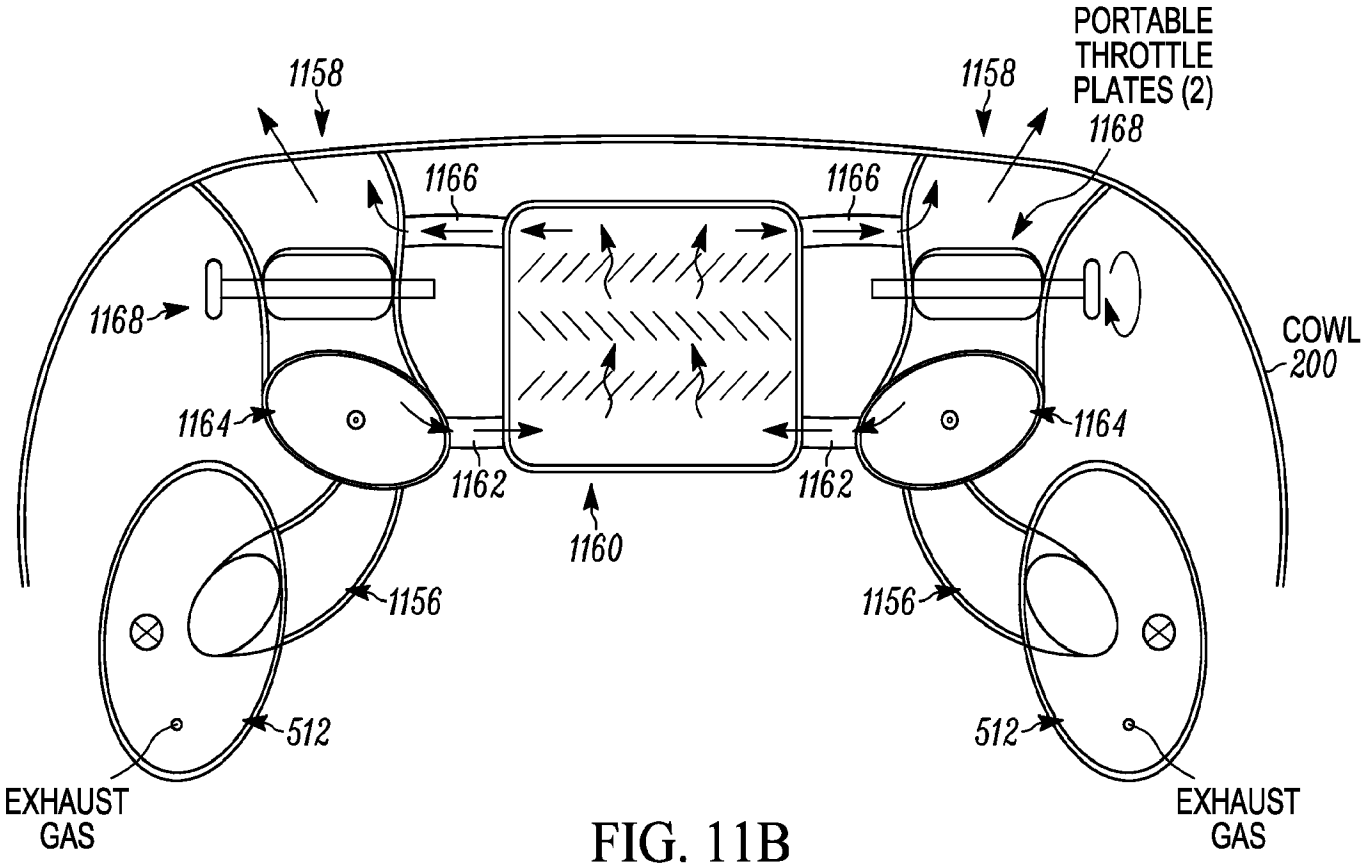
FIG. 11B illustrates various exhaust system components of the outboard motor in additional detail.

Turning to FIG. 11B, features of an alternate exhaust bypass outlet system are illustrated, which can also (or alternatively) be implemented in the outboard motor 104. In this arrangement, again the exhaust conduits 512 are shown through which exhaust flows downward to the lower portion 122 of the outboard motor. Additionally, portions of the input channels 1156 are shown that link the exhaust conduits 512 with bypass outlet orifices 1158 in the cowl 200 of outboard motor. Further as shown, an idle relief muffler 1160 is coupled to each of the input channels 1156 by way of respective intermediate channels 1162 extending between the idle relief muffler and intermediate regions 1164 of the input channels. Exhaust as processed by the idle relief muffler 1160 eventually is returned to the input channels 1156 prior to those input channels 1156 reaching the bypass outlet orifices 1158 by way of respective return channels 1166. Further, to govern the amount of exhaust passing through the input channels 1156 from the exhaust conduits 512 to the bypass outlet orifices 1158, respective rotatable (and controllable) throttle plates 1168 are positioned within the input channels 1156 in between the locations at which the respective intermediate channels 1162 encounter the respective input channels (that is, at the respective intermediate regions 1164) and the locations at which the respective return channels 1166 encounter the respective input channels. As result, the amount of exhaust that leaves the outboard motor via the orifices 1158 can be controlled, and exhaust flow can be permitted, limited, and/or completely precluded.

Figure 12:
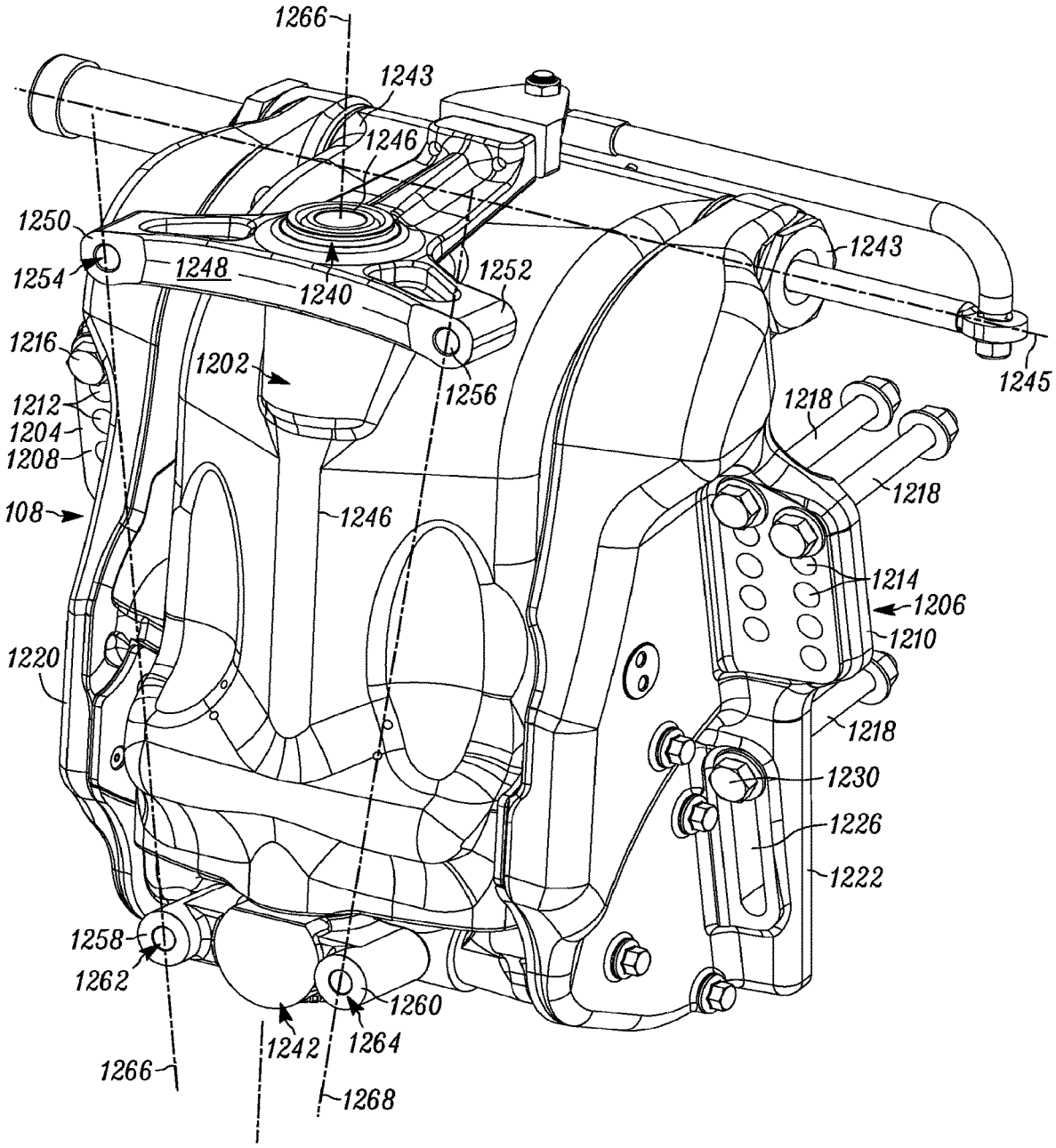
FIG. 12 is an enlarged perspective view of the exemplary mounting system in accordance with embodiments of the present disclosure.
Figure 13:
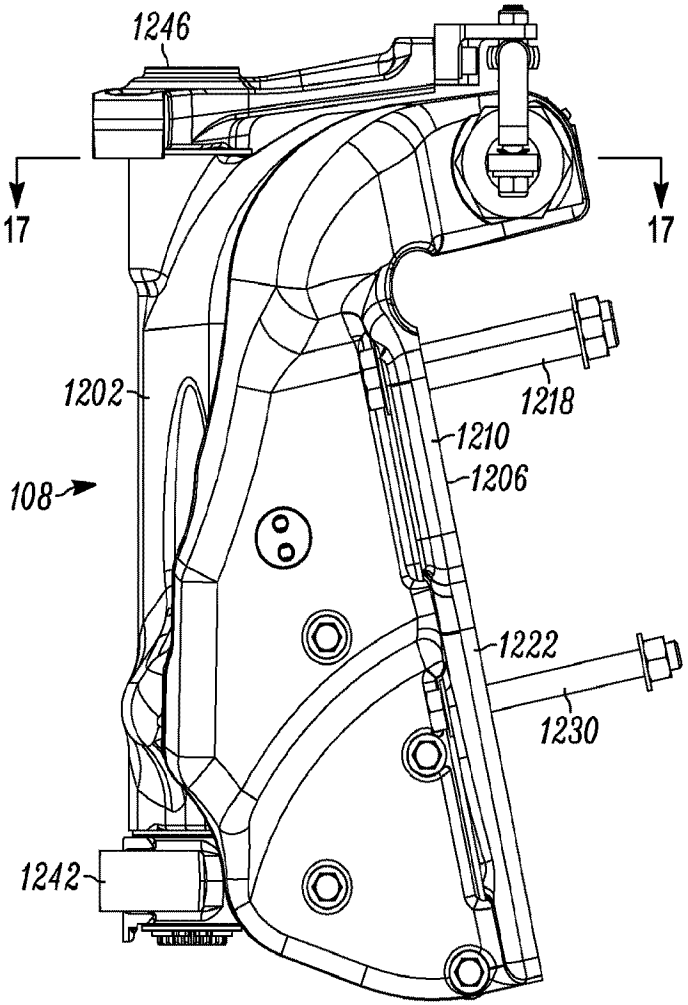
FIG. 13 is an enlarged right side elevational view of the mounting system of FIG. 12.
Figure 14:
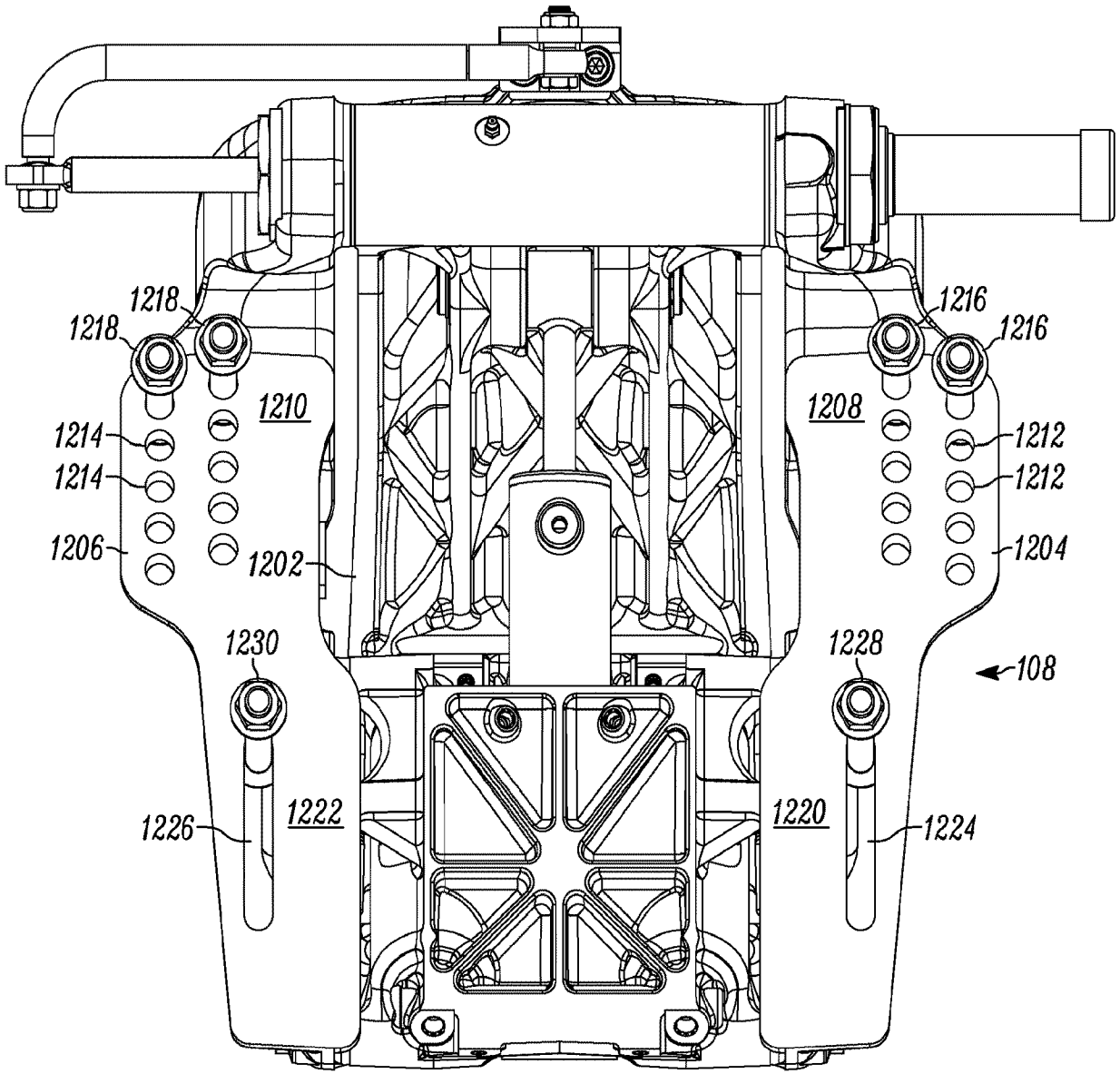
FIG. 14 is an enlarged front view of the mounting system of FIG. 12.

FIGS. 12, 13, and 14 are enlarged perspective, right side elevational, and front views, respectively, of a mounting system 108 in accordance with embodiments of the instant disclosure. Mounting system 108 generally links, or otherwise connects, an outboard motor to a marine vessel (for example, the exemplary outboard motor 104 and the exemplary marine vessel 102 shown and described in FIG. 1). More particularly, the mounting system 108 connects the outboard motor to the rear or transom area of the marine vessel and, in this way, the mounting system can also be termed a "transom mounting system". In accordance with at least some embodiments, mounting system 108 generally includes a swivel bracket structure 1202, which is cast or otherwise formed. Extending from the swivel bracket structure 1202 is a pair of clamp bracket structures 1204, 1206, respectively. In at least some embodiments, the clamp bracket structures 1204, 1206 are generally mirror images of, and thus are symmetric with respect to, one another and in this respect can be said to extend equally, or be equally disposed, with respect to the swivel bracket structure 1202. The clamp bracket structures 1204, 1206 are generally used to secure the mounting system to the marine vessel transom. In accordance with various embodiments, clamp bracket structures 1204, 1206 include respective upper regions 1208, 1210, a plurality of holes 1212, 1214 for receiving connectors or fasteners 1216, 1218. In addition, the clamp bracket structures 1204, 1206 include, respective lower regions 1220, 1222, and slots 1224, 1226, for receiving connectors or fasteners 1228, 1230. Connectors 1216, 1218, 1228, and 1230 are used to affix the clamp bracket structures 1204, 1206, and more generally the mounting system 108 to the marine vessel. Slots 1224 and 1226 provide for additional variability and/or adjustability such mounting by permitting the fasteners to be located in a variety of locations (e.g., higher or lower). Connectors 1216 and 1218 (only a few of which are shown) and 1228 and 1230 can, as shown, take the form of nut-bolt arrangements, but it should be understood that other fasteners are contemplated and can be used. Similarly, with regard to the holes 1212 and 1214, and slots 1224 and 1226, it should be understood that the size, shape, number and precise placement, among other items, can vary.

The swivel bracket structure 1202 further includes a first or upper steering yoke structure 1240, as well as a second or lower steering yoke structure 1242 that are joined by way of a tubular or substantially tubular structure 1246 (also called a steering tube structure). The first yoke structure 1240 includes a first or upper crosspiece mounting structure 1248 that is, in at least some embodiments, centered or substantially centered about the steering tube structure 1246, and the crosspiece mounting structure terminates in a pair of mount portions 1250, 1252 having passages 1254, 1256, respectively, which are used to couple the swivel bracket structure, typically via bolts or other fasteners (not shown), to the outboard engine via upper mounting brackets or motor mounts 520 (FIG. 5). The second or lower yoke structure 1242 similarly includes a pair of mount portions 1258, 1260 having passages 1262, 1264, respectively, which further couple, again typically via bolts or other fasteners (not shown), to the outboard engine, typically via lower mounting brackets or motor mounts 518 (FIG. 5) and as well be described below. A steering axis 1266 extends longitudinally along the center of steering tube structure 1246 and thereby provides an axis of rotation, which in use is typically a vertical or substantially vertical axis of rotation, for the upper and lower steering yoke structures 1240, 1242 and the swivel bracket structure 1202 to which they are joined. Swivel bracket structure 1202 is rotatable about a tilt tube structure 1243 having a tilt axis 1245 and thus also relative clamp bracket structures 1206 and 1208. The tilt axis 1245 generally is an axis of rotation or axis of pivot (e.g., permitting tiling and/or trimming about the axis), but for simplicity the axis is generally referred to simply as a tilt axis. When the outboard motor is in use, the tilt axis 1245 is typically a horizontal, or substantially horizontal, axis of rotation.

Figure 15:
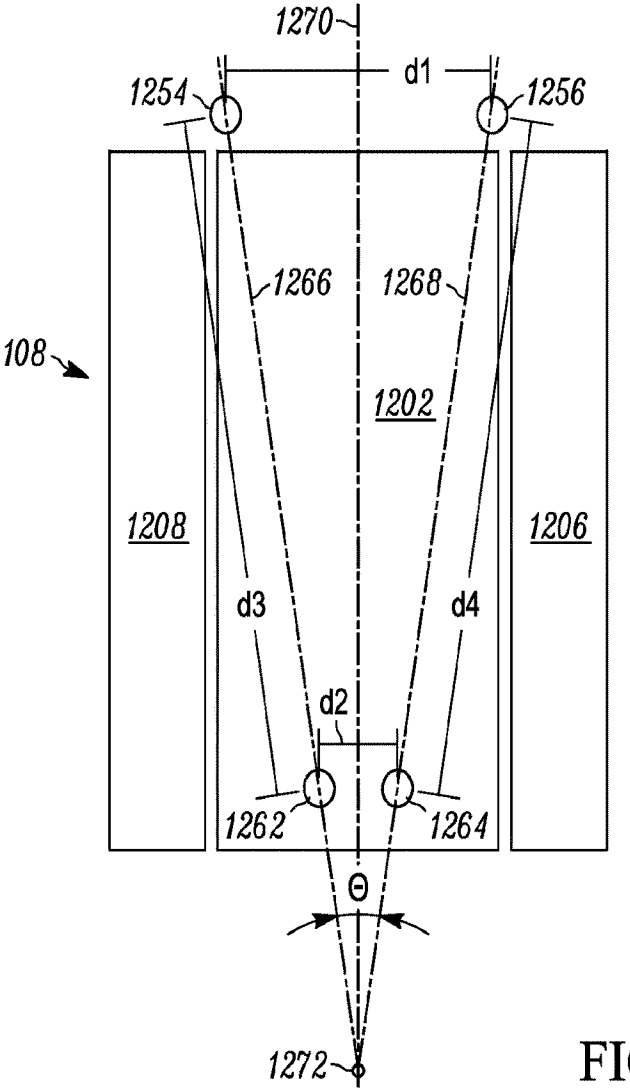
FIG. 15 is a schematic view of the mounting system of FIG. 12 generally illustrating convergence between the upper mounts and the lower mounts.

FIG. 15 is a schematic illustration of the mounting system 108 having the swivel bracket structure 1202 and clamp bracket structures 1206 and 1208. With reference to FIGS. 12 and 15. Passages 1254 and 1256 are separated by a distance "d1" and passages 1262 and 1264 are separated by a distance "d2". Similarly, passages 1254 and 1262 are separated by a distance "d3" and passages 1256 and 1264 are separated by a distance "d4". As can be seen, distance d1 is longer or greater than distance d2. It should be understood that distances d1-d4 referenced here are generally taken from centers of the respective passages which, as shown, are typically cylindrical or substantially cylindrical in shape. More generally, it should be understood that the distance separating the respective upper mounting portions is greater than the distance separating the lower mounting portions. In addition, other shapes for the passages are contemplated and the relative position for establishing the respective distances can vary to convenience. And more generally, connections can be accomplished using other structures besides passages, or external fastening mechanisms, and such modifications are contemplated and considered within the scope of the present disclosure.

An axis 1266 is illustrated to extend between passages 1264 and 1266 and further, and axis 1268, is depicted to extend between passages 1256 and 1264. For illustrative purposes, a center axis 1270 is provided bisecting the distances d1 and d2. As can be seen, by axes 1266 and 1268 converge on axis 1270, as shown, at a point of convergence 1272 located below or beyond yoke structure 1242 and an angle theta is established between these axes. Advantageously, having a distance d1 larger than d2 increases steering stability. More particularly, when the swivel bracket structure 1202 is coupled to a horizontal crankshaft engine of the kind described herein, resultant roll torque is reduced or minimized.

It is noted that while in the instant embodiment both the upper and lower yoke structures include a pair of passages, it should be understood that this can vary but yet still provide for the aforementioned convergence. For example, the lower yoke structure could include only a single mounting portion, with the single mounting portion (which again can include a passage) for mounting the yoke structure to swivel bracket structure located below and between the pair of upper mounting portions of the first or upper steering yoke structure such that the there is a similar convergence from the upper mounting portions to the lower mounting portion. In at least one embodiment the single mount portion would be generally situated, and in at least some instances centered about, the steering axis.

Figure 16:
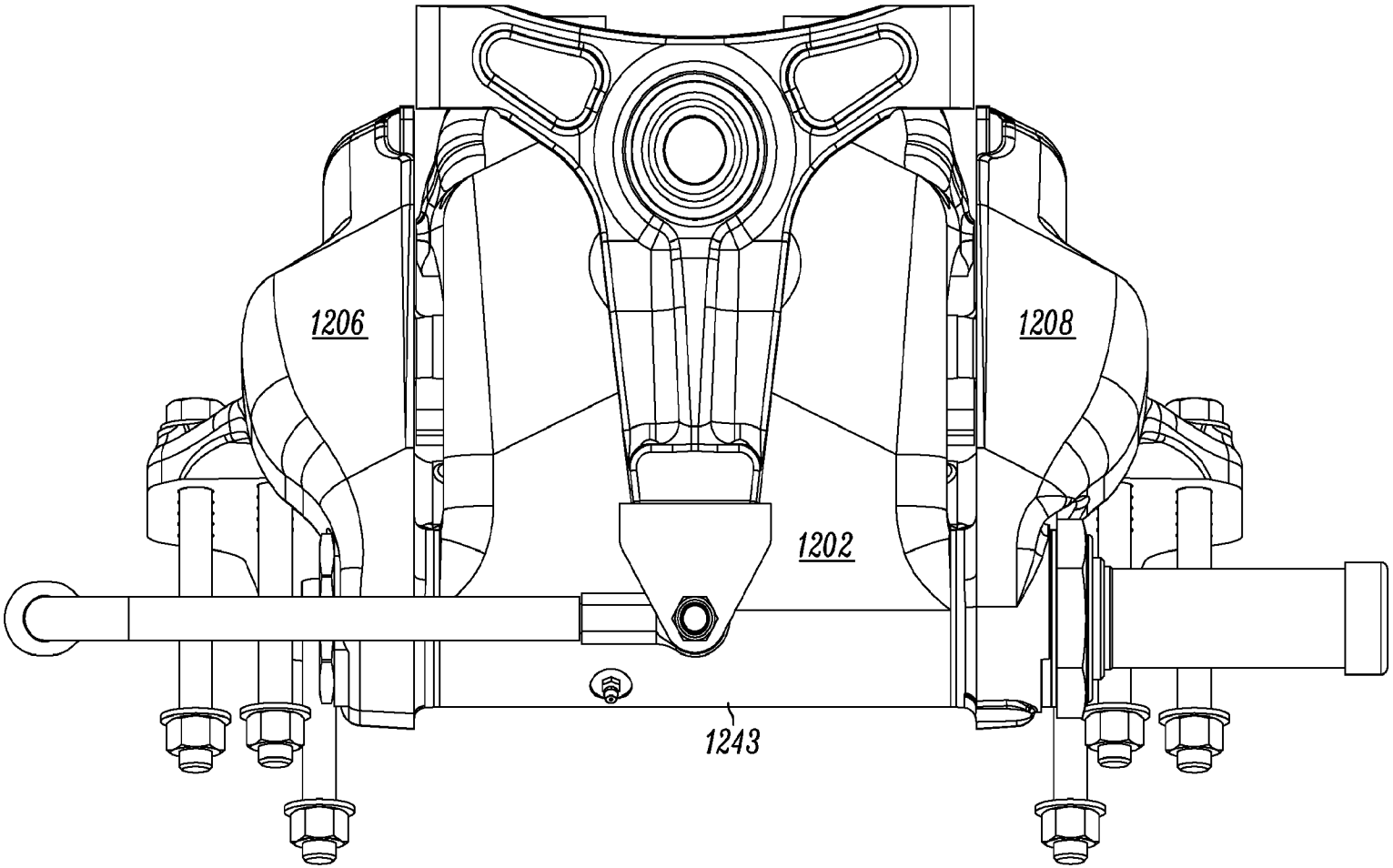
FIG. 16 is an enlarged top view of the mounting system of FIG. 12.
Figure 17:
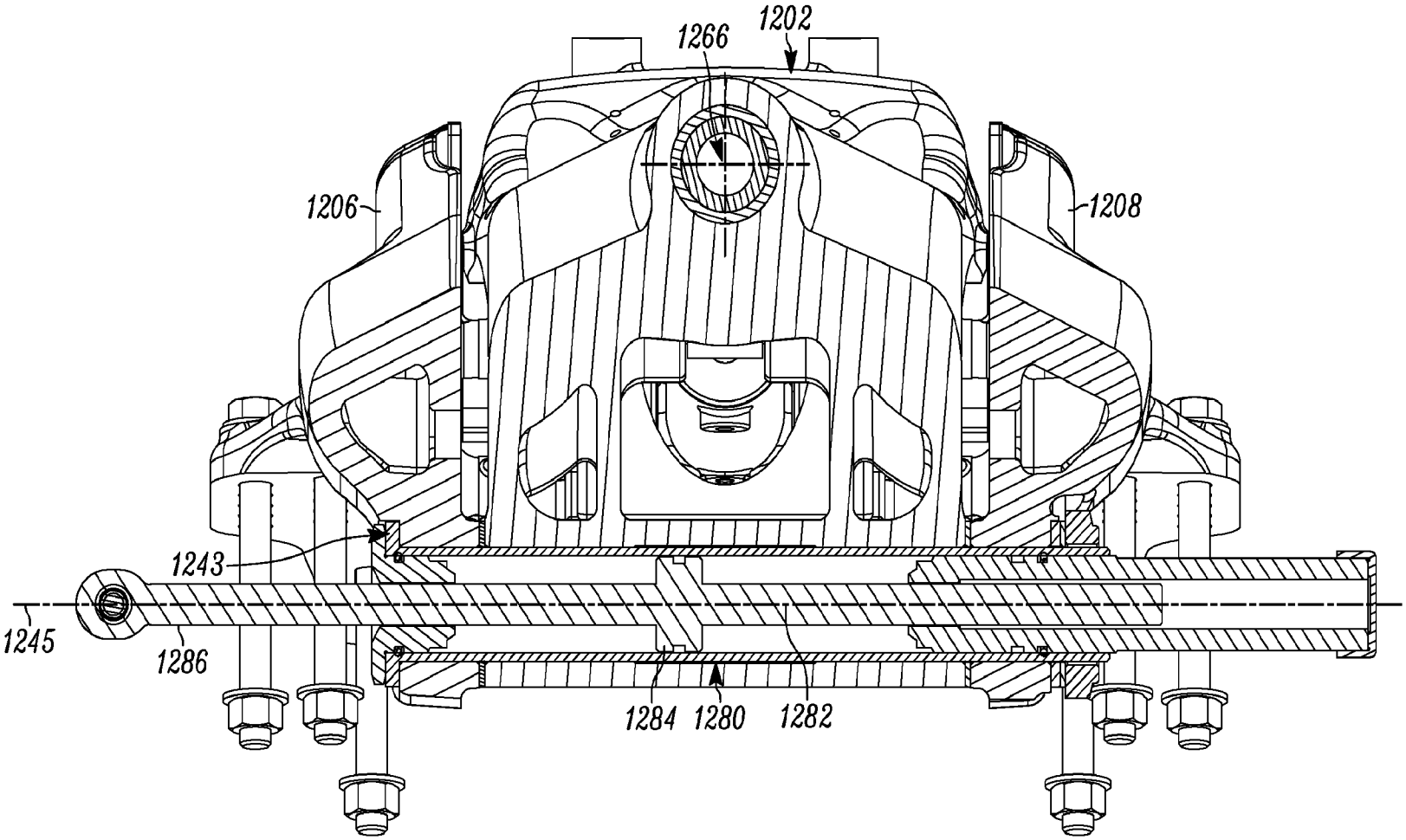
FIG. 17 is a cross sectional view taken along line 17-17 of FIG. 13 and/or through a tilt tube structure of the mounting system of FIG. 12.

Referring to FIG. 16, an enlarged top view of the mounting system 108 of FIG. 12 is shown. FIG. 17 illustrates a cross sectional view of the mounting system of FIG. 12 along or through tilt tube structure 1243. The tilt tube 1243 further provides a housing for a power steering cylinder 1280 having a central axis 1282 that coincides, or substantially coincides, with the tilt axis 1245. The power steering cylinder includes a power steering piston 1284 that translates or otherwise moves within the steering cylinder 1280 in response to power steering fluid (e.g., hydraulic fluid) movement. Actuation of the steering cylinder 1280 provides translation of a steering arm mechanism 1286 to actuate steering of the swivel bracket structure 1202 about the steering axis 1266. Positioning the power steering cylinder inside the tilt tube, the need for additional mounting space for the power steering components is eliminated. Further, such positioning accommodates the scaling of the structures, with the relative trim tube and power steering tube structure size typically related (e.g., based on engine size, vessel sized, etc.).

Several other considerations can be noted in relation to the power steering operation of the outboard motor 104. For example, in accordance with the present embodiment, a tilt tube structure (or, more generally a "tilt structure") surrounds a power steering actuator, the actuator comprising a hydraulic piston. However, it should be understood that, in accordance with alternative embodiments, a variety of actuators can be used, including by way of example, an electronic linear actuator, a ball screw actuator, a gear motor actuator, and a pneumatic actuator, among others. Various actuators can also be employed to control tilting/trimming operation of the outboard motor 104.

It should further be noted that the degree of rotation (e.g., pivoting, trimming, tilting) that can take place about a tilt tube structure axis of rotation (or more generally a "tilt structure axis of rotation") can vary depending upon the embodiment or circumstance. For example, in accordance with at least some embodiments, trimming can typically comprise a rotation of from about −5 degrees from horizontal to 15 degrees from horizontal, while tilting can comprise a greater degree of rotation, for example, from about 15 degrees from horizontal to about 70 degrees from horizontal. Further, it can be noted that, as the power steering structure (or other actuator) size is increased, the tilt tube structure that at least partially surrounds or houses the power steering structure is increased. Such increase in size of the tilt tube structure generally increases the strength of the tilt tube structure. The tilt tube structure can be constructed from steel or other similarly robust material.

Figure 18:
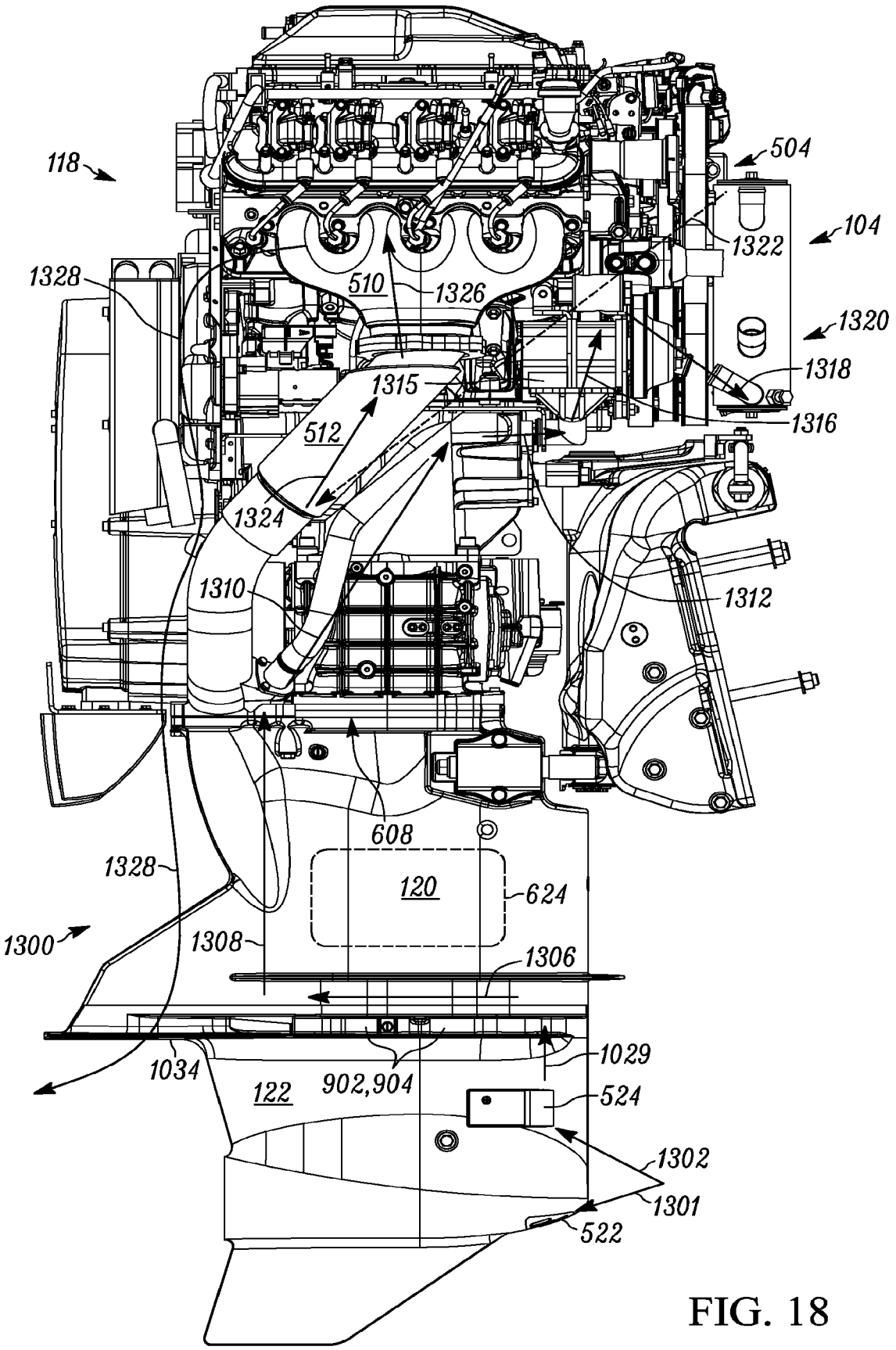
FIG. 18 is a right side view of the outboard motor showing an illustrative outboard motor water cooling system in accordance with embodiments of the present disclosure.

FIG. 18 is a right side view of outboard motor 104 showing an illustrative outboard motor water cooling system 1300 in accordance with various embodiments of the present disclosure. Cooling water flows throughout the motor to cool various components as shown and described, and such cooling water flow is generally represented by various arrows. As previously described in detail with respect to FIG. 10A, the outboard motor 104 receives/intakes, indicated by arrows 1301, 1302 into the lower portion 122 some of the water 101 (see FIG. 1) via multiple water inlets 522, 524, respectively. Cooling water then proceeds generally upwardly, as indicated by an arrow 1029, toward and into the mid portion 120 of the outboard motor 104 to provide a cooling affect. In accordance with at least some embodiments and as shown, cooling water proceeds generally rearwardly and then generally upwardly (e.g., vertically or substantially vertically) as indicated by an arrows 1306 and 1308, respectively, in the mid portion 120 past the second transmission oil reservoir 624 (shown in phantom) and gears 902 and 904 (which can be considered part of the lower portion 122) and thereby cools the oil in the reservoir and the gears.

Cooling water traverses generally upwardly, as indicated by arrow 1310, past, and in so doing cools, the second transmission 608, and into the upper portion 118, which includes the engine 504. More specifically, and in accordance with at least some embodiments, cooling water traverses forwardly, as indicated by arrow 1312 to a water pump 1315 where it proceeds, in the embodiment shown, upwardly, as indicated by arrow 1316. Water that is pumped by the water pump 1315 exits the water pump, after doing so, flows, as indicated by arrow 1318, into and through, so as to cool, an engine heat exchanger and an engine oil cooler, which are generally collectively referenced by numeral 1320. The engine heat exchanger and engine oil cooler 1320 serve to cool a heat exchanger fluid (e.g., glycol, or other fluid) and oil, respectively, within or associated with the engine 504 and at least in these ways accomplish cooling of the engine. A circulation pump circulates the cooled glycol (or other fluid) within the engine 504.

After exiting the engine heat exchanger and engine oil cooler 1320, water flows generally downwardly, toward and into a chamber surrounding the exhaust channels 512 (one of which is shown), as indicated by arrow 1322, where it then flows back upwardly, as indicated by arrows 1324, 1326, into the exhaust manifold 510. It is noted that, while in the chamber (not shown) surrounding the exhaust channels 512, cooling water runs in a direction counter to the direction of exhaust flow so as to cool the exhaust, with such counter flow offering improved cooling (e.g., due to the temperature gradient involved). From the exhaust manifold 510, cooling water flows downwardly, as indicated by arrow 1328, through the mufflers 1102, 1104 and past the first transmission 514 and, in so doing, cools the mufflers and the transmission. Cooling water continues to proceed out of the outboard motor 104 and into the sea, typically via the cavitation plate 1034 along the top of the lower portion 122.

From the above description, it should be apparent that the cooling system in at least some embodiments actually includes multiple cooling systems/subsystems that are particularly (though not necessarily exclusively) suited for use with outboard motors having horizontal crankshaft engines such as the outboard motor 104 with the engine 504. In particular, in at least some embodiments, the outboard motor includes a cooling system having both a closed-loop cooling system (subsystem), for example, a glycol-cooling system of the engine where the glycol is cooled by the heat exchanger. This can be beneficial on several counts, for example, in that the engine need not be as expensive in its design in order to accommodate externally-supplied water (seawater) for its internal cooling (e.g., to limit corrosion, etc.). At the same time, the outboard motor also can include a self-draining cooling system (subsystem) in terms of its intake and use of water (seawater) to provide coolant to the heat exchanger (for cooling the glycol of the closed-loop cooling system) and otherwise, where this cooling system is self-draining in that the water (seawater) eventually passes out of/drains out of the outboard motor 104. Insofar as the engine 504 includes both a closed-cooling system and a self-draining cooling system, the engine includes both a circulation pump for circulating glycol in the former (distinctive for an outboard motor) and a water (e.g., seawater) pump for circulating water in the latter. High circulation velocity is achievable even at low engine speeds. Further by virtue of these cooling systems (subsystems), enhanced engine operation is achievable, for example, in terms of better thermally-optimized combustion chamber operation/better combustion, lower emission signatures, and relative avoidance of hot spots and cold spots.

Many modifications to the above cooling system 1300 (and associated cooling water flow circuit) are contemplated and considered within the scope of the present disclosure. For example, the water pump 135, or an additional water pump, can be provided in the lower portion 122 (e.g., in a lower portion gear case) to pump water from a different location. In addition, and as already noted, various modifications can be made engine components and structures already described herein, including their placement, size, and the like and the above-described cooling system can be modified account for such changes.

Figure 19:
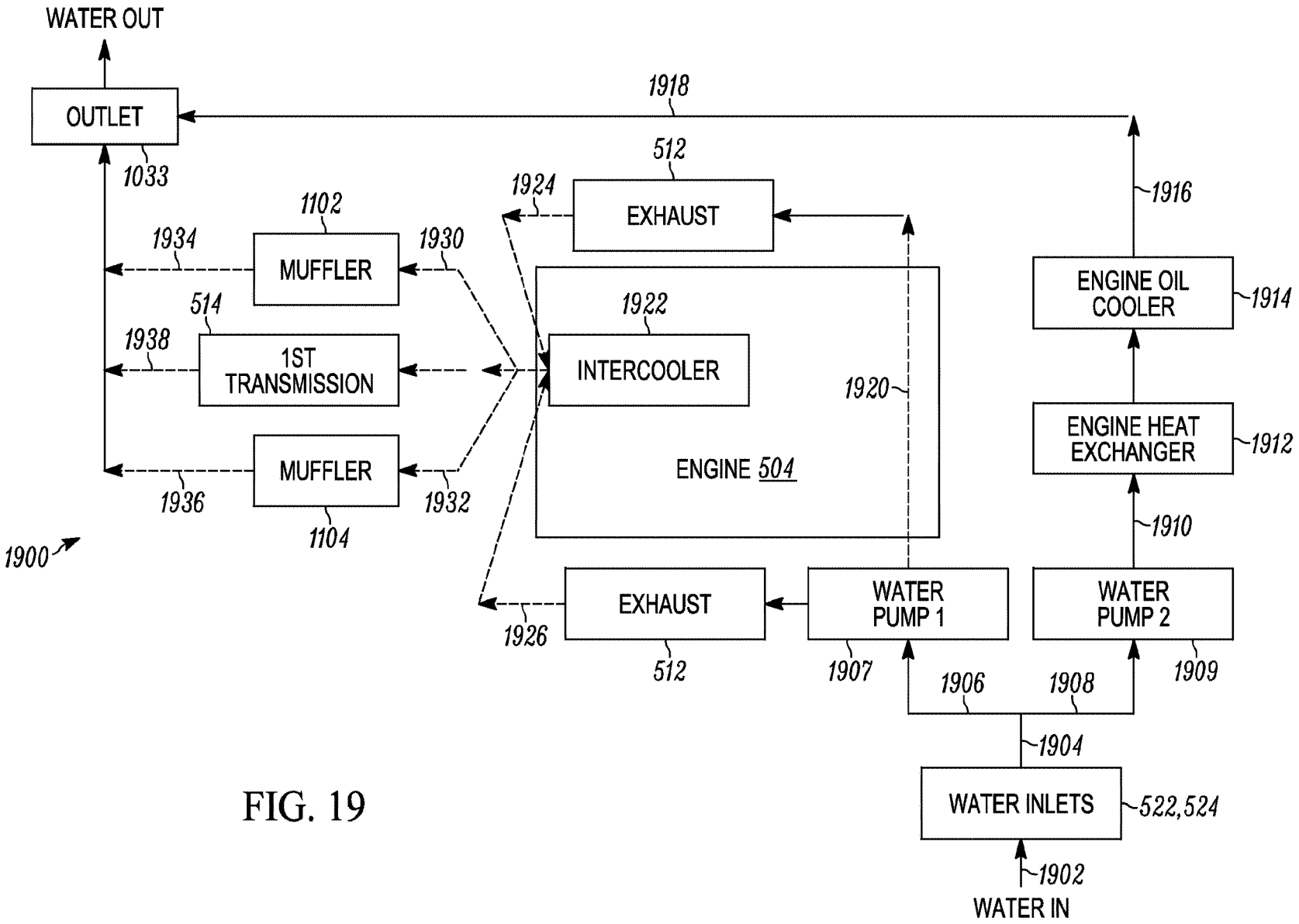
FIG. 19 is a schematic illustration of an alternative arrangement for an outboard motor water cooling system, in accordance with embodiments of the present disclosure.

FIG. 19 is a schematic illustration of an alternative arrangement for an outboard motor water cooling system 1900, in accordance with various embodiments of the present disclosure. In the present illustration, cooling water flow is again represented by various arrows. As shown, cooling water flows, as indicated by arrow 1902, into the water inlets 522, 524. In the instant exemplary embodiment, cooling water flows, as indicated by arrow 1904 and arrows 1906 and 1908, to first and second water pumps 1907, 1909 and, in so doing, cools the pumps. Water that is pumped by the water pump 1907 exits the water pump and, after doing so, flows, as indicated by arrow 1910, into and through an engine heat exchanger 1912 and then an engine oil cooler 1914. While shown as separate coolers, it is understood that the engine heat exchanger 1912 and the engine oil cooler 1914 can be integrated as a collective unit (e.g., as described with regard to FIG. 18). The engine heat exchanger 1912 serves to cool engine coolant (e.g., glycol, or similar fluid), and the engine oil cooler 1914 serves to cool oil, and at least in these ways cooling of the engine 504 is accomplished. After exiting the engine heat exchanger 1912 and engine oil cooler 1914, cooling water flows, as indicated by arrows 1916 and 1918 out to the sea, via a cavity 1033, which can be located within the cavitation plate in the lower portion 122.

In addition to, or in parallel with the cooling of the engine heat exchanger 1912 and the engine oil cooler 1914 as just described, water is pumped by the water pump 1907 and proceeds into a chamber (not shown) surrounding the exhaust channels 512. In so doing cools exhaust flowing within the channels. In at least some embodiments, the cooling water generally traverses, as indicated by 1920, the engine 504, and it is noted that such water flow may, but need not necessarily, serve to provide a cooling effect for the engine. Cooling water then flows to and cools the intercooler 1922 (or charge cooler) as indicated by arrow 1924, 1926. As indicated by arrows 1930, 1932, cooling water flows through the mufflers 1102, 1104, as well as past the first transmission 514, and in so doing, the mufflers and the first transmission are cooled. Finally water proceeds, as indicated by arrows 1934, 1936 from the mufflers 1102, 1104, as well as from the first transmission 514, as indicated by arrow 1938, out of the outboard motor to the sea, for example, via a cavity 1033.

Again, it is noted that many modifications to the above cooling systems are contemplated and considered within the scope of the present disclosure. For example, cooling of the intercooler 1922 can be separated from the cooling of the exhaust channels, the mufflers and the first transmission. An additional water pump and an additional heat exchanger (e.g., a dedicated heat exchanger) can be provided to accomplish such separated cooling of the intercooler 1922 (and associated cooling passages), allowing for the intercooler utilize a lighter fluid, such as glycol. Again, various modifications can be made engine components and structures already described herein, including respective placement, size, and the like and the above-described cooling system 1900 can be modified account for such changes.

Figure 20:
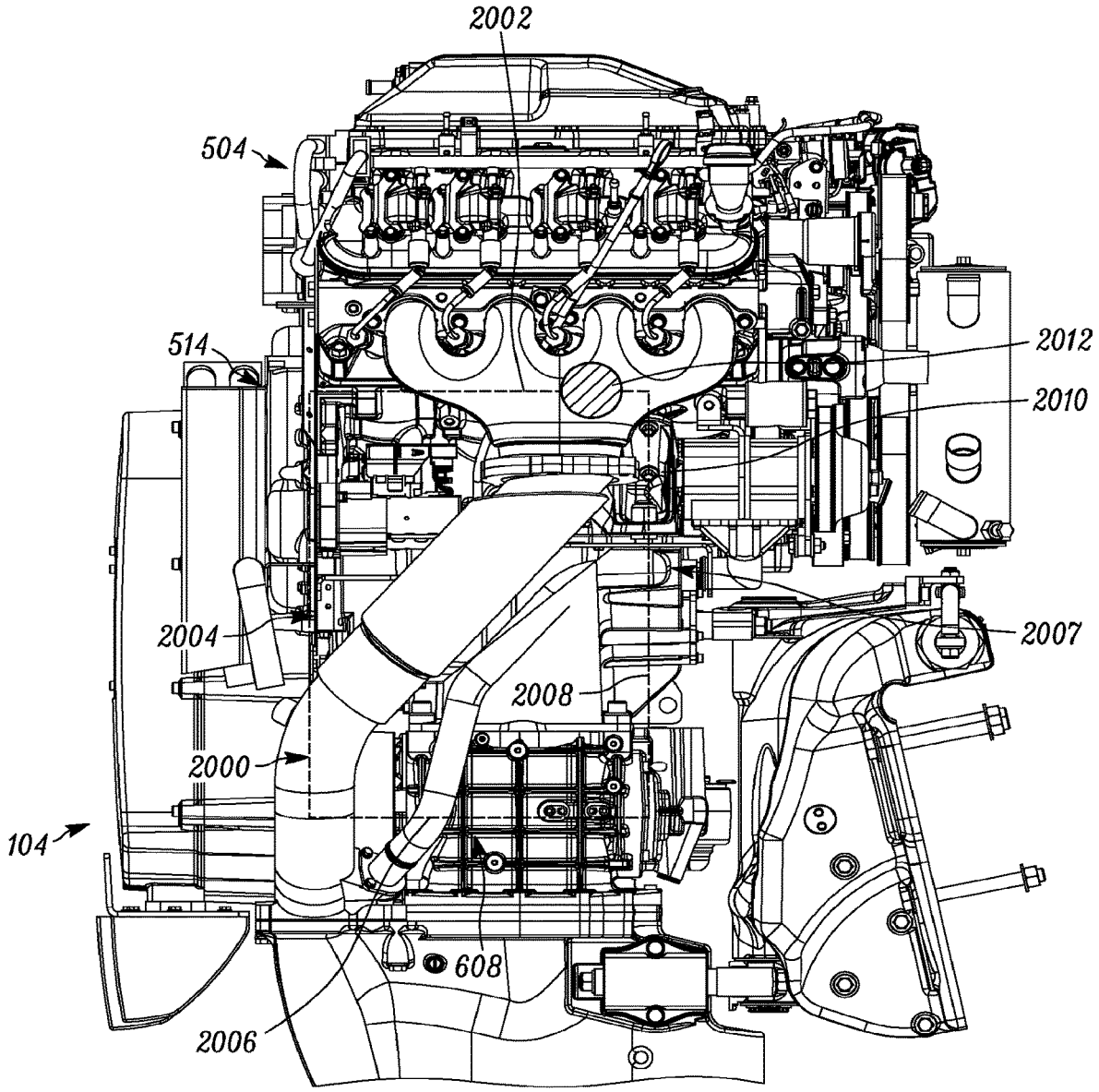
FIG. 20 is a right side view of the outboard motor including a rigid connection of multiple motor components or structures to create a rigid structure in accordance with embodiments of the present disclosure.

FIG. 20 is a right side view of the outboard motor 104 including a rigid connection of multiple motor components or structures to create a rigid structure or rigid body structure, indicated by dashed line 2000, and related method of assembly of the rigid structure, is shown in accordance with embodiments of the invention. The outboard motor can include a horizontal crankshaft engine 504. The engine 504 (or a surface or portion of the engine), can be bolted or otherwise connected to the first transmission 514 (or a surface or portion of the first transmission). The engine 504 is oriented horizontally, or substantially horizontally, and a horizontal plane representative of such orientation is indicated illustratively by horizontal dashed line 2002. The first transmission 514 is oriented vertically, or substantially vertically, and a vertical plane representative of such orientation is indicated illustratively by vertical dashed line 2004. The first transmission 514 (or a surface or portion of the first transmission) can be bolted or otherwise connected to the second transmission 608 (or a surface or portion of the second transmission). The second transmission 608 is oriented horizontally, or substantially horizontally, and a horizontal plane representative of such orientation is indicated illustratively by horizontal dashed line 2006. And the second transmission 608 (or a surface or portion of the second transmission, such as a cover portion) can be bolted or otherwise connected to the engine 504 (or a surface or portion of the engine) by way of a vertically oriented additional structure 2007, which can take the form of, for example, a cast motor structure or frame portion. A vertical, or substantially vertical, plane representative of such orientation is indicated illustratively by vertical dashed line 2008.

Rigid body structure 2000 thus is created by the interaction of these four structures engaged with one another. In accordance with at least one aspect and in the present illustrated embodiment, rigid body structure 2000 is rectangular or substantially rectangular in shape. Fastener 2010 is provided. Fastener 2010 permits adjustability needed (e.g., due to manufacturing tolerances and other variations) in the assembly of rigid body structure 2000 and particularly allows for variation in the spacing between the forwardmost portion of the engine and the forward most portion of the second transmission, that is, the spacing afforded by the additional structure 2007. In accordance with at least some embodiments, the center of gravity 2012 of the outboard motor 504 is located between the vertical (or substantially vertical) planes 2008 and 2004 of the rigid body structure 2000 and substantially at the plane 2002 of the engine 504. Creation and position of the rigid body structure 2000 in accordance with embodiments of the invention, including those which are illustrated, is particularly beneficial in that it offers resistance to bending and torsional moments (or similar stresses) which may result during operation of the outboard motor 504.

Figure 23C:
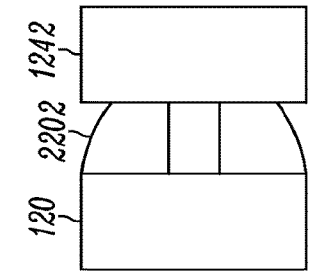
FIGS. 23A-C are schematic illustrations depicting a portion of the progressive mounting structure of FIG. 21 in operation.
Figure 23B:
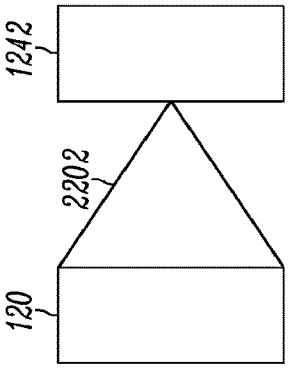
Figure 23A:
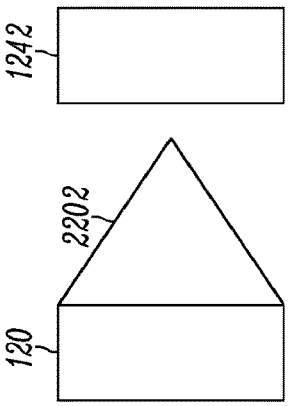
Figure 21:
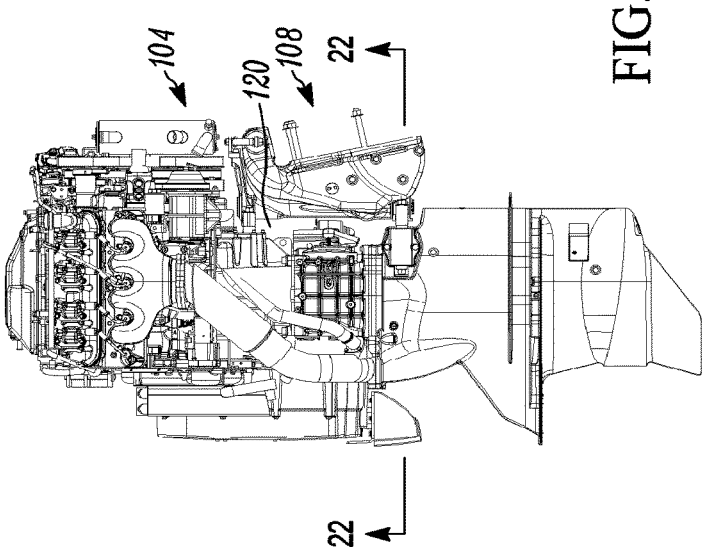
FIG. 21 is a reduced right side view of the outboard motor and a mounting system for mounting the outboard motor to a marine vessel.
Figure 22:
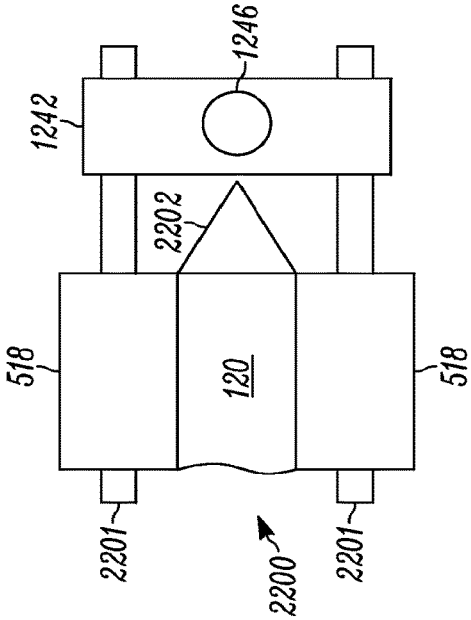
FIG. 22 is a schematic cross sectional view, taken along line 22-22 of FIG. 21, showing a progressive mounting assembly.

FIG. 21 is a reduced right side view of the outboard motor 104 and a mounting system 108, the mounting system being used to mount the outboard motor to a marine vessel as previously described. FIG. 22 is a schematic cross sectional view, taken along line 22-22 of FIG. 21, showing a progressive mounting assembly 2200. FIG. 22 shows the lower steering yoke structure 1242 mounted or otherwise connected to the lower mounting bracket structure 518 by way of bolts or other fasteners 2201 so that the mid portion 120 of the outboard motor 104 is linked to the mounting system 108. Also shown is steering tube structure 1246 which provides, as already described, for rotation of the mounting system 108 about the steering axis. A thrust mount structure 2202 is further provided between the mid portion 120 and the lower steering yoke structure 1246. Taken together, it can be seen that the progressive mounting assembly includes the lower steering yoke structure 1242, the lower mounting bracket structure 518, and the thrust mount structure 2202, FIGS. 23A-C are schematic illustrations depicting the progressive nature of the progressive mounting structure 2200 of FIG. 21 at various levels of operation. With references to FIG. 23A in particular, along with FIGS. 21 and 22, the progressive mounting structure 2200 is shown at an operational level having a low load (e.g., the motor 504 powers the marine vessel 102 at a slow or very slow speed) powering a watercraft. Accordingly, thrust mount structure 2202, which is disposed relative to, and possibly directly contacting motor mid portion 120, but with a space or air gap separating the thrust mount structure 2202 from the lower yoke assembly 1242.

With references to FIG. 23B in particular, along with FIGS. 21 and 22, the progressive mounting structure 2200 is shown at an operational level having a medium load (e.g., the motor 504 powers the marine vessel 102 at a medium or mid level speed). Accordingly, thrust mount structure 2202, which is disposed relative to, and possibly directly contacting motor mid portion 120, now contacts the lower yoke assembly 1242. That is, the thrust mount structure 2202 has moved relative the lower yoke assembly 1242 (e.g., such relative movement is permitted by way of the fasteners 2201), and the space or air gap previously separating the thrust mount structure 2202 from the lower yoke assembly 1242 is eliminated.

With references to FIG. 23C in particular, along with FIGS. 21 and 22, the progressive mounting structure 2200 is shown at an operational level having a high load (e.g., the motor 504 powers the marine vessel 102 at a high speed). Accordingly, thrust mount structure 2202, which is disposed relative to, and possibly directly contacting motor mid portion 120. The space or air gap previously separating the thrust mount structure 2202 from the lower yoke assembly 1242 is eliminated and the thrust mount structure 2202 contacts the lower yoke assembly 1242. The thrust mount structure 2202 is shown in a deformed state because it now serves to transfer force created by the high level of operation.

It should be understood that the aforementioned progressive mounting system previously described is illustrative in nature and various alternatives and modifications to the progressive mounting system can be made. Also, the progressive mounting structure facilitates changes to the thrust mount structure. For example, a thrust mount structure can, with relative ease, be removed and replaced with another thrust mount having different characteristics, such as a different size, shape or stiffness. Advantageously, the progressive mounting system is capable of being tuned or changed to accommodate a wide range (from very low to very high) of thrust placed on the system in a manner that is compact and suitable for a wide variety of outboard motor mounting applications.

Figure 24:
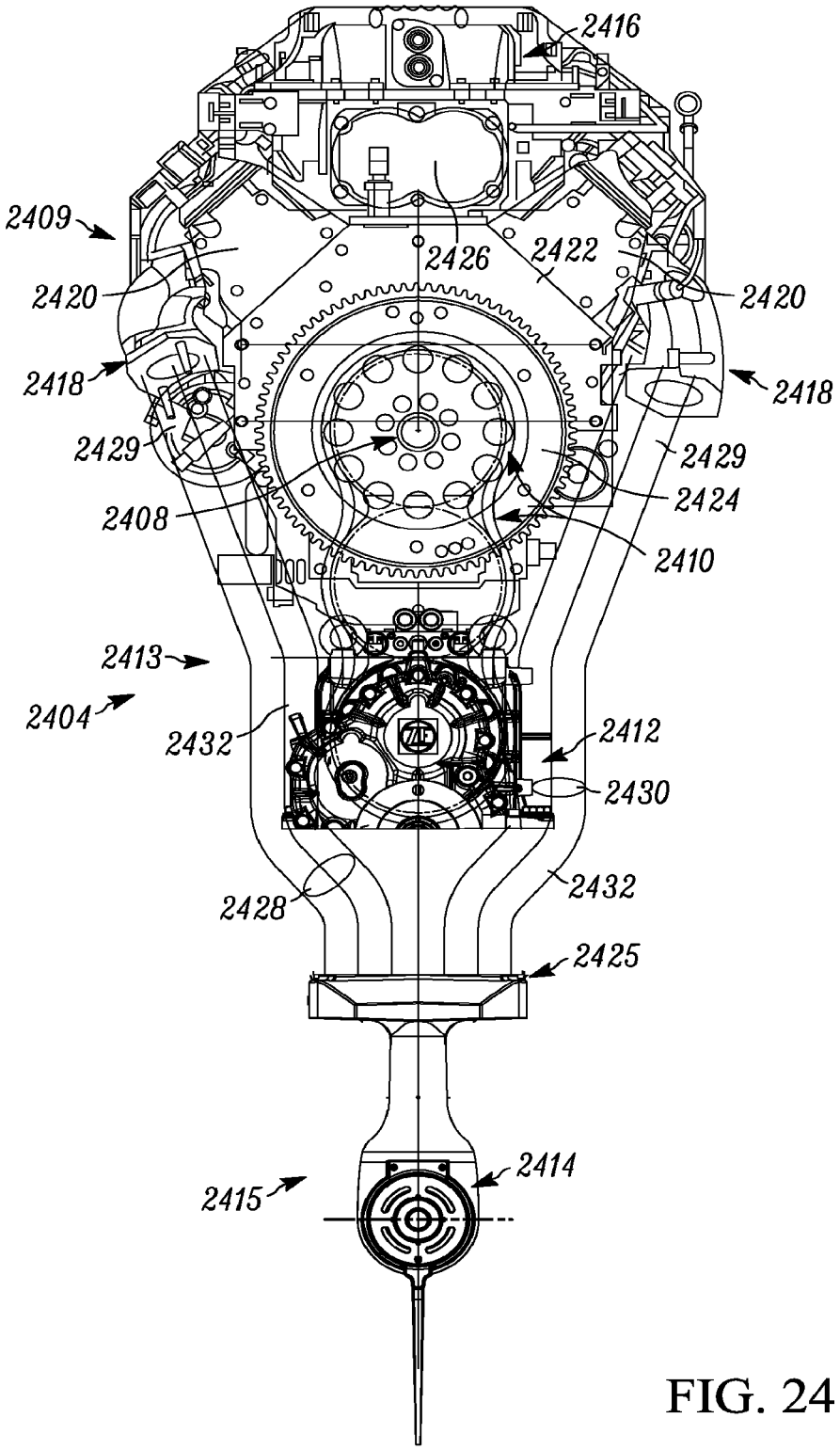
FIG. 24 is a rear elevation view of example structural support components and other components of an alternate embodiment of the outboard motor.

From the above discussion, it should be apparent that numerous embodiments, configurations, arrangements, manners of operation, and other aspects and features of outboard motors and marine vessels employing outboard motors are intended to be encompassed within the present invention. Referring particularly to FIG. 24, a rear elevation view is provided of internal components one alternate embodiment of an outboard motor 2404. In this embodiment, as with the outboard motor 104, there is a horizontal crankshaft engine 2406 with a rearwardly-extending crankshaft extending along a crankshaft axis 2408 at an upper portion 2409 of the outboard motor, a first transmission having an outer perimeter 2410, a second transmission 2412 within a mid portion 2413 of the outboard motor, and a third transmission 2414 at a lower portion 2415 of the outboard motor. Also, there is an intake manifold 2416 atop the engine 2406, exhaust manifold ports 2418 extending outward from port and starboard sides of the engine, and both cylinder heads 2420 of the engine and an engine block 2422 of the engine are visible, as is a flywheel 2424 mounted adjacent the rear of the engine. A gearcase mounting flange 2425 is further illustrated that can be understood as dividing the lower portion 2415 from the mid portion 2413, albeit it can also be understood as within the lower portion only. Further, in this embodiment, a supercharger 2426 is positioned above the engine block 2422 between the cylinder heads 2420. Although not shown, in still another embodiment a turbocharger can instead be positioned at the location of the supercharger 2426 or, further alternatively, one or more turbochargers can be positioned at locations 2429 beneath the manifold ports 2418.

Although in the embodiment of FIG. 24, port and starboard tubular exhaust conduits 2428 and 2430 extend downward (similar to the exhaust conduits of the engine 104) from the exhaust manifold ports 2418 to the lower portion 2415. However, in the embodiment of FIG. 24, the tubular exhaust conduits serve as more than merely conduits for exhaust. Rather, in the embodiment of FIG. 24, the tubular exhaust conduits collectively serve as a tubular mounting frame 2432 for the outboard motor 2404. In particular, the tubular mounting frame 2432 is capable of connecting the upper portion 2409, the mid portion 2413, and lower portion 2415 of the outboard motor 2404 with one another. Further, in still other embodiments, in addition to or instead of conducting exhaust, one or more tubes of such a tubular mounting frame can conduct coolant or other fluids as well.

From the above discussion, it should be understood therefore that the present invention is intended to encompass numerous features, components, characteristics, and outboard motor designs. Among other things, in at least some embodiments, the outboard motors encompassed herein are designed to be fastened to the aft end of a boat or other marine vessel (e.g., the transom) and to power or thrust the marine vessel through the use of a horizontal crankshaft engine. Further, in at least some embodiments, the outboard motors employ an engine that is coupled to a first transmission, a second transmission, and a third transmission, and/or is capable of steering about a steering axis and/or being rotatably trimmed about a trim axis. Further, in at least some embodiments, the outboard motor includes three portions, namely, upper, middle, and lower portions.

Also, in at least some embodiments, the engine is mounted above the transom with the crankshaft centerline substantially horizontal and substantially parallel to a keel longitudinal axis of the boat (parallel to the keel line or other bow-to stern axis) when trimmed to a nominal angle of 0 degrees (the steering axis can be perpendicular a sea level surface). The engine power take off (PTO) faces aft and rotatably drives a first transmission that transfers torque downwardly to a second transmission, which transmits torque through and 90 degree corner and then into a vertical output shaft than can be also be termed a driveshaft. The driveshaft transmits the torque to a third transmission, typically within a gearcase, which directs the torque into a horizontal propeller shaft where a propeller transfers the torque into thrust. The horizontal propeller shaft is typically located at or below the surface of the water so as to enable single or counter-rotating twin propellers. In at least some embodiments, the architecture of the outboard motor is intended to achieve good balance on the transom of the boat/marine vessel, good vibration isolation, and good steering stability across a wide operating speed range.

Additionally, in at least some embodiments, a pivot axis for trimming and tilting the outboard motor is located at the top of the transom, below the crankshaft centerline ahead of the steering axis (as noted above, the engine also is entirely or substantially above the trimming axis). A vertical steering axis is created by the swivel bracket which is constrained at the pivot axis for the trim system by the clamp brackets which are equally disposed to either side of the swivel bracket for securing the outboard to the transom. The outboard motor can be mounted to the swivel bracket with a plurality (e.g., four) rubber mounts attached by the steering head shafting which is rotatably mounted to the swivel bracket. The four rubber mounts create an elastic mounting axis which is designed to be aft of the vertical steering axis. Mountings as described are in the center portion of the outboard, or midsection. Extending the mounting axis upward to the upper portion where the engine is located, the elastic axis will be substantially proximal to the engine mounting positions which are located on opposite sides of the engine block proximal the midline of the crankshaft which is also proximate the vertical plane which contains the center of gravity of the engine whereby the discrete engine center of gravity as a separate component is mounted to the outboard's elastic mounting axis proximate the engines center of gravity. Extending the elastic axis downward to the lower portion, the gearcase, to the intersection of the propshaft centerline, the steering axis will be forward of the elastic axis and the elastic axis will be forward of the gearcase plan view center of pressure. With this architecture steering and vibration stability can be achieved.

Further, a mounting system that generally connects an outboard motor to a marine vessel is described in connection with a wide variety of embodiments. The mounting system accommodates significant thrust resulting from, for example, high power output by the engine during operation. As disclosed and in accordance with a variety of embodiments, the distance separating upper mounts or mounting portions is greater than the distance separating the lower mounts or mounting portions (or in the case of a single lower mount, the single lower mount or mounting portion is between and below the upper mounting portions). Such upper mount structure "spread" results in increased steering stability. In at least some further embodiments, an additional mounting structure (e.g., a thrust mount) can be included below the upper mount structure (e.g., yoke structure) for additional engagement with the outboard motor under at least some operating conditions. In such embodiments, there are five (or possibly four, if there is only one lower mount) mounts in the mounting assembly.

Further, in at least some embodiments, the engine is mounted to a tubular assembly which provides mountings for the engine, first, second and third transmissions, and the elastic mounts. The tubular structure can be constructed in such a way as to utilize the rear tubular segments as exhaust passages thus eliminating extra plumbing within the outboard system. The upper portion of the tubular structure provides a pair of mounting pads, disposed on opposite sides of the longitudinal centerline, which are designed to receive the engine mounts. Further, the upper portion provides a rear engine mounting surface designed to mount to the rear face of the engine to which the first transmission will also fasten. Thus, the rear mounting surface of the tubular structure is a plate that mounts the engine on one side and the first transmission on the other side. This method of mounting located the engines center of gravity as described above as well as providing a third rear mount for additional stability while under operating conditions. Additionally, the middle section of the tubular midsection provides a mounting surface for the second transmission. Below the mounting surface for the second transmission, the midsection provides for an oil sump for the transmission as well as a fuel sump and location for a high pressure fuel pump. Further, the lower section of the midsection provides for the mounting of the third transmission, the gearcase.

Additionally, it least some embodiments, the present invention concerns an outboard motor and/or marine vessel assembly having any one or more of the following features:

the center of gravity of the engine is vertically above the crankshaft center line;

torque flow: horizontal through engine, downward thru first transmission, forward and downward thru second transmission, downward and rearward thru third transmission;

wet clutch mounted in the midsection with a horizontal input and a vertical output;

tubular midsection construction;

separate oil pumps—dual engine pumps, transmission pump, and gearcase pump;

horizontal crankshaft with propeller below and engine vertically above;

dry sump with horizontal crankshaft;

engine oil proximate the transmission oil, and cooled by sea water;

outboard engine with integrated circulation pump and a separate remote circulation pump drive by an accessory belt for raw seawater;

air to glycol water cooling of an aluminum intercooler;

horizontal crankshaft outboard w/supercharger located in the vee of a vee type engine with the supercharger located below the intake manifold;

a horizontal crankshaft outboard engine with at least a turbo charger located in the V of a V-type engine with exhaust manifold also in the V;

a horizontal crankshaft engine with turbo chargers disposed on either side of the crankcase;

a horizontal crankshaft outboard with a supercharger above crankshaft centerline with an intercooler above crankshaft center line, with an intake manifold inlet above the supercharger;

a tubular midsection construction with exhaust conduit integrated as a structural member with the midsection;

the above including the combination of a water outlet tube with an exhaust tube; outboard motor with exhaust downwardly toward the propeller and upwardly toward a throttled outlet located above the waterline;

closure of exhaust throttle valves opens a third passage for idle relief through an exhaust attenuation circuit;

an exhaust throttle valve that actuates a water control circuit for an idle relief muffler;

horizontally disposed inlet to an exhaust system, without a riser, that flows downwardly toward the propeller;

outboard engine with accessory drive ahead of the driveshaft centerline;

an outboard with accessory drive in front of driveshaft centerline and a transmission behind the driveshaft centerline;

an outboard with a flywheel behind driveshaft centerline;

flywheel behind an engine, in front of a transmission, above a second transmission, above a third transmission;

a horizontal crankshaft outboard in combination with a wet clutch in the second transmission and a counter rotating propeller set;

a 90 degree transmission above the gearcase allowing torque to be evenly split between front and rear gears in both forward and reverse rotations to minimize torpedo diameter by eliminating shifting in the gearcase;

the above feature where the 90 degree transmission drives a third transmission with 2 input pinions and a single output shaft, and/or the above feature in combination with actively managed exhaust bypass to allow increased reverse thrust;

water cooling flow path where the water induced by vacuum water the gearcase, then passes the first transmission, then the second transmission, then the engine oil, to the inlet of a sea pump, where it is pressurized to pass through a heat exchanger, then up to the exhaust manifolds, then downwardly, then mixed with the exhaust and discharged, some with the exhaust and some without;

provision for the metering of water into the exhaust stream of the engine for the purpose of cooling but limiting and controlled to reduce the back pressure with the balance of water discharged outside of the exhaust path;

idle relief discharge to be common w/exhaust bypass where the discharge is located downstream of the throttle plate;

a hinged cowl system allowing the cowl to be hinged up out of the way without being removed that can also be alternately removed without being hinged up first;

a hinged cowl with a mechanical tether to prevent cowl ejection in the event of a strike of an underwater object while at operating speeds;

the above feature with the mechanical tether disposed opposite the service access points of the engine.

Among other things, in at least some embodiments, the present invention relates to an outboard motor configured to be mounted on a marine vessel. The outboard motor includes a housing including an upper portion and a lower portion, where at least one output shaft extends outward from the lower portion upon which at least one propeller is supported, and an engine configured to provide first torque at a first shaft extending outward from the engine, the engine being substantially situated within the housing. The outboard motor also includes a first transmission device that is in communication with the first shaft so as to receive the output torque and configured to cause second torque including at least some of the first torque to be communicated to a first location beneath the engine, a second transmission device configured to receive the second torque and to cause third torque including at least some of the second torque to be communicated to a second location beneath the first location within or proximate to the lower portion, a third transmission device positioned within or proximate to the lower portion that is configured to receive the third torque and cause at least some at least some of the third torque to be provided to the at least one output shaft.

Also, in at least some such embodiments, the first shaft is a crankshaft of the engine and extends aftward from the engine along a horizontal or substantially horizontal crankshaft axis, and a center of gravity of the engine is positioned above the horizontal crankshaft axis. Further, in at least some such embodiments, the third transmission device is situated at least partly within a gear casing of the lower portion, the gear casing having at least a portion that is substantially torpedo-shaped. Also in at least some such embodiments, the at least one output shaft includes a first output shaft and the at least one propeller includes a first propeller. Further, in at least some such embodiments, the third transmission device is situated at least partly within a gear casing of the lower portion, where the gear casing houses therewithin first and second pinions, where each of the first and second pinions is configured to receive a respective portion of the third torque, where the first and second pinions are respectively configured to rotate in opposite directions, where the gear casing further houses first and second additional gears are both axially aligned with the first output shaft, where the first and second additional gears respectively engage the first and second pinions in a manner such that opposite rotation of the first and second pinions relative to one another causes both of the first and second additional gears to rotate in a shared direction, and where such operation allows for the gear casing to have a reduced cross-sectional area. Additionally, in at least some such embodiments, the third transmission device additionally has third and fourth gears respectively situated above and coupled to the first and second pinions, respectively, where the third gear is coupled at least indirectly to the second transmission device so as to receive the third torque and drives the fourth gear. Further, in at least some such embodiments, the third transmission device is either a twin pinion transmission device or a single pinion transmission device, or the at least one output shaft additionally includes a second output shaft and the at least one propeller includes a second propeller, where the third transmission device is configured to cause the first and second output shafts to rotate in respectively opposite directions upon receiving the third torque such that the first and second propellers rotate in respectively opposite directions.

Additionally, in at least some such embodiments, the second transmission device includes, or is configured to receive the second torque via, an intermediate shaft, where the intermediate shaft is below and substantially parallel to the first shaft, and further in at least some such embodiments, the second transmission device is a multi-plate wet disk clutch transmission, and the third torque is communicated from the second transmission device to the third transmission device via an additional shaft that is substantially vertical in orientation, or the second transmission device is capable of being controlled to achieve forward, neutral, and reverse states, where in the forward state the second transmission device is configured to communicate the third torque in a first rotational direction, where in the reverse state the second transmission device is configured to communicate the third torque in a second rotational direction, and where the third transmission device is a twin pinion transmission device.

Further, in at least some such embodiments, the first transmission device includes one of (a) a series of gears each having a respective axis extending parallel to a first axis of the first shaft extending outward from the engine; (b) a first wheel or gear driven by the first shaft in combination with a second wheel or gear that drives a secondary shaft for providing the second torque further in combination with a belt or chain for linking the respective wheels or gears; or (c) first and second 90 degree type gear arrangements that interact such that the first torque provided via the first shaft is communicated from the first 90 degree type gear arrangement downward via an intermediary shaft to the second 90 degree type gear arrangement, which in turn outputs the second torque. Also, in at least some such embodiments, either (a) the first transmission device includes a transfer case that includes an arrangement of gears or other components that interact so that first rotational movement received from the first shaft is converted into second rotational movement accompanying the second torque, the second rotational movement differing in speed or magnitude from the first rotational movement, or (b) the second torque includes substantially all of the first torque, the third torque includes substantially all of the second torque, and the output shaft receives substantially all of the third torque.

Additionally, in at least some such embodiments, an oil reservoir for holding oil for the second transmission device is located within a mid portion of the outboard motor, between the second transmission device and the third transmission device, or the oil reservoir is either (a) cooled by water coolant arriving from the lower portion of the outboard motor, or (b) is capable of holding substantially 5 Liters or more of oil; and in addition to the oil reservoir for the second transmission device, each of the engine, the first transmission device, and third transmission device additionally has a further respective dedicated oil reservoir or repository of its own, so as to enhance operational robustness of the outboard motor. Also, in at least some such embodiments, a flow of rotational power from the engine to a propeller located at an aft end of a first propeller shaft of the at least one output shaft follows an S-shaped route from the engine to the first transmission device to the second transmission device to the third transmission device and finally to the propeller. Further, in at least some such embodiments, a gear ratio achieved between the output shaft and a first propeller shaft of the at least one propeller shaft can be varied by an operator by modifying at least one characteristic of at least one of the first, second, and third transmission devices.

Additionally, in at least some such embodiments, an aft surface of the engine is rigidly attached to the first transmission device, where the first transmission device is further rigidly attached to the second transmission device, and where the second transmission device is further rigidly attached, at least indirectly by an additional rigid member, to the internal combustion engine, whereby in combination the engine, first and second transmission devices, and additional rigid member form a rigid combination structure. Also, in at least some such embodiments, the outboard motor further includes a tubular assembly that provides mountings for the engine and each of the transmission devices, where a first of the mountings provided by the tubular assembly is located at a midsection of the tubular assembly, where proximate the midsection is further provided at least one of an oil sump, a fuel sump and a fuel pump, and where the tubular assembly includes at least a first tube that serves as a conduit for exhaust produced by the engine.

Further, in at least some additional embodiments, the present invention relates to a method of operating an outboard engine. The method includes providing first torque from the engine at a first shaft extending aftward from the engine, causing second torque including at least some of the first torque to be provided to a first location below the engine at least in part by way of a first transmission device, and causing third torque including at least some of the second torque to be provided to a second location below the first location at least in part by way of a second transmission device. The method additionally includes causing fourth torque including at least some of the third torque to be provided to a propeller supported in relation to a torpedo portion of the outboard engine.

Additionally, in at least some embodiments, the present invention relates to an outboard motor configured for attachment to and use with a marine vessel. The outboard motor comprises an internal combustion engine that is positioned substantially (or entirely) above a trimming axis and that provides rotational power output via a crankshaft that extends horizontally or substantially horizontally, a propeller rotatable about a propeller axis and positioned vertically below the internal combustion engine when the outboard motor is in a standard operational position, and at least one transmission component that allows for transmission of at least some of the rotational power output to the propeller. Further, in at least some such embodiments of the outboard motor, the outboard motor includes a front surface and an aft surface, the outboard motor being configured to be attached to the marine vessel such that the front surface would face the marine vessel and the aft surface would face away from the marine vessel when in the standard operational position, and the crankshaft of the engine extends in a front-to-rear direction substantially parallel to a line linking the front surface and aft surface. Also, in at least some such embodiments of the outboard motor, the internal combustion engine is an automotive engine suitable for use in an automotive application and further, in at least some additional embodiments, one or more of the following are true: (a) the internal combustion engine is one of an 8-cylinder V-type internal combustion engine; (b) the internal combustion engine is operated in combination with an electric motor so as to form a hybrid motor; (c) the rotational power output from the internal combustion engine exceeds 550 horsepower; and (d) the rotational power output from the internal combustion engine is within a range from at least 557 horsepower to at least 707 horsepower.

Further, in at least some such embodiments of the outboard motor, the at least one transmission component is positioned substantially below the internal combustion engine, between the internal combustion engine and the propeller axis. Also, in at least some such embodiments of the outboard motor, all cylinders of the internal combustion engine are positioned substantially at or above a center of gravity of the internal combustion engine. Additionally, in at least some such embodiments of the outboard motor, the engine includes (or is operated in conjunction with) at least one of a supercharger and a turbocharger, at least one of a plurality of spark plugs, one or more electrical engine components, the supercharger, and the turbocharger is positioned above one or both of the center of gravity of the internal combustion engine and the crankshaft of the engine, and the outboard motor includes at least one of an intercooler, a heat exchanger, and a circulation pump. Further, in at least some such embodiments of the outboard motor, all of the cylinders of the internal combustion engine have respective cylinder axes that are oriented so as to be either vertical or to have vertical components, and all of the cylinders of the internal combustion engine have exhaust ports that are above the crankshaft of the engine. Additionally, in at least some embodiments of the outboard motor, the outboard motor is configured to be attached to the marine vessel such that a front surface of the outboard motor would face the marine vessel and the aft surface would face away from the marine vessel when in the standard operational position, the internal combustion engine has front and aft sides, the front and aft sides respectively being proximate the front and aft surfaces, respectively, and a power take off of the internal combustion engine extends from the aft side of the internal combustion engine.

Also, in at least some such embodiments of the outboard motor, either (a) one or more of a heat exchanger and an accessory drive output are positioned at or extend from the front side of the internal combustion engine at or proximate to the front surface, or (b) one or more of an accessory drive, a belt, one or more spark plugs, one or more electrical engine components, and one or more other serviceable components are positioned at or proximate to a top side of the internal combustion engine or proximate to the front side of the internal combustion engine opposite the aft side of the internal combustion engine from which the power take off extends. Additionally, in at least some embodiments of the outboard motor, (a) a flywheel is positioned aft of the internal combustion engine, between an aft surface of the internal combustion engine and a first transmission component adjacent thereto, or (b) a center of gravity of the internal combustion engine is above an axis of the crankshaft of the internal combustion engine. Also, in at least some such embodiments of the outboard motor, an aft surface of the internal combustion engine is rigidly attached to a first transmission component of the at least one transmission component, the first transmission component is further rigidly attached to a second transmission component positioned below the internal combustion engine, and the second transmission components is further rigidly attached (at least indirectly by an additional rigid member) to the internal combustion engine, whereby in combination the internal combustion engine, first and second transmission components, and additional rigid member form a rigid combination structure.

Further, in at least some such embodiments of the outboard motor, the outboard motor further comprises a cowling that extends around at least a portion of the outboard motor so as to form a housing therefore. Additionally, in at least some such embodiments of the outboard motor, at least one portion of the cowling extends around an upper portion of the outboard motor at which is located the internal combustion engine. Also, in at least some such embodiments of the outboard motor, a first portion of the cowling is hingedly coupled to a second portion of the cowling by way of a hinge, and the hinge allows for rotation of the first portion of the cowling upward and aftward so that the one or more serviceable components of the internal combustion proximate a top surface or a front surface of the internal combustion engine are accessible. Further, in at least some embodiments, the present invention also relates to a boat comprising such an outboard motor, the boat being a marine vessel, the outboard motor being attached to a transom of the boat associated with a stern of the boat or a fishing deck of the boat. Additionally, in at least some such embodiments of the boat, an operator standing proximate the stern of the boat is able to access one or more components of the internal combustion engine proximate one or more of a front surface and a top surface of the internal combustion engine that are exposed when a cowling portion of the outboard motor is opened upward and aftward away from the stern of the boat. Also, in at least some such embodiments of the boat, the boat further comprises at least one additional motor also attached to the transom or another portion of the boat, and each of the at least one additional motor is identical or substantially identical to the outboard motor.

Also, in at least some embodiments, the present invention relates to an outboard motor configured for use with a marine vessel. The outboard motor comprises a horizontal crankshaft automotive engine and means for communicating at least some rotational power output from the horizontal crankshaft automotive engine to an output thrust device positioned below the horizontal crankshaft engine and configured to interact with water within which the outboard motor is situated. Further, in at least some such embodiments of the outboard motor, the output thrust device includes either a single propeller or two counterrotating propellers, the means for communicating includes a plurality of transmission devices, and a crankcase of the horizontal crankshaft automotive engine is made substantially or entirely from Aluminum.

Additionally, in at least some embodiments, the present invention relates to an outboard motor configured to be mounted on a marine vessel. The outboard motor comprises a housing including an upper portion and a lower portion, where at least one output shaft extends outward from the lower portion upon which at least one propeller is supported, and an engine configured to provide first torque at a first shaft extending outward from the engine, the engine being substantially situated within the housing. The outboard motor further comprises a first transmission device that is in communication with the first shaft so as to receive the output torque and configured to cause second torque including at least some of the first torque to be communicated to a first location beneath the engine, a second transmission device configured to receive the second torque and to cause third torque including at least some of the second torque to be communicated to a second location beneath the first location within or proximate to the lower portion, and a third transmission device positioned within or proximate to the lower portion that is configured to receive the third torque and cause at least some at least some of the third torque to be provided to the at least one output shaft.

In at least some such embodiments of the outboard motor, the first shaft is a crankshaft of the engine and extends aftward from the engine along a horizontal or substantially horizontal crankshaft axis, and a center of gravity of the engine is positioned above the horizontal crankshaft axis. Further, in at least some such embodiments of the outboard motor, the third transmission device is situated at least partly within a gear casing of the lower portion, the gear casing having at least a portion that is substantially torpedo-shaped. Also, in at least some such embodiments of the outboard motor, the at least one output shaft includes a first output shaft and the at least one propeller includes a first propeller. Additionally, in at least some such embodiments of the outboard motor, the third transmission device is situated at least partly within a gear casing of the lower portion, the gear casing houses therewithin first and second pinions, each of the first and second pinions is configured to receive a respective portion of the third torque, the first and second pinions are respectively configured to rotate in opposite directions, the gear casing further houses first and second additional gears are both axially aligned with the first output shaft, the first and second additional gears respectively engage the first and second pinions in a manner such that opposite rotation of the first and second pinions relative to one another causes both of the first and second additional gears to rotate in a shared direction, and wherein such operation allows for the gear casing to have a reduced cross-sectional area.

Additionally in at least some such embodiments of the outboard motor, the third transmission device additionally has third and fourth gears respectively situated above and coupled to the first and second pinions, respectively, and the third gear is coupled at least indirectly to the second transmission device so as to receive the third torque and drives the fourth gear. Also, in at least some such embodiments of the outboard motor, the third transmission device is either a twin pinion transmission device or a single pinion transmission device. Further, in at least some such embodiments of the outboard motor, the at least one output shaft additionally includes a second output shaft and the at least one propeller includes a second propeller, and the third transmission device is configured to cause the first and second output shafts to rotate in respectively opposite directions upon receiving the third torque such that the first and second propellers rotate in respectively opposite directions. Also, in at least some such embodiments of the outboard motor, the second transmission device includes (or is configured to receive the second torque via) an intermediate shaft, where the intermediate shaft is below and substantially parallel to the first shaft. Further, in at least some such embodiments of the outboard motor, the second transmission device is a multi-plate wet disk clutch transmission, and the third torque is communicated from the second transmission device to the third transmission device via an additional shaft that is substantially vertical in orientation. Also, in at least some such embodiments of the outboard motor, the second transmission device is capable of being controlled to achieve forward, neutral, and reverse states, where in the forward state the second transmission device is configured to communicate the third torque in a first rotational direction, where in the reverse state the second transmission device is configured to communicate the third torque in a second rotational direction, and where the third transmission device is a twin pinion transmission device.

Further, in at least some such embodiments of the outboard motor, the first transmission device includes one of (a) a series of gears each having a respective axis extending parallel to a first axis of the first shaft extending outward from the engine, (b) a first wheel or gear driven by the first shaft in combination with a second wheel or gear that drives a secondary shaft for providing the second torque further in combination with a belt or chain for linking the respective wheels or gears, or (c) first and second 90 degree type gear arrangements that interact such that the first torque provided via the first shaft is communicated from the first 90 degree type gear arrangement downward via an intermediary shaft to the second 90 degree type gear arrangement, which in turn outputs the second torque. Also, in at least some such embodiments of the outboard motor, either (a) the first transmission device includes a transfer case that includes an arrangement of gears or other components that interact so that first rotational movement received from the first shaft is converted into second rotational movement accompanying the second torque, the second rotational movement differing in speed or magnitude from the first rotational movement, or (b) the second torque includes substantially all of the first torque, the third torque includes substantially all of the second torque, and the output shaft receives substantially all of the third torque.

Further, in at least some such embodiments of the outboard motor, an oil reservoir for holding oil for the second transmission device is located within a mid portion of the outboard motor, between the second transmission device and the third transmission device. Also, in at least some such embodiments of the outboard motor, the oil reservoir is either (a) cooled by water coolant arriving from the lower portion of the outboard motor, or (b) is capable of holding substantially 5 Liters or more of oil. Further, in at least some such embodiments of the outboard motor, in addition to the oil reservoir for the second transmission device, each of the engine, the first transmission device, and third transmission device additionally has a further respective dedicated oil reservoir or repository of its own, so as to enhance operational robustness of the outboard motor.

Also, in at least some such embodiments of the outboard motor, a flow of rotational power from the engine to a propeller located at an aft end of a first propeller shaft of the at least one output shaft follows an S-shaped route from the engine to the first transmission device to the second transmission device to the third transmission device and finally to the propeller. Additionally, in at least some such embodiments of the outboard motor, a gear ratio achieved between the output shaft and a first propeller shaft of the at least one propeller shaft can be varied by an operator by modifying at least one characteristic of at least one of the first, second, and third transmission devices. Further, in at least some such embodiments of the outboard motor, an aft surface of the engine is rigidly attached to the first transmission device, the first transmission device is further rigidly attached to the second transmission device, and the second transmission device is further rigidly attached (at least indirectly by an additional rigid member) to the internal combustion engine, whereby in combination the engine, first and second transmission devices, and additional rigid member form a rigid combination structure. Also, in at least some such embodiments of the outboard motor, the outboard motor further comprises a tubular assembly that provides mountings for the engine and each of the transmission devices, where a first of the mountings provided by the tubular assembly is located at a midsection of the tubular assembly, where proximate the midsection is further provided at least one of an oil sump, a fuel sump and a fuel pump, and where the tubular assembly includes at least a first tube that serves as a conduit for exhaust produced by the engine.

Additionally, in at least some embodiments, the present invention relates to a method of operating an outboard engine. The method includes providing first torque from the engine at a first shaft extending aftward from the engine, causing second torque including at least some of the first torque to be provided to a first location below the engine at least in part by way of a first transmission device, causing third torque including at least some of the second torque to be provided to a second location below the first location at least in part by way of a second transmission device, and causing fourth torque including at least some of the third torque to be provided to a propeller supported in relation to a torpedo portion of the outboard engine.

Further, in at least some embodiments, the present invention relates to an outboard motor for a marine application comprising an upper portion within which is situated an engine that generates torque, and a lower portion including a gear casing, where a propeller output shaft extends aftward from the gear casing along an axis drives rotation of a propeller. Additionally, the gear casing includes each of: (a) first and second pinions, where each of the first and second pinions is configured to receive a respective portion of the torque generated by the engine via at least one transmission device, and where the first and second pinions are respectively configured to rotate in opposite directions; (b) first and second additional gears that are both axially aligned with the axis and coupled to or integrally formed with the propeller output shaft, where the first and second additional gears respectively engage the first and second pinions in a manner such that opposite rotation of the first and second pinions relative to one another causes both of the first and second additional gears to rotate in a shared direction; and (c) an exhaust port formed at or proximate an aft end of the gear casing, the exhaust port allowing exhaust provided thereto via at least one channel within the lower portion to exit the outboard motor.

Additionally, in at least some such embodiments of the outboard motor, at least one water inlet is formed along the lower portion by which water coolant is able to enter the outboard motor from an external water source. Further, in at least some such embodiments, the at least one water inlet includes a lower water inlet formed along a bottom front surface of the gear casing and at least one upper water inlet formed along at least one side surface of the lower portion at a location substantially midway between a top of the lower portion and the bottom front surface. Also, in at least some such embodiments of the outboard motor, the at least one upper water inlet includes port and starboard upper water inlets formed along port and starboard side surfaces of the lower portion. Further, in at least some such embodiments of the outboard motor, operation of the upper water inlets can be tuned by placing or modifying one or more cover plates over the upper water inlets so as to partly or entirely cover over one or more orifices formed within the port and starboard side surfaces in various manners, further operation of the lower water inlet can be tuned by placing an additional cover plate over or in relation to the lower water inlet, and all of the water inlets are positioned forward of the first and second pinions toward a forward side of the outboard motor, the outboard motor being configured so that the forward side faces a marine vessel when the outboard motor is attached to the marine vessel.

Additionally, in at least some such embodiments of the outboard motor, (a) at least one of the orifices is entirely covered over by way of at least one of the cover plates, so as to preclude any of the water coolant from entering the at least one orifice, or (b) the additional cover plate is added so as to block the lower water inlet and thereby preclude any of the water coolant from entering the lower water inlet. Further, in at least some such embodiments of the outboard motor, an oil drain screw associated with an oil reservoir for the gear casing extends, from within the lower portion, toward the lower water inlet without protruding out of the lower portion, whereby the oil drain screw can be accessed to allow draining of oil from the gear casing, and whereby a positioning of the oil drain screw is such that no portion of the oil drain screw protrudes out beyond an exterior surface of the gear casing. Also, in at least some such embodiments of the outboard motor, the lower housing includes a front coolant chamber configured to receive the water coolant able to enter the outboard motor via the at least one water inlet. Additionally, in at least some such embodiments of the outboard motor, the outboard motor further comprises first and second transfer gears respectively coupled to the first and second pinions by way of first and second additional downward shafts extending respectively from the first and second transfer gears to the first and second pinions, respectively, where the first and second transfer gears engage one another and the first transfer gear receives at least some of the torque generated by the engine from a transmission device positioned above the first and second transfer gears by way of an intermediate shaft extending from the transmission device to the first transfer gear.

Also, in at least some such embodiments of the outboard motor, the outboard motor further comprises a mid portion in between the upper portion and the lower portion, where the mid portion and lower portion are configured so that at least a first portion of the water coolant received by the front coolant chamber passes by the first and second transfer gears so as to cool the first and second transfer gears. Additionally, in at least some such embodiments of the outboard motor, the outboard motor further comprises an oil reservoir for the transmission device, the oil reservoir being positioned below the transmission device and above the first and second transfer gears within the mid portion, where the mid portion and lower portion are configured so that at least the first portion or a second portion of the water coolant received by the front coolant chamber passes by the oil reservoir so as to cool oil within the oil reservoir. Further, in at least some such embodiments of the outboard motor, Archimedes spiral mechanisms are formed in relation to each of the first and second additional downward shafts, such that oil is conducted upwards from a reservoir portion within the gear casing to the first and second transfer gears regardless of whether the outboard motor is operating a forward or reverse direction. Also, in at least some such embodiments of the outboard motor, the outboard motor further comprises a mid portion in between the upper portion and the lower portion, where a transmission device capable of forward-neutral-reverse operation is positioned within the mid portion above the first and second pinions, and where the respective portions of the torque are supplied to the first and second pinions at least indirectly from the transmission device.

Additionally, in at least some such embodiments of the outboard motor, the lower portion includes an exhaust cavity positioned aftward of the first and second pinions, the exhaust cavity being configured to receive exhaust provided thereto from the engine and being coupled by way of or constituting the at least one channel by which the exhaust is provided to the exhaust port. Further, in at least some such embodiments of the outboard motor, the exhaust port includes a plurality of exhaust port sections positioned around the propeller output shaft and separated from one another by a plurality of axially extending vanes. Also, in at least some such embodiments of the outboard motor, the lower portion includes a cavitation plate extending aftward along a top portion of the lower portion above the propeller, and the cavitation plate includes at least one of a (a) cavity within which water coolant circulating within the outboard motor arrives after performing cooling within the outboard motor and prior to exiting the outboard motor, the cavity at least partly in communication with the exhaust cavity and (b) a sacrificial anode.

Further, in at least some embodiments, the present invention relates to an outboard motor for a marine application that comprises an upper portion within which is situated an engine that generates torque, and a lower portion including a gear casing, where a propeller output shaft extends aftward from the gear casing along an axis drives rotation of a propeller. The gear casing has: (a) first and second pinions coupled respectively to first and second gears by way of first and second downwardly-extending shafts, respectively, where each of the first and second gears is configured to receive a respective portion of the torque generated by the engine via at least one transmission device, and where the first and second pinions are configured to rotate in opposite directions; (b) first and second additional gears that are both axially aligned with the axis and coupled to or integrally formed with the propeller output shaft, where the first and second additional gears respectively engage the first and second pinions in a manner such that opposite rotation of the first and second pinions relative to one another causes both of the first and second additional gears to rotate in a shared direction; and (c) a plurality of tunable water inlets formed along one or more forward surfaces of the lower portion, the tunable water inlets being configurable to allow or preclude entry of water coolant from an external water source to enter into the lower portion, wherein the lower portion is configured so that at least some of the water coolant entering the lower portion passes by the first and second gears so as to cool the first and second gears.

Additionally, in at least some such embodiments of the outboard motor, at least one of the lower portion, upper portion and a mid portion between the lower and upper portions is configured to direct at least some of the water coolant toward or by at least one of: (a) an oil reservoir for a transmission device; (b) a heat exchanger configured to cool glycol engine coolant upon receiving the water coolant; and (c) an exhaust conduit receiving exhaust from the engine. Further, in at least some such embodiments of the outboard motor, the engine is a horizontal crankshaft engine, and the at least one transmission device includes a wet disk clutch transmission. Also, the present invention also relates in at least some embodiments to a marine vessel comprising such embodiments of the outboard motor.

Further, in at least some embodiments, an outboard motor includes a lower portion having one or more tunable water inlets. In some such embodiments, there are one or two upper water inlets located substantially midway between top and bottom regions of the lower portion. In other embodiments, there is at least one tunable water inlet along a bottom surface of a gear case. In at least some such embodiments, one or more water inlets are tunable by placement of one or more covers (e.g., cover plates, clamshell-type structures, etc.) that entirely or partly block entry of water into an interior of the lower portion via the one or more water inlets. Water entering via the inlets can proceed into the outboard motor for use for cooling.

Additionally, in at least some embodiments, the present invention relates to a mounting system for connecting an outboard motor to a marine vessel. The mounting system comprises a swivel bracket structure having a steering tube structure and providing a steering axis about which the swivel bracket structure is capable of rotating, and a pair of clamp bracket structures extending from the swivel bracket structure. The mounting system also comprises a first steering yoke structure connected to the swivel bracket structure by way of the steering tube structure, and including a first crosspiece mounting structure that includes a pair of first steering yoke structure mount portions which can be used to couple the swivel bracket structure to the outboard engine, the pair of first steering yoke structure mount portions separated by a first distance. The mounting system further comprises a second steering yoke structure connected to the swivel bracket structure by way of the steering tube structure, and including a second steering yoke structure mount portion which can be used to couple the swivel bracket structure to the outboard engine, the second steering yoke structure mount portion positioned between the pair of first steering yoke structure mount portions.

Further, in at least some such embodiments of the mounting system, each of the pair of first steering yoke structure mount portions includes a respective first passage and the second steering yoke structure mount portion includes a second passage. Also, in at least some such embodiments of the mounting system, the second steering yoke structure mount portion passage is below and between the pair of first steering yoke structure mount portions. Additionally, in at least some such embodiments of the mounting system, the outboard motor includes a horizontal crankshaft engine.

Also, in at least some embodiments, the present invention relates to a mounting system for connecting an outboard motor to a marine vessel. The mounting system includes a swivel bracket structure having a steering tube structure and providing a steering axis about which the swivel bracket structure is capable of rotating, and a pair of clamp bracket structures extending from the swivel bracket structure. The mounting system further includes a first steering yoke structure connected to the swivel bracket structure about a steering tube structure, and including a first crosspiece mounting structure that includes a pair of first steering yoke structure mount portions which can be used to couple the swivel bracket structure to the outboard engine, the pair of first steering yoke structure mount portions separated by a first distance. The mounting system additionally includes a second steering yoke structure connected to the swivel bracket structure about the steering tube structure, and including a pair of second steering yoke structure mount portions which can be used to couple the swivel bracket structure to the outboard engine, the pair of second steering yoke structure mount portions separated by a second distance, where the first distance is greater than the second distance, thereby providing convergence from the pair of first steering yoke structure mount portions to the pair of second steering yoke structure mount portions.

Further, in at least some such embodiments of the mounting system, each of the pair of first steering yoke structure mount portions includes a passageway and the first distance is at least about the distance between respective centers of the passageways. Additionally, in at least some such embodiments of the mounting system, each of the pair of second steering yoke structure mount portions includes a passageway and the second distance is at least about the distance between respective centers of the passageways. Also, in at least some such embodiments of the mounting system, the first crosspiece mounting structure is centered or substantially centered about the steering tube structure, and the crosspiece mounting structure terminates in the pair of mount portions. Additionally, in at least some such embodiments of the mounting system, the clamp bracket structures are symmetric with respect to one another. Further, in at least some such embodiments of the mounting system, the clamp bracket structures are capable of being affixed rigidly or substantially rigidly to the marine vessel. Also, in at least some such embodiments of the mounting system, the crosspiece mounting structure terminates in the pair of mount portions.

Additionally, in at least some such embodiments of the mounting system, a steering axis extends longitudinally along the center of steering tube structure and provides an axis of rotation. Also, in at least some such embodiments of the mounting system, the axis of rotation is vertical or substantially vertical. Further, in at least some such embodiments of the mounting system, the mounting system further includes a tilt tube structure having an axis of rotation that permits at least one of tilting and trimming about the axis of rotation, and the axis of rotation of the tilt tube structure further coincides with an axis of actuation of a power steering actuator that is generally housed within the tilt tube structure. Also, in at least some such embodiments of the mounting system, the mounting system further includes a tilt tube structure having an axis of rotation. Further, in at least some such embodiments of the mounting system, the swivel bracket structure is rotatable about the tilt tube axis of rotation. Additionally, in at least some such embodiments of the mounting system, the swivel bracket structure is at least one of tiltable and trimmable about the tilt tube axis of rotation. Also, in at least some such embodiments of the mounting system, the tilt tube axis of rotation is horizontal or substantially horizontal and, by virtue of swiveling around the tilt tube axis of rotation, it is possible to rotate the outboard motor in relation to a transom of the marine vessel so as to bring a lower portion of the marine vessel out of the water within which it would ordinarily be situated.

Also, in at least some embodiment, the present invention relates to a mounting system for connecting an outboard motor to a marine vessel. The mounting system comprises a swivel bracket structure having a steering tube structure and providing a steering axis about which the swivel bracket structure is capable of rotating, and a pair of clamp bracket structures extending from the swivel bracket structure. The mounting system further comprises a tilt tube structure having an axis of rotation, the tilt tube structure housing (at least in part) a power steering cylinder having a central axis that coincides, or substantially coincides, with the tilt tube structure axis of rotation. Further, in at least some such embodiments of the mounting system, the power steering cylinder includes a power steering piston that is capable of moving within the steering cylinder in response to power steering fluid movement. Additionally, in at least some such embodiments of the mounting system, the swivel bracket structure is rotatable about the tilt tube axis of rotation. Further, in at least some such embodiments of the mounting system, the swivel bracket structure is at least one of tiltable and trimmable about the tilt tube axis of rotation. Also, in at least some such embodiments of the mounting system, the tilt tube axis of rotation is horizontal.

Additionally, in at least some such embodiments of the mounting system, the mounting system further comprises a first steering yoke structure connected to the swivel bracket structure by way the steering tube structure, and including a first crosspiece mounting structure that includes a pair of first steering yoke structure mount portions which can be used to couple the swivel bracket structure to the outboard engine, the pair of first steering yoke structure mount portions separated by a first distance, and a second steering yoke structure connected to the swivel bracket structure by way of the steering tube structure, and including a second steering yoke structure mount portion which can be used to couple the swivel bracket structure to the outboard engine, the second steering yoke structure mount portion positioned between the pair of first steering yoke structure mount portions. Also, in at least some such embodiments of the mounting system, the mounting system further comprises a first steering yoke structure connected to the swivel bracket structure about a steering tube structure, and including a first crosspiece mounting structure that includes a pair of first steering yoke structure mount portions which can be used to couple the swivel bracket structure to the outboard engine, the pair of first steering yoke structure mount portions separated by a first distance, and a second steering yoke structure connected to the swivel bracket structure about the steering tube structure, and including a pair of second steering yoke structure mount portions which can be used to couple the swivel bracket structure to the outboard engine, the pair of second steering yoke structure mount portions separated by a second distance, wherein the first distance is greater than the second distance, thereby providing convergence from the pair of first steering yoke structure mount portions to the pair of second steering yoke structure mount portions.

Further, in at least some embodiments, the present invention relates to a method of cooling an outboard motor having a lower portion, a mid portion, an upper portion, a first transmission disposed in the upper portion and a second transmission disposed in the mid portion. The method includes receiving, into the lower portion of the outboard motor, an amount of cooling water, and flowing the amount of cooling water generally upwardly into the mid portion of the outboard motor and past the second transmission. In at least some such embodiments of the method, the amount of cooling water is received into the lower portion of the outboard motor via a plurality of water inlets, and/or the cooling water cools at least in part the second transmission. Also, in at least some such embodiments of the method, the amount of cooling water that is flowing upwardly in the mid portion of the outboard motor flows vertically or substantially vertically. Further, in at least some such embodiments of the method, the amount of cooling water flowing into the mid portion of the outboard motor also flows generally rearwardly in the mid portion past at least one of a pair of transfer gears and a second transmission oil reservoir to cool any oil in the reservoir. Also, in at least some such embodiments of the method, an engine is disposed in the upper portion of the outboard motor and the amount of cooling water flows from the mid portion generally upwardly into the upper portion.

Additionally, in at least some such embodiments of the method, the method further comprises flowing the amount of cooling water forwardly to a water pump. Also, in at least some such embodiments of the method, the method further comprises pumping, using the water pump, the amount of cooling water into and through, so as to cool, an engine heat exchanger and an engine oil cooler. Further, in at least some such embodiments of the method, the method further comprises cooling a heat exchanger fluid at the heat exchanger using the amount of cooling water and further cooling an amount of oil at the engine oil cooler using the amount of water. Additionally, in at least some such embodiments of the method, the method further comprises, after exiting the engine heat exchanger and engine oil cooler, flowing the amount of water generally downwardly, toward and into at least one chamber surrounding a plurality of exhaust channels, and further flowing the amount of water back upwardly into at least one exhaust manifold, so as to cool exhaust. Also, in at least some such embodiments of the method, cooling water flows in a direction counter to a direction of exhaust flow so as to cool the exhaust (while in the at least one chamber surrounding the exhaust channels). Further, in at least some such embodiments of the method, after exiting the at least one exhaust manifold, the amount of cooling water flows downwardly, through one or more mufflers, and past the first transmission and, in so doing, cools the one or more mufflers and the first transmission. Also, in at least some such embodiments of the method, the method further comprises flowing the amount of cooling water out of the outboard motor, by way of the lower portion.

Further, in at least some embodiments, the present invention relates to a method of cooling an outboard motor having a lower portion, a mid portion, and an upper portion. The method comprises receiving, into the lower portion of the outboard motor, an amount of cooling water, and flowing the amount of water upwardly from the lower portion to and through the mid portion and into the upper portion. The method also includes flowing a first portion of the amount of water into a first water pump and pumping the water from the first pump into and through one or more engine heat exchangers (e.g., and engine coolant heat exchanger and/or an engine oil cooler) and, after exiting the engine heat exchanger(s), flowing the first portion of the cooling water out of the outboard motor by way of the lower portion. The method further includes flowing a second portion of the amount of water into a second water pump and pumping the second portion into chambers surrounding respective exhaust channels to cool exhaust flowing within the channels, and flowing the second portion of the amount of cooling water through a plurality of mufflers and past a first transmission disposed in the upper portion, and in so doing, cooling the mufflers and the first transmission. The method additionally includes flowing the second portion of the amount of cooling water from the mufflers and the first transmission, out of the outboard motor.

Additionally, in at least some such embodiments of the method, the method further comprises flowing the amount of cooling water generally upwardly into the mid portion of the outboard motor and past, so as to cool, the second transmission disposed in the mid portion. Further, in at least some such embodiments of the method, the method further comprises cooling the engine in the upper portion by cooling engine coolant using a heat exchanger and cooling engine oil using an engine oil cooler. Also, in at least some such embodiments of the method, the method further comprises at least one of: (a) flowing the second portion of the amount of cooling water to, so as to cool, an intercooler, and (b) flowing a third portion of the amount of water into a third water pump and pumping the third portion of the amount of cooling water to, so as to cool, an intercooler. Further, in at least some such embodiments of the method, the intercooler is an aluminum intercooler, and air to glycol water cooling is performed at the intercooler.

Further, in at least some embodiments, the present invention relates to a rigid body structure for use with outboard motor comprising an internal combustion engine that is rigidly attached to a first a first transmission assembly, a second transmission assembly positioned below the internal combustion engine and connected the first transmission assembly, and an additional rigid member connected to the second transmission assembly and to the internal combustion engine, whereby in combination the internal combustion engine, first and second transmission assemblies, and the additional rigid member form a rigid body structure. Additionally, in at least some such embodiments of the rigid body structure, the internal combustion engine is a horizontal crankshaft engine. Further, in at least some such embodiments of the rigid body structure, the rigid body structure is rectangular or substantially rectangular in shape. Also, in at least some such embodiments of the rigid body structure, the rigid body structure includes a fastener which permits adjustability in the assembly of the rigid body structure.

Additionally, in at least some embodiments, the present invention relates to a progressive mounting assembly of an outboard motor also having a transom mounting assembly, the progressive mounting assembly for use in allowing connection of the outboard motor to a transom of a marine vessel by way of the transom mounting assembly. The progressive mounting assembly includes a steering yoke structure capable of being used with the transom mounting assembly, a mounting bracket structure connected to the steering yoke structure and mountable to a remainder of the outboard motor, and a thrust mount structure in operable association with the steering yoke structure and the mounting bracket structure such that the thrust mount structure is capable of transferring force in during an operational range of the outboard motor. Further, in at least some such embodiments of the progressive mounting assembly, the thrust mount structure contacts the lower yoke assembly and is deformed transferring a moderate to substantial force.

Also, in at least some embodiments, the present invention relates to an outboard motor adapted for use with a marine vessel. The outboard motor comprises an internal combustion engine positioned substantially within an upper portion of the outboard motor, where the internal combustion engine is configured to output rotational power at a crankshaft and further output exhaust from at least one engine cylinder during operation of the engine, and a first exhaust conduit that is configured to communicate at least some of the exhaust downward from the engine to a gear casing at a lower portion of the outboard motor, where the exhaust is able to exit the lower portion by way of at least one orifice formed in an aft surface of the gear casing positioned in front of a propeller attached to the gear casing. The outboard motor further comprises at least one water inlet positioned proximate a front surface of the lower portion by which water coolant is able to enter into the lower portion from an exterior water source, and at least one channel leading from the at least one water inlet to a portion of the exhaust conduit, the least one channel being configured to direct at least some of the water coolant to pass in proximity to the exhaust conduit so as to cool the exhaust communicated by the exhaust conduit.

Further, in at least some such embodiments of the outboard motor, the at least one engine cylinder includes a plurality of engine cylinders, where the first exhaust conduit is configured to receive the exhaust from a first cylinder along a first side of the engine, and the outboard motor further comprises a second exhaust conduit that is configured to receive additional exhaust from a second cylinder along a second side of the engine and to communicate at least some of the additional exhaust downward from the engine to the gear casing. Also, in at least some such embodiments of the outboard motor, the first and second exhaust conduits run along port and starboard sides of the outboard motor so as to minimize heat transfer from the exhaust conduits to one or both of oil or other internal engine components. Additionally, in at least some such embodiments of the outboard motor, the outboard motor further comprises third and fourth exhaust conduits that link the first and second exhaust conduits, respectively, with first and second mufflers, respectively, the first and second mufflers being positioned aftward of the internal combustion engine substantially along first and second sides of a first transmission. Also, in at least some such embodiments of the outboard motor, the first and second mufflers are coupled in a manner tending to reduce or ameliorate noise associated with the exhaust and additional exhaust communicated from the engine.

Further, in at least some such embodiments of the outboard motor, output ports of the first and second mufflers are coupled to output orifices formed within an upper portion of a cowling of the outboard motor, where positioning of the orifices within the upper portion minimizes water entry into the orifices, and where the upper portion of the cowling further includes at least one air intake port. Additionally, in at least some embodiments, the engine is a horizontal crankshaft engine that outputs the exhaust communicated by the exhaust conduits. Also, in at least some embodiments, coolant for cooling exhaust flows in a direct opposite or counter a direction of flow of the exhaust leaving the engine.

Additional alternate embodiments are also possible. For example, in some other embodiments, more than one (e.g., two) of the outboard motors such as the outboard motor 104 are positioned on a single marine vessel such as the marine vessel 102 to form a marine vessel assembly.

Further, numerous additional features can be provided in one or more additional embodiments of outboard motors encompassed herein. Among these additional features are (a) a cowling system with one or more features that are in addition to or in place of one or more for cowling system features already discussed above; (b) a water pump system as described below; (c) a vapor separating tank (VST) system as described below; and (d) an oil tank system as described below. It should be understood that, notwithstanding the discussion below, the present disclosure is intended to encompass numerous different embodiments of outboard motors having any one or more of the features described above and/or below, including any one or more of the cowling, water pump, VST, and oil tank systems specifically described below, and/or modified versions of any one or more of those features or systems. Further, the present disclosure is intended to encompass any one or more of such features or systems as those features or systems can be implemented in a variety of outboard motors, as well as intended to encompass any of a variety of marine vessels that employ any one or more of such outboard motors and/or features and/or systems. Additionally, the present disclosure is intended to encompass numerous different embodiments of methods and processes of operation, use, manufacturing, and assembly suited for any one or more of such features or systems, outboard motors employing any such features or systems, and/or marine vessels employing any such outboard motors, features, and/or systems.

Cowling System

The present invention in at least some embodiments relates to an outboard motor that includes a cowling system in which the cowling is divided into first and second portions and serves to divide an interior region within the upper portion of the motor into two subcavities. A first portion of the cowling is implemented around the transmission, which is insensitive to water submersion, and air enters the outboard motor via the first portion. Additionally, a second portion of the cowling is enclosed around the engine. Airflow passages connect the two portions in such a manner as to allow passage of air but discourage passage of water.

In at least some such embodiments, the first portion is separated from the second portion by way of a substantially vertical interior wall formation, and the first portion and second portions are in fluid communication with one another by way of an opening proximate a bottom of the wall formation. Air entering the outboard motor enters at inlet(s) positioned at or proximate to a top of the motor and a top of the wall formation such that, for the air to reach the engine, the air must pass downward through the first portion to the opening and then upward into the second portion toward the engine. Further in at least some such embodiments, air is delivered to the engine in the second portion while entrapped/entrained water is separated in the first portion and allowed to drain through passages provided in the lowermost portion of the first portion of the cowling system. Also, in at least some such embodiments, the cross-sectional sizes of the first and second portions are different from one another such that air flow downward through the first portion is at a higher flow rate and air flow upward into/through the second portion is at a lower flow rate.

At least some embodiments of the improved cowling system are appropriate especially for large outboard motors that require high airflow rates due to elevated power levels. By dividing the cowling system into two separate compartments where a first compartment is partitioned from a second compartment and a relatively low restriction passage is provided between the first and second compartment. Then the first compartment can be utilized to create an airflow reversing effect where air velocity is utilized to separate water from air due to the reversal effect. Here airflow is introduced to the cowling and immediately directed downwardly in the first compartment then turned upwardly causing water to "fall out" to the bottom of the first compartment and thereby be drained. Then the upwardly rising air passes into the second and larger compartment causing a slowing of the airflow which in turn causes the remainder of entrapped water to be drained through a second set of drain orifices in the lower portion of the second cowl chamber.

Hence, in such embodiments, the first chamber is designed to be smaller than the second chamber as higher airflow velocity better serve the reversal effect than the larger chamber utilizes lower velocity for further water removal as the larger second chamber has a longer horizontal path that allows more time for gravity to pull the heavier entrapped water from the slowly rising airflow. In this way, low airflow restriction is accomplished for better engine breathing efficiency while water is efficiently removed sequentially in each of two chambers each equipped with independent drain orifices and enabled by both high velocity reversal effects and low velocity gravitational effects.

In view of these features, the outboard motor serves to one or more of (1) minimize the ingress of water into the motor (e.g., due to the high placement of the air inlets), (2) minimize proceeding of water toward water-sensitive components such as the engine due to one or more of (a) the required flow path for air involving forward movement of the air, (b) successive downward and then upward movement of the air within the motor, and/or (c) high velocity air flow downward followed by low velocity upward air flow, and/or (3) enhanced drainage of water from the outboard motor, so as to keep water-sensitive components such as the engine as dry as possible, by way of water outlets at two distinct regions of the outboard motor.

Figure 25:
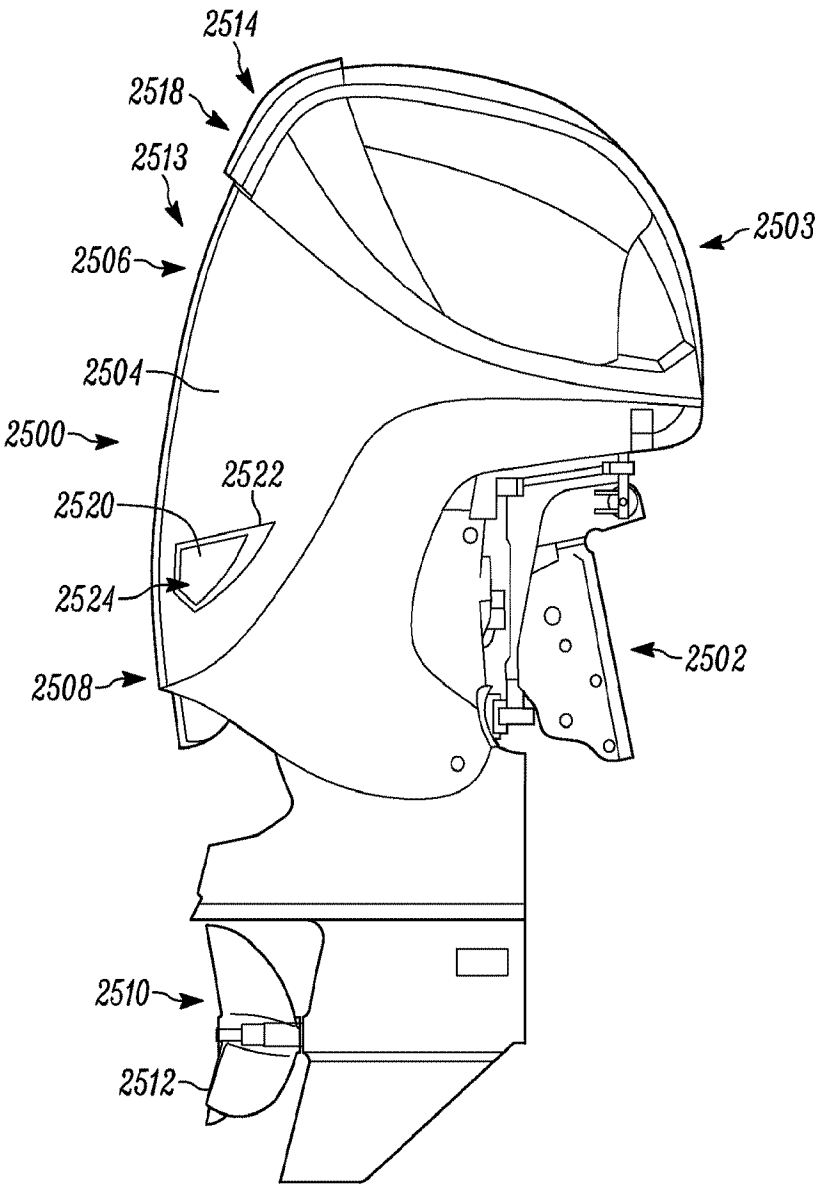
FIG. 25 is a right side elevation view of an example outboard motor having a cowling system in accordance with at least some embodiments herein.

Referring to FIG. 25, a right side elevation view of an example outboard marine propulsion system or outboard motor (or outboard engine or outboard machine) 2500 is shown. The outboard motor 2500 can be an alternate embodiment of the outboard motor 104 already discussed above. In the present embodiment, the outboard motor 2500 is configured to be coupled to a stern (rear) edge or transom of a marine vessel (not shown, but which can be for example the marine vessel 100 discussed above) by way of a mounting system 2502 positioned along a front edge or region 2503 of the outboard motor. As already discussed above, it will be appreciated that the marine vessel in relation to which the outboard motor 2500 can be utilized can take any of a variety of forms including a variety of speed boats, yachts, other pleasure craft, as well as other types of boats, marine vehicles and marine vessels.

Further with respect to FIG. 25, the outboard motor 2500 particularly includes a cowling system or simply cowling (or cowl) 2504 surrounding and forming a housing for an upper portion 2506 and a mid portion 2508 of the outboard motor. A lower portion 2510 of the outboard motor 2500 includes a propeller 2512 that is located along a rear edge or region 2513 of the outboard motor and that is rotated by operation of the outboard motor 2500 and, by virtue of such rotation, drives the outboard motor and any marine vessel to which the motor is attached. With respect to the cowling 2504 in particular, the cowling can generally be considered to have an upper cowl 2514 and a lower cowl 2516, where the upper cowl is generally the portion of the cowl corresponding to the upper portion 2506 of the outboard motor 2500, and the lower cowl generally encompasses the portion of the cowl positioned within the mid portion 2508 of the outboard motor (albeit the lower cowl can also be considered to be partly or entirely within a lower portion of the upper portion 2506 of the outboard motor). FIG. 25 additionally shows the cowling 2504 to include air inlet(s) (in the Helmut as discussed below) 2518 and optional side air inlets 2520 and associated covers 2522.

Figure 26:
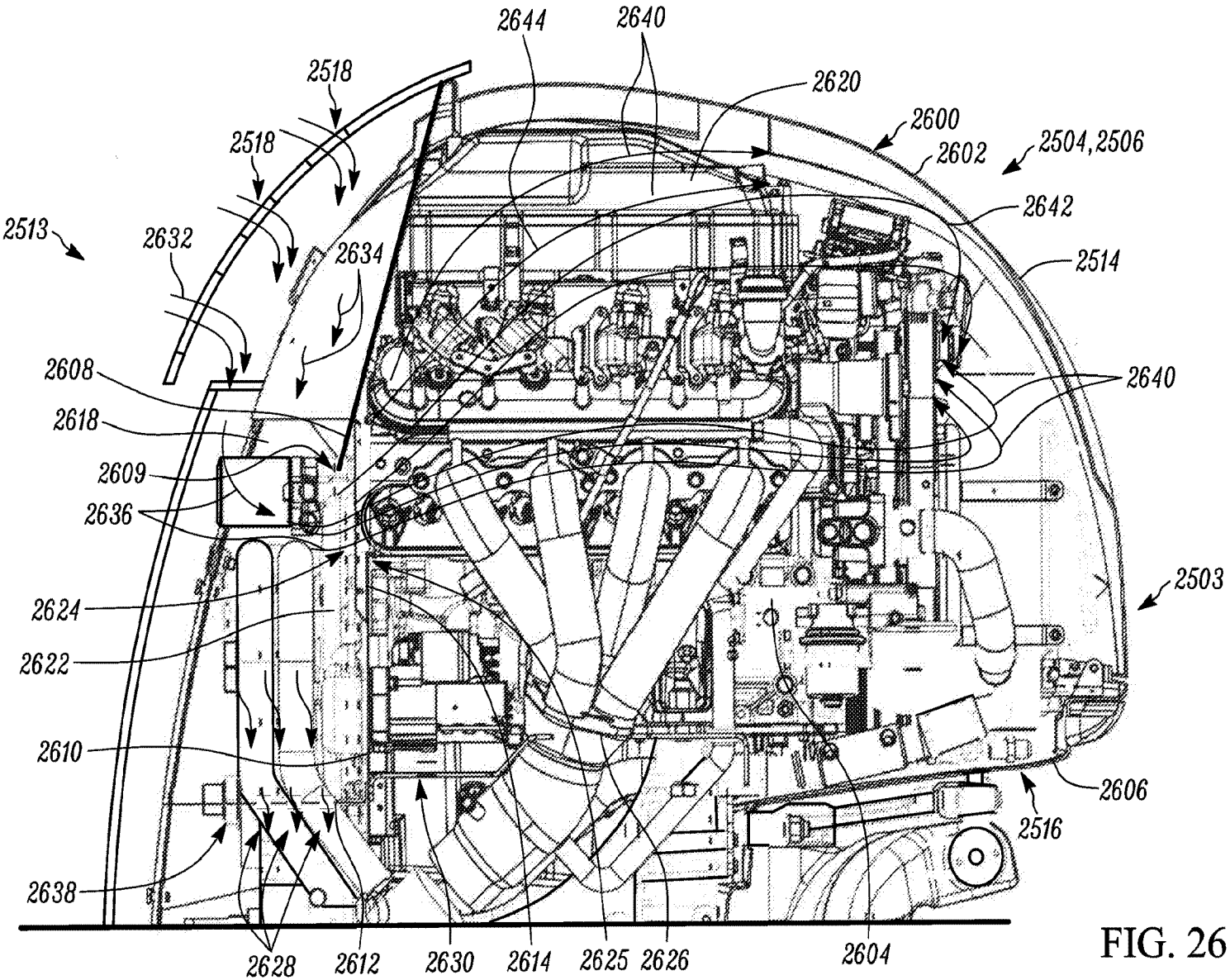
FIG. 26 is a right side elevation cutaway view of a top (or powerhead) portion of the outboard motor of FIG. 1, with a portion of the cowling system removed or sectioned so as to reveal at least some internal components of the outboard motor.
Figure 27:
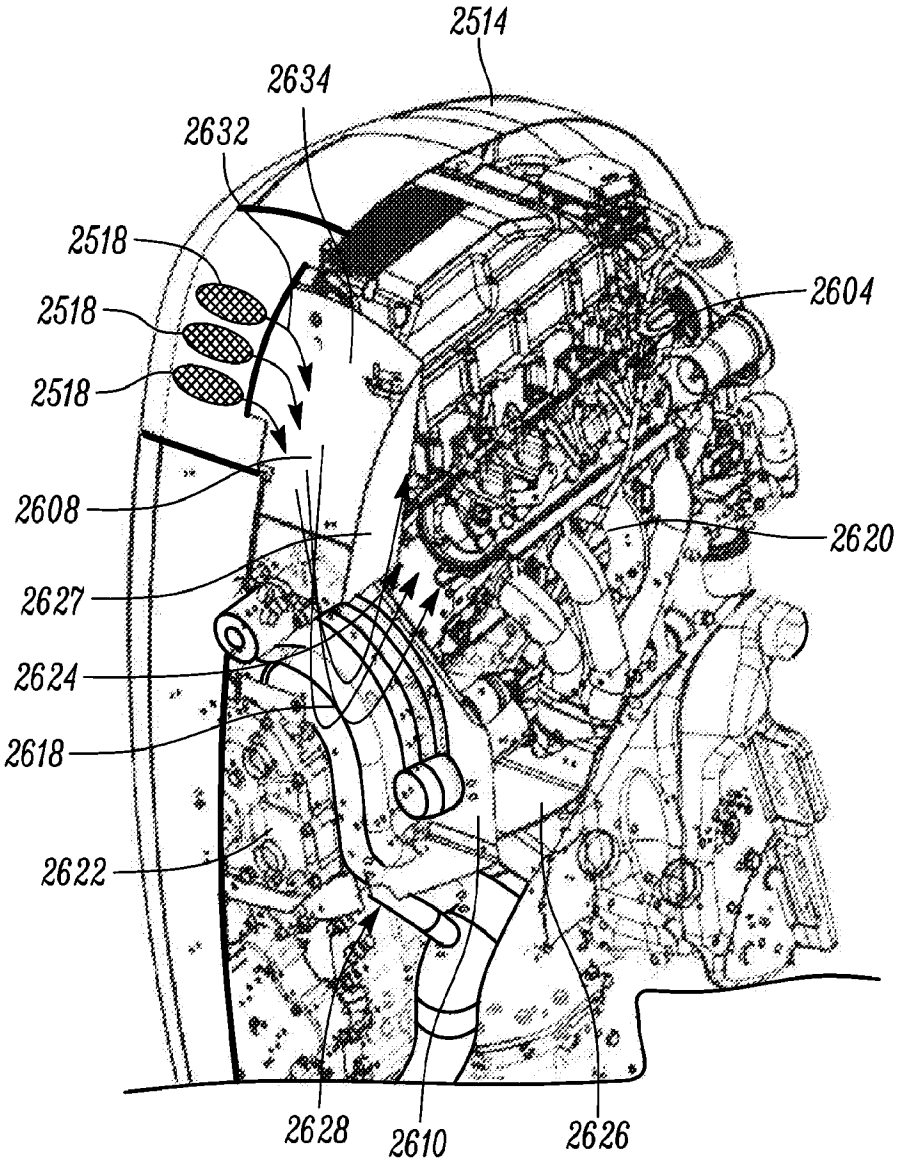
FIGS. 27 and 28 respectively are rear perspective (¾) and front perspective (¾) cutaway views of the top (or powerhead) portion of the outboard motor already shown in FIG. 2 (or substantially the same as that shown in FIG. 2)
Figure 28:
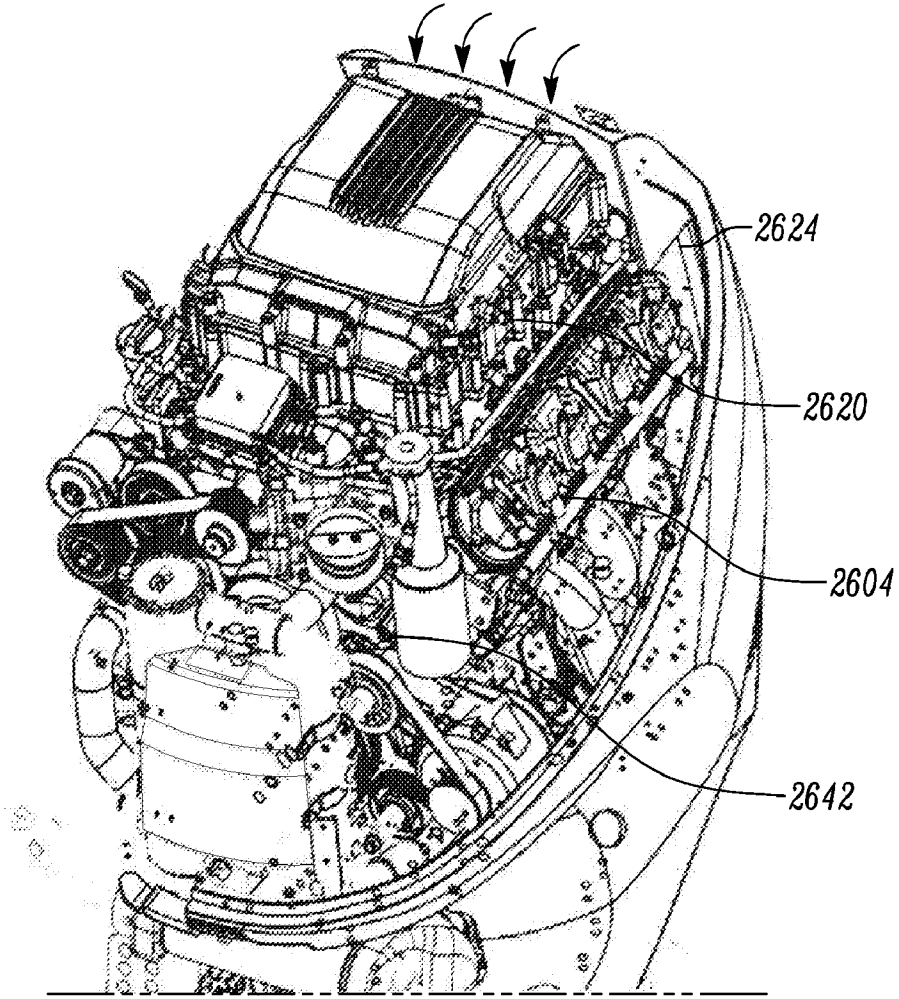

Turning to FIGS. 26, 27, and 28, a side elevation cutaway view, rear perspective cutaway view (or rear ¾ view), and front perspective cutaway view (or front ¾ view), respectively, of a portion of the outboard motor 2500 of FIG. 25 generally corresponding to the upper portion 2506 of the outboard motor and also referred to as a "powerhead" of the outboard motor are shown. For simplicity of discussion, FIG. 26 will be particularly referred to in the discussion below except where particular details of interest are particularly evident from one or more of FIGS. 27 and 28 as mentioned below, and it should be understood that the discussion below is equally pertinent to FIGS. 27 and 28. Further in addition to FIGS. 26, 27, and 28, an additional top view of the upper portion 2506 of the outboard motor 2500 is provided in FIG. 29, which differs from the views of FIGS. 26, 27, and 28 insofar as the upper portion 2506 is shown with the upper cowl 2514 (or a Helmut of the cowling 2504) removed.

FIG. 26 particularly shows portions of the cowling 2504, particularly portions of the upper cowl 2514, to be removed (sectioned off) so as to reveal several internal components of the outboard motor 2500 (that is, FIG. 26 can be considered a view of the powerhead with section cowl). Among other things, FIG. 26 shows that the cowling 2504 includes an outer (exterior) cowling 2600 that forms the outer housing of the upper portion 2506 of the outboard motor 2500. An upper portion 2602 of the outer cowling 2600 extends upward and over an internal combustion engine 2604 of the outboard motor 2500 and corresponds to (or forms part of) the upper cowl 2514. Further, a lower portion 2606 of the outer cowling 2600 extends underneath the engine 2604 and corresponds to (or forms part of) the lower cowl 2516.

In addition to the outer cowling 2600, the cowling 2504 further includes several interior cowling portions that are positioned/extend within the interior of the outer cowling. More particularly as shown, the interior cowling portions include an upper divider plate 2608 that extends within the interior of the outer cowling 2600, rearward of the engine 2604, downward from the upper portion 2602, to a location 2609 beneath (in this example, just beneath) the engine 2604 (and behind the engine). Further, the interior cowling portions also include a lower divider plate 2610 that is located beneath (and behind) the engine 2604. As shown in FIG. 26, the lower divider plate 2610 has a first section 2612 that extends horizontally inwardly (forwardly) from a rear surface of the upper cowl 2514, and then a second section 2614 that extends vertically upward from a front end of the first section 2612, up to a location beneath the location 2609 and beneath the engine 2604. By virtue of the upper and lower divider plates 2608 and 2610, respectively, an interior cavity within the cowling 2504 (and particularly within the upper cowl 2514) is substantially divided into two major subcavities, namely, a first cowling section 2618 and a second cowling section 2620. As shown, the second cowling section 2620 is located frontward of the first cowling section 2618, and the engine 2604 is situated within the second cowling section 2620. By contrast, a transmission 2622 is situated within the first cowling section 2618.

Although the upper and lower divider plates 2608 and 2610 serve to substantially divide the interior cavity of the cowling 2504 into the first and second cowling sections 2618 and 2620, those subcavities are still in fluid communication with one another by way of one or more intermediate air flow passages or spaces or openings 2624 that exist between the bottom edges of the upper divider plate 2608 at the location 2609 and an upper edge of the lower divider plate 2610, which is shown to be located at a location 2625. As will be discussed further below, the openings 2624 allow for air entering the first cowling section 2618 to proceed into the second cowling section 2620, so that the air can be received and utilized by the engine 2604 (or throttle) within that second cowling section. That is, the openings 2624 are air transfer openings from the first cowling section 2618 into the second cowling section 2620 allow for airflow to the engine 2604.

Figure 29:
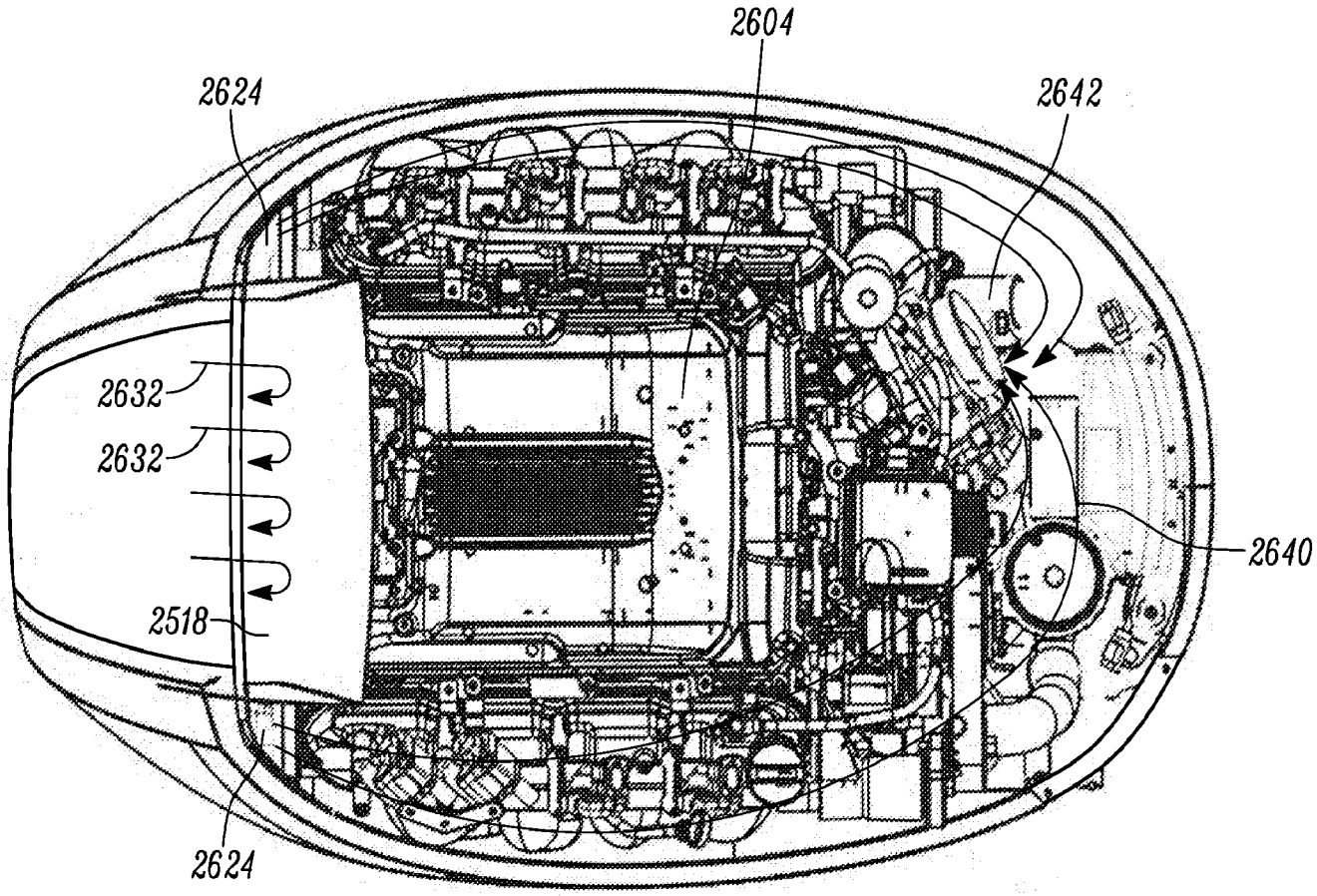
FIG. 29 is a further top view of the top (or powerhead) portion of the outboard motor of FIG. 1, with a portion of the cowling system removed so as to reveal at least some internal components of the outboard motor.

It should further be noted that, in relation to the openings 2624, in the present embodiment there are two such openings as is evident particularly from FIG. 29. More particularly as shown, the openings 2624 are located toward each of the left and rights sides of the cowling 2504. Further, as is evident particularly from FIG. 27, the openings 2624 in the present embodiment are actually formed at least partly between bottom edges (at the location 2609) of flap portions 2627 of the upper divider plate 2608 that extend at least partly in the rearward direction and upper edges of the lower divider plate 2610. In alternate embodiments, however, only one of the openings 2624 (e.g., one side only) or more than two of the openings can be present.

In addition to the above, the cowling 2504 further includes an additional lower cowl plate 2626 that extends forward from the lower divider plate 210. More particularly as shown, the lower cowl plate 2626 is generally at the same level (albeit somewhat vertically higher than) the first section 2612, and extends generally beneath the engine 2604 and forms a floor of the second cowling section 2620. Because the first section 2612 of the lower divider plate 2610 and the lower cowl plate 2626 respectively form the floors of the first and second cowling sections 2618 and 2620, respectively, any water entering the first and second cowling sections naturally due to gravity will eventually tend to fall to those structures. So that water reaching those structures can exit the outboard motor, the first section 2612 includes water outlet passages 2628 and the lower cowl plate 2626 also includes a water outlet passage 2630.

Referring still to FIG. 26, a path of the airflow thru the first and second cowling sections 2618 and 2620 is such that water entrained/entrapped in the air entering the outboard motor is substantially or entirely eliminated prior the air reaching the engine 2604 (or throttle associated therewith). As shown by arrows 2632, first the airflow enters thru the air inlets 2518 provided at the uppermost portion of the upper cowl 2514 of the cowling 2504, which can also be referred to as the Helmut (in at least some embodiments, the Helmut can be a removable portion of the cowling, and can correspond, for example, the upper portion 2602 of the cowling). The air inlets 2518 particularly are positioned as high as possible from the anticipated surface of the ocean or other body of water in which the outboard motor will be operated, so as to minimize the amount of water that will likely enter into the air inlets. By virtue of the positioning and orientation of the air inlets 2518 (which again are air passages that are downwardly directed into the first cowling section 2618), air particularly enters the cowling 2504 in a downwardly manner. In at least some embodiments, the air inlets 2518 are configured so that air entering air inlets needs to flow not only downward but also forward so as to enter the air inlets.

Further as shown by arrows 2634, the air entering the air inlets 2518 is directed downwardly by the steeply vertical surface of the upper (air) divider plate 2608, which as discussed above separates the first cowling section 2618 and the second cowling section 2620 (the upper divider plate 2608 can also be considered to form part of the first cowling section). The downwardly directed air then reaches the lower divider plate 2610 (which also serves to divide the first and second cowling sections 2618, 2620, and which can also be considered as part of the first cowl section), and that air is turned upwardly in order to escape into the second cowling section 2620 by way of the opening(s) 2624, as represented by arrows 2636.

As discussed, the air passing through the first cowling section 2618 will often if not typically include entrained/entrapped water. Due to the downward direction of the air flow within the first cowling section 2618, the heavier water droplets continue downwardly thereby are collected at the first section 2612 of the lower divider plate 2610 are drained from the first cowling section as indicated by arrows 2638 and ultimately out of the outboard motor via the water outlet passages 2628 provided thereon (the water outlet passages provided in the lower portion of the first cowling section 2618). Since the first cowling section 2618 encloses the transmission 2622, and since exposure to water is not a problem for the transmission (particularly water flowing around it), this water flow through and out of the first cowling section 2618 is an acceptable and satisfactory manner of handling the water.

As mentioned, the air entering the first cowling section 2618 eventually flows into the second cowling section 2620 via the openings 2624. In the present embodiment, two of the openings 2624 are provided, one on each side of the cowling 2504 (again see FIG. 29), albeit in other embodiments there could be more than two such openings or there could only be a single opening (e.g., one opening at only one side of the cowling). Upon entering the second cowling section 2620 where the engine 2604 resides, the air then flows forward and upward over and around the engine 2604 as represented by arrows 2640 toward a throttle 2642 (or air entrance into the engine), where it is then ingested into the engine.

Although much (if not largely or substantially all) of any water entrapped/entrained in the air entering the first cowling section 2618 leaves the engine via the water outlet passages 2628, some remaining water droplets can succeed in passing thru the first cowling section 2618. Even though this can occur, these water droplets nevertheless tend to exit out of the second cowling section 2620 by falling to the lower cowl plate 2626 and exiting from the water outlet passage 2630 before those water droplets pass by the engine 2604, or at least before those water droplets reach the throttle 2642. This process of the water droplets tending to exit the second cowling section 2620 before reaching the engine 2604 (or the throttle 2642) occurs partly because the water, in order to proceed from the openings 2624 to the throttle 2642, not only must pass over a relatively long distance between the openings 2624 and the throttle 2642, but also must do so even though the air is moving generally upward at this time over this distance.

Although water is eliminated from the outboard motor 2500 for the reasons discussed above, in the present embodiment there are other reasons as well. In particular, the cross-sectional areas of the first and second cowling sections 2618 and 2620 (as well as the openings 2624) are set in a manner that causes variations in the velocity of the air flow within the first and second cowling sections, which further aids in water elimination. More particularly, in the present embodiment, a first cross-sectional area of the flow path within the first cowling section 2618 (e.g., a first cross-sectional area taken normal to one of the downwardly-directed arrows 2634) is smaller than a second cross-sectional area of the flow path within the second cowling section 2620 (e.g., a second cross-sectional area taken normal to a first arrow 2644 of the arrows 2640). The openings 2624 can, in combination with one another, also have a total cross-sectional area equal or similar in size to that of the first cross-sectional area of the first cowling section (or alternatively some other size can be chosen). Given such dimensions, the air flow downward through the first cowling section 2618 occurs at a substantially higher velocity than the air flow forward and upward through the second cowling section 2620. This facilitates water elimination since, in the first cowling section, the water droplets in the downwardly-flowing air have a relatively high momentum such that, even though the air ultimately changes direction so as to proceed through the openings 2624, the water droplets tend to continue on downward toward the water outlet passages 2628.

Further, in the second cowling section 2620, the lower velocity of the air flow due to the larger cross-sectional area constitutes a further reason as to why the water drops are encouraged to fall out of the slower moving airstream, since this better allows the water to fall to the bottom of the second cowling section 2620 and thereby be drained through the water outlet passage (or passages) 2630 in the lower cowl plate 2626. The throttle 2642 in the second cowling section 2620 (within which is situated the engine 2604) is positioned high and as far (as far forward) as practical, away from the first cowling section 2618, so as to allow as much time and distance as possible for water to fall out of suspension with the air. By way of these features of the two-section cowling system, air and water are separated to the greatest extent possible to provide dry air to the engine and return liquid water to the ocean or other body of water.

In addition to the above-discussed features, as mentioned in relation to FIG. 25 in at least some embodiments the outboard motor 2500 also includes optional side air inlets 2520 and associated covers 2522. The side air inlets 2520 and covers 2522 particularly are configured so that air flowing in through the side air inlets necessarily flows in a forward direction as indicated by arrow 2524 in FIG. 25. Further, given the location of the side air inlets 2520, the side air inlets connect (open) directly into the second cowling section 2620 (as shown in FIG. 26) and, to reach the throttle 2642, the air flow must also be upwardly directed within the second cowling section 2620.

The side air inlets 2520 can be used to govern air flow entry for various purposes, depending upon the embodiment or circumstance (in some cases, there is electronic control of the opening or closing of the side air inlets, for example, by controlled opening or closing of the covers). Among other things, the flow of air via the side air inlets 2520 is used to control temperature or to control air inflow losses (or to provide additional air for use by the engine 2604). Because air flowing in via the side air inlets 2520 can only reach the throttle 2642 if the air is moving forward and upward, water entrained/entrapped in (or otherwise associated with) that air again tends not to reach the throttle. This is particularly true since, during operation of the outboard motor 2500 in connection with a marine vessel, the motor and vessel are already moving forward such that air is passing rearward in relation to the motor, and thus the air entering the side air inlets 2520 essentially has to completely change direction for it to enter in via the side air inlets.

Water Pump System

Figure 30:
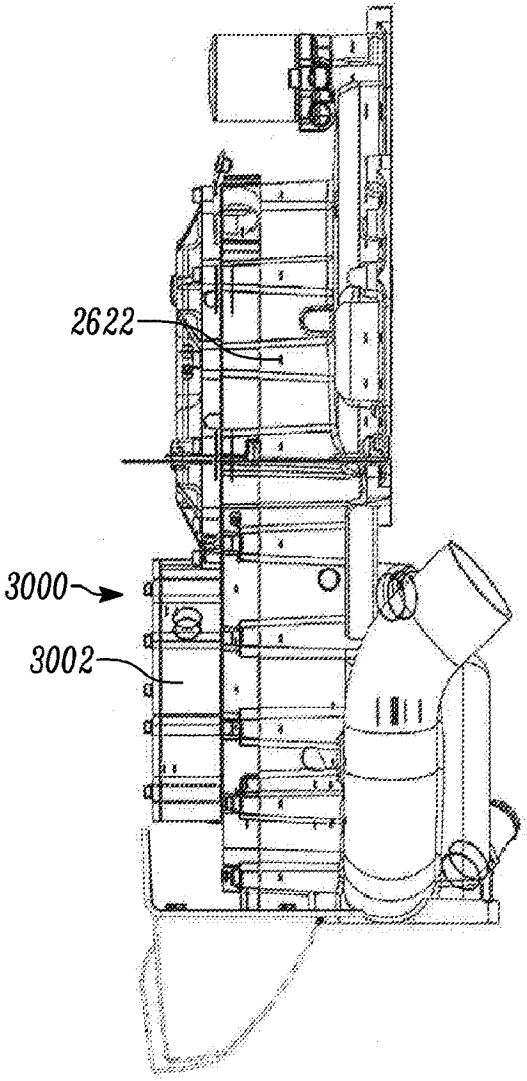
FIG. 30 shows an example side elevation view of a transmission assembly with an integrated water pump.
Figure 31:
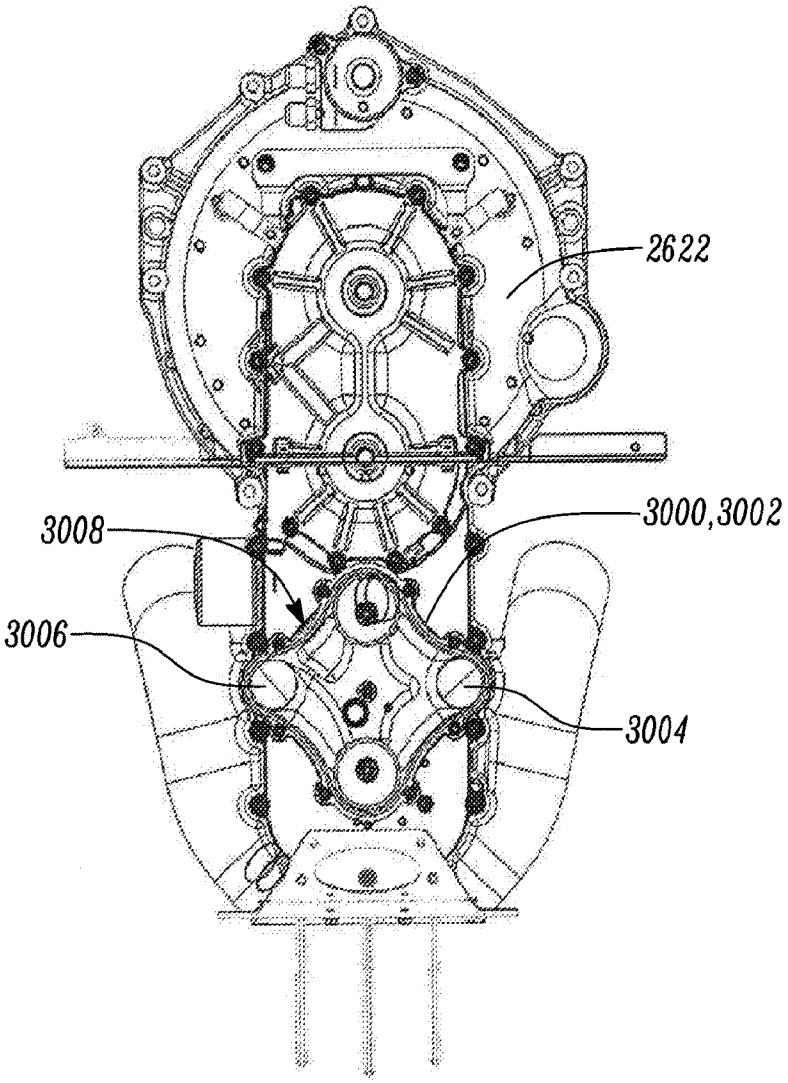
FIG. 31 shows an example rear elevation view of the transmission assembly and integrated water pump of FIG. 30.
Figure 32:
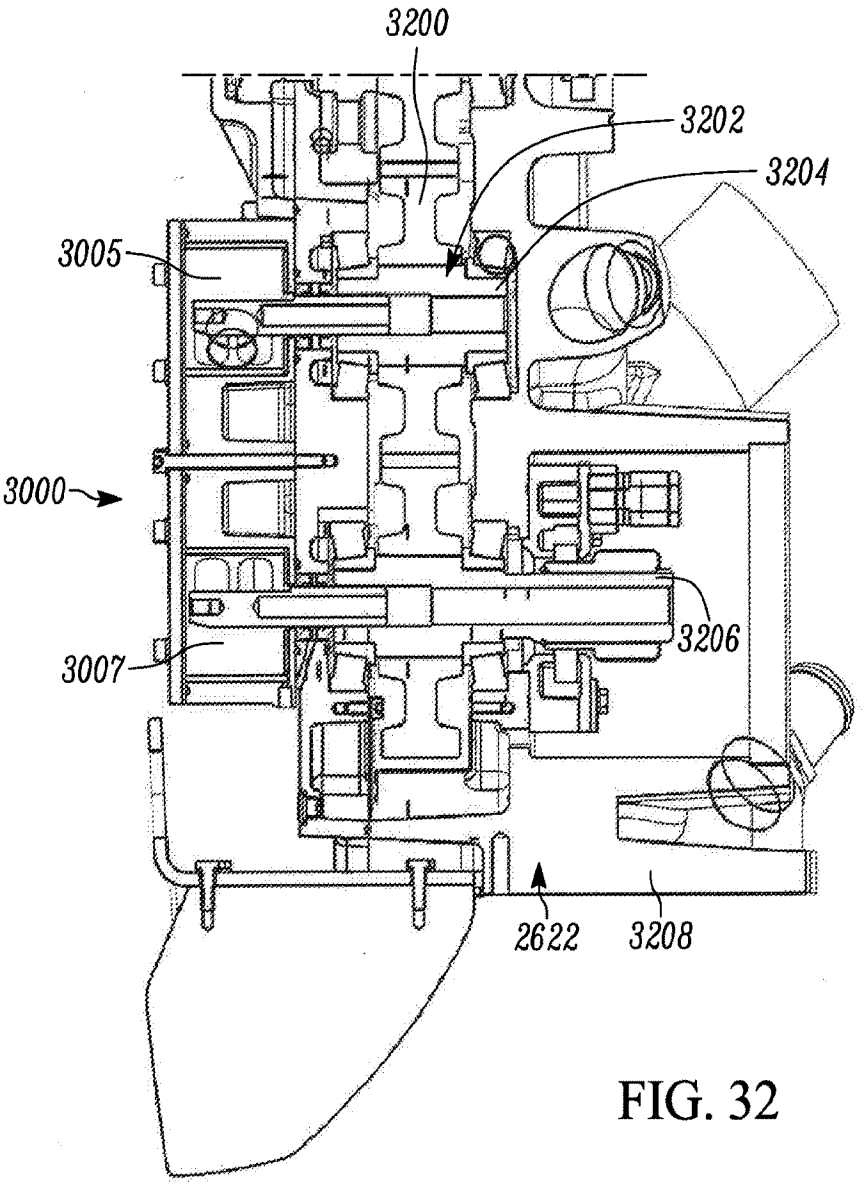
FIG. 32 is a right side cross-sectional cutaway view showing portions of the transmission assembly and integrated water pump of FIGS. 30 and 31, particularly, the water pump and lower portions of the transmission assembly with which the water pump is integrated.
Figure 33:
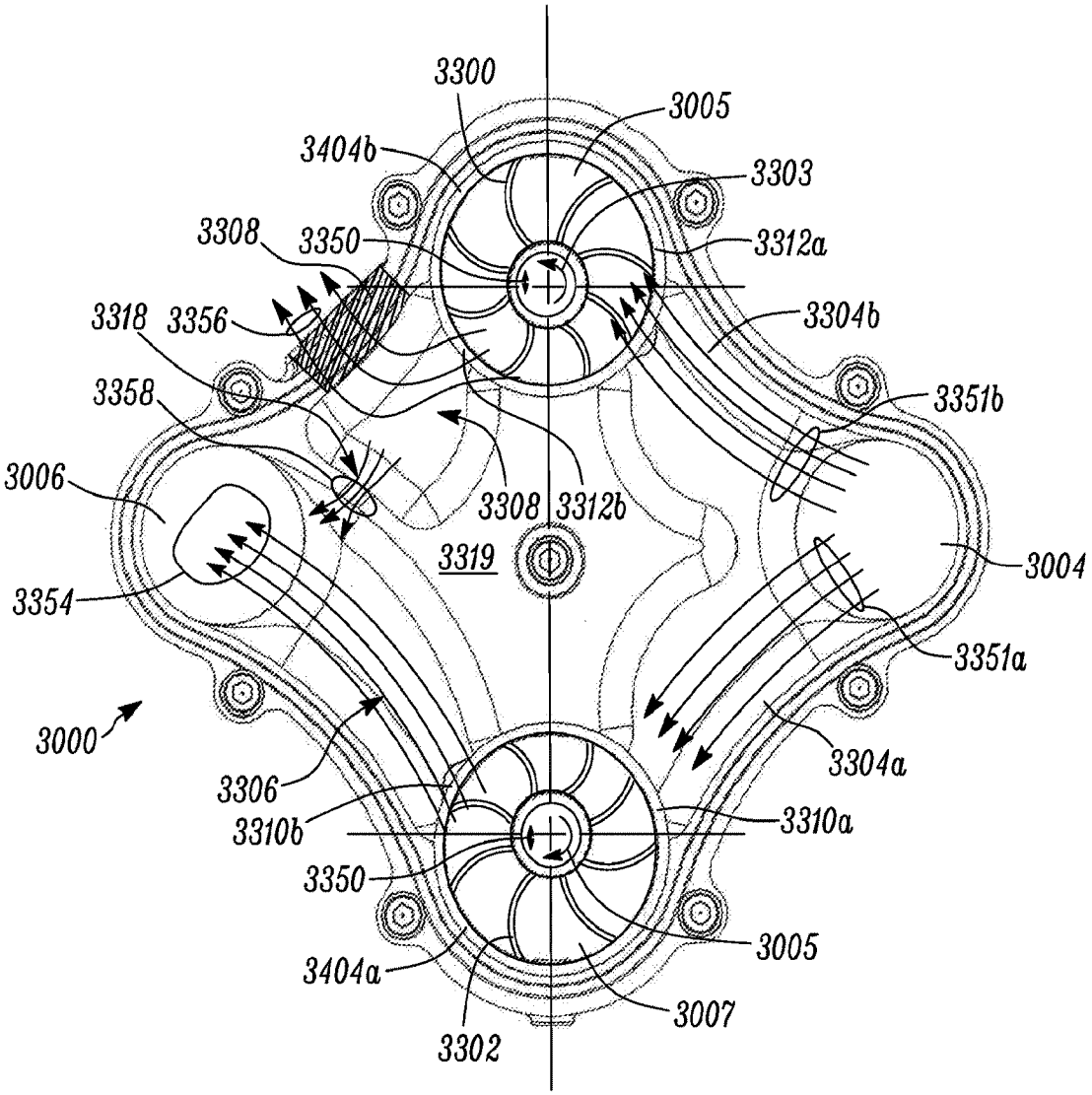
FIG. 33 is a rear cross-sectional view of the water pump of FIGS. 30, 31, and 32.

In at least some embodiments encompassed herein, and particularly in the outboard motor 2500 of FIG. 25, the outboard motor also employs an improved water pump system or arrangement, in which a water pump assembly is integrated with the transmission 2622 of the outboard motor. In particular, in the present embodiment, although an engine mounted circulation pump (such as that provided with automotive type engines) is used, the outboard motor 2500 also has a sea pump that is integrated into the transmission 2622 for compactness and durability by the elimination of external plumbing and rubber belt drive systems. As described in further detail below, FIGS. 30 and 31 show a water (sea) pump assembly (which can also generally be considered a water pump) 3000 integrated into the transmission 2622 (which can also be considered a transmission assembly) without any external plumbing. The combination of the transmission 2622 and water pump assembly 3000 shown in FIGS. 30 and 31 can be considered overall as forming a transmission and water pump assembly. Further, FIG. 32 shows a cross-sectional cutaway view through the transmission 2622 in proximity to the water pump assembly 3000, and further depicts a gear train 3200 and a shaft system 3202 that drives the twin counter rotating impellers. FIG. 33 further reveals the details of the counter-rotating impellers acting in conjunction with each other, and FIG. 34 is an exploded view of the water pump assembly to reveal the components of the water pump assembly that allow the water pump assembly to operate.

As already noted, FIGS. 30 and 31 illustrate the water pump assembly 3000 and transmission 2622 in accordance with the present embodiment. As shown, the water pump assembly 3000 is integrated into the transmission 2622 without any external plumbing (e.g., pipes, fixtures, etc.). The water pump assembly 3000 includes a water pump body or housing 3002 which generally houses (e.g., within its interior) components or structure of, or associated with, the water pump assembly as described and illustrated further herein. The water pump assembly 3000, and more particularly the housing 3002, includes an inlet or inlet port 3004 and an outlet or outlet port 3006 as well as an additional outlet port 3008, all of which are discussed further below. Additionally referring to FIG. 32, the cross-sectional cutaway view shown therein is particularly a cross-sectional view taken along a center vertical axis extending through the transmission 2622 (which therefore proceeds through the centers of the shafts within the transmission) in proximity to the water pump assembly 3000. FIG. 32 further depicts the gear train 3200 and shaft system 3202 that drives the water pump assembly 3000, and particularly its twin counter rotating impellers, as shown and described further herein, in accordance with embodiments of the present disclosure. As shown, in one orientation, the water pump assembly 3000 includes an upper water pump 3005 comprising an upper one of the twin impellers, and a lower water pump 3007 comprising a lower one of the twin impellers. Further, the shaft system 3002 is shown to comprise a first or driven shaft 3204 and a second or output shaft 3206. The transmission 2622 is housed by a transmission housing 3208.

Figure 34:
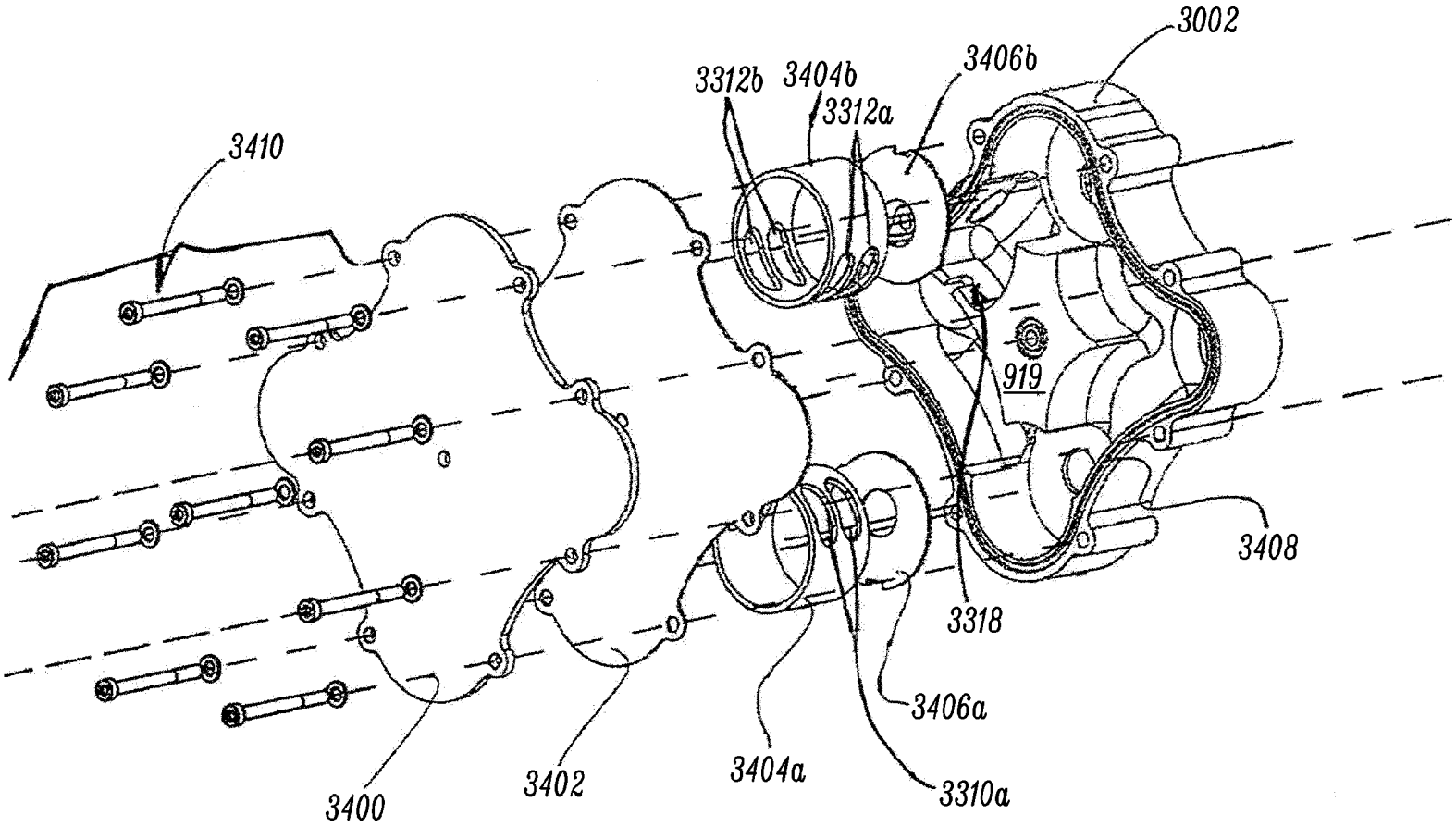
FIG. 34 is an exploded view of the water pump of FIGS. 30, 31, 32, and 33.

Turning to FIGS. 33 and 34, structural and functional details of the water pump assembly 3000 are revealed and illustrated. As illustrated in FIG. 33, the upper water pump 3005 of the water pump assembly 3000 particularly includes an impeller structure (or simply impeller) 3300 and the lower water pump 3007 of the water pump assembly 3000 particularly includes an impeller structure (or impeller) 3302. As already noted above, in accordance with the present embodiment, the impellers 3300 and 3302 are counter-rotating impellers acting in conjunction with each other. More particularly as shown in FIG. 34, the water pump assembly 3000 includes the water pump housing 3002, along with a cover plate structure 3400 (e.g., a cover plate), a wear plate structure 3402 (e.g., an outer wear plate), a plurality of ported liner structures 3404*a* and 3404*b*, inner wear plates 3406*a* and 3406*b*, and a seal structure 3408 (e.g., an o-ring seal), which are fastened or otherwise secured by way of fasteners 3410, which in this example include eight assembly screws. With respect to water pump orientation and operation, as seen in FIGS. 33 and 34 (and particularly FIG. 33), both of the two counter-rotating impellers 3300 and 3302 are utilized for the water pump assembly 3000 (which again is a sea pump) in the outboard motor 2500. In contrast to conventional outboard motors, the outboard motor 2500 (which for example can be, but is not limited to being, a large outboard motor capable of high levels of power output, such as 557 horsepower) includes both a sea pump and a circulation pump (albeit in other embodiments of outboard motors, the outboard motors only have sea pumps in the gear case or elsewhere that push water through the outboard motor power head).

Further with respect to FIG. 33, as indicated by an arrow 3303, in the present embodiment the impeller 3300 rotates in a counterclockwise rotating direction and additionally, as indicated by an arrow 3305, the impeller 3302 rotates in a clockwise rotating direction. Also in accordance with the present embodiment, each of the impellers 3300, 3302 is eccentrically offset from a respective center axis by a distance 3350. Further, as is normally done with an impeller, each of the impellers 3300 and 3302 is operated in a respective ported liner. More particularly, the impeller 3300 is operated in the ported liner 3404*b* and the impeller 3302 is operated in the ported liner 3404*a*, and each of the ported liners serves to allow water into and out of a respective pump chamber of the respective impeller. More specifically, the ported liner 3404*a* includes inlet and outlet ports 3310*a* and 3310*b*, respectively, and the ported liner 3404*b* includes inlet and outlet ports 3312*a* and 3312*b*, respectively. Both of the inlet ports 3310*a* and 3312*a* are connected to an intake tube (or port) 3004 of the water pump assembly 3000, which serves as a common water intake passage in order to consolidate intake plumbing.

More particularly, inlet port 3310*a* is connected to the intake tube 3004 by a channel 3304*a* extending within the water pump 3000, and inlet port 3312*a* is connected to the intake tube 3004 by a channel 3304*b* also formed within the water pump assembly 3000. By virtue of the channels 3304*a* and 3304*b* and inlet ports 3310*a* and 3312*a* (that is, both inlet ports), both of the two impellers 3300 and 3302 serve to pull sea water into the water pump (water pump system or assembly) 3000. Some water arriving via the intake tube 3004 proceeds via a water inlet path 3351*a* via the channel 3304*a* to the lower water pump 3007 and some water proceeds via a water inlet path 3351*b* via the channel 3304*b* to the upper water pump 3005. Thus, the upper and lower water pumps 3005 and 3007 operate, respectively by virtue of rotation of the respective impellers 3300 and 3302, to receive sea water via the same shared inlet arrangement (albeit there are two distinct water inlet paths 3351 and 3351*b* corresponding to the respective channels 3304*a* and 3304*b*) and particularly the same intake duct (intake tube 3004).

In contrast to the shared water input for each of the water pumps 3005 and 3007, the outlet sides of the water pump assembly 3000 are generally divided from one another. The lower water pump 3007 with the impeller 3302 particularly drives water into and through a low pressure passage 3306 that leads to the outlet port (or tube or passage) 3006, which is particularly suited for providing high volume—low pressure flow through a heat exchanger of the outboard motor 2500 (e.g., such as the heat exchanger 1912 already discussed above), so as to maximize mass flow of sea water thru the heat exchanger and thereby enhance its efficiency. Although not shown, it should be appreciated that the outboard motor 2500 will include suitable connector(s) linking the outlet port 3006 to the heat exchanger to communicate high volume—lower pressure water 3354 from the water pump assembly 3000 to the heat exchanger.

By contrast, the upper water pump 3005 with the impeller 3300 particularly drives water into a high pressure passage 3308 that leads to the outlet port (or tube or passage) 3008, which is particularly suited for providing higher pressure (and lower volume) water flow output. In particular, higher pressure—lower volume water 3356 that is output at the outlet port 3008 in the present embodiment is directed so as to force water flow through the exhaust headers (left and right) and also to force water flow through an intercooler (e.g., such as the intercooler 1922 already discussed above) of the outboard motor 2500 so as to cool the intake air charge. Again, although not shown, it should be appreciated that the outboard motor 2500 will include suitable connector (s) linking the outlet port 3008 to the exhaust headers and intercooler for this purpose. Therefore, in the present embodiment, the water pump assembly 3000 serves to provide both functions of outputting the high volume—lower pressure (high flow—low pressure) water 3354 and outputting the higher pressure—lower volume (low flow—high pressure) water 3356, by way of the two counter-rotating impellers 3300 and 3302 joined on the intake side but separated on the outlet side for distinctly different purposes.

Although in the present embodiment the outlet sides of the water pump assembly 3000 (corresponding to the upper and lower water pumps 3005 and 3007) are generally separate, it should further be appreciated from FIG. 33 that the two outlet sides are not entirely separate. In particular, a connective passing structure or passage 3318 is included that allows communication of water between the low pressure passage 3306 and the high pressure passage 3308 (and thus effectively between the outlet port 3006 and the outlet port 3008). The connective passage 3318 is provided so as to allow the higher pressure water exiting the outlet port 3008 to spill into outlet port 3006, thereby adding to the flow through the heat exchanger if required. Also if either of impellers 3300 or 3302 happen to stop working normally or provide less than desired amounts of water flow, the connective passage 3318 would or can allow water flow between the passages 3306 and 3308. Thus, the connective passage 3318 allows for water cooling of each of the devices cooled by water flow from each of the outlet ports 3006, 3008 (e.g., all of the heat exchanger, exhaust headers, and intercoolers) to continue, at least at reduced rates, since water can continue to keep flowing out of each of the outlet ports 3006, 3008, and the connective passage accordingly allows for a "return home" feature due to the two impeller redundancy (that is, either of the impellers is to redundant with respect to the other, at least to some extent, and can direct water to all of the devices being cooled via water flow through both of the outlet ports 3006 and 3008).

In addition to the above features, it should be appreciated that the arrangement of the impellers 3300 and 3302 and other components of the water pump assembly 3000 includes several structural features that are noteworthy and advantageous in various respects. First, the arrangement of the impellers 3300 and 3302 relative to one another is advantageous insofar as the impellers are coplanar in their arrangement. That is, a single plane perpendicular to each of the central axes of rotation of each of the impellers 3300 and 3302 is a plane along which each of the impellers is located. Thus, the impellers 3300, 3302 are compactly positioned, in contrast to a design in which the impellers would be at different positions along their axes of rotation (that is, a design in which the impellers would be "stacked").

Additionally as shown in FIG. 33, it can be noted that the impellers 3300, 3302 are separated from one another by an intermediate structure 3319, and also that the inlet port 3004 and outlet port 3006 are separated from one another by the intermediate structure 3319. Accordingly, the inlet port 3004, outlet port 3006, upper water pump 3005 (with the impeller 3300), and lower water pump 3007 (with the impeller 3302) are arranged generally in the shape of a diamond, with each of those structure positioned at a respective vertex of the diamond (albeit the outlet port 3008 is positioned in between the two positions occupied by the outlet port 3006 and the upper water pump 3005).

It should be appreciated that the present embodiment of water pump assembly 3000 with the above-described design features results in a very compact, durable, redundant, sea water pump to facilitate high water flows and high pressure flows thru multiple devices simultaneously. Also, among other things, absence of a rubber belt to drive the pump particularly can improve durability, and the arrangement also is advantageous in terms of affording a lower parts count. That said, the present invention is intended to encompass numerous variations and alternate embodiments in addition to the water pump assembly 3000. For example, although the intermediate structure 3319 (and water pump assembly 3000 more generally) is shown to take one particular form in this embodiment, in other embodiments the intermediate structure (and water pump assembly overall) can take on numerous other shapes. For example, in the present embodiment a curved surface 3321 of the intermediate structure 3319 is elongated so as to extend up to and from the connective passage 3318, in another embodiment, the curved surface can be shortened so that the overall intermediate structure 3319 is substantially symmetrical. In such an embodiment, it would be possible for all water directed by each of the impellers to flow out the outlet port 3306 (and the outlet port 3308 would no longer be present).

Vapor Separating Tank (VST)

Turning now to FIG. 35, in at least some embodiments encompassed herein, including that of the outboard motor 2500 of FIG. 25, the outboard motor includes a fuel vapor suppression mechanism or VST system that eliminates (or substantially or largely eliminates) the need to control the volume of the working fuel chamber of the internal combustion engine 2604 by pressurizing the working fuel to a pressure above the "vapor pressure" of the fuel that can be reached during the operation of the engine. In at least some such embodiments, the VST system includes a primary pump that is utilized to lift fuel and then pressurize the fuel to a primary pressure (e.g., about 10 psi) so as to supply a secondary, high pressure, pump with liquid fuel that has been pressurized in order to prevent fuel vaporization. Additionally, in at least some such embodiments, a working volume internal to the VST system is maintained at the primary pressure as controlled with a pressure regulator valve which discharges fuel back to the fuel inlet in the event that the pressure at the output of the primary pump becomes too high. Also, in at least some such embodiments, the working volume is provided by a fuel filter and mixer. Thus, fuel is obtained from a fuel source (e.g., a fuel tank located on a marine vessel such as the marine vessel 100 to which the outboard motor 2500 is attached), pressurized to a regulated valve, circulated through the fuel filter and thereby supplied to the high pressure pump (secondary circuit).

Additionally, in at least some such embodiments, upon reaching the high pressure pump, the high pressure pump in turn pressurizes the filtered fuel to a higher, regulated pressure (e.g., regulated at 65 psi) that is suitable for the internal combustion engine 2604 (e.g., suitable for a fuel rail thereof). The high pressure pump also includes at its output (or at a location at the same pressure as its output) a fuel regulator relief valve that allows fuel flow to be directed through a fuel cooler and returned back to the pressurized fuel filter, in the event fuel pressure at the output of the high pressure pump becomes too high. Thus, the function of drawing fuel from the marine vessel (e.g., boat) fuel tank, and filtering the fuel, and pressurizing of the fuel to prevent the formation of air vapors is accomplished with a low pressure primary circuit. Then the supplying of the fuel under elevated pressure regulated to a high or higher level (e.g., 65 psi) that is supplied to the engine fuel rail is accomplished with a high pressure secondary circuit.

Embodiments with VST systems such as those discussed above are advantageous in several respects. First, in such embodiments, both the low pressure primary circuit and the high pressure secondary circuit are contained within the same device (e.g., within a single integrated structure) in order to minimize size and loss. Also, containment of the working fuel volume within the fuel filter (or region in which the filter is present) serves to enhance the simplicity of the VST system. Additionally, in such embodiments in which the high pressure regulator is connected on its discharge side to the control pressure of the primary fuel working volume (e.g., the location of the fuel filter), advantageous operation can result. In particular, such an arrangement does affect the high pressure fuel supply pressure by slight amounts during low fuel flow experienced at idle speeds of the engine 2604. This pressure drift is accounted for by the electronic control unit (ECU) of the engine 2604 at idle operation. Additionally, cooling of the fuel is required at sustained idle in hot environments and is accomplished with a remote fuel cooler that is connected to sea water flowing through the engine cooling heat exchangers. This fuel is pressurized to the primary fuel pressure to enhance the fuel cooling effect and prevent the formation of vapor in the fuel.

Figure 35A:
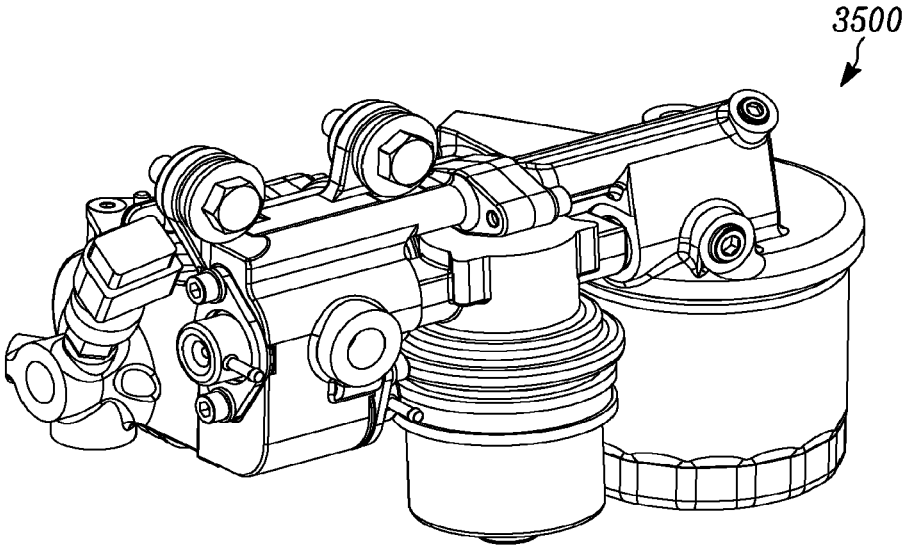
FIGS. 35A and 35B are side perspective views of an example vapor separating tank (VST) system that can be employed in an outboard motor in accordance with an embodiment encompassed herein.
Figure 35B:
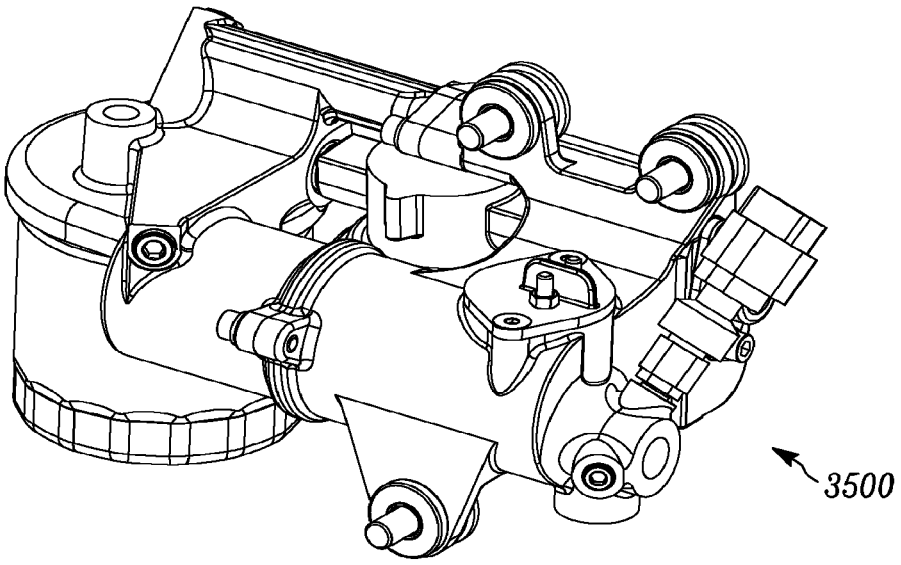

Referring now to FIGS. 35A and 35B, first and second (e.g., respectively right and left) side perspective views are provided of a VST system 3500 that is employed in the outboard motor 2500 of FIG. 25, and that can also be employed in other outboard motors such as the outboard motor 104 of FIG. 1. Additionally referring to FIG. 36, an exploded view is provided of the VST system 3500 to highlight various components thereof. As shown, the VST system 3500 includes a low pressure fuel pump 3600 having an input port 3602 and an output port 3604 and also a cylindrical fuel filter 3606. The cylindrical fuel filter 3606 has a cylindrical container 3608, within which (when the cylindrical fuel filter is fully assembled) is provided a cylindrical fuel filter element 3610, and a cap structure 3612 having an input port region 3614 by which the output port 3604 of the low pressure fuel pump 3600 can be in fluid communication with the interior of the cylindrical fuel filter 3606 and the cylindrical fuel filter element 3610 therewithin (when the VST system is fully assembled). Also, the cap structure 3612 includes a pressure regulator extension 3616 by which the cap structure 3612 can be coupled to a pressure regulator extension 3617 of a fuel regulator assembly 3618 when the VST system is fully assembled.

Further, the VST system 3500 also includes a high pressure fuel pump 3620 having an input end 3622 and an output end 3624. The cap structure 3612 includes output port region 3626 by which the cylindrical fuel filter 3606 can be in fluid communication with an input port associated with the input end 3622 of the high pressure fuel pump 3620 when the VST system 3500 is fully assembled. Additionally when the VST system 3500 is fully assembled, the high pressure fuel pump 3620 is positioned within an orifice 3619 within the fuel regulator assembly 3618 so that the output end 3624 of the high pressure fuel pump is also coupled at least indirectly with the internal combustion engine 2604 (or engine rails) for providing fuel thereto, as discussed in further detail below. Also in the present embodiment, when the VST system 3500 is fully assembled, the fuel regulator assembly 3618 includes first and second pressure regulators 3628 and 3630 that respectively serve as low and high pressure regulators (or vice-versa, depending upon the embodiment). The interior of the cylindrical container 3608 of the cylindrical fuel filter 3606 is coupled to the first pressure regulator 3628 by way of the pressure regulator extensions 3616 and 3617, and the output end 3624 of the high pressure fuel pump 3620 is coupled to the second pressure regulator 3630 in addition to being coupled at least indirectly with the internal combustion engine 2604 (the link between the output end 3624 and the second pressure regulator 3630 is indirect and passes by way of a fuel cooler described below).

Figure 36:
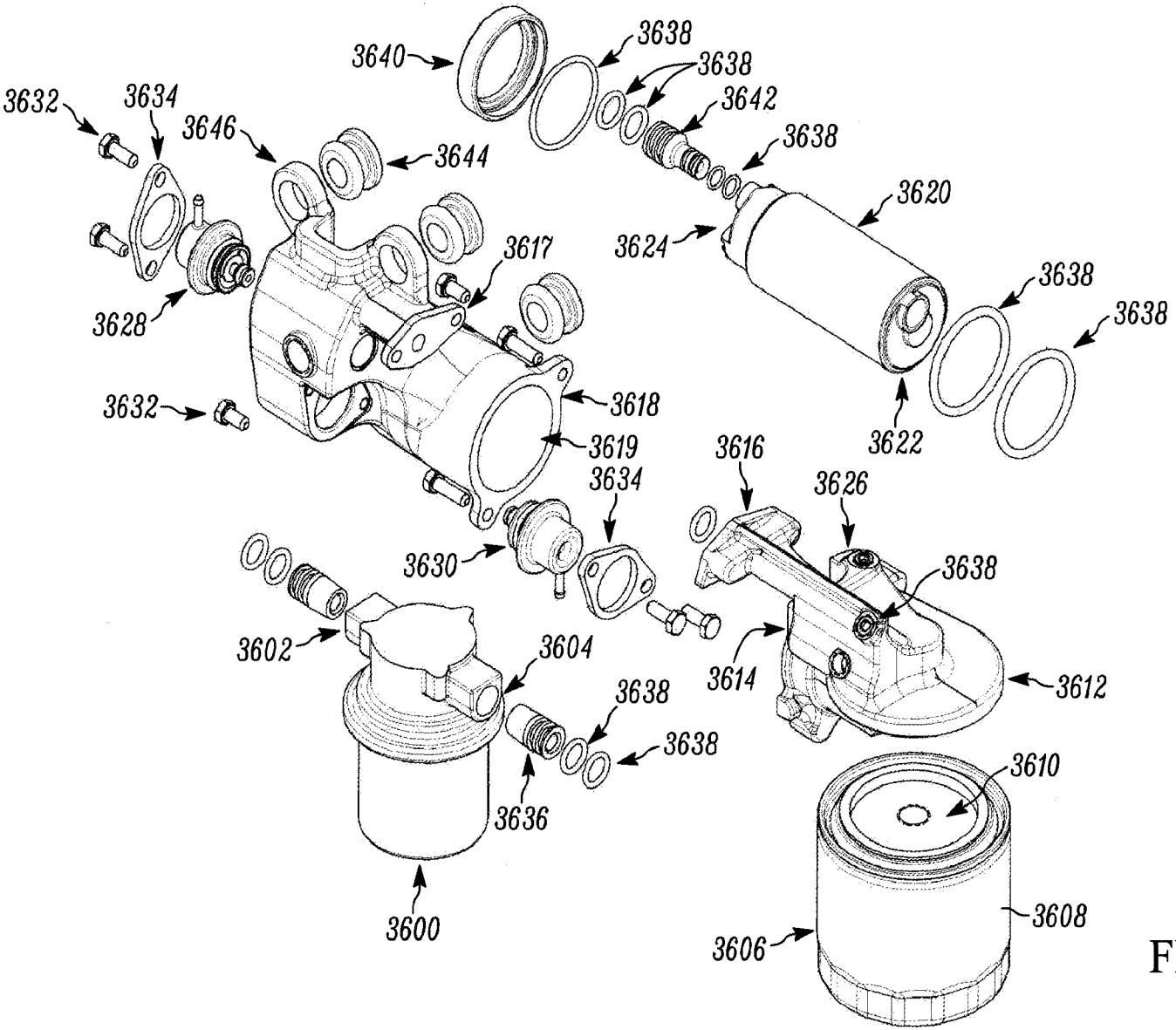
FIG. 36 is an exploded view of components of the VST system of FIGS. 35A and 35B.

Although the VST system 3500 includes, as its primary components, the low pressure fuel pump 3600, cylindrical fuel filter 3606 (having both the cylindrical container 3608 and the cap structure 3612), the high pressure fuel pump 3620, and the fuel regulator assembly 3618, it will be appreciated from FIG. 36 that numerous additional components such as bolts 3632, fuel regulator cover structures (or cover regulators) 3634, plugs 3636, O-rings 3638, sealing rings 3640, fittings 3642, and support fittings 3644, which are configured to fit within complementary support orifices 3646 on the fuel regulator assembly 3618, are also employed to couple the components together and/or provide sealed connections and allow fluid communication between various ones of the input and output ports of the various components. The particular configurations, numbers, and types of components used for such purposes can vary depending upon the embodiment. That said, in the present embodiment, the VST system 3500 is generally intended to be compact and to provide an arrangement that minimizes hoses or coupling links and other parts used for coupling or fastening purposes, and uses many off the shelf components.

Figure 37A:
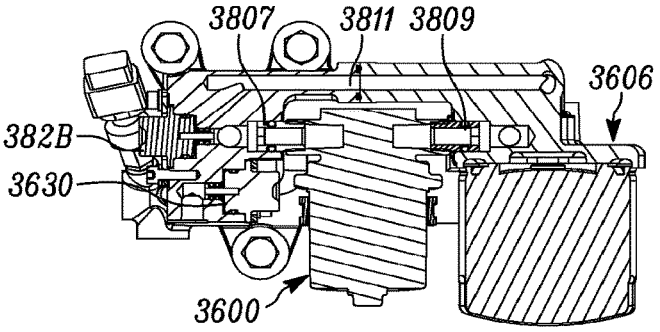
FIGS. 37A-37E are cross-sectional views of the VST system of FIGS. 35A and 35B, with FIGS. 37A-37D showing cross-sectional views taken along different respective vertical planes extending through various portions of the VST system and FIG. 37E showing a cross-sectional view taken along a horizontal plane extending through a cylindrical axis of a second (high-pressure) regulator of the VST system.
Figure 37B:
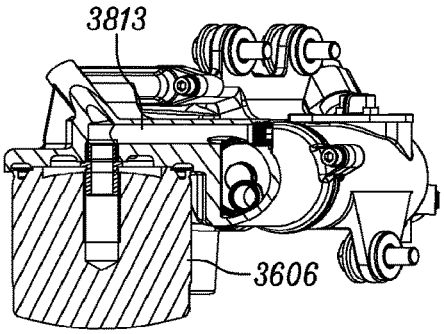
Figure 37C:
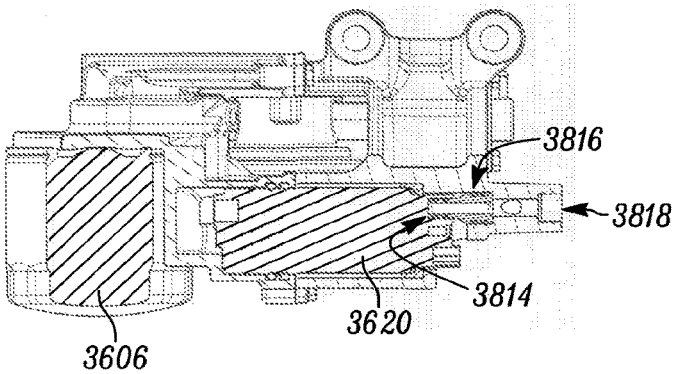
Figure 37D:
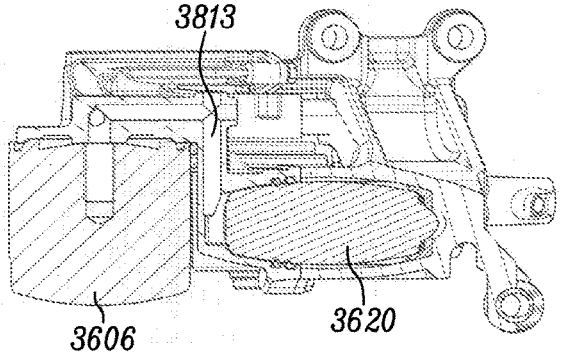
Figure 37E:
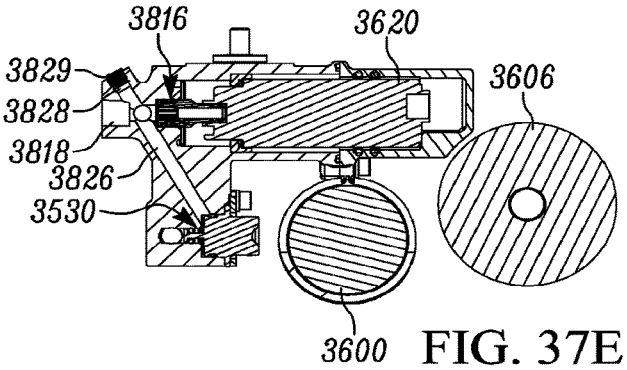
Figure 38:
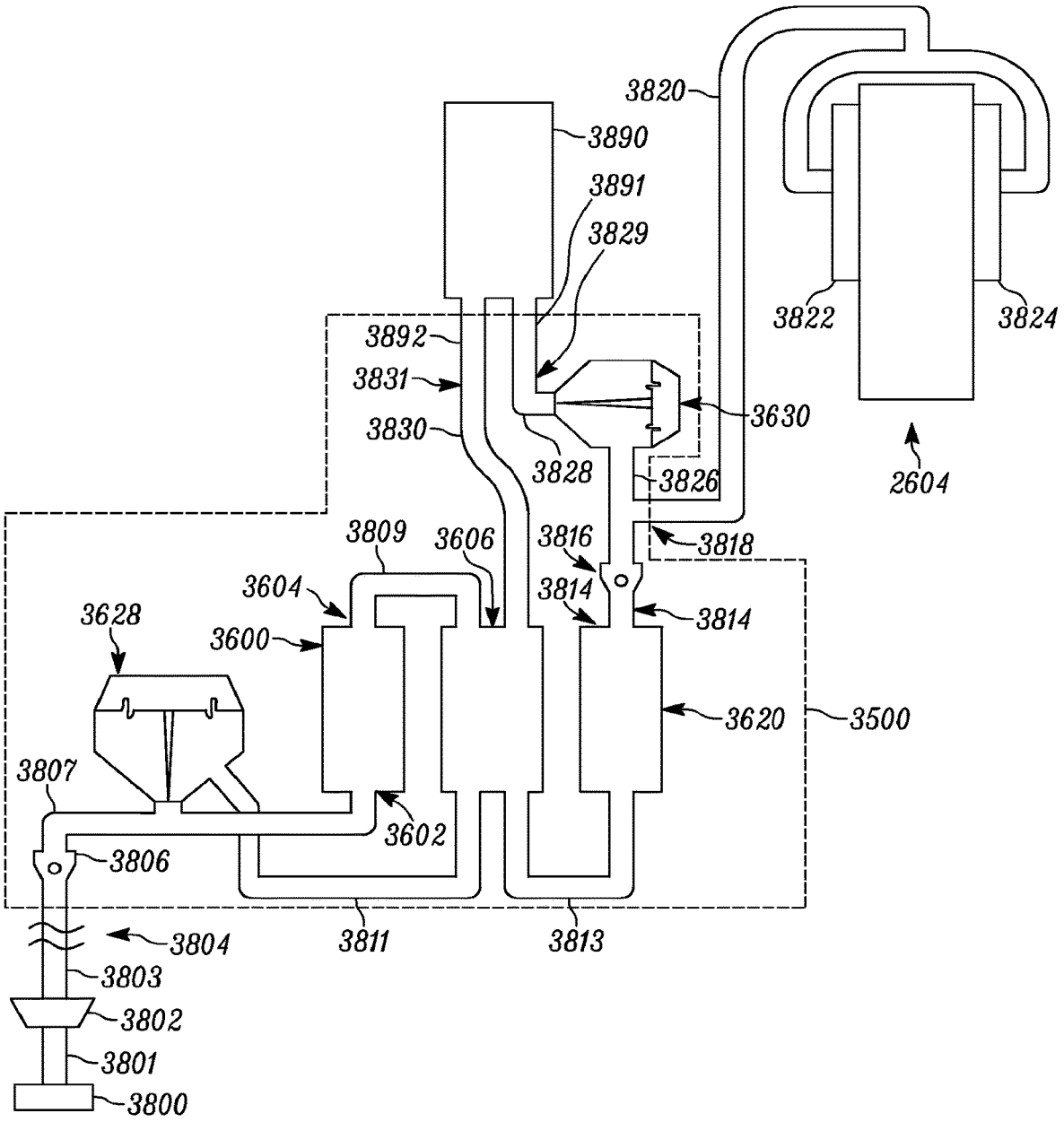
FIG. 38 is a schematic view of the VST system of FIGS. 35A and 35B in relation to an internal combustion engine and fuel cooler of an outboard motor on which the VST system is implemented, and additionally in relation to a fuel source (e.g., fuel tank) from which the outboard motor draws fuel, such as a fuel source located on a marine vessel to which the outboard motor is attached.

Turning now to FIGS. 37A, 37B, 37C, 37D, and 37E, first, second, third, fourth, and fifth cross-sectional views 3700, 3720, 3740, 3760, and 3780, respectively, of the VST system 3500 are provided in order to show various interrelationships among components of the VST system in more detail as well as to show portions of internal communication channels linking those components. Additionally, FIG. 18 is provided to illustrate in schematic form the interrelationships among the components of the VST system 3500 relative to one another as well as with respect to a fuel source 3800 (which would be located separate from the outboard motor 2500, e.g., on the marine vessel 100) and the internal combustion engine 2604, to show how fuel proceeds to, through, and out of the VST system 3500. Particularly as illustrated in FIG. 38, fuel is drawn into the VST system 3500 from a fuel tank 3800 via a filter 3802, both of which typically are provided on a marine vessel (e.g., the marine vessel 100 of FIG. 1) to which the outboard motor 2500 is coupled, that is, provided separate from the outboard motor (as represented by region 3804). As shown, link 3801 links the fuel tank 3800 with the filter 3802 and an additional link 3803 links the filter 3802 with the VST system 3500. The links 3801 and 3803 can be hoses or tubes or any of a variety of other linkages allowing for fluid communication.

Fuel enters the VST system 3500 particularly via a check valve 3806 (an input port of which can be considered the fuel input port of the VST system overall) that prevents the fuel from returning back into the fuel tank 3800 after it has been drawn to the VST system 3500. This is significant particularly insofar as the VST system 3500 typically is at a vertical elevation that is above that of the fuel tank 3800, e.g., forty inches higher than the fuel tank. After passing through the check valve 3806, the fuel is drawn to the low pressure fuel pump 3600, which can also be considered a lift pump since operation of that fuel pump serves to lift the fuel from the fuel tank 3800 to the level of the lift pump within the VST system 3500. The fuel is communicated from the check valve 3806 by way of a channel 3807 within the VST system 3500, which leads to the input port 3602 of the low pressure fuel pump 3600, which in the present embodiment is an electrically-driven fuel pump mechanism.

Additionally, by virtue of operation of the low pressure fuel pump 3600 the fuel is pressurized to a low (or mid-level) pressure level and driven out of the output port 3604 of that fuel pump, via a channel 3809, to the cylindrical fuel filter 3606 via the input port region 3614 thereof. FIG. 37A shows a cross-sectional view taken along a vertical plane extending through the low pressure fuel pump 3600 and the cylindrical fuel filter 3606 that particularly illustrates portions of the channels 3807 and 3809 (but not the channels in their entirety). Further due to operation of the low pressure fuel pump 3600 and pressurization of the fuel as a result, a reed vapor pressure (RVP) of the fuel (e.g., the fuel within the cylindrical fuel filter) is driven up so that the fuel is no longer likely to vaporize and so that fuel at a steady fuel pressure can be delivered, even if heat generated by the internal combustion engine 2604 (or for other reasons) becomes elevated, for example, during idling of the engine. Indeed, vaporization is eliminated or reduced by the VST system 3500 even when only relatively modest fuel cooling is provided by way of the fuel cooler (described further below). In the present embodiment, the low (or mid-level) pressure of the fuel output by the low pressure fuel pump 3600 can be 10 psi albeit, in other embodiments, the pressure can be at other levels such as 12 psi, 15 psi, or 18 psi.

Additionally, as already noted, the cylindrical fuel filter 3606 includes a cylindrical fuel filter element 3610, such that the cylindrical fuel filter 3606 serves both as a filter to remove impurities (e.g., water) from the fuel and also serves as a mixer. Further, the cylindrical fuel filter 3606 also serves as a fuel reservoir, from which the high pressure fuel pump 3620 can draw fuel as described further below. As shown in FIG. 38, the cylindrical fuel filter 3606 not only is coupled to the low pressure fuel pump 3600 and to the high pressure fuel pump 3620 (and coupled between those two fuel pumps), but also the cylindrical fuel filter is coupled to the first pressure regulator 3628 by way of a channel 3811, and the first pressure regulator is coupled between the channel 3811 and the channel 3807. A portion of the channel 3811 is also shown in the cross-sectional view of FIG. 37A, and it can be appreciated that the channel 3811 generally extends within the pressure regulator extensions 3617 and 3616 of the fuel regulator assembly 3618 and the cap structure 3612, respectively. The first pressure regulator 3628 in this embodiment serves as a low pressure regulator that allows fuel to return from the channel 3811 back to the channel 3807 if the pressure at the channel 3811 (which is the pressure within the cylindrical fuel filter 3606 and at the output port 3604 of low pressure fuel pump 3600) exceeds a predetermined value, e.g., if the pressure exceeds 10 psi or exceeds 10 psi by more than a preset margin.

With respect to the high pressure fuel pump 3620, as shown in FIG. 38, that pump draws fuel from the cylindrical fuel filter 3606 by way of a channel 3813. In addition to being shown in FIG. 38, it will be appreciated that the channel 3813 extends generally from the output region 3626 of the cap structure 3612 as shown in FIG. 36. Also, FIG. 37B, which shows a cross-sectional view of the VST system 3500 taken along a vertical plane extending through an end portion of the VST system and particularly through the cylindrical fuel filter 3606, also shows a portion of the channel 3813. Further FIG. 37D, which provides an additional cross-sectional view of the VST system 3500 taken along another vertical plane extending through the cylindrical fuel filter 3606 and the high pressure fuel pump 3620, illustrates the channel 3813 as well. As is the case with the low pressure fuel pump 3600, the high pressure fuel pump 3620 in the present embodiment is electrically driven, and in the present embodiment both of the pumps 3600 and 3620 are operated to run continuously and therefore no switching circuits are employed to turn on and off the pumps (albeit in alternate embodiments, such switching circuits can be employed). In contrast to the low pressure fuel pump 3600, which in the present embodiment is a cylindrical structure having a generally vertical cylinder axis, the high pressure fuel pump 3602 is a cylindrical structure having a generally horizontal cylinder axis.

In the present example, the high pressure fuel pump 3620 particularly operates to draw in the fuel from the cylindrical fuel filter 3606, which is at 10 psi (or other pressure level as established by the low pressure fuel pump 3600), and further operates to pressurize that fuel so that the fuel reaches a higher pressure suitable for use by the internal combustion engine 2604. In the present embodiment, the higher pressure is 65 psi albeit, in other embodiments, that pressure can be at other levels. The fuel output by the high pressure fuel pump 3620 is particularly delivered at an output port 3814 of the high pressure fuel pump (corresponding to the output end 3624 of FIG. 36), is then driven from the output port 3814 through a check valve 3816, and then is output from a VST system output port 3818, which is connected by way of one or more links (e.g., tubes, pipes, or channels) 3820 to left hand and right hand rails 3822 and 3824, respectively, of the internal combustion engine 2604, at which the fuel is consumed (e.g., by way of fuel injectors). Additionally in this regard, FIG. 37C provides a further cross-sectional view of the VST system 3500 taken along a vertical plane extending through the cylindrical fuel filter 3606 and the high pressure fuel pump 3620, and particularly shows the output port 3814, check valve 3816, and VST system output port 3818 allowing for the fuel to proceed from the high pressure fuel pump 3620 out of the VST system for use by the internal combustion engine 2604.

In addition to being coupled to the check valve 3816, the VST output port 3818 (and downstream end of the check valve 3816) is also coupled by way of a channel 3826 to the second pressure regulator 3630, which in the present embodiment is a high pressure regulator. The second pressure regulator 3630 in turn is coupled in between the channel 3826 and an additional channel 3828, which in turn extends to a fuel cooler output port 3829 of the VST system 3500.

In the present embodiment, the fuel cooler 3890 is separate from the VST system 3500 but is coupled to the fuel cooler output port 3829 of the VST system by way of a channel 3891, and also is coupled to a fuel cooler input port 3831 of the VST system by way of an additional channel 3892, where the fuel cooler input port 3831 is in turn coupled to the cylindrical fuel tank 3606 by way of a further channel 3830. Thus, the fuel cooler 3890 is coupled for fluid communication between the second pressure regulator 3630 and the cylindrical fuel filter 3606 by way of the channels 3828, 2891, 3892, and 3830 such that fuel passing through the second pressure regulator 3630 into the channel 3828 is cooled at the fuel cooler 3890 and then returned to the cylindrical fuel filter 3606. Further in this regard, FIG. 37E shows a cross-sectional view taken along a horizontal plane extending through the VST system 3500 generally along the central axis of the high pressure fuel pump 3620 that shows not only the output port 3814, check valve 3816, and VST system output port 3818 (as already shown in FIG. 37C), but also shows the second pressure regulator 3630 and the additional channel 3828 linking the second pressure regulator to the fuel cooler output port 3829.

Figure 41:
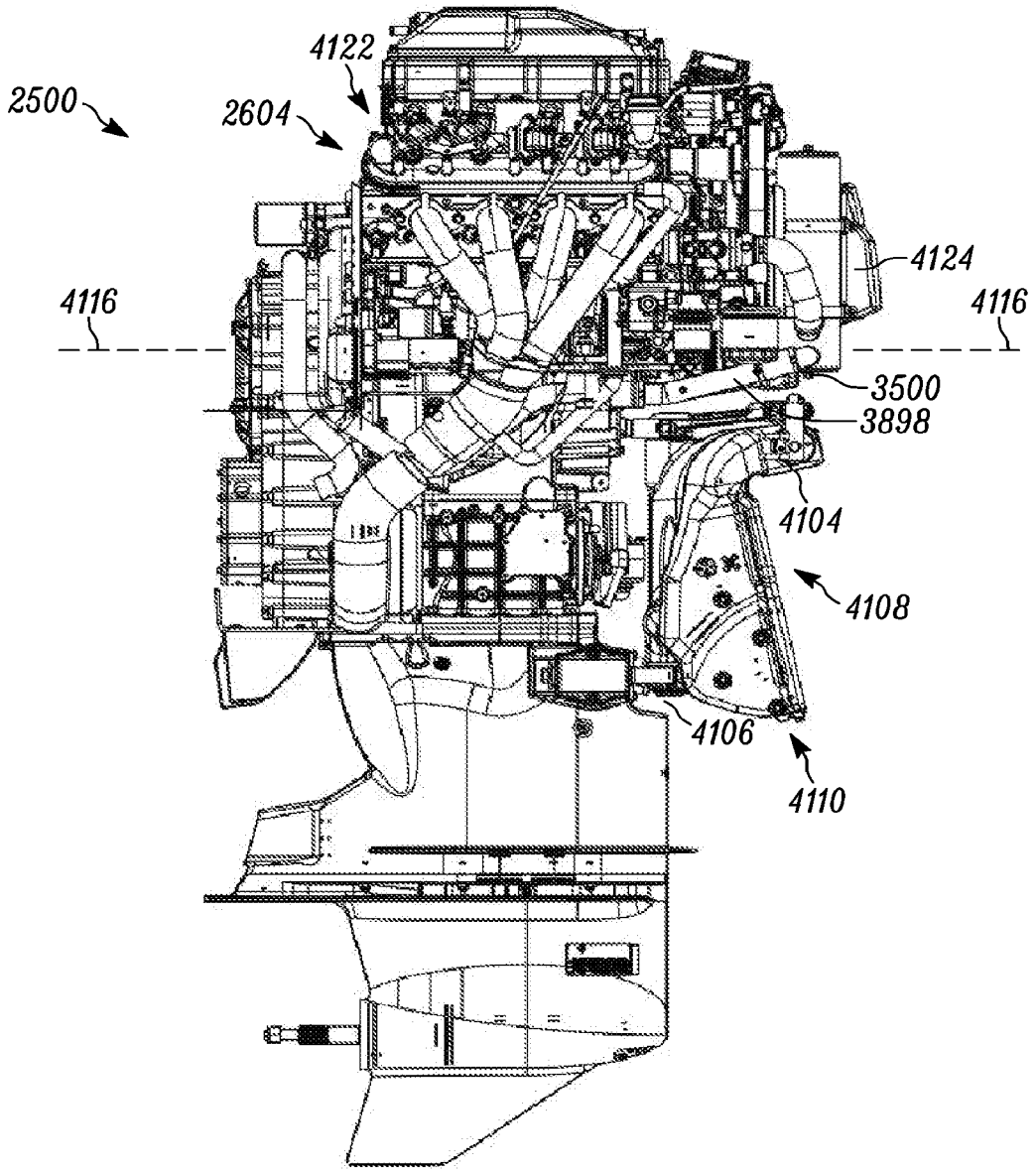
FIG. 41 is a further right side elevation view of the outboard motor of FIG. 25, showing in more detail several example internal components of the outboard motor particularly revealed when cowling portion(s) of the outboard motor are removed (with the outboard motor being shown in a first or standard operating or operational position), showing in detail several example internal components of the outboard motor (again particularly revealed when cowling portion(s) of the outboard motor are removed) such as the VST system of FIGS. 35A and 35B and a tank for holding oil, or other lubricant(s), in accordance with embodiments of the present disclosure.
Figure 42:
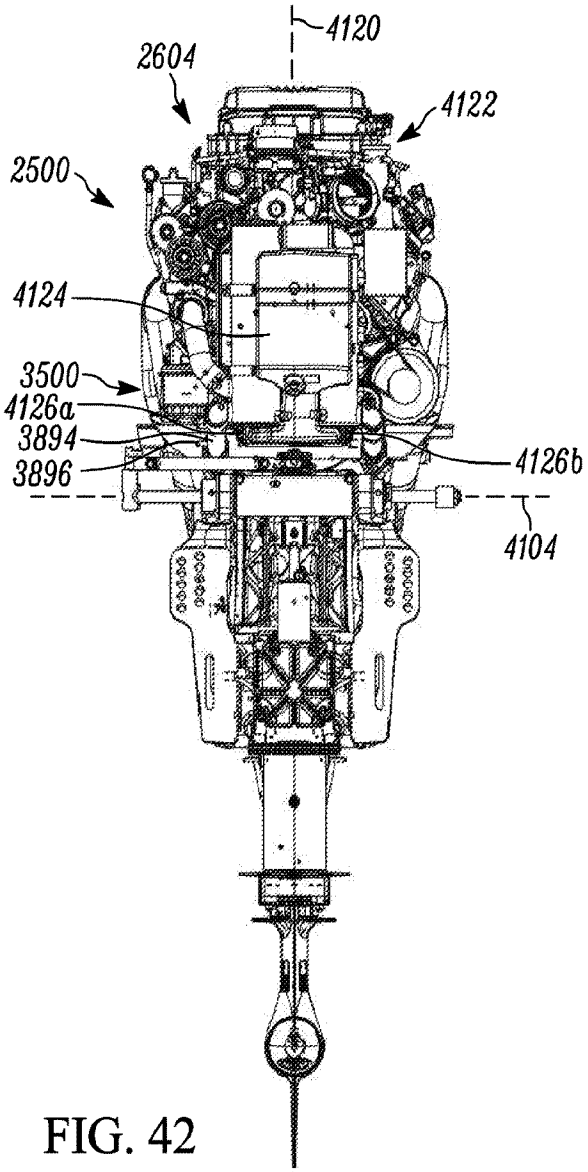
FIG. 42 is a front elevation view of the outboard motor of FIG. 41.

With respect to the fuel cooler 3890, referring additionally to FIGS. 41 and 42, this component in the present embodiment is positioned proximate to (but not directly adjacent to) the VST system 3500, proximate a side of the internal combustion engine 2604 generally at or near the front end of the engine. Although not shown in FIGS. 41 and 42, from FIG. 38 it should be understood that, when fully assembled, the VST system 3500 (and particularly the fuel cooler input and output ports 3831 and 3829) is coupled to the fuel cooler 3890 by way of the channels 3892 and 3891, respectively. More particularly, the fuel cooler 3890 includes first and second connection ports 3894 and 3896 (see FIG. 42) that are respectively ports at which the channels 3891 and 3892 are coupled when those channels are implemented, so as to allow fuel to proceed to the fuel cooler 3890 from the VST system 3500 and to be returned to the VST system 3500 from the fuel cooler, respectively.

Although the fuel cooler can take various forms depending upon the embodiment, in one example embodiment the fuel cooler includes a mesh of tubes that surround a coolant channel 3898 (see FIG. 41) by which coolant (e.g., seawater) is being directed to the internal combustion engine 2604 for engine cooling purposes. That is, fuel entering the fuel cooler 3890 at the first connection port 3894 passes through the mesh of tubes such that heat transfer occurs between that fuel and the coolant flowing through the coolant channel, and then passes out of the mesh of tubes via the second connection port 3894 for return to the VST system 3500. In the present embodiment, the coolant provided to the fuel cooler section is the same coolant that is used to cool the internal combustion engine 2604 and can be water, such that all of the water going through the engine cooler passes also through the fuel cooler 3890. The fuel cooler 3890 in the present embodiment can use the engine coolant for cooling of the fuel because that engine coolant has not yet reached the engine, at which coolant ultimately becomes sufficiently warm that it would not serve well as fuel coolant.

Although the present embodiment of the VST system 3500 includes the fuel cooler 3890, it should be understood that, by comparison with many conventional fuel pump mechanisms associated with outboard motors, the VST system 3500 does not require as much coolant or fuel cooling operation to eliminate or reduce the possibility of fuel vaporization in or at the output of the fuel pump mechanism (or particularly in terms of vaporization present in the fuel delivered to the internal combustion engine 2604). This is true even during engine idling operation, when the engine can still impart significant heat to the fuel in the VST system and even when the amount of coolant delivered to the fuel cooler section 3890 is reduced by comparison with times at which the engine is fully operating. Rather, thanks to the pressurization achieved by the low pressure fuel pump 3600, fuel vaporization still does not occur, or occurs to a much lesser degree, under most or all engine operating conditions, including idling operation. Also, such elimination or minimization of fuel vaporization is still achieved without any need for vents to allow for fuel vapors to escape into the atmosphere.

Figure 39:
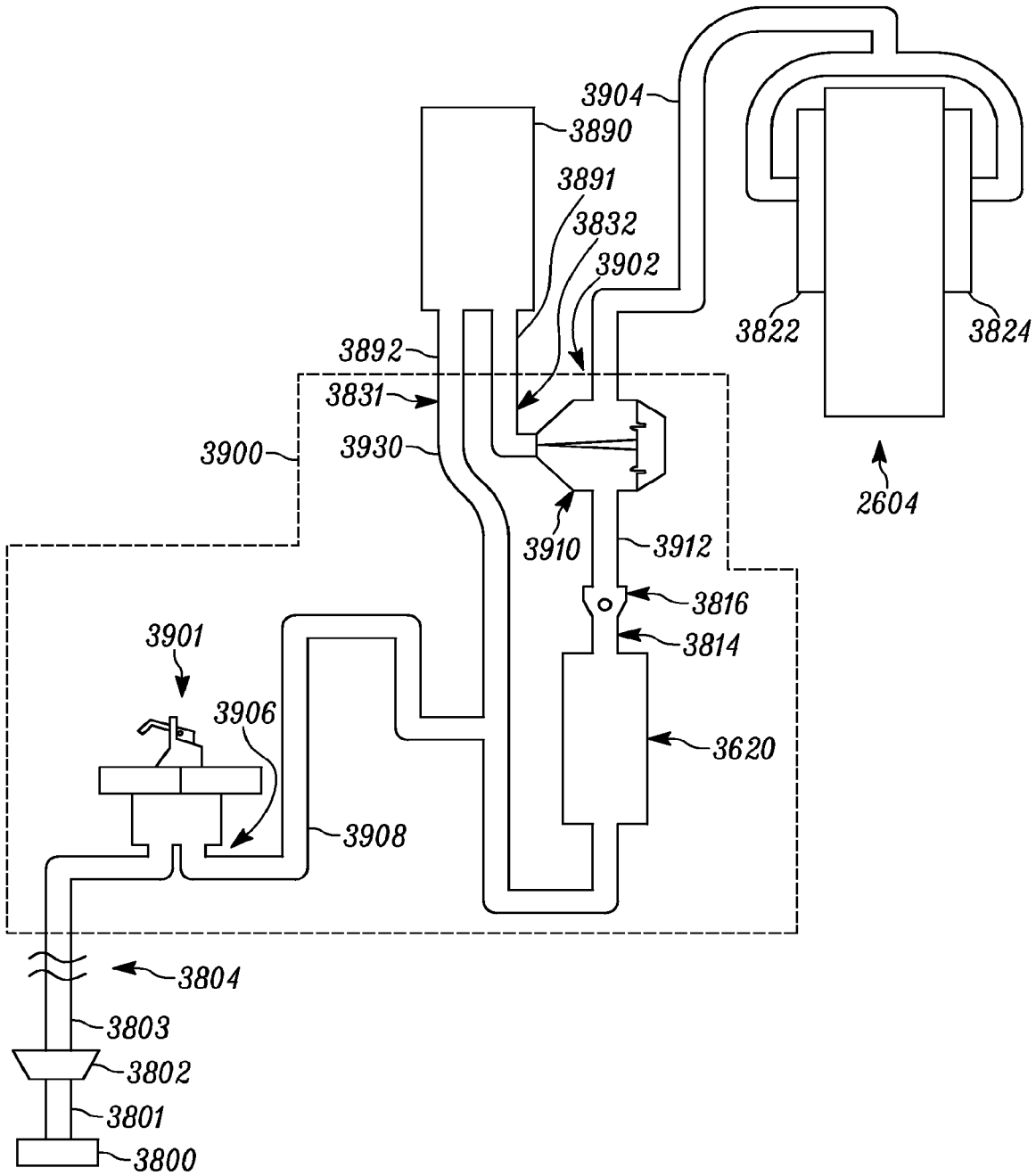
FIG. 39 is a schematic view of an alternate embodiment of a VST system differing from that of FIG. 38.

Although the VST system 3500 of FIGS. 35-38 is one example of a VST system encompassed herein, the present invention is intended to encompass numerous variations on the VST system 3500 and alternate embodiments of VST systems or fuel vaporization suppression systems. For example, as shown in FIG. 39, in an example alternate embodiment VST system 3900, a diaphragm pump (mechanical pump) is employed as a low pressure fuel pump 3901 instead of the low pressure fuel pump 3600. In such embodiment, fuel is drawn from the fuel tank 3800 (via the same filter 3802, links 3801 and 3803, and region 3804 as in FIG. 38) into an input port of the VST system by way of the low pressure fuel pump 3901, and an output port 3902 at which high pressure fuel is output by the VST system 3900 is coupled to the same internal combustion engine 2604 and associated rails 3822, 3824 as shown in FIG. 39, via one or more links 3904. The VST system 3900 can operate by employing the same high pressure fuel pump 3620 and operate in conjunction with the fuel cooler 3890 as in the VST system 3500, where the fuel cooler is again coupled to the fuel cooler input and output ports 3831 and 3832 by way of the channels 3892 and 3891, respectively. However, due to the incorporation of the low pressure fuel pump 3901, the interconnection of other components is different in the VST system 3900 by comparison with that of the VST system 3500.

More particularly, an output port 3906 of the low pressure fuel pump 3901, at which the low pressure fuel pump outputs fuel at a low (or mid-level) pressure that is elevated relative to the pressure in the fuel tank 3800, is coupled by way of a link 3908 directly to the input port of the high pressure fuel pump 3620. The output port 3814 of the high pressure fuel pump 3620 is coupled to the output port 3902 of the VST system 3900 by way of the check valve 3816 and also by way of a high pressure regulator 3910 (which can be, but need not be, the same as the pressure regulator 3630), which in this embodiment is shown to be connected in series between the output port 3902 and a link 3912 by which it is additionally connected to the output (downstream) port of the check valve 3816. The high pressure regulator 3910 is coupled to the fuel cooler output port 3832 by way of a channel 3928 and governs whether pressurized fuel output by the high pressure fuel pump 3620 is allowed to proceed to the fuel cooler 3980 by way of the channels 3928 and 3891. Additionally, in the VST system 3900, the fuel cooler 3890 is coupled to the fuel cooler input port 3831 by way of the channel 3891, and the fuel cooler input port 3831 is coupled to the link 3908 by way of a channel 3930. Thus, the fuel cooler 3890 is coupled in between the high pressure regulator 3910 and the link 3908 such that the fuel cooler section can serve (at least partly) as a fuel reservoir from which fuel is drawn by the high pressure fuel pump 3620.

Figure 40B:
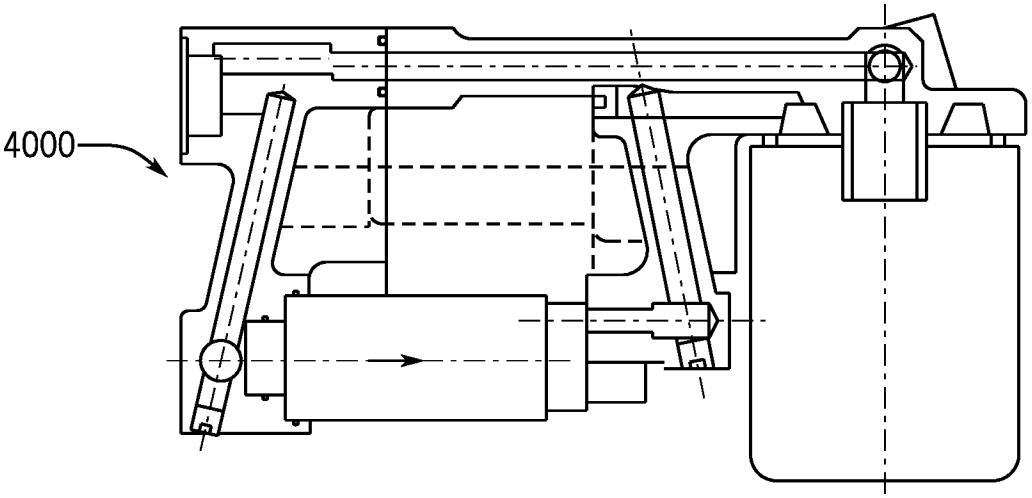
FIGS. 40A, 40B, and 40C are end, left side, and right side elevation views of an alternate embodiment of a VST system differing form that of FIGS. 35A and 35B.
Figure 40C:
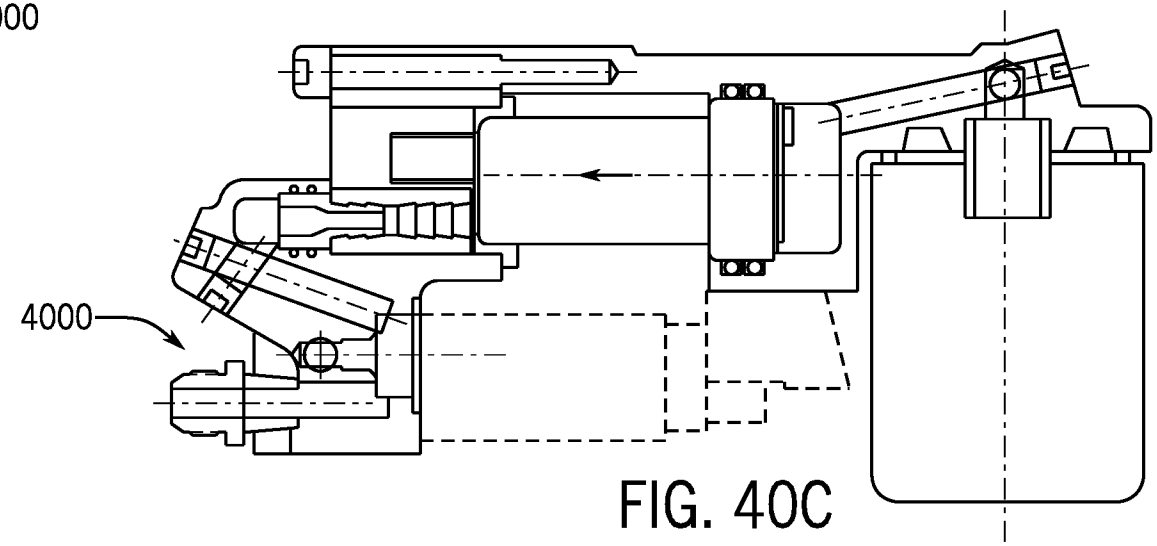
Figure 40A:
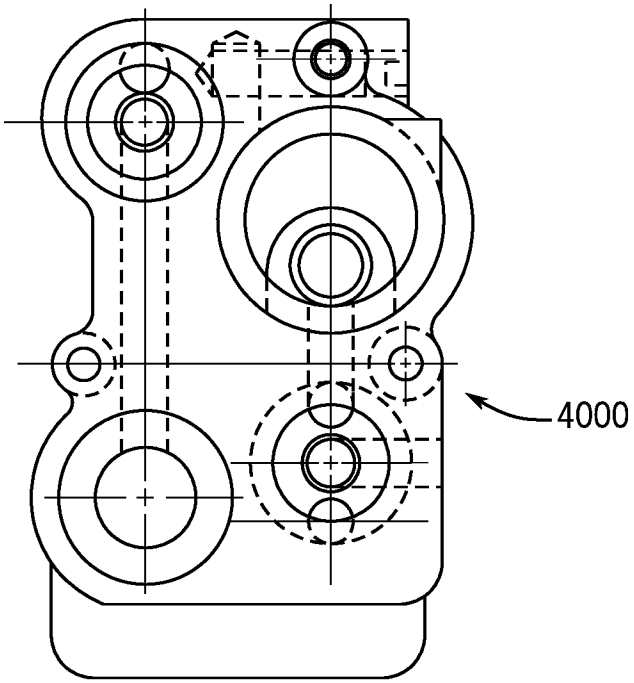

Further, it should also be appreciated that the arrangement of components of the VST system 3500 can be varied and that the present invention is intended to encompass numerous such variations. FIGS. 40A, 40B, and 40C for example show an end elevation view, a left side elevation view, and a right side elevation view (partly in phantom) of a further embodiment VST system 4000. Also depending upon the embodiment, a VST system can be employed in combination with other types of engines and/or engine components other than or in addition to those discussed above. For example, in some embodiments, a fuel rail pressure sensor can be integrated into the outlet of the high pressure pump from the VST housing. Also, although the engine 2604 in the present embodiment is a fuel injected engine, it should be appreciated that in other embodiments the engine can take other forms such as a carbureted engine.

Thus, in at least some embodiments encompassed herein such as the present embodiment of the VST system 3500 of FIGS. 35-38, a VST system on an outboard motor includes a primary fuel pump that is capable of lifting fuel up to the level of the internal combustion engine from a fuel source (e.g., a fuel tank within a marine vessel to which the outboard motor is attached), for example, a distance of approximately forty inches, at a flow rate that is required by the engine. The primary pump is capable of pressurizing the working fuel volume to regulated pressure levels at sufficient flow rate for the engine. Additionally, the discharge side of the primary regulator is connected to the inlet side of the primary pump thereby completing the primary circuit. With such an arrangement, no venting of the working fuel that is maintained at a regulated primary pressure is required in order to prevent vapor formation, and thus fuel is not lost to the outside environment due to evaporation (and, relatedly, there are no fuel fumes that pass out into the environment due to such venting). Further, in such arrangements, an inlet side of a secondary pump is coupled to the primary pressure thereby supercharging the secondary pump enhancing its efficiency. The discharge of the high pressure pump is connected with minimal effect upon the control of secondary fuel pressure supplied to the engine fuel rail. Also, the fuel cooler is connected to the discharge of secondary regulator thereby creating flow at primary fuel pressure through the fuel cooler thus enhancing its function and preventing vapor formation.

Oil Tank

Figure 43:
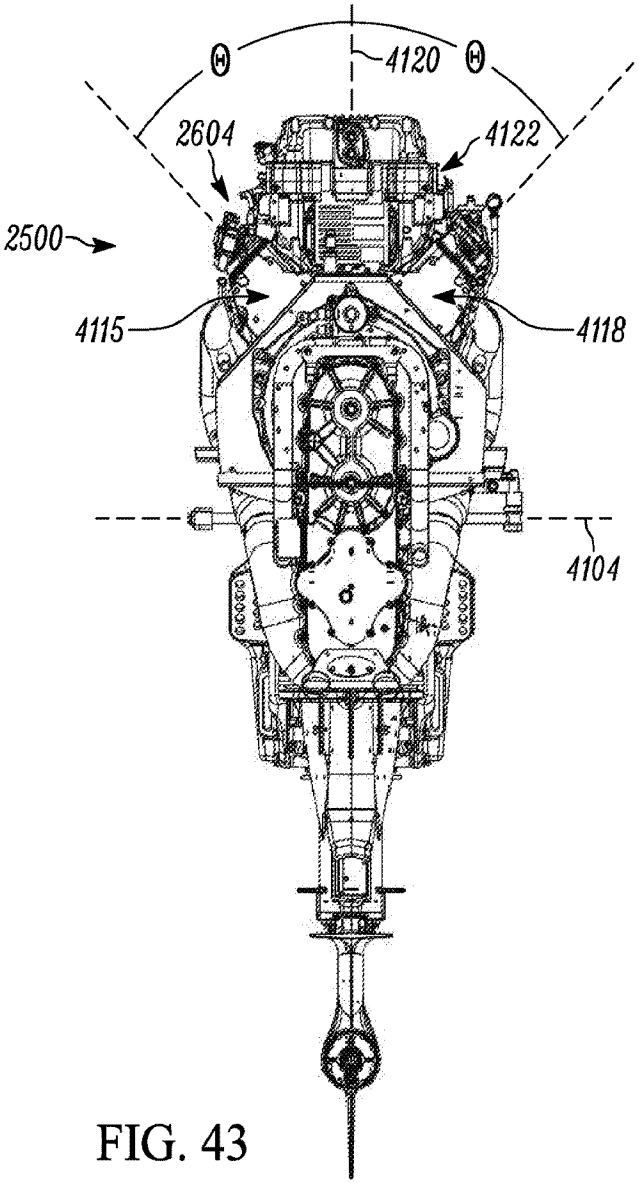
FIG. 43 is a rear elevation view of the outboard motor of FIG. 41.

With reference to FIGS. 41-43, FIG. 41 is a further right side elevation view of the outboard motor 2500 of FIG. 25, showing in more detail several example internal components of the outboard motor particularly revealed when cowling portion(s) of the outboard motor are removed. The outboard motor 2500 comprises the engine 2604 which, as described with respect to previous embodiments, is positioned entirely, or at least substantially, above a trimming axis 4104 (which is shown as a dashed line in FIGS. 42 and 43) and which is steerable about a steering axis that in this position coincides with a vertical axis 4106 (which is shown in FIG. 41). The vertical axis 4106 (which again is the same as the steering axis in this position) is shown in relation to a mounting structure 4108 which, as previously described (e.g., with reference to FIGS. 12, 13, and 14), is a structure that generally links, or otherwise connects, the outboard motor 2500 to a marine vessel (for example, the exemplary outboard motor 104 and the exemplary marine vessel 102 shown and described in FIG. 1).

More particularly, and again as noted earlier, the mounting system 4108 connects (or is configured to connect) the outboard motor 2500 to the rear or transom area of the marine vessel and, in this way, the mounting system can also be termed a "transom mounting system". In accordance with at least some embodiments, the mounting system 4108 generally includes a swivel bracket structure 4110, which is cast or otherwise formed and which provides for rotation of the motor about the steering axis (which again in this view corresponds to the vertical axis 4106). In accordance with embodiments of the present disclosure, the outboard motor 2500 is configured, by virtue of the mounting system 4108, to be steered about its steering axis, which again in this view corresponds to the vertical axis 4106 (that is, the steering axis is vertical or substantially vertical), relative to the marine vessel, and further allows the outboard motor 2500 to be rotated about the tilt or trimming axis 4104 that is perpendicular to (or substantially perpendicular to) the vertical axis 4106. The steering axis (in this case, corresponding to the vertical axis 4106) and trimming axis 4104 can both be perpendicular to (or substantially perpendicular to) a front-to-rear axis, such as the front-to-rear axis 114 illustrated in FIG. 1 that generally extending from the stern edge 106 of the marine vessel 102 toward a bow 116 of the marine vessel.

In accordance with at least some embodiments, the engine 2604 is a horizontal crankshaft internal combustion engine having a horizontal crankshaft arranged along a horizontal crankshaft axis 4116 (shown as a dashed line in FIG. 41). Further, in at least some embodiments the engine 2604 not only is a horizontal crankshaft engine, but also is a conventional automotive engine capable of being used in automotive applications and having multiple cylinders, two of which are referenced generally by the numeral 4118 in FIG. 43, and other standard components found in automotive engines. More particularly, in the present embodiment, the engine 2604 particularly is an eight-cylinder V-type internal combustion engine such as available from the General Motors Company of Detroit, Mich. for implementation in Cadillac (or alternatively Chevrolet) automobiles.

With continuing reference to FIGS. 41-43, the cylinders 4118 are symmetrically oriented about a vertical plane 4120 passing through and coinciding with the crankshaft axis 4116. That is, each of the cylinders 4118 (again two of which are referenced by the numeral 4118) is positioned at an angle $+\theta$ or $-\theta$, respectively, where each respective angle is measured from the vertical plane 4120 that passes through center of the V-type engine to a respective cylinder axis generally centered within a respective cylinder. More generally, in V-type engines, each of the cylinders is oriented such that the angle $\theta$ is typically between about 30 degrees and about 60 degrees as measured from (and on either side of) the vertical plane 4120. Additionally, each of the respective cylinders on a respective side of the engine 2604 (in this case four of the eight cylinders of the eight cylinder V-type engine) is oriented such that the cylinder axes of all of those cylinders on the same side of the engine are parallel with one another. It will be appreciated that, in other embodiments, the cylinders can have other orientations, including that the cylinders can be oriented generally in straight-line fashion, such as vertically oriented (e.g., so that the cylinder axes are, in the present view, along or coincident with the vertical plane 4120). As shown in FIGS. 41-43, the outboard engine 2604 is positioned in what will be termed a first operating or operational position corresponding to a standard operating or operational position, that is, a an operating position in which the trimming axis 4104 is at least substantially horizontal and the steering axis 4106 is at least substantially vertical, with the steering axis 4106 particularly being at least substantially parallel to and/or in line with the vertical plane 4120.

It should be appreciated that the outboard motor 2500 employs a lubricant sump (not visible) for containing a lubricant (e.g., oil). The lubricant sump is typically long, narrow, and shallow and, moreover, is typically integral with, or otherwise integrated with respect to, a crankcase. The crankcase is generally understood to include a volume or space within the engine 2604 in which are positioned the crankshaft connecting rods, and sometimes camshafts and lubricant (e.g., oil) pumps of the engine and, is generally referenced in FIGS. 41-43 by the numeral 4122. In accordance with embodiments of the present disclosure, additionally a tank or tank structure 4124 (not visible in FIG. 43) is provided on the outboard motor 2500 for storing and providing lubricant (e.g., oil) for use by the engine 2604. As is evident from FIGS. 41 and 43, in the present embodiment, the tank 4124 is provided at the front of the engine 2604. Also, the tank 4124 is connected to the crankcase 4122 by a plurality of lubricant (e.g., oil) lines, which in the present embodiment include first and second lubricant lines 4126*a* and 4126*b* at locations that are at or near the bottom of the crankcase 4122 and that are visible in FIG. 42, and that are also at or near the bottom of the oil tank 4124, which is configured to extend generally upwardly from the locations at which those oil lines extend from the oil tank. Additionally, the oil tank 4124 is positioned substantially (or entirely) above the crankshaft axis 4116, and is further connected to the crankcase by way of a vent line at or near the top of the crankcase (not shown). In accordance with at least some embodiments of the present disclosure, the tank 4214 is also connected to the oil sump of the outboard motor 2500.

Figure 45:
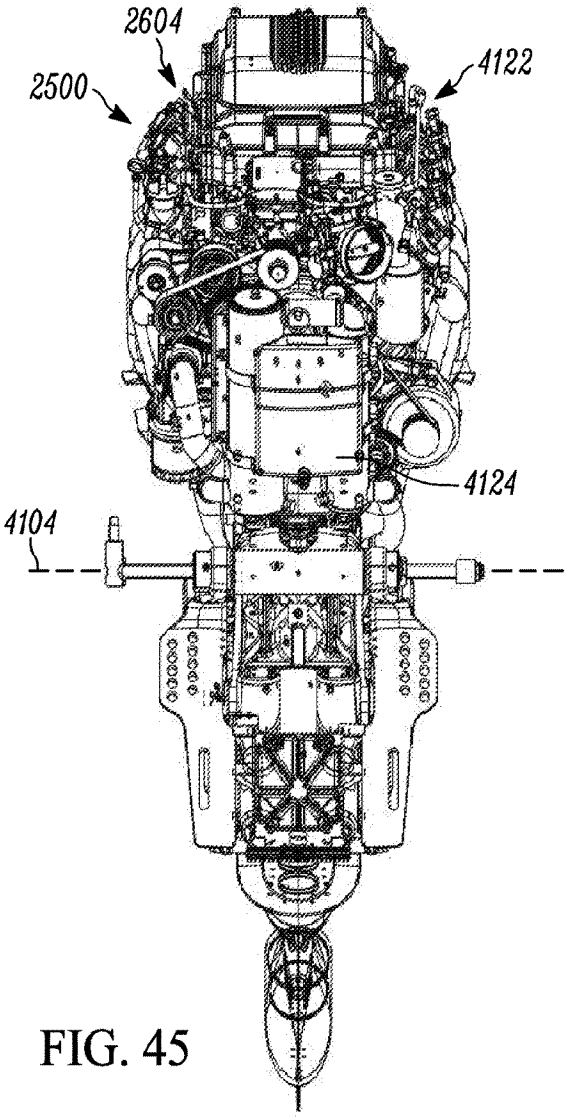
FIG. 45 is a front elevation view of the outboard motor of FIG. 44, that is with the outboard motor again shown in the second operating or operational position.
Figure 44:
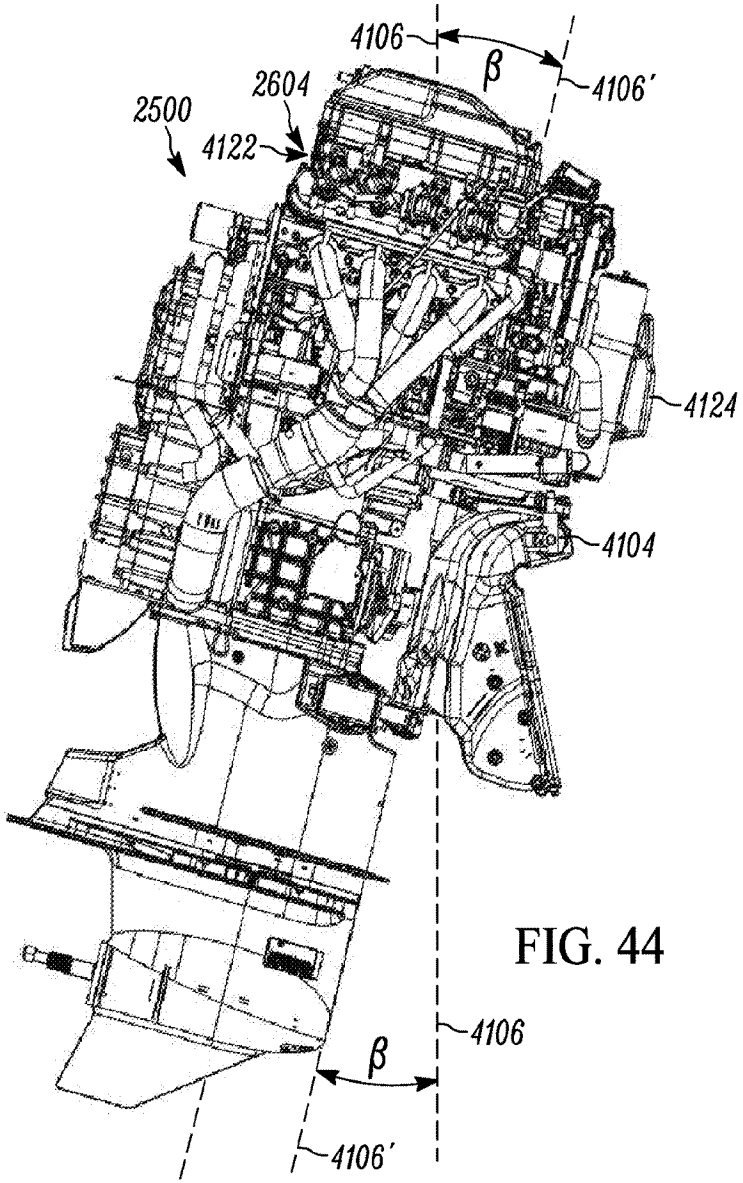
FIG. 44 is a right side elevation view of the outboard motor of FIG. 41, with the outboard motor now shown such that it has been tilted, rotated and/or otherwise moved and is positioned in a second operating or operational position.

FIGS. 44 and 45 are right side and front elevation views, respectively, of the outboard motor 2500 of FIG. 41, with the outboard motor now shown such that it has been tilted, rotated and/or otherwise moved so that the outboard motor and particularly the engine 2604 is positioned at a second operating or operational position. More specifically, the second operating position corresponds to a position in which the outboard motor 2500 is tilted, rotated or otherwise moved about the trimming axis 4104 such that a steering axis 4106' of the outboard motor as rotated is at an angle up to (and including) a maximum angle β relative to the vertical axis, that is, rotated at an angle up to a maximum angle β relative to the steering axis of the outboard motor when in the standard operating position (FIGS. 41-43). In the present embodiment, the angle β is fifteen (15) degrees off of the vertical axis 4106, albeit this can vary depending upon the embodiment. Thus, it should be appreciated that the particular rotational position of the outboard motor 2500 shown in FIG. 46 illustrates the maximum rotational position of the outboard motor away from the vertical axis 4106 at which the outboard motor can still be considered to be in the second operating position in this embodiment, and the outboard motor 2500 would also be considered to be in the second operating position if it was rotated a lesser amount less than the angle β (e.g., rotated an amount less than 15 degrees but greater than, or substantially greater than, zero degrees).

It additionally should be appreciated that the rotational range (up to a maximum of β) corresponding to the second operating position is intended generally to encompass positions of the outboard motor 2500 suited for shallow water drive operation of the outboard motor 2500 in which the outboard motor can be operated at, or substantially at, full propulsion or full power. In accordance with embodiments of the present disclosure, the tank 4124 is configured or structured so that the lubricant/oil utilized by the engine 2604 remains in (that is, the lubricant/oil is kept or retained in) the crankcase 4122 during such shallow water drive operation, rather than enters into the tank 4124. That is, very little (or none) of the engine oil enters or remains within the tank 4124, due to the position of the lines 4126*a* and 4126*b* and the structure of the tank (which extends generally above those lines). Notwithstanding the above description, it should be understood that the second operating position can comprise many other positions depending upon the design and intended use of the outboard motor 2500.

Figure 47:
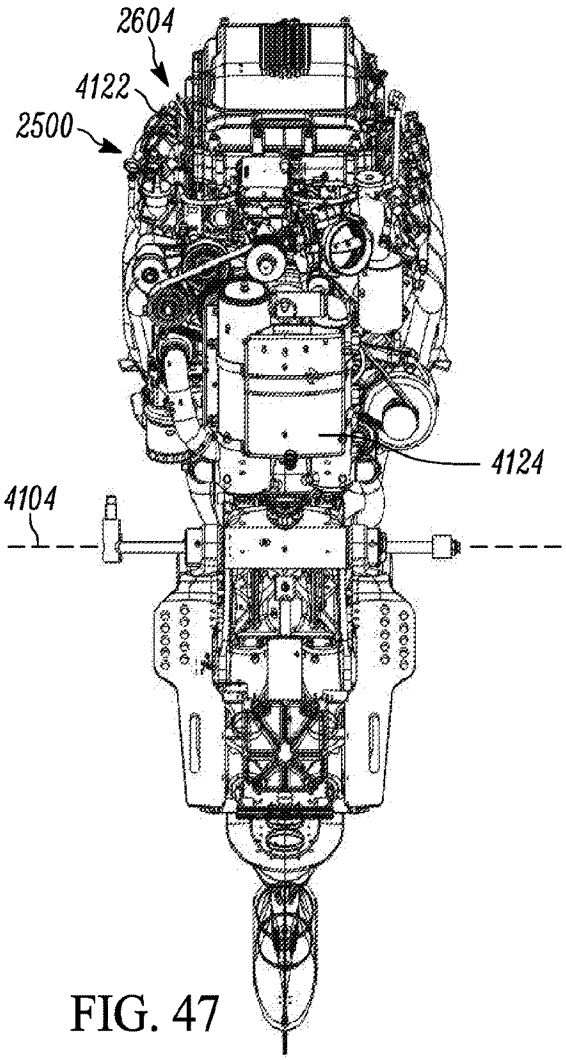
FIG. 47 is a front elevation view of the outboard motor of FIG. 46, that is with the outboard motor again shown in the third operating or operational position.
Figure 46:
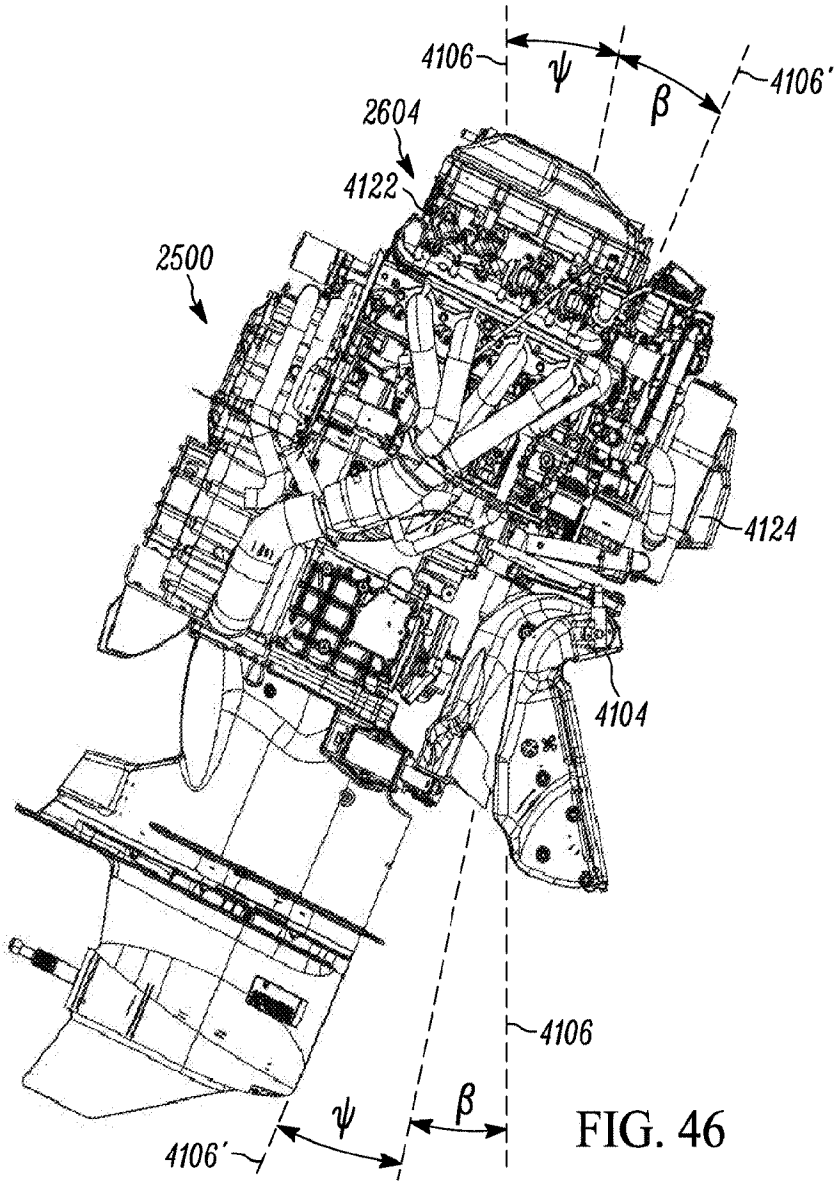
FIG. 46 is a right side elevation view of the outboard motor of FIG. 41, with the outboard motor now shown such that it has been further tilted, rotated and/or otherwise moved so that it is positioned a third operating or operational position.

Turning next to FIGS. 46 and 47, there are provided right side and front elevation views, respectively, of the outboard motor 2500 of FIG. 41 that are similar to those of FIGS. 44 and 45, except insofar as the outboard motor is now shown such that it has been tilted, rotated and/or otherwise moved so that the outboard motor (and particularly the engine 2604 thereof) is positioned in a third operating or operational position. More specifically, the third operating position corresponds to a position in which the outboard motor 2500 is tilted, rotated or otherwise moved about the trimming axis 4104 such that a steering axis 4106" of the outboard motor as rotated is greater than the angle β up to a maximum angle of ψ-β relative to the vertical axis 4106, that is, rotated at an angle from β up to a maximum angle ψ-β relative to the steering axis of the outboard motor when in the standard operating position (FIGS. 41-43). In the present embodiment, the angle ψ is ten (10) degrees off of the steering axis 4106', and.ir the angle ψ-β is twenty-five (25) degrees off of the vertical axis 4106, albeit these amounts can vary depending upon the embodiment. Thus, it should be appreciated that the particular rotational position of the outboard motor 2500 shown in FIG. 46 illustrates the maximum rotational position of the outboard motor away from the vertical axis 4106 at which the outboard motor can still be considered to be in the third operating position in this embodiment, and the outboard motor 2500 would also be considered to be in the third operating position if it was rotated a lesser amount less than the angle ψ-β down to the angle β (e.g., rotated an amount less than 25 degrees off of the vertical axis 4106 but greater than, or substantially greater than, 15 degrees off of the vertical axis).

The range of rotational positions corresponding to the third operating position is intended generally to correspond to a shallow water drive operation of the outboard motor 2500 in which the outboard motor can be operated at limited propulsion or limited power. Here again, in accordance with embodiments of the present disclosure, the tank 4124 is configured or structured so that all or substantially all of the lubricant/oil in the crankcase 4122 remains in (or is kept or retained in) the crankcase during such shallow water drive operation. Again, such operation is particularly achieved again by virtue of the relatively low positioning of the lines 4126*a* and 4126*b* relative to the remainder of the tank 4124 and the relatively high positioning of most of the tank relative to both of those lines as well as relative to large sections of the internal combustion engine 2604. Notwithstanding the above description, it should be appreciated that the third operating position can comprise many other positions depending the embodiment, design, and/or intended use of the outboard motor 2500.

Figures 48, 49:
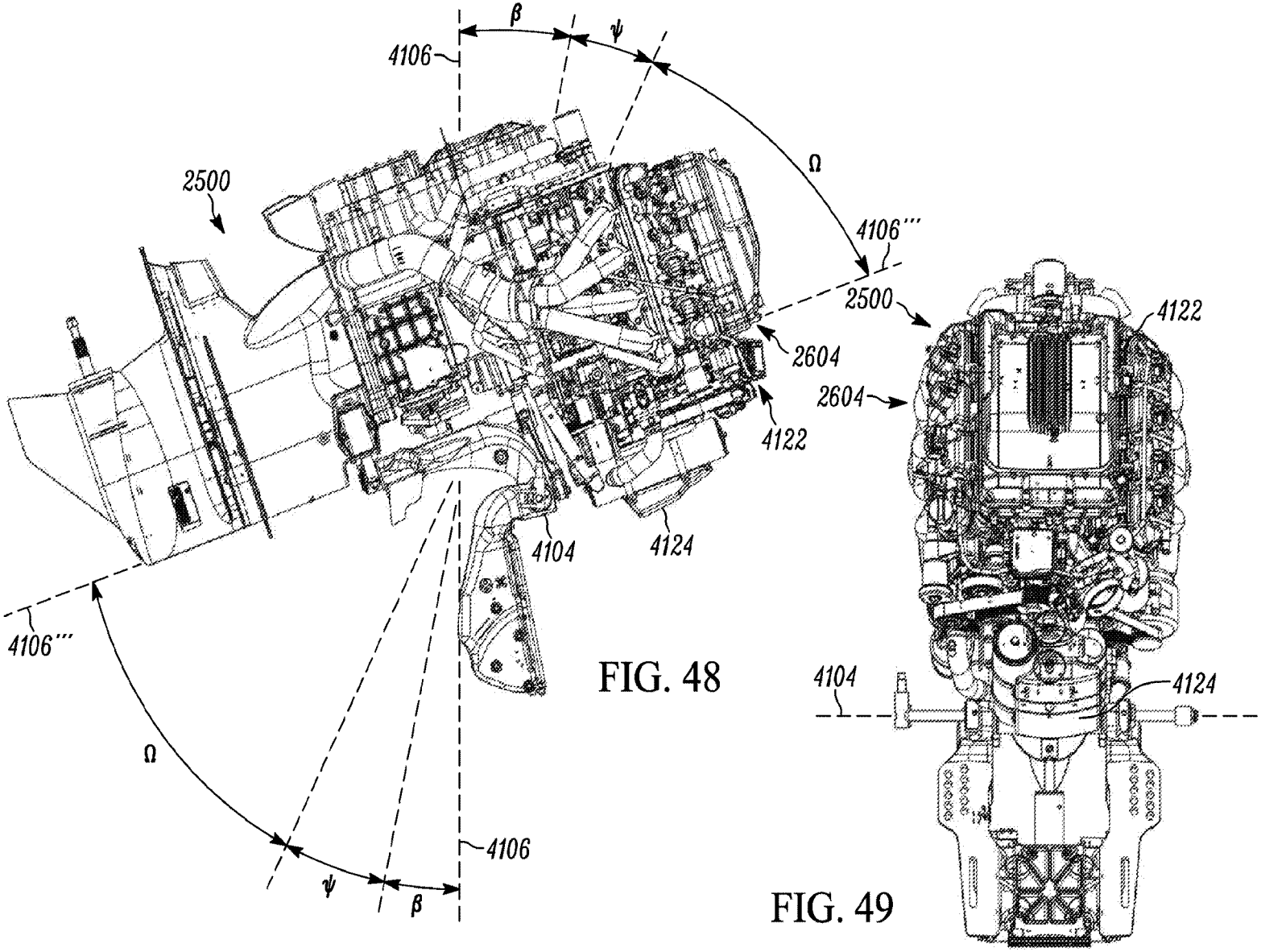
FIG. 48 is a right side elevation view of the outboard motor of FIG. 41, with the outboard motor now shown such that it has been still further tilted, rotated and/or otherwise moved so that it is positioned in a first storage position, such as a position in which the outboard motor can be serviced or transported from one location to another.
FIG. 49 is a front elevation view of the outboard motor of FIG. 48, that is with the outboard motor again shown in the first storage position.

Next turning to FIGS. 48 and 49, there are provided right side and front elevation views, respectively, of the outboard motor 2500 of FIG. 41 that are similar to those of FIGS. 46 and 47, except insofar as the outboard motor is now shown such that it has been tilted, rotated and/or otherwise moved so that the outboard motor (and particularly the engine 2604 thereof) is positioned in fourth position that is a first storage position. More specifically, the first storage position corresponds to a position in which the outboard motor 2500 is tilted, rotated or otherwise moved about the trimming axis 4104 such that a steering axis 4106' of the outboard motor as rotated is greater than the angle ψ+β up to a maximum angle of Ω+ψ+β relative to the vertical axis 4106, that is, rotated at an angle from ψ+β up to a maximum angle Ω+ψ+β relative to the steering axis of the outboard motor when in the standard operating position (FIGS. 41-43). In the present embodiment, the angle Ω is forty-five (45) degrees off of the steering axis 4106", and Ω+ψ+β seventy (70) degrees off of the vertical axis 4106, albeit these amounts can vary depending upon the embodiment. Thus, it should be appreciated that the particular rotational position of the outboard motor 2500 shown in FIG. 48 illustrates the maximum rotational position of the outboard motor away from the vertical axis 4106 at which the outboard motor can still be considered to be in the first storage position in this embodiment, and the outboard motor 2500 would also be considered to be in the first storage position if it was rotated a lesser amount less than the angle Ω+ψ+β down to the angle ψ+β (e.g., rotated an amount less than 70 degrees off of the vertical axis 4106 but greater than, or substantially greater than, 25 degrees off of the vertical axis).

More particularly, the first storage position is intended generally correspond to a position of the outboard motor 2500 in which the outboard motor is typically serviced or transported from one location to another. As such, the first storage position is a position taken on by the outboard motor 2500 when the outboard motor is typically not operational or operating, and is thus typically static. Such a storage position is one that is particularly suitable when the outboard motor is being stored, serviced, or transported from one location to another. However, it is contemplated that the outboard motor 2500 can operate when positioned in the first storage position in at least some embodiments under at least some circumstances, and/or for at least a limited period of time, and so the use of the term first storage position, while generally indicative of a status in which the outboard motor is not operating, should not in all cases be viewed as excluding all outboard motor/engine operation. That said, for ease of understanding, and notwithstanding the possibility of at least some limited operation of the outboard motor 2500, the position of the outboard motor illustrated in exemplary fashion by FIG. 48 is referred to herein as the first storage position.

Figure 51:
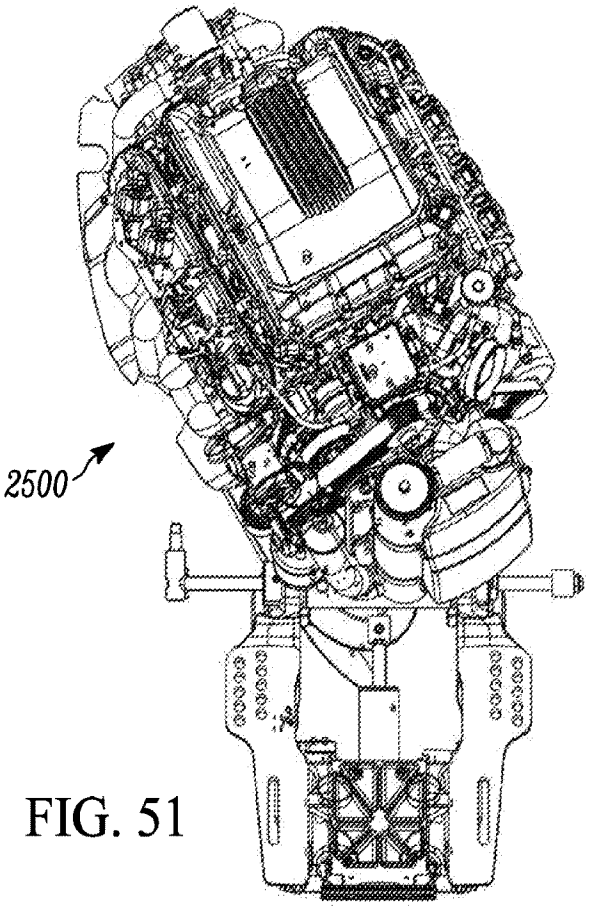
FIG. 51 is a front elevation view of the outboard motor of FIG. 48, that is with the outboard motor again shown in the second storage position.
Figure 50:
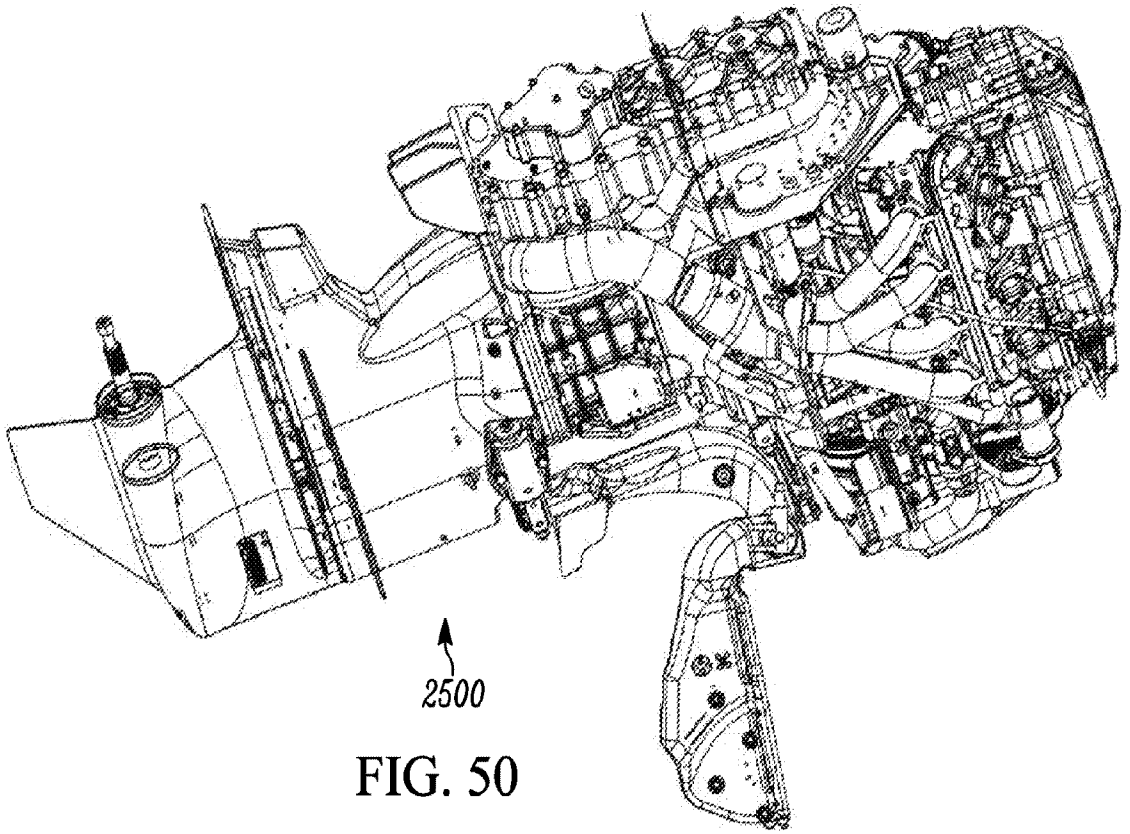
FIG. 50 is a right side elevation view of the outboard motor of FIG. 41, with the outboard motor now shown such that it has been yet still further tilted, rotated and/or otherwise moved so that it is positioned in a second storage position.
Figure 52:
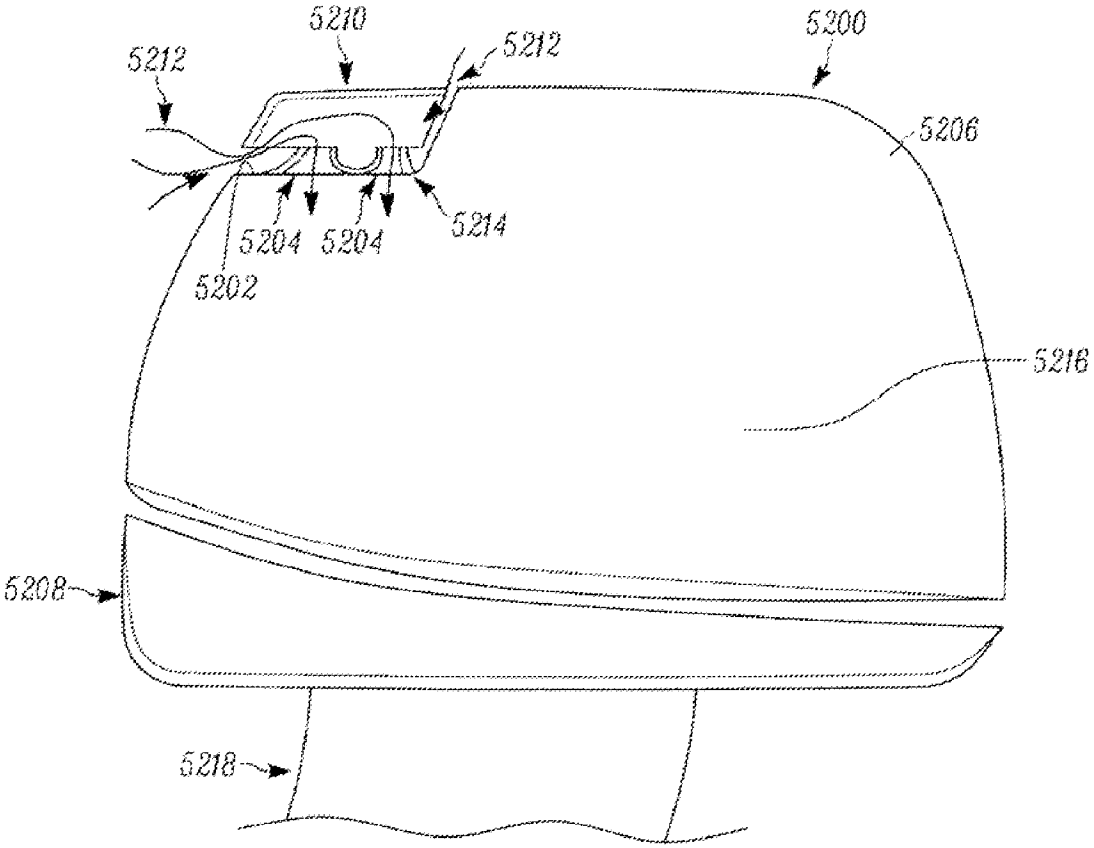
FIG. 52 (PRIOR ART)
FIG. 52 is an illustration of a right side elevation cutaway of view of upper portions of a Prior Art outboard motor.

Additionally, FIGS. 50 and 51 are a right side elevation and front elevation view, respectively, of the outboard motor of FIG. 41, with the outboard motor now shown such that it has been still further tilted, rotated and/or otherwise moved so that it is positioned in a second storage position. More particularly, the outboard motor 2500 is shown in a position in which the outboard motor is tilted, rotated or otherwise moved about the trimming axis 4104, as previously described with respect to FIGS. 48-49 (the details of which are not repeated here), but additionally the outboard motor 2500 is also further tilted, rotated or otherwise moved (e.g., steered) about the steering axis 4106'". The second storage position, as with the first storage position illustrated in FIGS. 48-49, is intended to generally correspond to a position of the outboard motor 2500 that is particularly suitable when the outboard motor is being stored, serviced, or transported from one location to another and, as such, corresponds to a position in which the outboard motor is typically not operational or operating. However, it is again contemplated that the outboard motor 2500 can operate when positioned in the first storage position under at least some circumstances, and/or for at least a limited period of time. That said, for ease of understanding, and notwithstanding the possibility of at least some limited operation of the outboard motor 2500, the position of the outboard motor illustrated in exemplary fashion by FIGS. 50 and 51 is referred to herein as the second storage position. It should also appreciated that, although FIG. 51 shows the outboard motor 2500 to be steered to certain steering orientation, in one direction (e.g., toward the starboard side of a marine vessel to which the outboard motor would be attached), it is intended that FIG. 51 be representative of the outboard motor 2500 taking on other steered positions that can involve turning the outboard motor to a lesser or greater degree than that shown, as well as turning the outboard motor to any such variety of degrees in the opposite direction (e.g., to toward the port side of the marine vessel).

As shown in FIGS. 40-51, the outboard motor 2500 is configured so that the tank 4124 is positioned in front of the engine 2604 and sized to have sufficient capacity or at least enough volume to hold a desired quantity of oil (or other engine lubricant). In particular, in the present embodiment, the tank 4124 particularly is configured to be able to hold a sufficient quantity of oil so that oil does not tend to congregate at or near one or more of the cylinders 4118 of the engine 2604. Such operation is desirable for the purpose of preventing one or more of the cylinders 4118 from filling up or otherwise becoming flooded with oil (or at least substantially limiting the extent to which, or chance that, one or more of the cylinders become filled with oil), particularly when the outboard motor 2500 is positioned in a storage and/or non-operating position such as the first or second storage positions depicted respectively in FIGS. 48-49 and FIGS. 50-51, respectively. Additionally, the tank 4124 is configured in such a manner that an amount of oil (or other lubricant) can flow into the tank from the engine 2604 (particularly from the crankcase 4122 thereof) when the engine is tilted to a storage position (again, FIGS. 48-49 and FIGS. 50-51), and additionally, oil (or other lubricant) can flow out of the tank back into the engine (and particularly into the crankcase 4122 thereof) when the outboard motor is returned to any of the first (normal), second, or third operating positions shown in FIGS. 41-47.

In accordance with at least some embodiments of the present disclosure, the tank 4124 can be sized to hold all, or substantially all, of the engine oil contained within the crankcase 4122 for use in operating the engine 2604 of the outboard motor 2500. Also in accordance with at least some embodiments of the present disclosure, an amount of oil will enter the tank 4124 when the outboard motor 2500 is moved (e.g., tilted) to one of the first and second storage positions, such as above 25 degrees of tilt, as shown by way of example in FIGS. 48 and 49. Similarly, an amount of oil will enter, or re-enter so as to be returned (and ultimately fully returned) to the crankcase 4122 (such operation being referred to as "drain back"), when the outboard motor 2500 is positioned (or re-positioned as the case may be) in one of the operating positions, e.g., a position at which the tilt of the outboard motor is at or less than twenty-five degrees off of the vertical axis 4106 as shown by way of example in FIGS. 41-47. In general, the rate of oil return (during drain back) from the tank 4124 will, in at least some embodiments of the present disclosure, match or substantially match or correspond to the time required to tilt the engine 2604 from a given storage position back into a given operating position, so as to ensure or increase the likelihood that a minimum amount or level of oil is returned to the crankcase 4122 by time an operator of the outboard motor 2500 may decide to attempt to start the engine.

The particular arrangement or structural details of the tank 4124 can vary depending upon the embodiment, and the particular structural details of the tank 4124 shown in FIGS. 41-51 are only intended to be exemplary. As noted previously, in accordance with at least some embodiments of the present disclosure, the tank 2012 is connected by the plurality of lubricant lines 4126*a* and 4126*b* (see FIG. 42) located at or near the bottom of the engine crankcase 4122 and a vent line (not shown). The actual numbers of the lubricant and vent lines can vary depending upon the embodiment, as can the structural characteristics of those lines (e.g., the inner diameters of the channels within those lines establishing flow paths) and their particular locations along the tank 4124 and/or the engine 2604. It should be understood that connection of the tank 4124 to the crankcase 4122 by way of the vent line provides a closed system that creates a constant, or at least substantially constant, crankcase volume (where the crankcase volume includes the volume of the tank 4124 as well as the crankcase 4122), thereby allowing for the free exchange of volume, that is, oil (or other lubricant) for air and air for oil, particularly when tilting of the outboard motor 2500 from an operating position (e.g., from the first or standard operating opposition of FIGS. 41-43) to a storage position (e.g., the first storage position of FIGS. 48-49) occurs. Moreover, a closed system desirably avoids the venting of vapors (or at least substantially limits the extent to which there is venting of vapors) from the crankcase 4122 to the outside environment and thus is advantageous from an emissions standpoint. The rate of oil exchange between the crankcase 4122 to the tank 4124 is generally limited or otherwise governed by the size of the connecting lubricant lines 4126*a-b* and the vent line, which as noted above can vary depending upon the embodiment (and can vary to convenience). Similarly, the angle at which oil is transferred from the crankcase to the tank (and back) can vary to convenience and is generally governed by the geometry and relative positioning of the tank and the connecting lines.

Depending upon the embodiment, the use of the tank 4124 or a similar tank in an outboard motor such as the outboard motor 2500 can provide various advantages. The embodiment of the outboard motor 2500 and tank 4124 shown in FIGS. 41-51 is particularly advantageous in that, when the outboard motor 2500 (and engine 2604 thereof) is mounted in an outboard configuration and tilted or otherwise positioned into a storage position, an amount (up to and including all or substantially all) of the engine oil does not pour out of the oil sump of the outboard motor 2500 and into the crankcase 4122, even as the cylinders 4118 of the engine reach a near horizontal position (e.g., tilted up to an angle of 70 degrees), instead of running into one or more of the cylinders (and particularly combustion chambers acted upon by respective pistons within those cylinders) which could potentially be undesirable in terms of adversely affecting engine operational performance or leading to hydraulic locking or stressing upon various engine components such as connecting rods of the engine. Indeed, in the present embodiment, the tank 4124 is configured so that oil enters the tank so as to avoid reaching or entering (or so as to avoid substantially reaching or entering) even that one of the cylinders 4118 of the engine 2604 that may be at a lowest position due to the particular storage position of the engine (e.g., that one of the cylinders that is most forward in the V-type engine 2604 and on the starboard side of that engine when in the second storage position shown in FIG. 51, where in such case that one cylinder could potentially be arranged such that its cylinder axis was substantially horizontal). In at least some embodiments, no more than 10% of the total engine oil can proceed from the engine into the tank 4124 until the outboard motor 2500 has been trimmed to an angle of more than 30 degrees off of the vertical axis 4106 (so that the tank does not "steal" oil). The tank 4124 is helpful for storing oil when the outboard motor is in a storage position, and also due to its configuration oil flows into and out of the tank due to the influence of gravity. Also in accordance with at least some embodiments of the present disclosure, the tank 4124 can be configured or structured to mount or be mounted to other components of the outboard motor 2500, such as heat exchangers and/or the tank 4124 can be configured or structured to receive hot oil (e.g., oil that is heated to approximately 300 degrees Fahrenheit).

Although numerous embodiments are disclosed above, it is envisioned that numerous variations to the disclosed embodiments above are possible and encompassed herein. Among other things, although embodiments of the outboard motor 100 above envision use of an internal combustion engine (the engine 204) that is a horizontal crankshaft engine and that, in at least some such embodiments, can be an automotive engine, in alternate embodiments the engine can be another engine including, for example, a vertical crankshaft engine. Also for example, although the water pump assembly 600 shown above is "diamond-shaped" in that it has generally four corners, with the impellers located at two of those corners and the inlet and one of the outlets located at the other two corners, in other embodiments the water pump assembly could take on a different shape such as a pentagon (e.g., where two of the vertices of the pentagon were locations at which each of the two outlets were positioned). Additionally, it should be appreciated that any use of terms pertaining to orientation, such as with respect to a vertical and horizontal axes as described above, is for purposes of reference and understanding of the embodiments described above, and that such teachings are not intended to limit the scope of the present disclosure to encompass embodiments having other orientations.

Additionally, at least some example embodiments encompassed herein relate to an outboard motor for use with a marine vessel. The outboard motor includes a transmission, and an engine positioned adjacent to the transmission. The outboard motor further includes a cowling assembly including at least one outer formation extending around the transmission and the engine so as to provide a housing therefore, and a wall formation extending within the outer formation between the transmission and the engine so as to form a barrier therebetween, so that an interior within the at least one outer formation is divided into a plurality of portions including a first portion and a second portion. The transmission is positioned at least partly within the first portion and the engine is positioned at least partly within the second portion, there exists a space beneath the wall formation so that the first portion is in fluid communication with the second portion, and the at least one outer formation includes at least one inlet positioned at or proximate to a top of the at least one outer formation along the first portion so as to allow the first portion to be in fluid communication with a region outside of the outboard motor. The outboard motor is configured to allow air to enter the first portion via the at least one outer formation and to pass from the first portion into the second portion via the space, whereby, due to the wall formation, the air entering the outboard motor via the at least one inlet must pass downward within the first portion to the space in order for the air to enter into the second portion, and due to the downward movement of the air, at least some water entering the at least one inlet along with the air proceeds downward past the space and does not enter the second portion.

In at least some such embodiments, the cowling assembly includes at least one outlet opening at or below a vertical level of the space, where the at least some water that does not enter the second portion exits the outboard motor by way of the at least one outlet opening. Further, in at least some such embodiments, the first portion and the transmission are positioned aftward of the wall formation, and the second portion and the engine are positioned forward of the wall formation. Additionally, in at least some such embodiments, a throttle assembly is positioned also within the second portion, and an additional outlet opening is formed along a floor of the second portion. Further, in least some such embodiments, the throttle assembly is positioned at or proximate to a frontmost portion of the second portion, whereby the throttle assembly is positioned away from the space, and/or the engine is a horizontal crankshaft engine.

Also, in at least some such embodiments, the air entering the second portion via the space must proceed at least partly upward in order to reach one or both of the engine or another component of the outboard motor. Further, in at least some such embodiments, at least some additional water that enters the second portion along with the air ceases to move upward along with the air and fails to reach the engine or another component of the outboard motor but rather then proceeds downward within the outboard motor and exits the outboard motor by way of the at least one outlet opening or an additional outlet opening. Additionally, in at least some embodiments, a first cross-sectional area of the first portion through which the air proceeds downward from the at least one inlet to the space is smaller than a second cross-sectional area of one or both of the space and a region within the second portion through which the air proceeds at least partly upward, so that a first velocity of the air as it proceeds downward is greater than a second velocity of the air as it proceeds into or at least partly upward within the second portion. Also, in at least some embodiments, the at least one outer formation includes a rear wall formation, a front wall formation, a left wall formation, a right wall formation, and a roof formation, where each of the rear, front, left, and right wall formations extend downward from the roof formation.

Further, at least some example embodiments encompassed herein relate to a water pump assembly. The water pump assembly includes a pump housing having an inlet and an outlet, a first impeller located within the pump housing and configured to rotate in a rotational plane, about a first axis of rotation, in a first rotating direction, and a second impeller located within the pump housing and configured to rotate in the rotational plane, about a second axis of rotation, in a second rotating direction that is opposite the first rotating direction.

In at least some such embodiments, the first rotating direction is clockwise and the second rotating direction is counter-clockwise and the first impeller and the second impeller are counter-rotating impellers. Also, in at least some such embodiments, the first impeller and the second impeller both rotate to draw or pull water from the pump housing inlet. Further, in at least some embodiments, the first impeller rotates to draw a first amount of water flowing from the inlet and the second impeller rotates to draw a second amount of water from the inlet. Also, in at least some embodiments, the first and second impellers each are eccentrically offset. Additionally, in at least some embodiments, the pump housing outlet includes a first outlet area and a second outlet area. Also, in at least some embodiments, the first outlet area and the second outlet area are connected by way of a connective or connecting passage.

Further, in at least some embodiments, the pump housing outlet includes a first outlet area and a second outlet area, where all or substantially all of an amount of water from the first impeller and at least some of another amount of water from the second impeller are discharged via the first outlet area, and further where all or substantially all of a remaining amount of the other amount of water from the second impeller is discharged via the second outlet area. Also, in at least some embodiments, (i) the first impeller rotates to draw a first amount of water flowing from the inlet and the second impeller rotates to draw a second amount of water from the inlet, and/or (ii) the pump housing outlet includes a first outlet area and a second outlet area, where all or substantially all of the first amount of water from the first impeller and at least some of the second amount of water from the second impeller are discharged via the first outlet area, and further where all or substantially all of a remaining amount of the second amount of water from the second impeller is discharged via the second outlet area. Further, in at least some embodiments, the pump housing outlet includes a first outlet area and a second outlet area, the second outlet area structured to discharge a volume of water that is less than, and at a higher pressure than, another volume of water that is discharged from the first outlet area.

Also, in at least some such embodiments, the water pump assembly further includes a first liner structure and a second liner structure, where the first impeller is positioned within, or substantially within, the first liner structure and the second impeller is positioned in, or substantially in, the second liner structure. Additionally, in at least some embodiments, each of the first and second liner structure include one or more water ports. Also, in at least some embodiments, the pump housing includes an inlet side and an outlet side. Further, in at least some embodiments, the water pump assembly further includes one or more wear plates structures, a cover plate structure, at least one seal structure, and a plurality of assembly fasteners for securing the one or more wear plate structures, the cover plate structure, the seal structure and the housing together. Additionally, in at least some embodiments, the at least one seal structure includes an O-ring type seal and the plurality of assembly fasteners comprises one or more screws.

Further, at least some example embodiments encompassed herein relate to an outboard motor (or outboard engine) that includes a water pump assembly as described above. In at least some such embodiments, the outboard motor includes a transmission assembly and the water pump assembly is integrated with or into, or in proximity to, the transmission assembly. Also, in at least some embodiments, the water pump assembly is operably connected to the transmission assembly by a geartrain. Further, in at least some embodiments, the transmission drives at least one of the first and the second impellers. Additionally, in at least some embodiments, one of the first impeller and the second impeller is located above, and spaced apart from the other of the first impeller and second impeller.

At least some additional example embodiments encompassed herein relate to a vapor separating tank (VST) system. The VST system includes a first pump configured to receive fuel at a first pressure from a fuel source and to output the fuel at a second pressure that is higher than the first pressure, and also includes a fuel reservoir coupled to the first pump via at least one first linkage so that the fuel at the second pressure output by the first pump is received at the fuel reservoir. Further, the VST system also includes a second pump coupled to the fuel reservoir via at least one second linkage, where the second pump is configured to receive the fuel at the second pressure from the fuel reservoir and to output the fuel at a third pressure that is higher than the second pressure, and additionally includes an output port by which at least some of the fuel at the third pressure can be communicated from the VST system to an internal combustion engine. Also, the VST system further includes a first pressure regulator at least indirectly coupled between the output port and the fuel reservoir by way of at least one third linkage so that, if a first pressure differential across the first pressure regulator exceeds a first predetermined threshold, a first fluid communication path is at least temporarily established between the output port and the fuel reservoir via the first pressure regulator.

Additionally, in at least some such embodiments, the fuel reservoir includes a filter by which the fuel received from the first pump is filtered, and the fuel reservoir additionally is configured to operate as a mixer. Further, in at least some embodiments, the second pump is a high pressure pump and the first pump is a low pressure pump. Also, in at least some embodiments, each of the first pump and second pump is an electrically-driven pump. Additionally, in at least some embodiments, the VST system further includes a second pressure regulator at least indirectly coupled between the fuel reservoir and an input port of the first pump by way of at least one fourth linkage so that, if a second pressure differential across the second pressure regulator exceeds a second predetermined threshold, then a second fluid communication path is at least temporarily established between the fuel reservoir and the input port via the second pressure regulator. Also, in at least some embodiments, the first and second pressure regulators, the first and second fuel pumps, and the fuel reservoir are assembled in a unitary component, with the first fuel pump having a first cylindrical axis and the second fuel pump having a second cylindrical axis, the first and second cylindrical axes being substantially perpendicular to one another. Additionally, in at least some embodiments, the VST system includes a fuel cooler output port and a fuel cooler input port by which the VST system is capable of being coupled to a fuel cooler so that at least one amount of the fuel that exits the fuel cooler output port returns via the fuel cooler input port after being cooled by way of the fuel cooler, and the fuel cooler output port is at least indirectly coupled to the first pressure regulator and the fuel cooler input port is at least indirectly coupled to the fuel reservoir. Further, in at least some embodiments, the first pump is a diaphragm pump and the second pump is an electrically-driven pump.

Also, at least some example embodiments encompassed herein relate to an outboard motor that includes a VST system as described above, where the outboard motor includes an internal combustion engine that is a fuel injected engine. Also, in at least some such embodiments, the outboard motor comprises a coolant channel by which coolant is directed to the internal combustion engine, and further comprises a fuel cooler that extends proximate a portion of the coolant channel, where the fuel cooler is coupled between the first pressure regulator and the fuel reservoir so that a portion of the fuel passing through the first pressure regulator in turn passes through the fuel cooler before returning to the fuel reservoir.

Additionally, at least some example embodiments encompassed herein relate to an outboard motor having a front surface and an aft surface and configured to be mounted on a marine vessel having a front to rear axis, such that the front surface would face the marine vessel and the aft surface would face away from the marine vessel when in a standard operational position. The outboard motor includes a housing having an upper and a lower portions and having an interior, and an internal combustion engine disposed within the housing interior and that provides rotational power output via a crankshaft that extends horizontally or substantially horizontally in a front-to-rear direction when the outboard motor is in the standard operational position, where the engine is further disposed substantially or entirely above a trimming axis and is steerable about a steering axis, the trimming axis being perpendicular to or substantially perpendicular to the steering axis, and the steering axis and trimming axis both being perpendicular to or substantially perpendicular to the front-to-rear axis of the marine vessel. The outboard motor further includes a tank positioned within the housing and connected to a crankcase of the engine, where the tank is configured such that little, if any, of an amount of the lubricant is in or provided to the tank when the engine is in the standard operational position.

Further, in at least some such embodiments, the tank is positioned along or on a front of the engine, nearer the front surface of the outboard motor than the aft surface thereof. Also, in at least some embodiments, the outboard motor is configured to be tilted about the trimming axis away from the standard operating position to at least one additional operating position and at least one additional position suitable for storing, transporting and/or limited operation of the outboard motor. Additionally, in at least some embodiments, the standard operating position is a position in which the trimming axis is at least substantially horizontal and the steering axis is at least substantially vertical, with the steering axis being at least substantially parallel to and/or in line with a vertical plane passing through a center of the engine, where the outboard motor is configured to be tilted from the standard operating position to at least one of: (i) a second operating position that corresponds to a position in which the outboard motor is tilted, rotated or otherwise moved about the trimming axis such that a steering axis of the outboard motor as rotated is at an angle $\beta$ relative to at least one of a vertical axis and to the steering axis of the outboard motor when in the standard operating position; (ii) a third operating position that corresponds to a position in which the outboard motor is tilted, rotated or otherwise moved about the trimming axis such that a steering axis of the outboard motor as rotated is greater than the angle $\beta$ up to a maximum angle of $\psi+\beta$ relative to the vertical axis, and rotated at an angle from $\beta$ up to a maximum angle $\psi+\beta$ relative to the steering axis of the outboard motor when in the standard operating position; (iii) a first storage position that corresponds to a position in which the outboard motor is tilted, rotated or otherwise moved about the trimming axis such that a steering axis of the outboard motor as rotated is greater than the angle $\psi+\beta$ up to a maximum angle of $\Omega+\psi-\beta$ relative to the vertical axis, and rotated at an angle from $\psi+\beta$ up to a maximum angle $\Omega+\psi-\beta$ relative to the steering axis of the outboard motor when in the standard operating position; and (iv) a second storage position that corresponds to a position in which the outboard motor is tilted, rotated or otherwise moved about the trimming axis and is also further tilted, rotated or otherwise moved about the steering axis.

In at least some such embodiments, the angle $\beta$ is fifteen (15) degrees off of the vertical axis. Also, in at least some embodiments, the angle $\beta$ is the maximum rotational position of the outboard motor away from the vertical axis at which the outboard motor is in the second operating position, and the outboard motor is in the second operating position if it is rotated a lesser amount less than the angle β. Further, in at least some embodiments, the second operating position encompasses positions of the outboard motor suited for shallow water drive operation of the outboard motor in which the outboard motor can be operated at, or substantially at, full propulsion or full power. Also, in at least some embodiments, the tank is configured or structured so that the lubricant/oil utilized by the engine remains in the crankcase during shallow water drive operation, and very little or none of the engine lubricant/oil enters or remains within the tank. Further, in at least some embodiments, the tank is connected to the engine via one or more oil lines that having a relatively low positioning relative to the remainder of the tank and the relatively high positioning of at least most of the tank relative to the one or more oil lines as well as relative to large sections of the internal combustion engine. Also, in at least some embodiments, the angle ψ is ten (10) degrees off of the steering axis, and the angle ψ+β is twenty-five (25) degrees off of the vertical axis. Additionally, in at least some embodiments, the angle ψ+β is the maximum rotational position of the outboard motor away from the vertical axis at which the outboard motor can still be considered to be in the third operating position in this embodiment, and the outboard motor is in the third operating position if it is rotated a lesser amount less than the angle ψ+β down to the angle β. Further, in at least some embodiments, the third operating position encompasses positions of the outboard motor in which the outboard motor can be operated at limited propulsion or limited power.

Also, in at least some embodiments, the tank is configured or structured so that all or substantially all of the lubricant/oil in the crankcase remains in the crankcase during such shallow water drive operation. Further, in at least some embodiments, the tank is connected to the engine via one or more oil lines having a relatively low positioning relative to the remainder of the tank and to the relatively high positioning of at least most of the tank relative to the one or more oil lines as well as relative to large sections of the internal combustion engine. Additionally, in at least some embodiments, the angle Ω is forty-five (45) degrees off of the steering axis, and Ω+ψ+β is seventy (70) degrees off of the vertical axis. Further, in at least some embodiments, the angle Ω is the maximum rotational position of the outboard motor away from the vertical axis at which the outboard motor can still be considered to be in the first storage position, and the outboard motor is in the first storage position if it is rotated a lesser amount less than the angle Ω+ψ+β down to the angle ψ+β.

Also, in at least some embodiments, the first storage position corresponds to a position of the outboard motor in which the outboard motor is serviced, or transported, from one location to another. Further, in at least some embodiments, the second storage position corresponds to a position of the outboard motor that is particularly suitable when the outboard motor is being stored, serviced, or transported from one location to another. Additionally, in at least some embodiments, the tank is configured to receive some or all of the lubricant from the crankcase when the outboard motor is positioned in one or both of the first and second storage positions. Further, in at least some embodiments, the tank is sized to hold a quantity of oil or other lubricant needed to prevent one or more of the cylinders from filling up with oil/lubricant, when the outboard motor is positioned in one or both of the first and second storage positions. Additionally, in at least some embodiments, the tank is configured such that an amount of lubricant can flow into the tank when the engine is tilted to the one or both of the first and the second storage positions and the amount of lubricant can flow out of the tank when the engine is repositioned to at least one of the standard, second and third operating positions. Further, in at least some embodiments, the internal combustion engine is an automotive engine suitable for use in an automotive application. Also, in at least some embodiments, one or more of the following is/are true: (a) the internal combustion engine is one of an 8-cylinder V-type internal combustion engine; (b) the internal combustion engine is operated in combination with an electric motor so as to form a hybrid motor; (c) the rotational power output from the internal combustion engine exceeds 550 horsepower; and (d) the rotational power output from the internal combustion engine is within a range from at least 557 horsepower to at least 707 horsepower.

It is further specifically intended that the present invention not be limited to the embodiments and illustrations contained herein and in the addenda attached hereto, but include modified forms of those embodiments including portions of the embodiments and combinations of elements of different embodiments as come within the scope of the following claims.

We claim:

1. An outboard motor having a front surface and an aft surface and including a mounting system by which the outboard motor can be mounted on a marine vessel having a front-to-rear axis, such that the front surface would face the marine vessel and the aft surface would face away from the marine vessel when in a first operating position, the outboard motor comprising:

a housing having an upper portion and a lower portion and having an interior;

an internal combustion engine disposed within the housing interior and that provides rotational power output via a crankshaft that extends horizontally or substantially horizontally in a front-to-rear direction when the outboard motor is in the first operating position and the internal combustion engine is further disposed substantially or entirely above a trimming axis and is steerable about a steering axis, the trimming axis being perpendicular to or substantially perpendicular to the steering axis, wherein the first operating position is an outboard motor position in which the trimming axis is at least substantially horizontal and the steering axis is at least substantially vertical, with the steering axis also being at least substantially parallel to or in line with a vertical plane;

an oil tank positioned within the housing along or on a front of the internal combustion engine, nearer the front surface of the outboard motor than the aft surface thereof, and connected to a crankcase of the internal combustion engine, such that no more than ten percent of a total amount of a lubricant of the internal combustion engine can proceed from the internal combustion engine into the oil tank until the outboard motor has been trimmed to an angle of more than thirty degrees off a vertical axis; and an oil sump.

2. The outboard motor of claim 1, wherein the outboard motor can be tilted about the trimming axis away from the first operating position to at least one additional operating position and at least one additional position for storing, transporting and/or operating of the outboard motor.

3. The outboard motor of claim 1, wherein the first operating position is a position in which the trimming axis is at least substantially horizontal and the steering axis is at least substantially vertical, and with the steering axis being at least substantially parallel to and/or in line with a vertical plane passing through a center of the internal combustion engine, and wherein the outboard motor can be tilted from the first operating position to at least one of:

(i) a second operating position that corresponds to a position in which the outboard motor is tilted, rotated or otherwise moved about the trimming axis such that a steering axis of the outboard motor as rotated is at an angle β relative to at least one of a vertical axis and to the steering axis of the outboard motor when in the first operating position;

(ii) a third operating position that corresponds to a position in which the outboard motor is tilted, rotated or otherwise moved about the trimming axis such that a steering axis of the outboard motor as rotated is greater than the angle β up to a maximum angle of ψ−β relative to the vertical axis, and rotated at an angle from β up to a maximum angle ψ+β relative to the steering axis of the outboard motor when in the first operating position;

(iii) a first storage position that corresponds to a position in which the outboard motor is tilted, rotated or otherwise moved about the trimming axis such that a steering axis of the outboard motor as rotated is greater than the angle ψ+β up to a maximum angle of Ω+ψ−β relative to the vertical axis, and rotated at an angle from ψ+β up to a maximum angle Ω+ψ−β relative to the steering axis of the outboard motor when in the first operating position; and (iv) a second storage position that corresponds to a position in which the outboard motor is tilted, rotated or otherwise moved about the trimming axis and is also further tilted, rotated or otherwise moved about the steering axis.

4. The outboard motor of claim 3, wherein either: (a) the angle β is fifteen (15) degrees off of the vertical axis; or (b) the angle β is the maximum rotational position of the outboard motor away from the vertical axis at which the outboard motor is in the second operating position, and wherein the outboard motor is in the second operating position if it is rotated a lesser amount less than the angle β.

5. The outboard motor of claim 3, wherein the second operating position encompasses positions of the outboard motor in which the outboard motor can be operated at, or substantially at, full propulsion or full power.

6. The outboard motor of claim 5, wherein the lubricant utilized by the internal combustion engine remains in the crankcase when the outboard motor is in the second operating position.

7. The outboard motor of claim 6, wherein the oil tank is connected to the internal combustion engine via one or more oil lines that are positioned at or near a bottom of the oil tank.

8. The outboard motor of claim 5, wherein either: (a) the angle ψ is ten (10) degrees, and the angle ψ+β is twenty-five (25) degrees off of the vertical axis; or (b) the angle ψ+β is a maximum rotational position of the outboard motor away from the vertical axis at which the outboard motor can still be considered to be in the third operating position in this embodiment, and wherein the outboard motor is in the third operating position if it is rotated a lesser amount less than the angle ψ+β down to the angle β.

9. The outboard motor of claim 5, wherein all or substantially all of the lubricant in the crankcase remains in the crankcase when the outboard motor is in the second operating position.

10. The outboard motor of claim 9, wherein the oil tank is connected to the internal combustion engine via one or more oil lines that are positioned at or near a bottom of the oil tank.

11. The outboard motor of claim 3, wherein either: (a) the angle Ω is forty-five (45) degrees, and Ω+ψ+β is seventy (70) degrees off of the vertical axis; or (b) the angle Ω is a maximum rotational position of the outboard motor away from the vertical axis at which the outboard motor can still be considered to be in the first storage position, and wherein the outboard motor is in the first storage position if it is rotated a lesser amount less than the angle Ω+ψ+β down to the angle ψ+β.

12. The outboard motor of claim 3, wherein the first storage position corresponds to a position of the outboard motor in which the outboard motor is serviced, or transported, from one location to another, and wherein the second storage position corresponds to a position of the outboard motor when the outboard motor is being stored, serviced, or transported from one location to another; and wherein some or all of the lubricant from the crankcase is received by the oil tank when the outboard motor is positioned in one or both of the first and second storage positions.

13. The outboard motor of claim 3, wherein the oil tank is sized to hold a quantity of the lubricant needed to prevent one or more of a plurality of engine cylinders from filling up with the lubricant when the outboard motor is positioned in one or both of the first and second storage positions.

14. The outboard motor of claim 3, wherein a portion of the lubricant can flow into the oil tank when the outboard motor is tilted to one or both of the first and the second storage positions and the portion of the lubricant can flow out of the oil tank when the outboard motor is repositioned to at least one of the first, second and third operating positions.

15. The outboard motor of claim 1, wherein the internal combustion engine is an automotive engine.

16. The outboard motor of claim 15, wherein (a) the internal combustion engine is an 8-cylinder V-type internal combustion engine, (b) the internal combustion engine is operated in combination with an electric motor so as to form a hybrid motor, (c) the rotational power output from the internal combustion engine exceeds 550 horsepower, or (d) the rotational power output from the internal combustion engine is within a range from at least 557 horsepower to at least 707 horsepower.

17. The outboard motor of claim 1, wherein at least some of the lubricant can flow into and out of the oil tank due to the influence of gravity.

18. An outboard motor having a front surface and an aft surface and including a mounting assembly by which the outboard motor can be mounted on a marine vessel having a front-to-rear axis, such that the front surface would face the marine vessel and the aft surface would face away from the marine vessel when in a first operating position, the outboard motor comprising:

a housing having an upper portion and a lower portion and having an interior;

an internal combustion engine disposed within the housing interior and that provides rotational power output via a crankshaft that extends horizontally or substantially horizontally in a front-to-rear direction when the outboard motor is in the first operating position, wherein the internal combustion engine includes a plurality of cylinders and the internal combustion engine is steerable about a steering axis and also rotatable about a trimming axis that is perpendicular to or substantially perpendicular to the steering axis, wherein the first operating position is an outboard motor position in which the trimming axis is at least substantially horizontal and the steering axis is at least substantially vertical, with the steering axis also being at least substantially parallel to or in line with a vertical plane;

an oil sump; and an oil tank positioned within the housing and connected to a crankcase of the internal combustion engine;

wherein the outboard motor can be tilted about the trimming axis away from the first operating position to a first storage position, and wherein a lubricant enters the oil tank so as to avoid reaching or entering, or so as to avoid substantially reaching or entering, a first cylinder of the plurality of cylinders having a lowest position when the internal combustion engine is in the first storage position.

19. The outboard motor of claim 18, wherein the lubricant utilized by the internal combustion engine remains in the crankcase when the outboard motor is in a second operating position, rather than entering into the oil tank, and wherein at least some of the lubricant can flow into and out of the oil tank due to the influence of gravity.

20. An outboard motor having a front surface and an aft surface and including a mounting system by which the outboard motor can be mounted on a marine vessel having a front-to-rear axis, such that the front surface would face the marine vessel and the aft surface would face away from the marine vessel when in a first operating position, the outboard motor comprising:

a housing having an upper and a lower portions and having an interior;

an internal combustion engine disposed within the housing interior and that provides rotational power output via a crankshaft that extends horizontally or substantially horizontally in a front-to-rear direction when the outboard motor is in the first operating position and the internal combustion engine is further disposed substantially or entirely above a trimming axis and is steerable about a steering axis, the trimming axis being perpendicular to or substantially perpendicular to the steering axis, wherein the first operating position is an outboard motor position in which the trimming axis is at least substantially horizontal and the steering axis is at least substantially vertical, with the steering axis also being at least substantially parallel to or in line with a vertical plane;

an oil tank positioned within the housing and connected to a crankcase of the internal combustion engine; and an oil sump;

wherein the oil tank is configured such that none or substantially none of a lubricant utilized by the internal combustion engine is in or provided to the oil tank when the internal combustion engine is in the first operating position.

21. The outboard motor of claim 20, wherein none of the lubricant utilized by the internal combustion engine is in or provided to the oil tank when the internal combustion engine is in the first operating position.

22. The outboard motor of claim 20, wherein at least some of the lubricant can flow into and out of the oil tank due to the influence of gravity.

23. An outboard motor having a front surface and an aft surface and including a mounting system by which the outboard motor can be mounted on a marine vessel having a front-to-rear axis, such that the front surface would face the marine vessel and the aft surface would face away from the marine vessel when in a first operating position, the outboard motor comprising:

a housing having an upper portion and a lower portion and also having an interior;

an internal combustion engine disposed within the interior, wherein the internal combustion engine includes a crankcase and a crankshaft that extends along a crankshaft axis and extends horizontally or substantially horizontally in a front-to-rear direction when the outboard motor is in the first operating position, wherein the internal combustion engine is disposed substantially or entirely above a trimming axis of the outboard motor that is perpendicular or substantially perpendicular to a steering axis of the outboard motor, and wherein the first operating position is an outboard motor position in which the trimming axis is at least substantially horizontal and the steering axis is at least substantially vertical, the steering axis also being at least substantially parallel to or in line with a vertical plane; and an oil tank positioned within the housing and connected to the crankcase by way of connecting lines, wherein the oil tank is positioned at or substantially at a front of the internal combustion engine, wherein the oil tank extends generally upwardly from the connecting lines such that the oil tank is positioned substantially above the connecting lines, and wherein additionally the oil tank is positioned substantially or entirely above the crankshaft axis.

24. The outboard motor of claim 23, wherein the connecting lines are at or near an oil tank bottom of the oil tank, and wherein the oil tank is sized to be able to hold all, or substantially all, of the engine oil that is contained within the crankcase for use when the internal combustion engine is operating.

25. The outboard motor of claim 24, wherein the connecting lines also are at or near a crankcase bottom of the crankcase, and wherein the oil tank is configured such that none or substantially none of the engine oil utilized by the internal combustion engine is in or provided to the oil tank when the internal combustion engine is in the first operating position.

* * * * *